US006619580B2

(12) United States Patent
Ohshio et al.

(10) Patent No.: US 6,619,580 B2
(45) Date of Patent: Sep. 16, 2003

(54) TAKE-UP REEL, VENEER REELING APPARATUS, TAPE FEEDING UNIT FOR VENEER ROLL, VENEER ROLL UNWINDING APPARATUS AND A PRODUCTION METHOD FOR LAMINATED WOOD

(75) Inventors: Youichi Ohshio, Inuyama (JP); Yasuyuki Ohdaira, Komaki (JP); Akihiro Mizuno, Aichi (JP); Shinichi Nakagawa, Tokai (JP); Yasuyuki Kohara, Kounan (JP); Mitsumasa Narita, Tokai (JP); Hideki Kawamori, Kani (JP); Reiji Yamada, Kani (JP); Masanori Murakami, Komaki (JP); Kazumi Sugiyama, Nagoya (JP); Tomoharu Okada, Komaki (JP)

(73) Assignee: Kabushikikaisha Taiheiseisakusho, Komaki (JP)

( * ) Notice: Subject to any disclaimer, the term of this patent is extended or adjusted under 35 U.S.C. 154(b) by 0 days.

(21) Appl. No.: 10/252,071

(22) Filed: Sep. 23, 2002

(65) Prior Publication Data

US 2003/0089815 A1 May 15, 2003

Related U.S. Application Data

(62) Division of application No. 09/673,576, filed as application No. PCT/JP00/00030 on Jan. 7, 2000, now Pat. No. 6,557,795.

(30) Foreign Application Priority Data

| | | |
|---|---|---|
| Feb. 25, 1999 | (JP) | 11-48675 |
| Feb. 25, 1999 | (JP) | 11-48677 |
| May 26, 1999 | (JP) | 11-146884 |
| May 26, 1999 | (JP) | 11-146885 |
| Jul. 21, 1999 | (JP) | 11-206400 |
| Jul. 21, 1999 | (JP) | 11-206401 |
| Oct. 29, 1999 | (JP) | 11-308146 |
| Dec. 20, 1999 | (JP) | 11-361544 |
| Dec. 20, 1999 | (JP) | 11-361545 |

(51) Int. Cl.[7] ..... B65H 18/22; B65H 18/26

(52) U.S. Cl. ..... 242/528; 242/541.3; 242/541.1; 242/535.4

(58) Field of Search ..... 242/528, 541.3, 242/541.4, 541.7, 535.4

(56) References Cited

U.S. PATENT DOCUMENTS 3,874,607 A 4/1975 Hornig (List continued on next page.)

FOREIGN PATENT DOCUMENTS

| | | |
|---|---|---|
| DD | 25 42 461 A1 | 3/1977 |
| JP | 56-10464 | 6/1954 |

(List continued on next page.)

*Primary Examiner*—John M. Jillions
(74) *Attorney, Agent, or Firm*—Snider & Associates; Ronald R. Snider

(57) ABSTRACT

A take-up reel has a diameter equal to or more than 85 times a thickness of a veneer sheet wound thereon and equal to or more than 300 mm so as to be of a curvature of the take-up reel to reduce cracking in parallel to fiber orientations that occurs in winding a veneer sheet after drying on a winding surface of the take-up reel. A veneer reeling apparatus comprises: a take-up reel disposed in a veneer sheet reeling position in a rotatable manner; a drive roller disposed on the lower surface of the take-up reel, transmitting a driving force with a variable speed; a veneer dryer disposed upstream from the veneer sheet reeling position; a conveyor provided between the terminal end of the veneer dryer and the drive roller in the veneer sheet reeling position; an a plurality of thread feeding mechanisms disposed at arbitrary spatial intervals along a length direction of the take-up reel for a veneer sheet, wherein a continuous dried veneer sheet or dried veneer sheets whose sizes are of a constant length or of a length at random are wound on the take-up reel to form a veneer roll, with threads as guide by a frictional force of the drive roller. Further, pairs of two overlapping veneer sheets or set of a pair of two overlapping veneer sheets and a single veneer sheet can be wound on the take-up reel in a composite form.

4 Claims, 74 Drawing Sheets

U.S. PATENT DOCUMENTS

| | | | | | |
|---|---|---|---|---|---|
| 3,957,220 | A | * | 5/1976 | Beck et al. | 242/528 |
| 4,181,269 | A | | 1/1980 | Ketteler et al. | |
| 4,291,843 | A | | 9/1981 | Yanagawa et al. | |
| 4,442,982 | A | | 4/1984 | Iwamoto | |
| 4,811,496 | A | | 3/1989 | Honda et al. | |
| 5,116,043 | A | * | 5/1992 | Jermann et al. | 242/528 |
| 5,988,558 | A | | 11/1999 | Koike et al. | |

FOREIGN PATENT DOCUMENTS

| | | | | |
|---|---|---|---|---|
| JP | 48-41526 | | 12/1973 | |
| JP | 52-58158 | | 5/1977 | |
| JP | 57-70602 | | 5/1982 | |
| JP | 57-83402 | | 5/1982 | |
| JP | 57-129701 | | 8/1982 | |
| JP | 57-137102 | | 8/1982 | |
| JP | 57-175647 | * | 10/1982 | 242/541.3 |
| JP | 59-138409 | | 8/1984 | |
| JP | 60-47771 | | 4/1985 | |
| JP | 62-45906 | | 3/1987 | |
| JP | 62-132064 | | 8/1987 | |
| JP | 64-064801 | | 3/1989 | |
| JP | 1-209258 | | 8/1989 | |
| JP | 2-14101 | | 1/1990 | |
| JP | 02-117546 | | 5/1990 | |
| JP | 02-270773 | | 11/1990 | |
| JP | 3-256958 | | 11/1991 | |
| JP | 05-16102 | | 1/1993 | |
| JP | 11-221804 | | 8/1999 | |
| JP | 2000-61909 | | 2/2000 | |

* cited by examiner

TAKE-UP REEL, VENEER REELING APPARATUS, TAPE FEEDING UNIT FOR VENEER ROLL, VENEER ROLL UNWINDING APPARATUS AND A PRODUCTION METHOD FOR LAMINATED WOOD

RELATED APPLICATIONS

This application claims the priority of Japanese Patent Application Nos. 11-48675 filed on Feb. 25, 1999, 11-48677 filed on Feb. 25, 1999, 11-146884 filed on May 26, 1999, 11-146885 filed on May 26, 1999, 11-206400 filed on Jul. 21, 1999, 11-206401 filed on Jul. 21, 1999, 11-308146 filed on Oct. 29, 1999, 11-361544 filed on Dec. 20, 1999, 11-361545 filed on Dec. 12, 1999, and PCT/JP00/00030 filed on Jan. 7, 2000 which are incorporated herein by reference. This application is a divisional of application Ser. No. 09/673,576 filed on May 15, 2001, now U.S. Pat. No. 6,557,795.

TECHNICAL FIELD OF THE INVENTION

The present invention relates to a take-up reel on which a veneer sheet in a damp state as cut by a veneer lathe, or a veneer sheet that has been dried from the damp state thereof by a dryer is wound, a veneer reeling apparatus that reels the veneer sheet, a tape feeding unit that feeds a tape into between veneer sheets which is reeled into a veneer roll and a veneer roll unwinding apparatus that automatically unwinds a veneer sheet from a veneer roll wound on the take-up reel to send the veneer sheet to a next step and a production method for laminated wood.

DISCLOSURE OF THE INVENTION

It is an object to provide a take-up reel on which a veneer sheet in a damp state as cut by a veneer lathe, or a veneer sheet that has been dried from the damp state thereof by a dryer is wound and a veneer reeling apparatus that winds a veneer sheet on a take-up reel in a smooth manner while preventing cracks, rifts or the like in directions of fibers of the veneer sheet from occurring. It is another object to provide a tape feeding unit that feeds a tape into between veneer sheets from a tape roll and can cut the tape at an arbitrary timing. It is still another object to provide a veneer roll unwinding apparatus that automatically unwinds a veneer sheet from a veneer roll wound on the take-up reel to send the veneer sheet to a next step.

According to findings from experiments conducted by the present inventors, when a take-up reel (a diameter of 165 mm) that has been used for reeling a veneer sheet before drying, that is a veneer sheet as cut from a log, is used for reeling a veneer sheet after drying with no special consideration, there have been many of cases where the veneer sheet after drying does not adapt itself to a small diameter of the take-up reel and as a curvature of a winding circumferential surface of a take-up reel is smaller as compared with a thickness of the veneer sheet to be wound, cracks are easier to occur in parallel to fiber directions, thereby making it impossible for the veneer sheet to be wound on the take-up reel. Especially, when there are cracks, rifts or the like generated in a veneer sheet after drying, tearing and breaking occur from such defects. The inventors have acquired a way to determine a diameter of a take-up reel on which a veneer sheet after drying is wound in connection with a thickness T of the veneer sheet based on the findings from experiments: A diameter of a take-up reel as a curvature corresponding to a thickness T of a veneer sheet is given based on a ratio of a diameter D of a take-up reel/ a thickness T of a veneer sheet wound thereon and the minimum diameter of a take-up reel is set to 300 mm. According to the way to determine a diameter of a take-up reel, a veneer sheet after drying can preferably be wound on a take-up reel having a diameter equal to or more than 85 times a thickness of a veneer sheet and equal to or more than 300 mm.

According to a take-up reel of the invention, a weight of the take-up reel can be reduced and a burden of driving power can be decreased in transportation of a take-up reel, reeling a veneer sheet, storage of a veneer roll in a veneer roll stock area of a reeling deck and so on. Further, a veneer sheet on a winding circumferential surface of the take-up reel has ventilation passages, in radial direction, in communication with spaces formed in the interior of the take-up reel and openings are formed in winding supports for a veneer sheet fixed on a reel shaft to produce communication between the spaces along the reel shaft direction. With such a structure, since the winding circumferential surface of a veneer sheet of the take-up reel and the spaces formed in the interior of the take-up reel communicate with the air outside the take-up reel, ventilation is ensured. Therefore, hot air, moisture and so on included in the veneer sheet after drying is released through many of openings into the outside air and thereby, an equilibrium moisture content of each wound veneer sheet can be accelerated to reach in the storage.

In the take-up reel, flanges disposed at a spatial interval of a length corresponding to a winding width of a veneer sheet are used as winding supports for the veneer sheet and the veneer sheet is wound on the take-up reel to form a veneer roll. In such a situation, air in spaces between the flanges are released into the outside air through openings formed in the flanges and finally openings of the flanges at both outermost sides of the take-up reel. Therefore, hot air, moisture and so on, included in a veneer sheet after drying, wound on the take-up reel are released from spaces between the flanges into the outside air through openings formed in the flanges and finally openings of the flanges at both outermost sides of the take-up reel, while fresh air in the outside air flows into the interior of the take-up reel through the openings of the flanges at both outermost sides of the take-up reel.

A veneer sheet after drying is wound on the take-up reel as a pair of two overlapping veneer sheets with threads as guide to form a composite veneer roll. The composite veneer roll is prepared for combination of a face veneer sheet and a substrate veneer sheet for use in a multi-ply laminated wood and two veneer sheets are superimposed on each other while fiber orientations of the respective sheets are aligned to be the same as each other. The two overlapping veneer sheets are composed of those of different kinds or preferably composed of a face sheet and a substrate sheet, wherein the face and substrate sheets are each selected from various kinds thereof. Further, since face and substrate sheets are almost of the same in grade, two face sheets of the same kind or two substrate sheets of the same kind are sometimes combined to form two overlapping veneer sheets.

Further, pairs of two overlapping veneer sheets and single veneer sheets, both after drying, with a pair of overlapping veneer sheets and a single veneer sheet as a set, are alternately wound on the take-up reel with threads as guide to form a composite veneer roll. The composite veneer roll is prepared for use in five-ply laminated wood, and a pair of two overlapping veneer sheets and a single veneer sheet, both of the same fiber orientation, are combined as a set. The three veneer sheets composing the set can be constituted of those of different kinds from one another or preferably constituted of a face sheet, a substrate sheet and a central core sheet, wherein the face, substrate and central core sheets are each selected from various kinds thereof. Face and substrate sheets in an overlapping state as pairs and single central core sheets are alternately wound on a take-up reel. Further, since face and substrate sheets are almost the same in grade, two face sheets of the same kind or two substrate sheets of the same kind are sometimes combined to form two overlapping veneer sheets.

A veneer reeling apparatus of the invention comprises: a take-up reel installed in a veneer reeling position in a rotatable manner; a drive roller that is disposed below the take-up reel and which transmits a driving force at a variable speed; a veneer dryer installed upstream from the veneer reeling position; a connection conveyor installed between the terminal end of the veneer dryer and the drive roller in the veneer reeling position; and a plurality of thread feeding mechanisms arranged at arbitrary spatial intervals in the length direction of the take-up reel, wherein a continuous veneer sheet that has been dried in a veneer dryer can be wound on the take-up reel with threads in plural rows arranged in the length direction of the take-up reel as guide.

Further, a veneer reeling apparatus of the invention comprises: a take-up reel installed at a veneer reeling position in a rotatable manner; a drive roller that is disposed below the take-up reel and which transmits a driving force at a variable speed; a veneer dryer installed upstream from the veneer reeling position; a direction change-over conveyor installed between the terminal end of the veneer dryer and the drive roller in the veneer reeling position; and a plurality of thread feeding mechanisms arranged at arbitrary spatial intervals in the length direction of the take-up reel, wherein a non-continuous veneer sheet that has been dried in a veneer dryer can be wound on the take-up reel with threads in plural rows arranged in the length direction of the take-up reel as guide.

A winding guide member comprises: for example, endless bands in plural number of rows that each extend over three pulleys disposed at least at three points including a base end section, a middle section and a distal end section. Each endless band is connected to the distal end of a transport conveyor that transports a veneer sheet at a pulley in the base end section. Further, when the pulleys in the distal end section are swung in a direction toward a take-up reel by a following action means, the endless bands get into press contact to part of the circumferential surface of the take-up reel along the curvature thereof.

It should be appreciated that while each endless band is of a belt-like shape that extends over pulleys in the base end section and the distal end section in an endless manner, diameters of the pulleys in the base end and distal end sections are not equal to each other but the pulleys in the base end section are large in diameter as compared with the pulleys in the distal end section. Therefore, when the endless bands are pressed on the lower portion of the circumferential surface of the take-up reel, there arises a spatial margin corresponding to a difference between diameters of both pulleys in the base end and distal end sections, which makes the endless bands press the circumferential surface of the take-up reel over a surface area extending in the reel shaft direction with a width in the lower portion thereof. With such press on the surface area, more of a frictional force can be produced between the endless bands and the lower portion of the circumferential surface of the take-up reel due to increase in contact area, enabling winding of the veneer sheet on the take-up reel in a stable manner. Pairs of support arms are bent in the middle region thereof with the distal end thereof displaced toward the take-up reel, as a diameter of a veneer roll increases with progress in winding operation, the following inconveniences are avoided: such as those that the upper tracks of the endless bands get into contact and interfere with the support arms, between a lower surface and an upper surface, or the endless bands cease circulation, ensuring winding of a veneer sheet on a take-up reel.

Further, when a winding guide member is in a press contact state in conformity with the curvature of part of the circumferential surface of the take-up reel, rotary pulleys provided maintains the winding guide member in a firmly stretching condition under a constant tension by pushing or pulling the endless bands constituting the winding guide member under a pressure while guaranteeing a circulation force of the winding guide member so as to be rotatable all time. Therefore, the winding guide member can run a long the curvature of the take-up reel while imparting almost the same frictional force on a veneer sheet, which enables a stable winding operation.

Especially, it is also possible that the rotary pulleys are individually provided on the endless bands in plural row constituting the winding guide member so as to individually adjust pushing or pulling the endless bands under a pressure while ensuring its circulation force. When firm stretching means are independently provided for the respective endless bands in such a way, it is possible that the endless bands of the winding guide member can individually be maintained in a firm stretching state in the same degree and thereby, a veneer sheet can receive almost the same frictional force at any points on a take-up reel along the shaft direction thereof even if there arise a deflection caused by self weight in the take-up reel or a thickness of a veneer sheet fluctuates in the course of winding operation, for example.

According to a tape feeding unit of the invention, a tape roll is blocked on its movement and controlled on its position in a tape feeding direction by forward movement stopper members on transport means and a tape unwinding from the tape roll that is under such control can be inserted into between veneer sheets that is wound on the take-up reel to form a tape roll. When a veneer sheet is wound on a take-up reel to form a veneer roll in synchronism with a speed at which the veneer sheet is cut from a log by a veneer lathe, the tape can be put in a firm stretching state between the tape roll and the veneer roll. A cutting section of a tape cutting tool is in a sliding contact with the surface of the tape in unwinding and feeding rotation of the tape roll can be stopped at a position where movement of the tape roll is blocked.

Further, a tape feeding unit for a veneer roll which feeds a tape into between veneer sheets that is wound on a take-up reel can comprises:

- a vacuum chuck conveyor that guides the tape into between veneer sheets from a feed source;
- a tape rack that is provided to a tape feed source, which has a plurality of tape housing rooms not only arranged in a movable manner in a direction almost at a right angle to a tape feed direction of the vacuum-chuck conveyor, but also respectively separated by partition members preventing falling of a tape roll to either of both sides and respectively having tape rolls accommodated therein that are each produced by winding a tape on a core; which is intermittently moved a distance equal to a pitch at which the tape housing rooms are arranged such that each of the tape housing rooms are sequentially located on a transport route of the vacuum-chuck conveyor; and which is operated such that when a tape housing room arrives on the transport route, it is possible that a tape is unwound from a tape roll through the front side thereof that is opened while a tape roll is rotatably supported and simultaneously prevented from falling to either of both sides by partition members; a forward movement stopper member that is disposed in an adjacent manner to the tape rack downstream therefrom on the transport route of the vacuum-chuck conveyor, which stops a tape roll, after a tape housing room of the tape rack comes to be located on the transport route of the vacuum-chuck conveyor, and a tape roll in the tape housing room then moves forward by an extreme extent at which the tape roll does not disengage from partition members, and which controls a position of the tape roll such that the tape is unwound from the tape roll at a place where the tape roll has been stopped while being rotated by the vacuum conveyor;

a tape cutting tool that protrudes from the distal end of the transport means; and a tape roll rotation stop device that ceases rotation of the tape at a position upstream from the forward movement stopper member.

In such a way, with use of a tape rack, not only is falling of a tape roll to either of both sides prevented from occurring, but the next tape roll can be fed by moving the tape rack over a distance corresponding to a predetermined pitch of partition members when unwinding the preceding tape roll is completed. In this case, a forward movement stopper member can be provided separately and independently from the tape rack, for example, with a position thereof being fixed.

A forward movement stopper member may be one that allows unwinding of a tape roll in a sliding contact with the tape roll while preventing forward movement of the tape roll, but a stopper of a idling roller type is preferably used since the stopper is in a rolling contact with the tape roll and thereby, resistance therebetween of relative movement is minimized. Further, two idling roller stoppers can be used instead of a single idling roller stopper: for example one that is used to be in contact with a tape roll of a large diameter and the other that is used to be in contact with a tape roll of a small diameter.

Further, when winding of a veneer sheet is interrupted or terminated, rotation of a tape roll is ceased by pressing one side of the tape roll in a direction intersecting a direction of tape unwinding from the other side thereof. In this case, as means for stopping rotation of a tape roll, there are provided a receiving member that receives the one side surface of the tape roll and which is erected from a frame of a vacuum-chuck conveyor constituting of the transport means on one side thereof as viewed in a direction intersecting the tape unwinding direction at a position upstream from the forward movement stopper member and a press member connected to a cylinder mounted to the frame, wherein the press member is press-movable to the other side surface of the tape roll. Further, when winding of a veneer sheet is interrupted or terminated, rotation of a tape roll is ceased by pressing the press member to the receiving member while being in contact with the other side surface of the tape roll.

A cutting tool for cutting a tape protrudes from the distal end of the transport means, and not only has a cutting section extending in a direction intersecting the tape feed direction but can move in a direction in which the cutting tool comes into contact with the tape and the cutting section gets into a sliding contact with the tape, which is fed, by a movement mechanism. In order to attain a good sliding contact state, for example, a transport means swings about a fulcrum and thereby, the cutting section of the tape cutting tool goes from a sliding contact state to a state where the section partly presses into the surface of the tape.

While driving of a veneer lathe is ceased almost in synchronism with cease of rotation of a tape roll, a take-up reel continues inertial rotation movement at a veneer reeling position. Therefore, the tape is pulled by the veneer take-up reel that keeps its inertial rotation movement in spite of stoppage of tape unwinding from a tape roll, which causes the tape in a pulled state to be cut at the weakest position thereof, that is a position with which the cutting section of the tape cutting tool is in a sliding contact.

Further, when a tape unwound is twisted, there is a chance to cause a trouble since an adhesive surface of the tape is turned upside down. In order to prevent such a twist of the tape surface, an upside-down turn (twist) preventive member of a spatula-like member by which a twist of the tape surface is corrected or prevented from occurring can be provided at the distal end of the transport means. A tape unwound from the tape roll is pressed on the circumferential surface of a veneer roll by advancing the spatula-like member continuously at regular intervals from when the tape gets inserted into between veneer sheets to when the tape is cut. While a tape unwound from a tape roll being inserted in a normal state is sometimes turned upside down by chance in the course of operation and inserted into between veneer sheets in a wrong state, the twist phenomena can be prevented from occurring by adoption of the twist preventive member.

In a veneer roll unwinding apparatus of the invention, drive guide bands are constituted of endless bands such as belts that extend over a plurality of base end pulleys fixedly mounted on a support shaft located below a unwinding position in the shaft direction thereof at arbitrary spatial intervals and as many distal end pulleys as the number of the base end pulleys, wherein the distal ends at which the distal end pulleys are mounted are free. The distal end pulleys are swingable with the support shaft as a fulcrum and the drive guide bands are moved to or away from the lower portion of the circumferential surface of a veneer roll formed by winding a veneer sheet on a take-up reel which is rotatably disposed at the unwinding position.

Further, relay pulleys whose diameters are larger than those of the base end pulleys are rotatably mounted on a shaft on which the base end pulleys are fixedly mounted in the fold-back side of the drive guide bands, that is in the base end pulley side where a veneer sheet is folded back and turned upside down. It is preferable that the a plurality of relay pulleys are in a freely idling manner disposed on the shaft on which the base end pulleys are fixedly mounted while arranged in lateral direction together with the base end pulleys and a fold-back guide member is provided on the opposite side to the relay pulleys in the fold-back section. The fold-back guide member is preferably constructed of: a frame with an opposite surface to the relay pulleys which surface has a profile of an arc extended along the curvature of the relay pulleys; a plurality of pulleys that are supported on the frame; and endless bands extending over the pulleys. The endless bands extending over the pulleys respectively correspond to the relay pulleys in number and disposed in positions opposite to the positions where the relay pulleys are located, and in sliding contact with the outer circumferential surface of a veneer sheet fold-back side of the relay pulleys.

The endless bands circulates at almost the same speed as that of a transport speed of a veneer sheet transported on the drive guide bands to a fold-back direction. When the drive guide bands circulate in contact with the lower portion of circumferential surface of a veneer roll while swinging with a support shaft as a fulcrum the veneer sheet is unwound by a frictional force of the drive guide bands acting on a veneer roll. The unwound veneer sheet is then transported on the drive guide bands and reach the fold-back section thereof, and then is transferred to the relay pulleys from the drive guide bands. The transferred veneer sheet is folded back by receiving a driving force of the endless bands of the fold-back member while being pinched between the relay pulleys and the endless bands, with the result that the veneer sheet is turned upside down.

In such a way, since a transport speed of the drive guide bands and a fold-back speed at which a veneer sheet is folded back while being pinched between the endless bands constituting the fold-back member and the pulleys in the fold-back section are controlled to be almost the same as each other, there is no chance that a veneer sheet is stretched in a direction perpendicular to fiber orientations of the veneer sheet in company with control of a circumferential speed as described above. Therefore, there arises no excessive concentration of tension at a starting position in unwinding of a veneer sheet when a veneer sheet is unwound from a veneer roll by means of the drive guide bands, thereby preventing breaking and tearing in fiber orientations of a veneer sheet at the starting position in unwinding from occurring.

Further, in a veneer roll unwinding apparatus as described above, a plurality of thread reels are provided in downstream positions from the unwinding position while a travel member is provided in a freely reciprocating manner to or away from the plurality of thread reels with a backward movement limit thereof in an upstream side from the unwinding position. On the travel member, not only there are provided a plurality of grasping members that grasp the terminal ends, which are free fore-ends, of threads that hang down from a veneer roll, wherein the threads are wound on the veneer roll in plural row along the length direction thereof as guide for a veneer sheet, but the grasping members can respectively be provided with nozzles that communicate with an air duct. With such a configuration, the free ends of the threads can be grasped when the travel member advances and the threads are wound on the thread reels by air streams from the nozzles at the travel member forward movement limit. A veneer sheet is unwound by pressing the drive guide bands to part of the circumferential surface of a veneer roll while the threads continues to be wound by the air streams.

Further, in the veneer roll unwinding apparatus, the following configuration can also be adopted: A frame on which a plurality of thread reels are disposed is provided in a downstream side from the unwinding position in a freely reciprocating manner to or away from the unwinding position, wherein the thread reels are disposed at positions on the frame corresponding to threads, which are wound on a veneer roll as guide for a veneer sheet in plural rows along the length direction of the veneer roll, and whose free ends hang down from a veneer roll, and suction holes that communicate with an exhaust duct are respectively formed at winding portions of the thread reels at which threads begin to be wound. In the configuration, the threads are wound on the thread reels by an exhaust stream to the exhaust holes when the frame is positioned at the forward movement limit, thereafter the frame return to its original position and then, a veneer sheet can be unwound from a veneer roll with the drive guide bands in press contact with part of the circumferential surface of the veneer roll while threads continue to be wound on the thread reels.

Further, in the veneer roll unwinding apparatus, the following configuration can also be adopted: A pair of unwinding rollers are disposed at positions downstream from the unwinding position such that both or one of the unwinding rollers can freely be moved to or away from each other, or the other, and the unwinding rollers work for unwinding threads at the positions corresponding to the threads, which are wound on a veneer roll as guide for a veneer sheet in plural rows along the length direction of the veneer roll, and whose free ends hang down from a veneer roll. In the configuration, a veneer sheet can be unwound from a veneer roll with the drive guide bands in press contact with part of the circumferential surface of the veneer roll while the pair of unwinding rollers take up and pinch free ends of threads therebetween by moving to each other and unwind the threads. In this case, it is preferable that one of the pair of unwinding rollers is of a single cylinder, while the other is replaced with a plurality of unwinding rollers on a common axial line each with a same diameter cylinder, wherein the single unwinding roller and the plurality of unwinding rollers can freely be moved to or away from each other.

It should be appreciated that it is preferable that in the drive guide bands, a diameter of base end pulleys is larger than that of distal end pulleys, and pairs of support arms that respectively support the distal end pulleys are each bent in the middle region with the distal end thereof displaced upward.

In unwinding a veneer sheet from a veneer roll in which unwinding assist members constituted of long flexible members are reeled together with a veneer sheet, when a position from which a veneer sheet begins to be unwound from the circumferential surface of the veneer roll is called a veneer sheet separating position and a veneer sheet separation opposite position is set at an opposite point on the circumferential surface of the veneer roll from the veneer sheet separating point, on the other side of the central axial line of the veneer roll from the veneer sheet separating point, a direction along which the unwinding assist members are pulled out from the veneer roll can be determined between the veneer sheet separating position and the veneer sheet separation opposite position in the veneer sheet unwinding side. In the veneer sheet unwinding side formed between the veneer sheet separating position, from which a veneer sheet begins to be unwound from the circumferential surface of the veneer roll, and the veneer sheet separation opposite position, at which a line from the veneer sheet separating position through the center of the veneer roll intersects the circumference of the veneer roll, a direction along which the unwinding assist members, for example the threads, are pulled out from the veneer roll is determined in a space between the veneer sheet separating position and the veneer sheet separation opposite position. It is important that the pulling direction is determined such that when a veneer sheet unwound from the veneer roll tends to be wound on the veneer roll in accompanying manner, the pulling direction works so as to prevent accompanying phenomena of a veneer sheet with the veneer roll from occurring and to be effective for bringing the veneer sheet to the transport surface. That is, when a thread is pulled toward almost directly above along the curvature of the veneer roll or in a direction inclined from the directly above toward the other side from the veneer sheet unwinding side, it is hard to block the accompanying action of a veneer sheet by a thread. Therefore, it is preferable that an angle formed between a line that connects the center of the veneer roll and the veneer sheet separating position and a line that connects the center and a separating point of a thread is less than 90 degrees and a thread is pulled out from the veneer roll with an angle in the range.

A thread support device is located at an outward position radially spaced apart from the circumferential surface of a veneer roll and thread auxiliary pulleys are rotatably mounted on a support shaft thereof disposed in parallel to the central axial of the veneer roll. When threads that are wound on the veneer roll along the curvature are protruded from the veneer roll outwardly, the threads are recovered by supporting on the thread auxiliary pulleys so as to minimize a loss of the threads, wherein the threads are received into a recovery box or onto thread reels in a firmly stretching state of the threads. Further, in supporting the thread auxiliary pulleys, if the thread auxiliary pulleys are rotatably mounted on the fore-ends of protruded arms that protrude from the support shaft, the threads can be supported by the thread auxiliary pulleys with ease.

The support shaft of the thread support device is supported by one ends of arm rods at both ends of the support shaft and one of rotary shafts attached to the other end of the arm rod is mounted to a piston rod of a fluid cylinder. The rotary shaft is swung through an angle by extending or contracting the piston rod, thereby enabling displacement of a position of the support shaft outwardly spaced from the veneer roll along the circumference of the veneer roll. With such a configuration to enable the displacement, the threads are positioned in a protruding manner while being spaced from the veneer sheet unwinding surface of the veneer roll and in addition, in a case where the protruding position is not so much effective for blocking the threads tending to be wound accompanying the circumferential surface of the veneer roll, the position at which the threads are supported spaced outwardly while swinging the rotary shaft is displaced to a position of the support shaft with which the veneer sheets that tends to be wound on the veneer roll are effectively blocked from accompanying the circumferential surface thereof, that is the support shaft is displaced to a position closer to the veneer sheet unwinding surface.

BEST MODE FOR CARRYING OUT THE INVENTION

Description will be made of an embodiment of a veneer reeling apparatus of the invention with reference to the accompanying drawings below.

Figure 1:
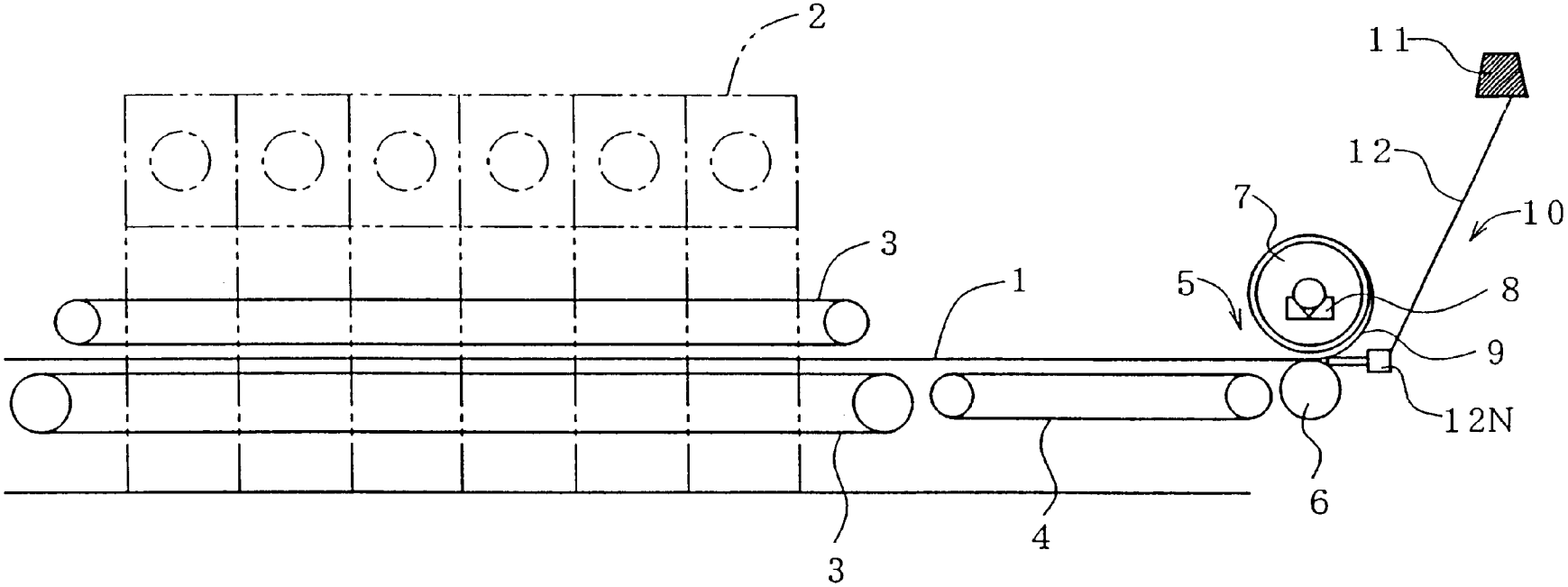
FIG. 1 is a schematic side view showing reeling a veneer sheet in a continuous state after drying.

In FIG. 1, there is shown an embodiment in which a veneer sheet 1 after drying in a continuous state is reeled. In this case, a veneer dryer 2 includes a transport system configured as follows: two metal mesh bands 3 are provided one above the other with a gap therebetween as a transport route and each extend over two pulleys disposed spaced from each other along a transport direction, wherein the metal mesh belts 3 are respectively circulated in opposite directions to transport a veneer sheet in a continuous state. Further, a continuous veneer sheet 1 is dried by a circulated hot air blown from upper air vents of the veneer dryer in transportation and, at the exit of the dryer 2, transferred to a connection conveyor 4 abutted by an end of a metal mesh band 3. Further, the connection conveyor 4 is provided with a pulse generator and a detector that senses the veneer sheet after drying transported thereon, which will be detailed later.

A veneer sheet reeling position 5 where a continuous veneer sheet 1 is reeled is located at a position downstream from the connection conveyor 4. A drive roller 6 is supported with bearings, the top of the drive roller 6 is at a height almost equal to that of the transport surface of the connection conveyor 4 and the length direction thereof at least intersects a transport direction of the veneer sheet 1. While a speed of the drive roller 6 can be variable, the drive roller 6 is normally operated at a speed almost same as that of the connection conveyor 4. A take-up reel 7 whose diameter is large is rotatably supported by a reel receiver 8 with bearings at both ends of the take-up reel 7. The take-up reel 7 is on the drive roller 6 while the lower surface of the take-up reel 7 is kept in contact with the upper surface of the drive roller 6 and the take-up reel 7 is thereby rotated in a counterclockwise direction as viewed in FIG. 1 by a frictional force produced from a driving force of the drive roller 6, following the drive roller 6.

After the continuous veneer sheet 1 is dried in the veneer dryer 2, the sheet 1 is transported on the connection conveyor 4 to reach the veneer reeling position 5. When the continuous veneer sheet 1 arrives at between the drive roller 6 and the take-up reel 7, the take-up reel 7 is in an opposite direction rotated by a frictional force produced from a driving force of the drive roller 6 to take-up the continuous veneer sheet 1 thereon, while the drive roller 6 rotates at almost the same speed as that of the connection conveyor 4. In such a way, the continuous veneer sheet 1 is wound on the take-up reel 7 in a sequential manner. While since the veneer sheet 1 is continuous, it can normally be wound on the take-up reel 7 by a frictional force produced from a driving force of the drive roller 6 with no other special means applied, there sometimes arise breaks with ease due to cracks, rifts or the like produced after a drying operation, or in anther case, relaxation of a veneer roll in the middle portion thereof. To cope with such adverse situations, a plurality of thread feeding mechanisms 10 are provided in a case, as a countermeasure, to the take-up reel 7 at arbitrary spatial intervals in a length direction of the take-up reel 7. In this case, the threads 12 are fed from thread reels 11 of the thread feeding mechanisms 10, the tips of the threads 12 are first wound on the take-up reel 7 at arbitrary spatial intervals along a length direction thereof and thereafter the threads are respectively wound together with the continuous veneer sheet 1 as guides at plural positions on the take-up reel 7.

Figure 2:
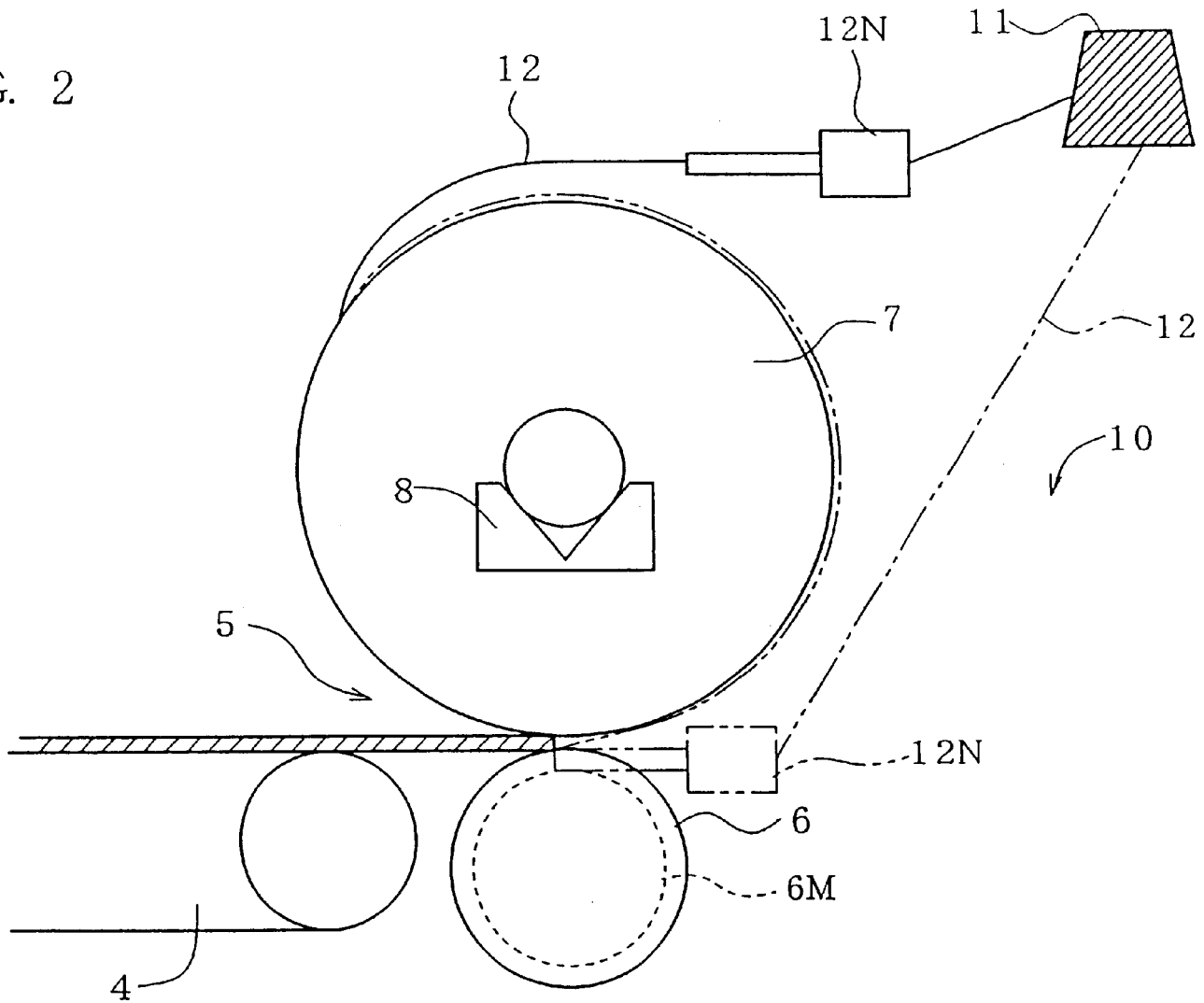
FIG. 2 is an enlarged view for illustration showing a way that threads are wound on a take-up reel.

To be concrete, a way that the threads 12 are wound on the take-up reel 7 is shown in FIG. 2. That is, the take-up reel 7 has highly frictional regions at arbitrary spatial intervals along a length direction thereof on the circumferential surface thereof, such as made from sand papers, fine protrusions or the like with which the threads 12 becomes entangled. A plurality of nozzles for use in feeding the threads are provided to the take-up reel 7 in a position downstream therefrom such that the nozzles can freely be located between upper positions spaced apart from the outer surface of the take-up reel 7 and lower positions by means of, for example, guide rails curved like an arc (not shown) or a mechanism, freely movable, forward or backward, and upward or downward(not shown). The drive roller 6 has grooves 6M at a plurality of positions at arbitrary spatial intervals in a shaft direction and the fore-ends of the nozzles are accommodated in the grooves 6M. The tips of the threads 12 fed from the thread reel 11 are carried on a stream blown to the highly frictional regions of the take-up reel 7 through the nozzles 12N locating at the upper positions so as to become entangled with the highly frictional regions of the take-up reel 7. Thereafter, the nozzles 12N are moved downward to reach the respective grooves 6M on the drive roller 6. At this point, the nozzles 12N are located lower than the upper surface of the drive roller 6 and the threads 12 are in a firmly stretched state between sites where the threads 12 are entangled with on the take-up reel 7 and the nozzles 12N. Hence, when the veneer sheet 1 is wound on the take-up reel 7 by a frictional force produced from a driving force of the drive roller 6, the threads 12 work as a guide and are wound together with the veneer sheet 1 thereon at a plurality of sites on the veneer sheet 1.

In this situation, when the reel receiver 8 that supports the take-up reel 7 with bearings is fixedly positioned, the connection conveyor 4 and the drive roller 6 are freely swung downward with the starting end of the connection conveyor 4 as a fulcrum and as a winding diameter of a veneer roll increases, the drive roller 6 is pivotally lowered in an automatic manner together with the connection conveyor 4 by a half of the increase in diameter. Contrary to this, when bearings of the drive roller 6 are fixedly positioned, the reel receiver 8 of the take-up reel 7 is raised by a half of the increase in diameter of the take-up reel. Further, since the drive roller 6 imparts a frictional force to the take-up reel 7, a fluid pressure, a balance weight or the like is employed in order to maintain a state in which the drive roller 6 is in press contact with the take-up reel 7 under a constant pressure all the time.

Further, while a veneer sheet 1 after drying is wound on the take-up reel 7, it has been impossible to use a take-up reel of a diameter 165 mm for a veneer sheet 1 after drying without any special means applied, which take-up reel has traditionally been for use in reeling a green veneer sheet as cut from a log. That is, when a veneer sheet 1 after drying is wound on a reel of the diameter of 165 mm, the veneer sheet 1 frequently is not adapted to a the small diameter and generates cracks in sites in parallel to fiber orientations with ease, thus making it impossible to winding the veneer sheet 1 on the take-up reel 7. Especially, when there remain cracks and rifts as produced after drying in a veneer sheet 1, breaking or tearing gets started from such defective sites. The inventors have acquired a diameter equivalent to a curvature of a take-up reel 7 that corresponds to a thickness of a veneer sheet 1 after drying wound thereon based on findings as results of experiments wherein the diameter of a take-up reel 7 is limited as a value equal to or more than 300 mm while the diameter is designated using a parameter for determining the diameter=a diameter of a take-up reel 7/a thickness T of a veneer sheet wound on the take-up reel. According to this method for determining a diameter of a take-up reel, a dried veneer sheet 1 can be wound on a take-up reel 7 in a good condition by setting a diameter of the take-up reel 7 such that a diameter of the take-up reel 7 is equal to or larger than not only 85 times a thickness T of a veneer sheet 1 but 300 mm. For example, if a thickness of a veneer sheet 1 is 2 mm, a diameter D of a take-up reel 7 would be set to 170 mm, but since this value is less than 300 mm, the diameter of a take-up reel 7 is eventually set to a value equal to or larger than 300 mm. In this embodiment, a diameter of the take-up reel 7 was set to 450 mm and thereby, a good result was obtained in winding a veneer sheet 1 after drying.

Figure 3:
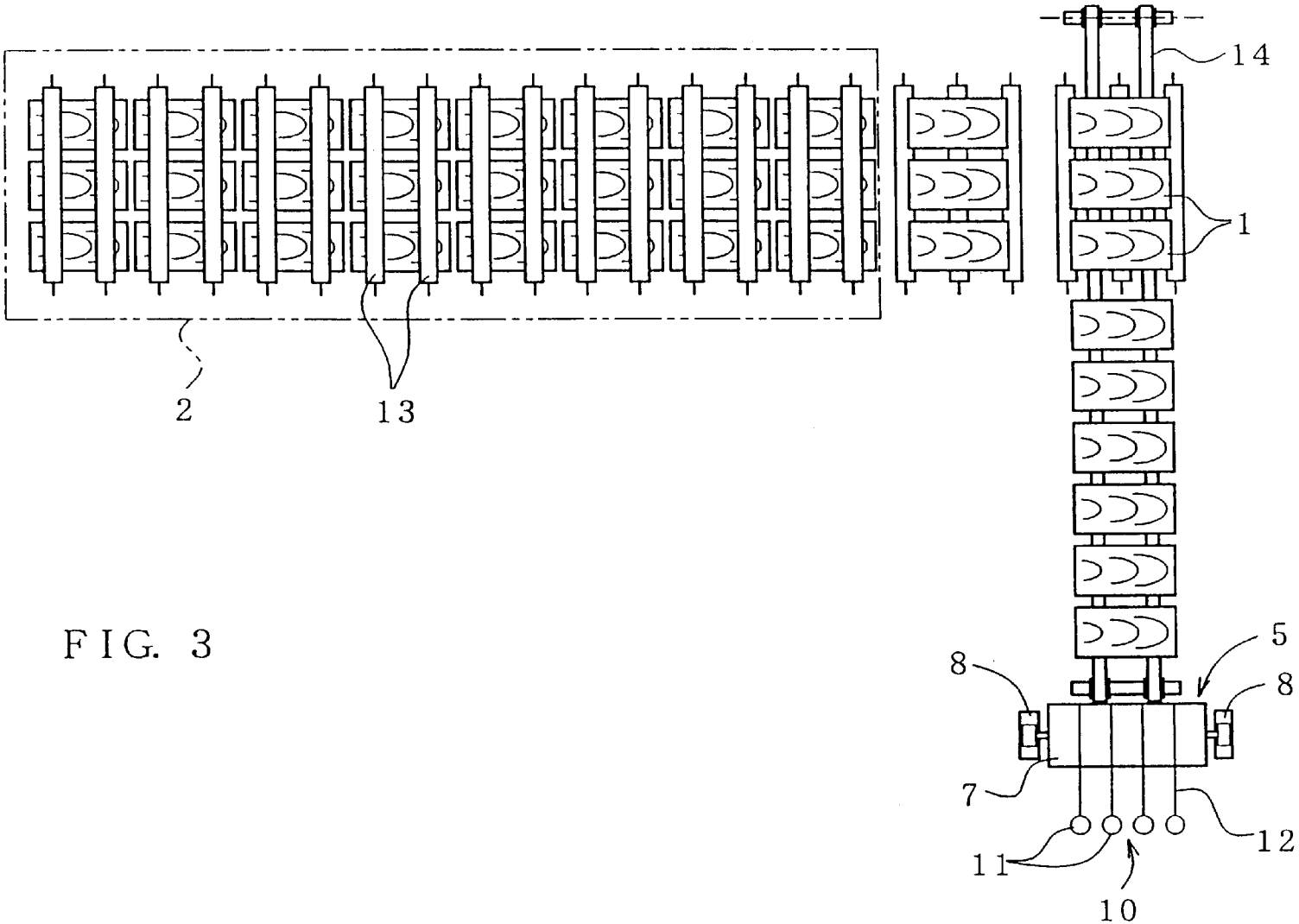
FIG. 3 is a schematic plan view showing reeling veneer sheets in a non-continuous state after drying.

In FIG. 3, there is shown an embodiment in which veneer sheets 1 whose sizes are of a constant length or of a length at random (, in the latter case, the veneer sheets 1 having random sizes and are non-continuous) are wound on a take-up reel after drying. In this case, transport routes in stages of a veneer dryer 2 are constructed of a plural pairs of feed rollers 13, one above the other, disposed at positions along a length direction thereof, wherein the plural pairs of rollers send a veneer sheet 1 by pressing the veneer sheet 1 from both sides in a thickness direction of the veneer sheet 1 and rotating. The veneer sheets 1 are sent simultaneously in plural number as a set (three sheets in the figure) being arranged with a length direction in parallel to a fiber orientation and in a direction perpendicular to a transport direction. The veneer sheets 1 are dried by circulating hot air from upper vents in the veneer dryer 2 in the course of transportation and transferred to a direction change-over conveyor 14 that changes a moving direction of the transportation by an almost right angle at the exit of the veneer dryer 2.

A veneer sheet reeling position 5 is located in a position downstream from the direction change-over conveyor 14, in which position the veneer sheet 1 is wound on a take-up reel. In the veneer sheet reeling position 5, there are provided with a drive roller 6, the take-up reel 7 whose diameter is large, and thread feed mechanisms 10 that are disposed in a length direction of the take-up reel 7 at arbitrary spatial intervals in plural number, all similar to the above described.

Figure 4:
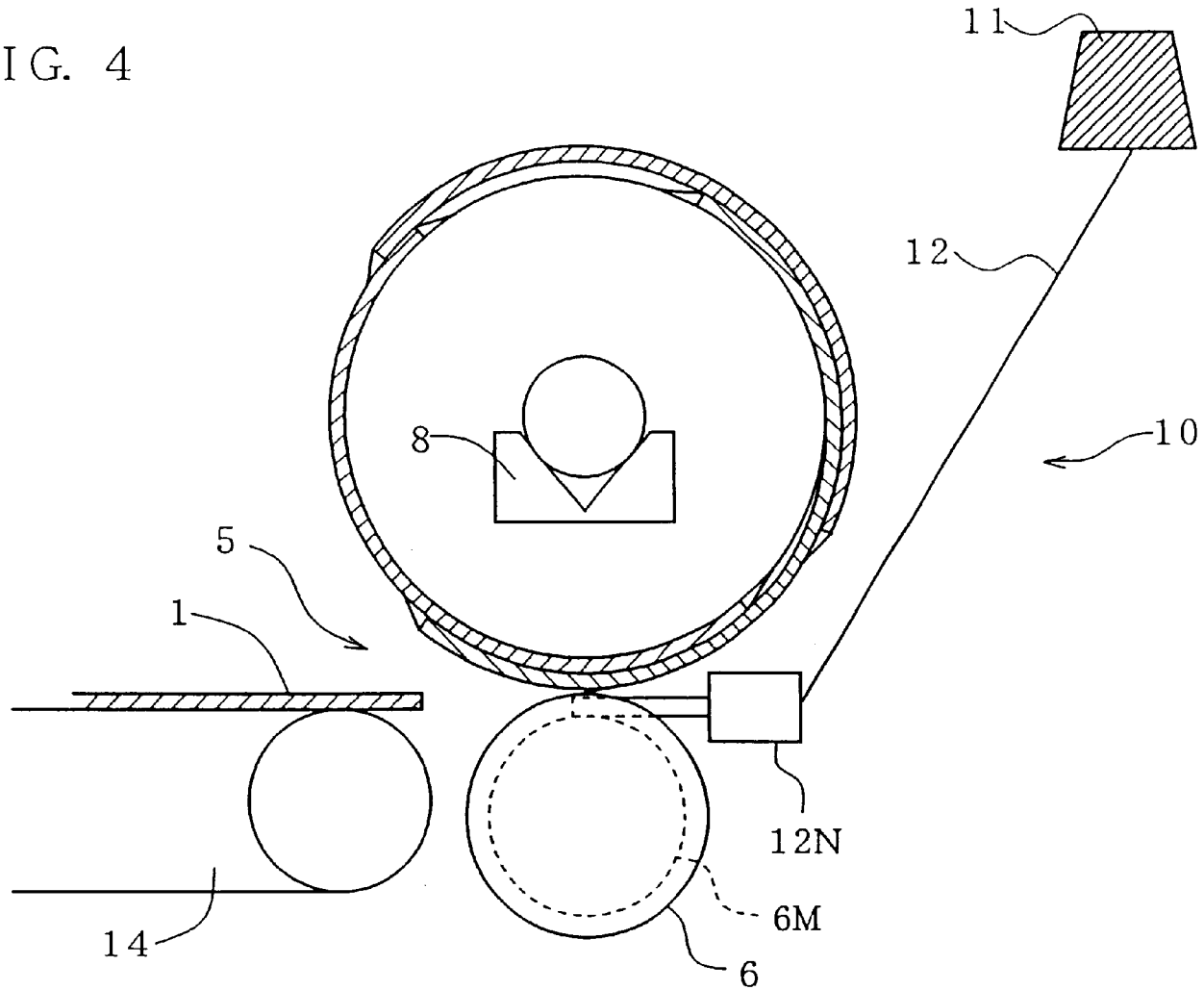
FIG. 4 is a schematic enlarged view for illustration showing a way that veneer sheets in a non-continuous state after drying are reeled.

After the veneer sheet 1 is dried in the veneer dryer 2, it is transferred to the direction change-over conveyor 14 from the transport route in a state in which a transport direction is changed over by a right angle. Hence, the veneer sheet 1 is thereafter transported in a state in which a fiber orientation intersects the new transport direction and reaches the veneer sheet reeling position 5. Then, winding of the veneer sheets 1 get started and threads 12 fed from thread reels 11 of the thread feed mechanisms 10 are blown through nozzles 12N as described above and wound over a plurality of sites located along a length direction of the take-up reel 7 at arbitrary spatial intervals such that tips of the threads 12 are entangled with the plurality of sites. Then when the veneer sheets 1 arrive at between a drive roller 6 and the take-up reel 7, the take-up reel 7 is rotated in an opposite direction from the drive roller 6 by a frictional force produced from a driving force thereof, wherein the drive roller 6 rotates at almost the same speed as a circulation speed of the direction change-over conveyor 14 and thereby, the veneer sheets 1 are wound on the take-up reel 7 with the threads 12 as guides at the plurality of sites thereon. The veneer sheets 1 fed from the direction change-over conveyor 14 are sequentially-wound on the take-up reel 7 as shown in FIG. 4 and at the case, spatial intervals between the veneer sheets 1 arranged end to end in a transport direction are narrowed under consideration of winding efficiency.

Such interval narrowing means will be described with reference to FIG. 5. A detector 15 is placed above the direction change-over conveyor 14 and as a detector, a contact type, or a non-contact type such as a transparency type, a reflection type or the like may be employed. When the detector 15 senses the leading edge of a veneer sheet 1, it transmits a detection instruction to a drive controller 16 that is a control system of the drive roller 6. A distance setter 17 that sets a distance K from the detector 15 to the drive roller 6 is connected to the drive controller 16 and the drive controller 16 stops the drive roller 6 in response to the detection instruction. A pulse generator 19 is provided to the direction change-over conveyor 14 and thereby, a distance K over which a veneer sheet 1 is carried on the direction change-over conveyor 14 is detected by counting up of the number of pulses. A veneer sheet 1 that has arrived on the drive roller 6 is moved over a length of the veneer sheet 1 by the drive roller 6 and thereby is wound on the take-up reel 7 with the threads 12 as a guide. A length of a veneer sheet 1 is determined by the detector 15 through detecting the leading and trailing end of the veneer sheet 1 in transportation of the veneer sheet 1 on the direction change-over conveyor 14 and stored in the drive controller 16 as the number of pulses. It should be appreciated that when a length of a veneer sheet 1 is cut constant, the constant length may be stored in the drive controller 16 as a length of a veneer sheet in advance.

When the leading edge of a next veneer sheet 1 is detected by the detector 15, the veneer sheet 1 comes onto the drive roller 6 after steps similar to the above described and the veneer sheet 1 is wound on the take-up reel 7 with the threads 12 as a guide while a gap between the veneer sheet wound previously and the veneer sheet in consideration are narrowed. By repetitions of the above described operations, the drive roller 6 intermittently rotates and veneer sheets 1 are efficiently wound on the take-up reel 7 with narrowed intervals.

Figure 5:
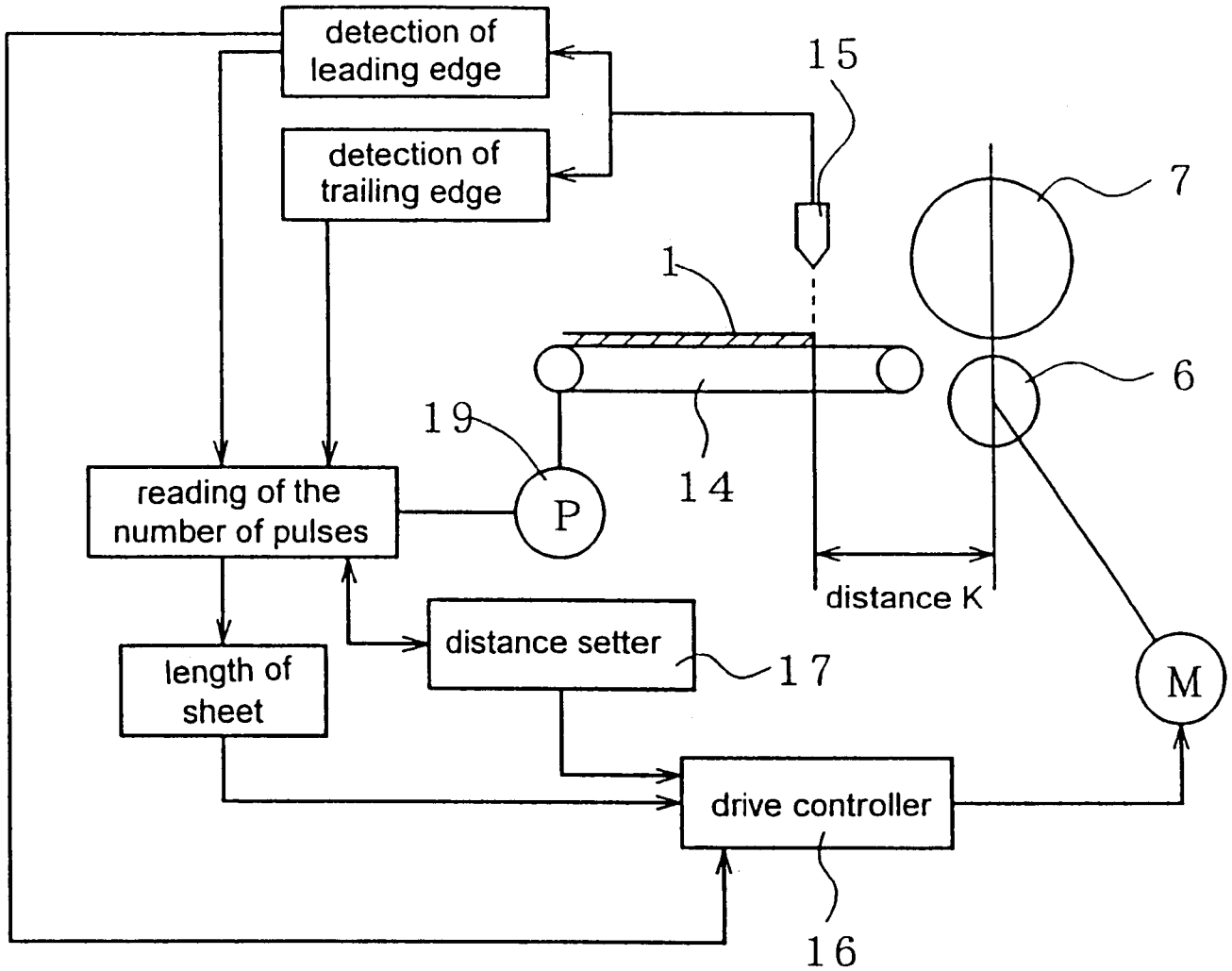
FIG. 5 is a block diagram of interval narrowing means.
Figure 6:
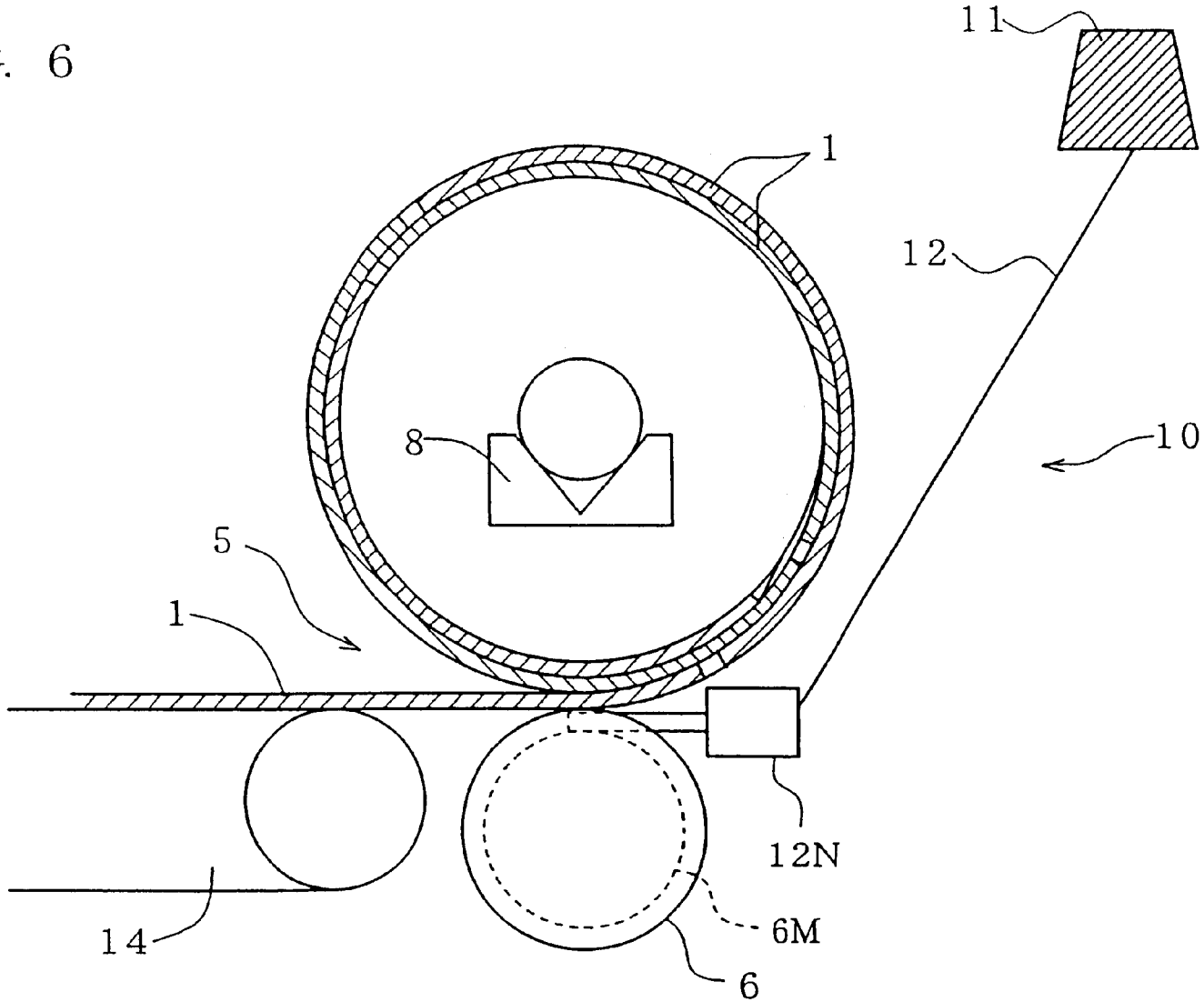
FIG. 6 is an enlarged view for illustration showing a winding state while narrowing spatial intervals between veneer sheets in a non-continuous state after drying.
Figure 7:
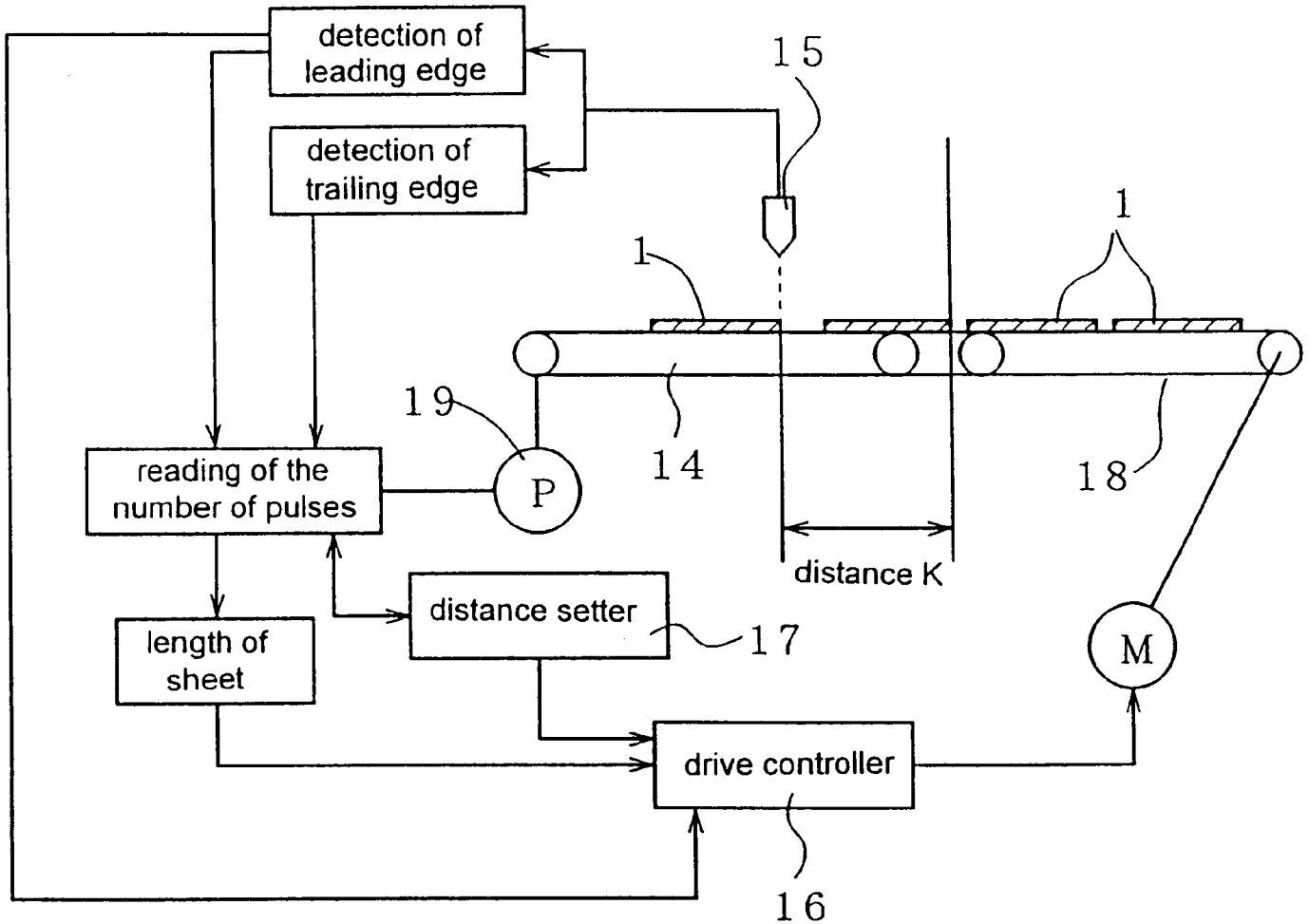
FIG. 7 is a block diagram showing another embodiment of the interval narrowing means.

Since the interval narrowing means shown in FIG. 5 winds a veneer sheet 1 on the take-up reel 7 by intermittently rotating the drive roller 6 at the veneer sheet reeling position 5, when a transport speed of the conveyor and an average speed of intermittent winding (slow speed) correspond to each other, no trouble arises in reeling. However, if a winding speed is intended to be higher, a trouble arises. In this case, adjustment of spatial intervals of veneer sheets 1 is performed during transportation at a stage prior to the veneer sheet reeling position 5. Then, another embodiment of the interval narrowing means will be described with reference to FIG. 7, wherein the same constituents as those corresponding of FIG. 5 are indicated by the same marks. At first, the starting end of an interval narrowing conveyor 18 that performs narrowing spatial intervals between veneer sheets 1 arranged along a transportation direction is disposed in a staggered manner with the terminal end of the direction change-over conveyor 14, wherein both conveyors 14 and 18 can independently be driven. In this situation, when a detector 15 disposed above the direction change-over conveyor 14 detects the leading edge of a veneer sheet 1, the detector 15 transmits a detection instruction to a drive controller 16 that is a control system of the interval narrowing conveyor 18. A distance setter 17 in which a distance K from the detector 15 to a point on the interval narrowing conveyor 18 is set is connected to the drive controller 16 and driving of the interval narrowing conveyor 18 is stopped in response to the detection instruction. A pulse generator is provided to the direction change-over conveyor 14, a veneer sheet 1 is carried on the direction change-over conveyor 14 over a distance K and transportation over the distance K is detected by counting up of the number of pulses. A veneer sheet 1 having arrived on the interval narrowing conveyor 18 is driven by a length of the veneer sheet 1. A length of a veneer sheet 1 is determined by the detector 15 through detecting the leading and trailing end of the veneer sheet 1 in transportation of the veneer sheet 1 on the direction change-over conveyor 14 and stored in the drive controller 16 as the number of pulses. It should be appreciated that since a length of a veneer sheet 1 is cut constant, the constant length may be stored in the drive controller 16 as the length of a veneer sheet 1 in advance. With this intermittent driving, veneer sheets 1 are rearranged such that spatial intervals end to end of the veneer sheets 1 along the transport direction are smaller on the interval narrowing conveyor 18. Then, the veneer sheets 1 are transferred to another conveyor whose speed coincides with a winding speed, followed by winding on a take-up reel 7 at the speed.

A veneer roll 9 obtained by winding a veneer sheet or sheets 1 after drying on a large diameter take-up reel 7 are stored in a veneer roll stock area of a reeling deck for a time period such that each veneer roll comes to have an equilibrium moisture content It is appreciated that the take-up reel 7 is a cylinder with a shaft 7G as a center of rotation and a closed space is normally formed in the interior of the cylinder with a welded structure. Especially, since the take-up reel 7 has a large diameter(equal to or larger than 300 mm and in the embodiment, a diameter of 450 mm) as compared with a take-up reel (of a diameter of 165 mm) that has been employed in reeling a green veneer sheet as cut from a log, a weight of a take-up reel itself is increased and thereby, requirement for driving power is increased in transportation of a take-up reel 7, winding a veneer sheet or sheets 1, storage in a veneer roll stock area of a reeling deck and so on, and mechanical reinforcement is also necessary for related structures such as the reeling deck.

Figure 8:
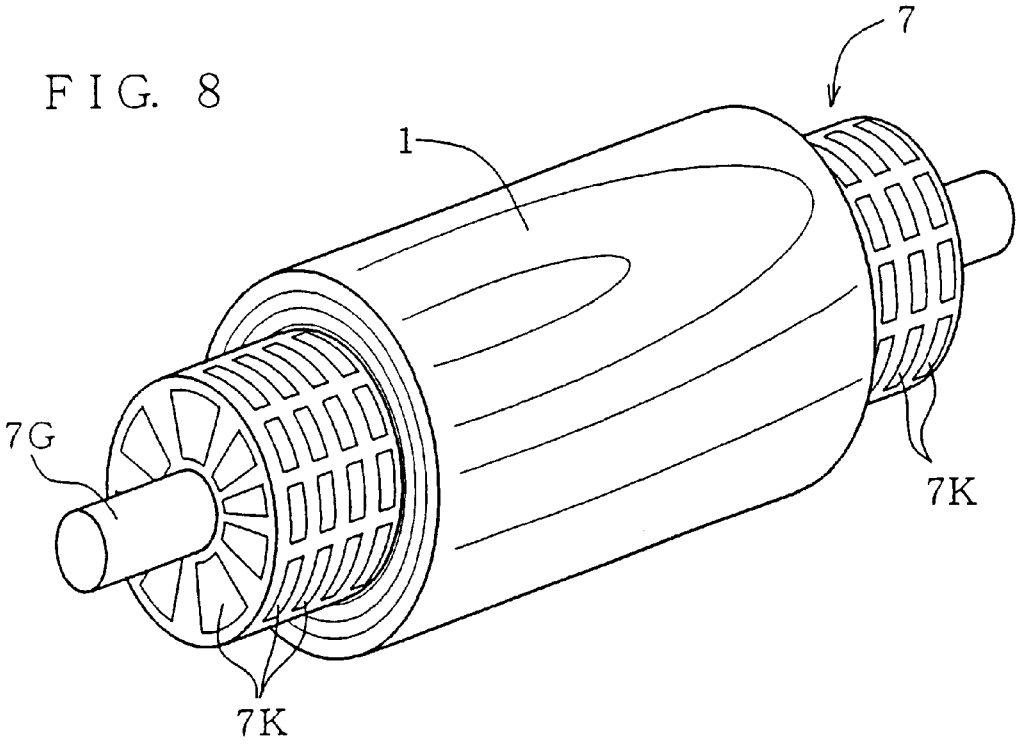
FIG. 8 is a perspective view showing another embodiment of the take-up reel.
Figure 9:
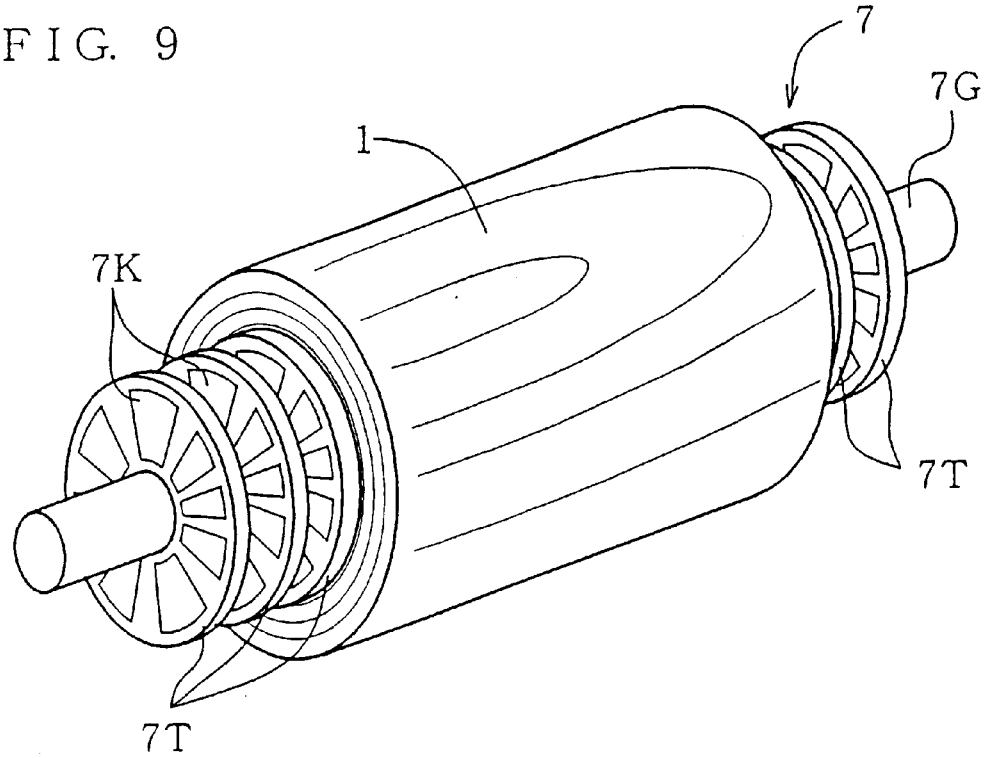
FIG. 9 is a perspective view showing another embodiment of the take-up reel.

In order to cope with such requirements, other structures of a take-up reel of the invention are shown in FIGS. 8 and 9. That is, A large diameter take-up reel 7 shown in FIG. 8 has an outer surface portion where many of openings 7K each having a slit-like shape and a large diameter take-up reel 7 shown in FIG. 9 has a plurality of flanges 7T each of the same large diameter as one another mounted on a reel shat 7G at arbitrary spatial intervals along the shaft direction, wherein a surface portion of each flange 7T has a opening 7K according to a need.

Figure 10:
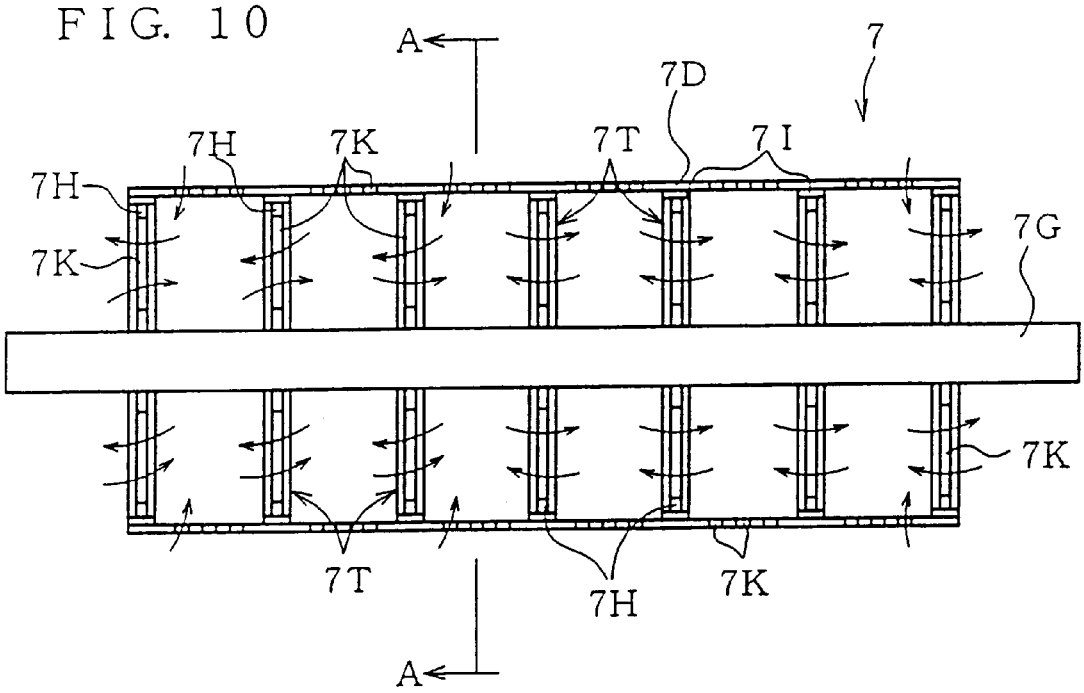
FIG. 10 is a sectional view taken on the shaft direction of the take-up reel shown in FIG. 8.

In FIG. 10, there is shown a section taken along a shaft direction of the take-up reel 7 shown in FIG. 8. That is, disc reinforcement plates 7H are fixed on the reel shaft 7G along the direction of the reel shaft 7G at predetermined spatial intervals by means of welding or the like. A flat plate 7I is fixed in a winding manner on the outer peripheries of the reinforcement plates 7H by means of welding or the like, wherein the flat plate 7I has a width several times as large as a thickness of a reinforcement plate 7H, thereby forming so-called a flange 7T. The flanges 7T all have the same outer diameter as one another and a shell plate 7D that constitutes a body portion of the take-up reel 7 and on which a veneer sheet or sheets 1 are wound is fixed along the curvature of the circumferences of the flanges 7T by means of welding or the like.

Figure 11:
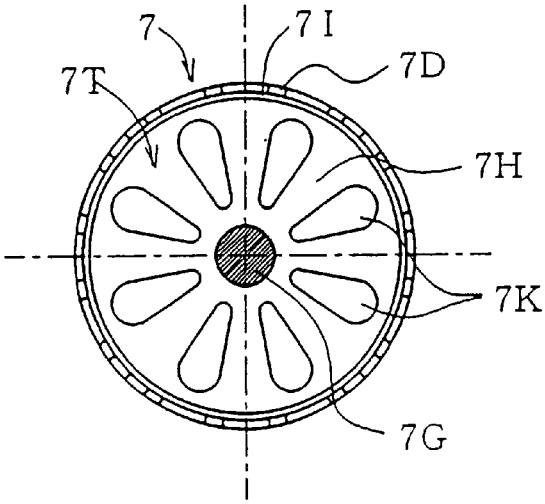
FIG. 11 is a sectional view taken on line A—A of FIG. 10 in an arrow direction.

Openings 7K are radially formed in each flange 7T in a plurality of sites as shown in FIG. 11 and Openings 7K are also formed on the shell plate 7D as shown in FIG. 8. Therefore, the interior of a take-up reel 7 and the outside air in communication with each other and a great lot of air can flow into the interior of the take-up reel 7 through the openings 7K., 7K respectively formed in the flanges 7T and the shell plate 7D and in a reverse way, air in the interior of the take-up reel 7, that is air in spaces formed between the flanges 7T, can flow out to the outside through the openings 7K, 7K respectively of the flanges 7T and the shell plate 7D. It should be appreciated that while in the embodiment, the openings 7K each are in the shape of a slit, there is no specific limitation to this shape but any shape such as a circle, an ellipse and a polygon can be adopted as far as an opening can be formed with it.

Figure 12:
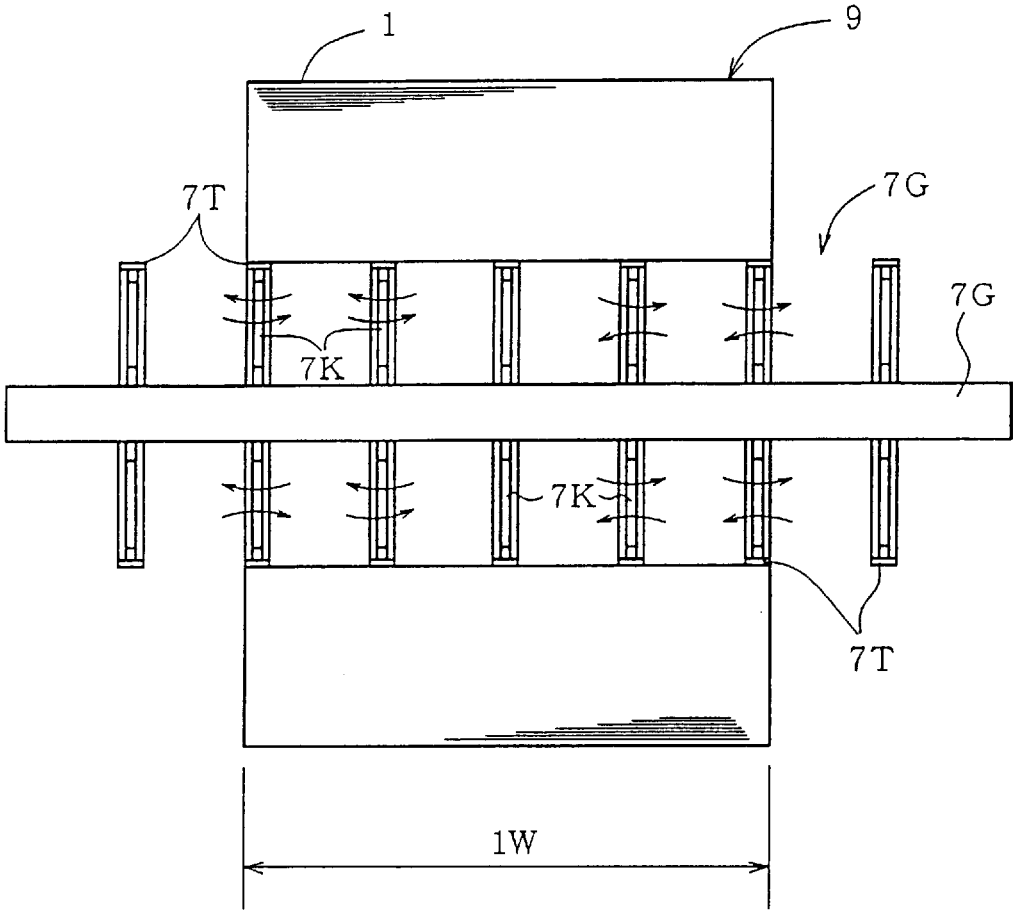
FIG. 12 is a sectional view taken on the shaft direction of the take-up reel shown in FIG. 9.

In FIG. 12, there is shown a section taken along a shaft direction of a take-up reel 7 shown in FIG. 9. That is, the take-up reel 7 has flanges 7T that are fixed on a shaft 7G at predetermined spatial intervals along the shaft direction by means of welding of the like and a plurality of openings 7K are formed in each flange 7T and the outer peripheries of the flanges 7T constitute a body portion of the reel. In this case, fiber orientations of a reeled veneer sheet 1 is in parallel to a direction of a winding width 1W and since the veneer sheet 1 has a mechanical strength to some extent in the fiber orientations, a winding support for the veneer sheet 1 can be constituted of the outer peripheries of the flanges 7T. In this take-up reel 7, the flanges 7T arranged in the spatial interval corresponding to the winding width 1W serve as winding supports for the veneer sheet 1 and the veneer sheet 1 is wound on the take-up reel 7 to form a veneer roll 9. In this structure, air in the spaces between the flanges 7T are released to the outside through the openings 7K located on both sides of each space.

Therefore, according to the take-up reels 7, a weight of a reel is decreased and furthermore, requirement for driving power, mechanical reinforcement and so on that are described above can be eliminated. Further, in a case where a veneer sheet 1 is wound on a large diameter take-up reel 7, since the interior of the take-up reel 7 is in communication with the outside air through many of openings 7K formed in the take-up reel 7, ventilation in the interior is ensured through the openings 7K. That is, according to a take-up reel 7 shown in FIGS. 8, 10 and 11, even if moisture, hot gas and so on included in a veneer sheet 1 after drying flow into the interior of a take-up reel 7 through openings 7K formed in the shell plate 7D, the moisture and so on are released by ventilation through the openings 7K of the flanges 7T in the interior of the reel 7 and the openings 7K formed in the flanges 7T at both outermost sides of the take-up reel 7, or through openings 7K in the shell plate 7D on which a veneer sheet 1 is not wound, into the outside air. On the other hand, fresh air in the outside air flows into the interior of the take-up reel 7 through the openings of the flanges 7T at the both outermost sides of the reel 7 or the openings K in the shell plate 7D on which the veneer sheet 1 is not wound and the flow-in air is put in contact with the veneer sheet 1 that has been wound on the reel 7 by ventilation through the openings of the flanges 7T in the interior of the reel 7 and then the openings 7K of the shell plate 7D. Therefore, hot air, moisture and so on included in the veneer sheet 1 after drying are not retained in the interior of the take-up reel 7 but can always be replaced with fresh air from the outside.

Further, according to a take-up reel 7 shown in FIGS. 9 and 12, hot air, moisture and so on included in a dried veneer sheet 1 are released into the outside air through the openings 7K from spaces between the flanges 7T and further the openings 7K at the outermost both side flanges 7T, while fresh air from the outside air flows into the interior of a take-up reel 7 through the openings 7K of the flanges 7T. In such a way, a veneer sheet 1 that has been wound on a take-up reel 7 to form a veneer roll 9 is stored in a veneer roll stock area of a reeling deck for a time period and an equilibrium moisture content of each veneer roll can be accelerated to reach in the storage.

It should be appreciated that while in the embodiment, description is made such that a flange 7T is obtained by fixing a flat plate 7I of a width as large as several times a thickness of a disc reinforcement plate 7H along the outer peripheries thereof in a winding manner by means welding or the like, the flange 7T can be a disc plate itself with no flat plate 71 interposed between disc reinforcement plates 7H.

Figure 13:
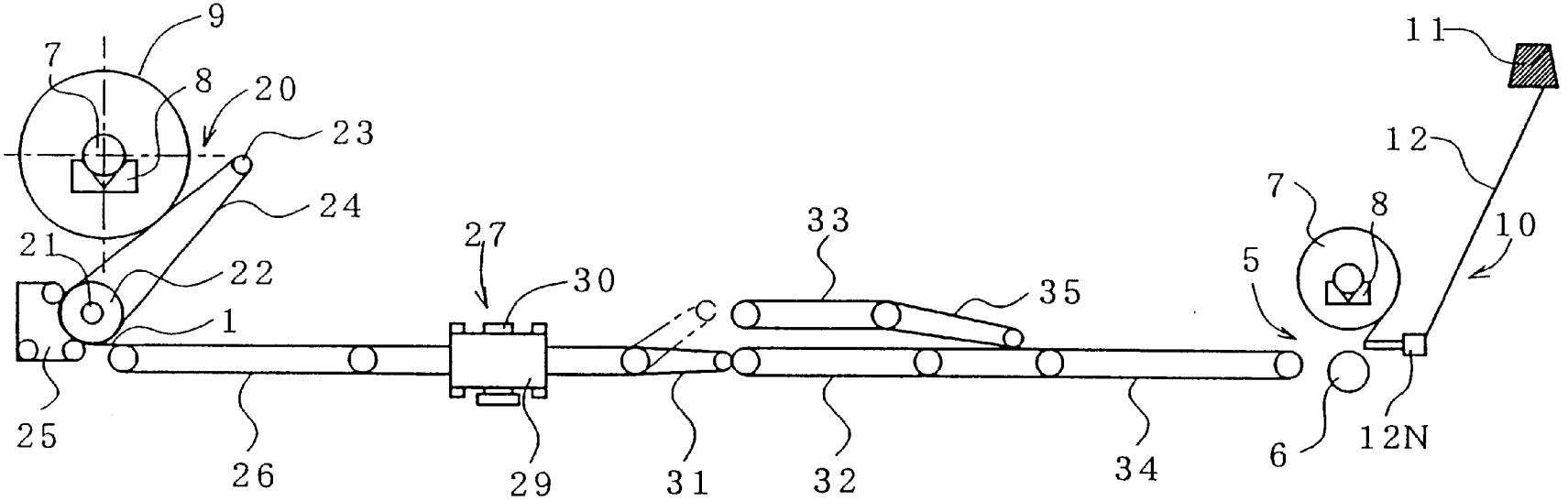
FIG. 13 is a side view of an embodiment in which a veneer roll that has been obtained by reeling a dried veneer sheet is unwound to combine and form a composite veneer roll.
Figure 14:
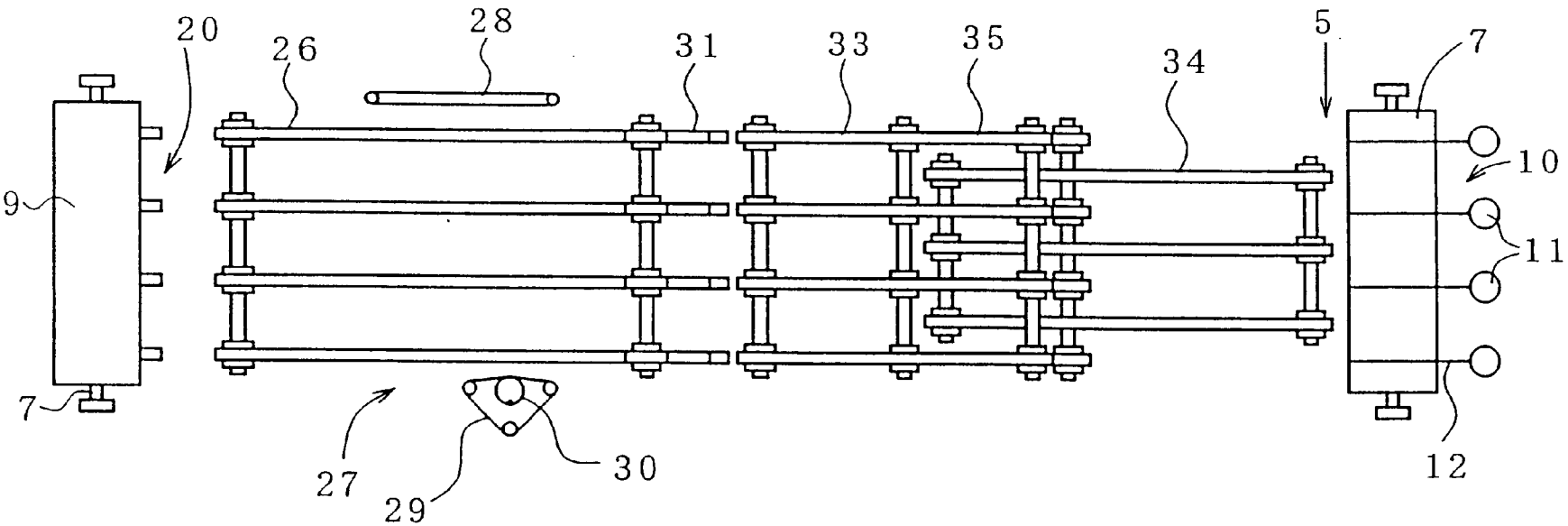
FIG. 14 is a plan view of FIG. 13.

Then, description will be made of a case where a veneer roll that has been obtained by reeling a dried veneer sheet is unwound to combine and form a composite veneer roll with reference to FIGS. 13 and 14. A veneer roll 9 that has been obtained by reeling a veneer sheet 1 after drying is rotatably supported on a reel receiver 8 with bearings at both sides of a take-up reel 7 in a veneer sheet unwinding position 20. A support shaft 21 is disposed with bearings below the veneer roll 9 and a plurality of base end pulleys 22 each of a large diameter are mounted on the support shaft 21 along the shaft direction at arbitrary spatial intervals. A pair of support arms are respectively held in a swingable manner at each of both ends of the support shaft 21 of the base end pulleys 22 and distal pulleys 23 each of a small diameter are rotatably supported between the pair of support arms. Drive guide bands 24 respectively extend over the large diameter base end pulleys 22 and the small diameter distal pulleys 23. The distal pulleys 23 are pivoted toward the veneer roll 9 with the support shaft 21 as a fulcrum and thereby, the drive guide bands 24 is pressed to the veneer roll 9 on a lower portion on the circumferential surface of the veneer roll 9. When the drive guide bands 24 are swung counterclockwise as viewed in FIG. 13, the veneer sheet 1 is unwound by a frictional force between the veneer roll 9 and the drive guide bands 24. An unwound veneer sheet 1 is transferred on the drive guide bands 24, further runs to a folded back guide member 25 and then, again folded back in a transport direction sectionally in a Z letter form to proceed onto a transport conveyor 26.

The veneer sheet 1 is transported in a state in which a fiber orientation thereof intersects the transport direction on the transport conveyor 26 and a position thereof is controlled in the course of travel by a position control means 27 disposed in parallel to the transport conveyor 26. The position control means 27 has a construction in which a first control belt is arranged not only in parallel to the transport conveyor 26 but in a vertical state of the shaft direction on one side of the transport conveyor 26 as viewed in the transport direction and a press body that presses the veneer sheet 1 in transportation on the other side thereof. The press body controls the position of the veneer sheet 1 by pressing the veneer sheet 1 from the other side toward the first control belt 28 side in a direction intersecting the transport direction of the veneer sheet 1. As press means, two means are exemplified: one is that the veneer sheet 1 is moved forward or rearward, in a direction intersecting the transport direction by a fluid pressure and the other is that as shown in the figure, a second control belt 29 not only in parallel to the transport conveyor 26 but in a vertical state of the shaft direction is employed and an eccentric ring 30 is supported by bearings between both tracks of the second control belt 29, wherein the eccentric ring 30 is rotated. To be more detailed, the surface of a track of the second control belt 29 is moved toward along a direction intersecting the transport direction by rotation of the eccentric ring 30 and thereby the veneer sheet 1 is pressed by the surface of a track of the second control belt 29 at one side of the sheet 1, with the result that the position of the veneer sheet 1 is eventually controlled by the first control belt 28 that turns in the same direction as the transport direction at its contact surface with the sheet 1.

A change-over conveyor 31 is provided at the terminal end of the transport conveyor 26 and the change-over conveyor 31 swings at any angle with the terminal end of the transport conveyor 26 as a fulcrum. A distal end of the change-over conveyor 31 is connected to conveyors in two ways: The distal end is connected to the starting end of a lower level conveyor 32 such that a transport route of the veneer sheet 1 proceeds straight or the distal end of the change-over conveyor 31 is connected to the starting end of an upper level conveyor 33 such that a transport route of the veneer sheet 1 proceeds above. Therefore, the veneer sheet 1 transported on the transport conveyor 26 is transferred into the lower level conveyor 32 and the upper level conveyor 33 in an alternate manner by actions of the change-over conveyor 31. Each veneer sheet 1 that has been transported in the transport conveyor 26 is aligned in regard to the leading edge in either of the lower level conveyor 32 or the upper level conveyor 33.

A combining conveyors 34 is connected at a position downstream from the lower level conveyor 32 and a veneer sheet 1 is transferred onto the lower level conveyor 32 keeping a straight movement. On the other hand, there is provided a guide conveyor 35 that guides the veneer sheet 1 on the upper level conveyor 33 to a transport surface of the combining conveyor 34 at the terminal end of the upper conveyor 33. The guide conveyor 35 has a down slope in a transport direction and the distal end thereof is kept being disposed close to the transport surface of the combining conveyor 34. On the combining conveyor 34, a veneer sheet 1 that is transported in a straight movement and a veneer sheet 1 that is transported from the upper level conveyor 33 through the guide conveyor 35 are combined in an overlapping manner while being aligned such that the leading edges of both veneer sheets 1 coincide with each other.

A veneer sheet reeling position 5 at which two veneer sheets 1 overlapping each other are simultaneously reeled is located at a position downstream from the combining conveyor 34. A drive roller 6 whose length direction at least intersects the transport direction of the veneer sheet 1 is supported with bearings such that the upper surface thereof is at almost the same height as that of the transport surface of the combining conveyor 34. While the drive roller 6 has a variable speed but normally rotates at the same speed as that of the combining conveyor 34. A take-up reel 7 of a large diameter is rotatably supported with bearings at both ends thereof by a reel receiver 8 above the drive roller 6. The take-up reel 7 is put in contact with the upper surface of the drive roller 6 at the lower surface thereof and thereby, the take-up reel 7 is rotated counterclockwise as viewed in FIG. 13 by a frictional force produced from a driving force of the drive roller 6. A plurality of thread feeding mechanisms 10 are disposed at positions downstream from the take-up reel 7 at arbitrary spatial intervals along a length direction of the take-up reel 7.

The two overlapping veneer sheets 1 are transported by being carried on the combining conveyor 34 to arrive into the veneer sheet reeling position 5. On arrival at the veneer sheet reeling position 5, tips of the threads 12 fed from thread reels 11 of the thread feeding mechanisms 10 are wound on the take-up reel 7 at arbitrary spatial intervals in the length direction thereof. When the two overlapping veneer sheets 1 arrive at between the drive roller 6 and the take-up reel 7, the take-up reel 7 is rotated in a reverse direction by a driving force of the drive roller 6 that rotates at the same speed as that of the composing conveyor 34 and takes up the two overlapping veneer sheets 1 with the threads 12 at a plurality of positions as guides. The two overlapping veneer sheets 1 that are transported from the combining conveyor 34 are sequentially wound on the take-up reel 7.

There is a case where a spatial interval between a preceding two overlapping veneer sheets 1 and the following two overlapping veneer sheets 1 is narrowed in consideration of efficiency in winding on the take-up reel 7. Description will be made of interval narrowing means for pairs of two overlapping veneer sheets 1 end to end in a transport direction with reference to FIG. 15.

A pulse generator 36 is provided to the combining conveyor 34 and a detector 37 is placed above the combining conveyor 34 and as a detector, a contact type, or a non-contact type such as a transparency type, a reflection type of the like may be employed. A distance setter 39 that sets a distance K from a position of the detector 37 to the drive roller 6 is connected to a drive controller 38 and the distance K is stored as the number of pulses by reading the number of pulses from the pulse generator 36. When the detector 37 senses the leading edges of the two overlapping veneer sheets 1 (a face sheet and a substrate sheet), the detector 37 transmits a detection instruction to the drive controller 38 that is a control system of the drive roller 6. A plurality of memory elements is included in the drive controller 38 and the detection instruction is written on one of the memory elements and the drive controller 38 stops driving of the drive roller 6. The two overlapping veneer sheets 1 (a face sheet and a substrate sheet) are transported on the combining conveyor 34 by a distance K and when the memory element detects the transportation by counting up of the number of the pulses, the drive controller 38 not only activates the drive roller 6 but resets the memory element. The two overlapping veneer sheets 1 (a face sheet and a substrate sheet) that arrives at the upper surface position of the drive roller 6 are wound on the take-up reel 7 by driving of the drive roller 6 over an angular turn along a circumferential direction corresponding to a length of the two overlapping veneer sheets 1 (a face sheet and a substrate sheet) with the threads 12 as guide. The length of the two overlapping veneer sheets 1 (a face sheet and a substrate sheet) is determined by the detector 37 such that when the two overlapping veneer sheets 1 (a face sheet and a substrate sheet) are transported on the combining conveyor 34, the detector 37 senses the leading and trailing edges and stores the length as the number of pulses in the drive controller 38. It should be appreciated that since veneer sheets are cut at almost the same length, the constant length may be stored in the drive controller 38 as a sheet length 40 in advance.

When the number of pulses corresponding to the sheet length 40 is counted, a drive stop instruction is issued to the drive roller 6 from the drive controller 38 to stop the drive roller 6 again. Then, the next two overlapping veneer sheets 1 (a face sheet and a substrate sheet) are transported on the combining conveyor 34 and when the leading edge is sensed by the detector 37, process thereafter goes following steps similar to those as describe above. In this case, if the preceding two overlapping veneer sheets 1 (a face sheet and a substrate sheet) are still in transportation on the combining conveyor 34 or still in winding operation on the take-up reel 7, since the memory element that stores the preceding detection instruction has not yet been reset, pulse control is performed by another memory element. In such a way, the next pair of two overlapping veneer sheets 1 (a face sheet and a substrate sheet) come to arrives at the upper point of the drive roller 6 and then, the next two overlapping veneer sheets 1 (a face sheet and a substrate sheet) are wound on the take-up reel 7 with the threads 12 as guide while spatial intervals between the successive two pairs of the sheets are narrowed. Such operations are repeated and thereby, the drive roller 6 intermittently rotates and pairs of two over lapping veneer sheets 1 are efficiently wound on the take-up reel 7 as shown in FIG. 16 while spatial intervals between pairs of the sheets adjacent to each other are narrowed.

Figure 16:
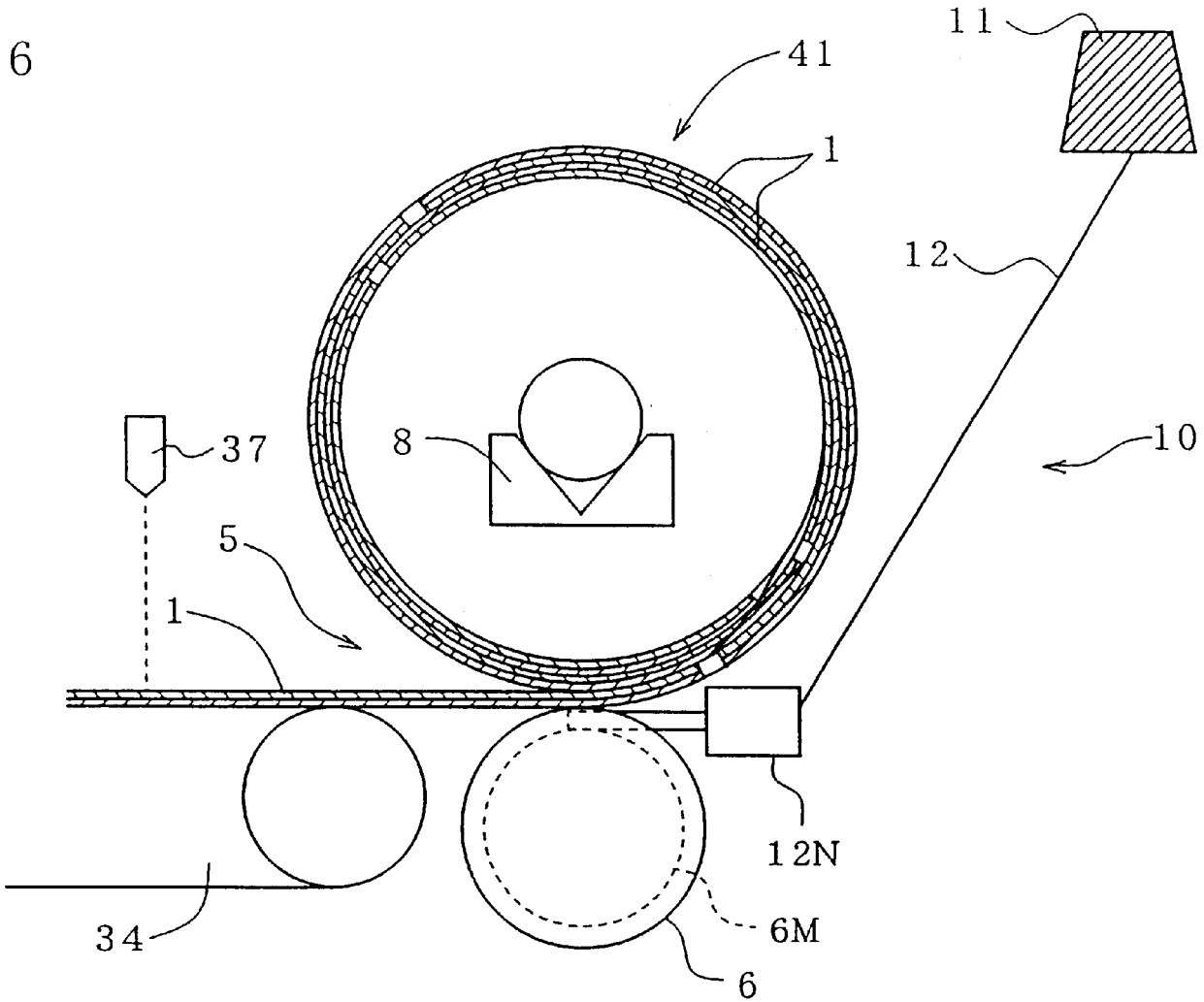
FIG. 16 is a schematic view for illustration of a composite veneer roll after narrowing spatial intervals.

The leading edge of a next pair of overlapping veneer sheets are detected by the detector 37, and then, the two overlapping veneer sheets 1 arrives at the upper position of the drive roller 6 after steps similar to those as described above and wound on the take-up reel 7 with the threads 12 as guide while spatial intervals between successive pairs of the sheets are narrowed as shown in FIG. 16. By repetition of the above described operations, the drive roller 6 intermittently rotates and pairs of two overlapping veneer sheets 1 are reeled in an efficient manner while spatial intervals between successive pairs of the sheets are narrowed.

Figure 15:
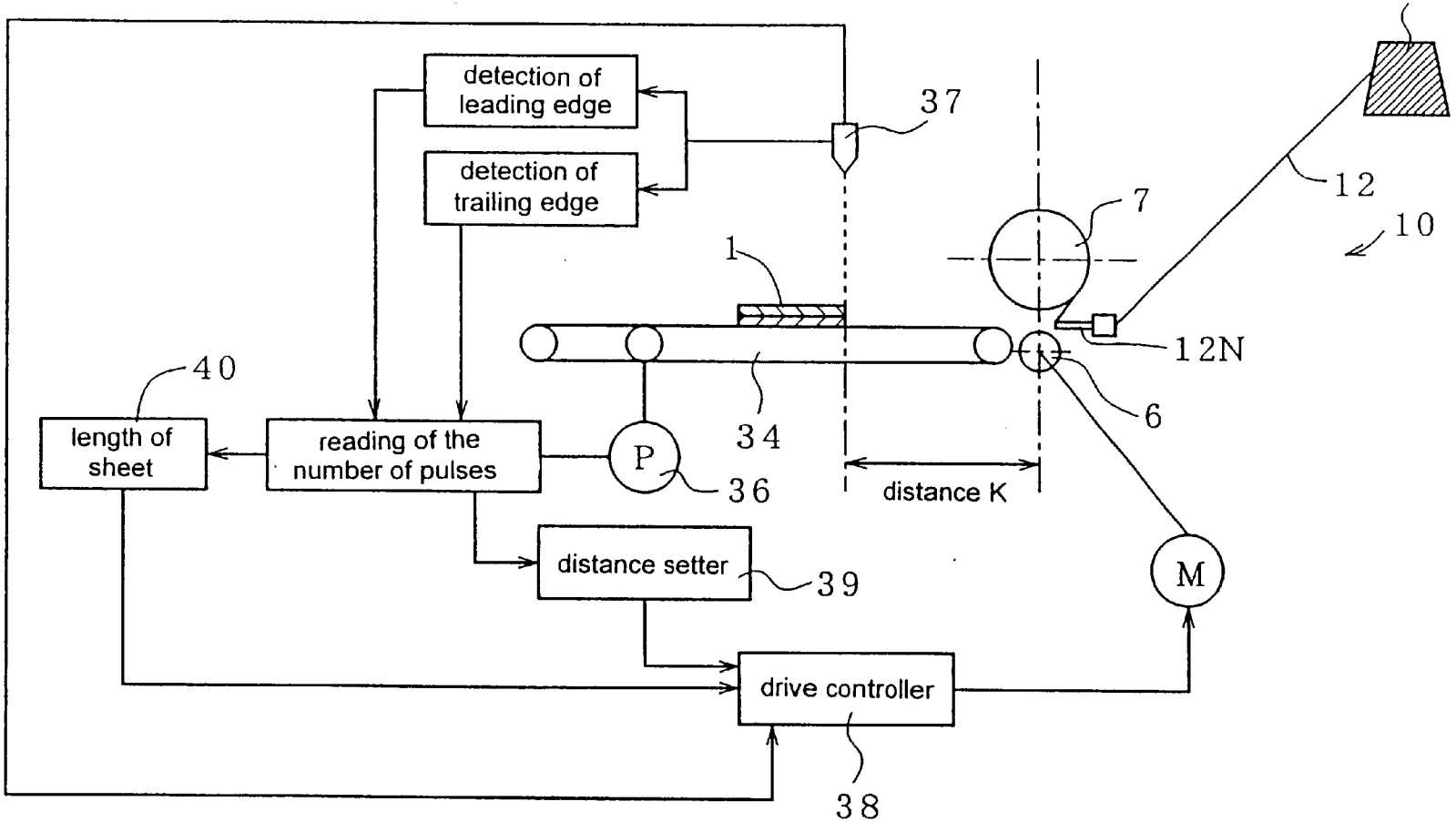
FIG. 15 is a block diagram illustrating interval narrowing means.
Figure 17:
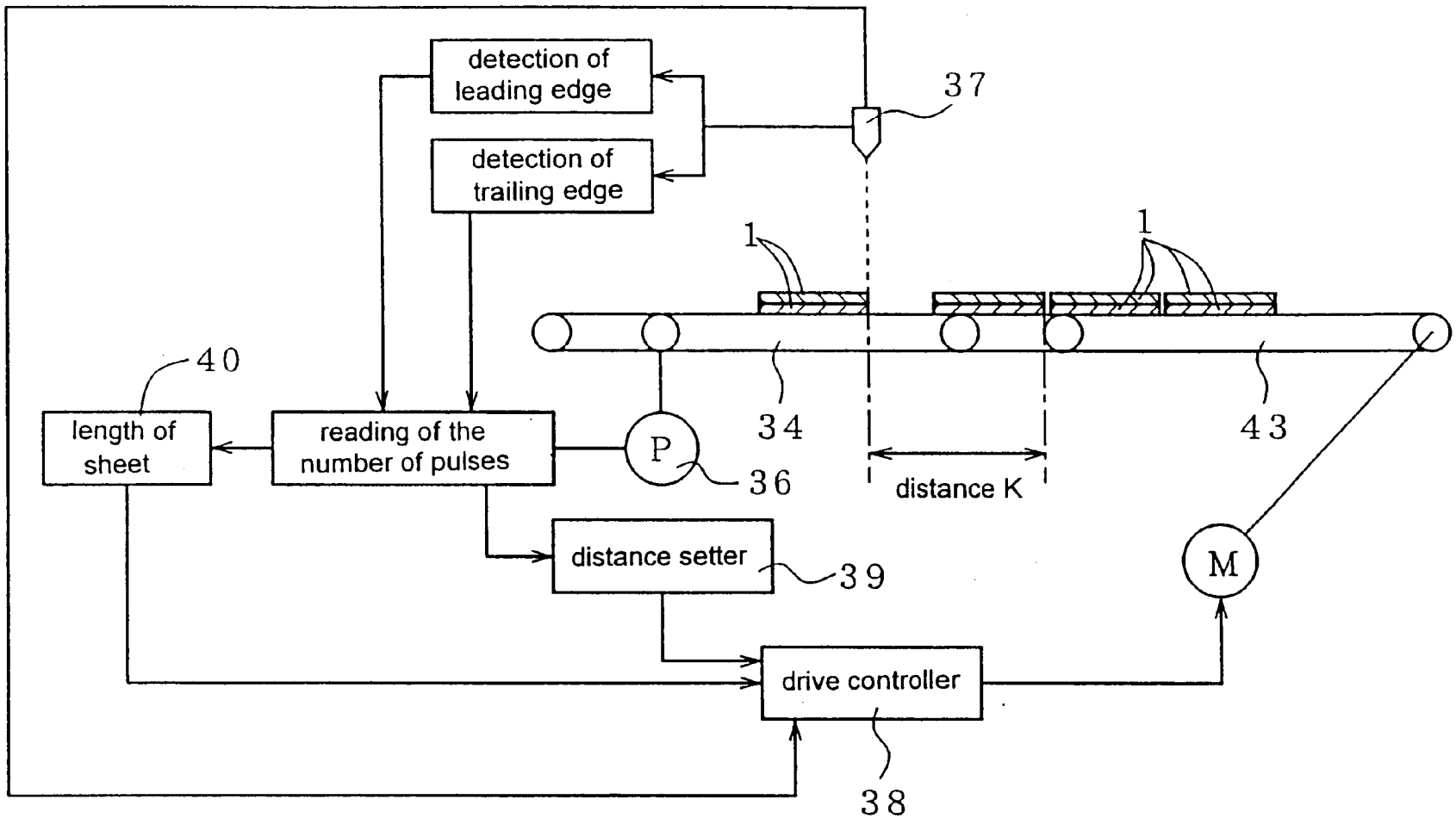
FIG. 17 is a block diagram illustrating another embodiment of the interval narrowing means.

The interval narrowing means shown in FIG. 15 has no problem in reeling as far as a transport speed of the conveyor and an average winding speed (slow) in intermittent movement almost corresponds to each other since pairs of two overlapping veneer sheets 1 are reeled in a veneer sheet reeling position 5 by an intermittent rotation of the drive roller 6. However, in a higher winding speed, a problem arises. In this case, adjustment of spatial intervals of pairs of two overlapping veneer sheets 1 is performed during transportation in a stage prior to the veneer sheet reeling position 5. Then, description will be made of another embodiment of interval narrowing means with reference to FIG. 17, wherein the same constituents as those corresponding of FIG. 15 are indicated by the same marks.

At first, the starting edge of an interval narrowing conveyor 43 that performs narrowing spatial intervals between pairs of two overlapping veneer sheets 1, end to end, in the transport direction is disposed in a staggered manner with the terminal end of a combining conveyor 34 and both conveyors are set such that the conveyors can independently be operated. In this situation, when a detector 37 that is located above the combining conveyor 34 senses the leading edge of a pair of two overlapping veneer sheets 1, the detector 37 transmits a detection instruction to a drive controller 38 that is a control system of the interval narrowing conveyor 43. A distance setter 39 that sets a distance K from the detector 37 to a point on the interval narrowing conveyor 43 is connected to the drive controller 38 and the drive controller 38 stops driving of the interval narrowing conveyor 43 in response to the detection instruction. A pulse generator 36 is provided to the combining conveyor 34 and the two overlapping veneer sheets 1 are transported on the combining conveyor 34 by a distance K and the distance K is detected by counting up the number of pulses. The two overlapping veneer sheets 1 that arrives at the interval narrowing conveyor 43 is further transported on the interval narrowing conveyor 43 by driving thereof over a length of the two overlapping veneer sheets 1. The length of the two overlapping veneer sheets 1 (a face sheet and a substrate sheet) is determined by the detector 37 such that when the two overlapping veneer sheets 1 (a face sheet and a substrate sheet) are transported on the combining conveyor 34, the detector 37 senses the leading and trailing edges and stores the length as the number of pulses in the drive controller 38. It should be appreciated that since veneer sheets are cut at almost the same length, the constant length may be stored in the drive controller 38 as a sheet length in advance. Spatial intervals between pairs of two overlapping veneer sheets 1, end to end, in the transport direction are narrowed on the interval narrowing conveyor 43 and a pair of two overlapping veneer sheets 1 are transferred to another conveyor and wound on the take-up reel 7 at a speed matching a winding speed.

In this situation, when the reel receiver 8 that supports the take-up reel 7 with bearings is fixedly positioned, the combining conveyor 34 and the drive roller 6 are freely swung downward with the starting end of the combining conveyor 34 as a fulcrum and as a winding diameter of a veneer roll increases, the drive roller 6 is swingably lowered in an automatic manner together with the combining conveyor 34 by a half of the increase in diameter. Contrary to this, when bearings supporting the drive roller 6 are fixedly positioned, the reel receiver 8 of the take-up reel 7 is raised by a half of the increase in diameter of the take-up reel. Further, since the drive roller 6 imparts a frictional force to the take-up reel 7, a fluid pressure, a balance weight or the like is employed in order to maintain a state in which the drive roller 6 is in press contact with the take-up reel 7 under a constant pressure all the time.

In such a way, pairs of two overlapping veneer sheets 1 are sequentially reeled to form a composite veneer roll 41 in which veneer sheets are combined as pairs of a face sheet and a substrate sheet for producing a three ply laminated wood. The composite veneer roll 41 is transported to a composite veneer roll stock area of a reeling deck. The composite veneer roll stock area is constructed in a structure including beams vertically disposed at many levels and a plurality of composite veneer rolls are stored for a time period (one day and night) in the composite veneer roll stock area to achieve an equilibrium moisture content in common with a face sheet and a substrate sheet.

In the embodiment, description is made in the case where veneer sheets 1 after drying each of a constant length are individually unwound from one veneer roll 9 in the veneer sheet unwinding position 20 and pairs of two veneer sheets are combined in an overlapping manner to produce a composite form. This is because a face sheet and a substrate sheet are almost the same as each other in terms of grade and therefore and two veneer sheets of the same kind both for use as a face sheet are superimposed on each other, or on the contrary two veneer sheets of the same kind both for use as a substrate sheet are superimposed on each other. In such a case, if a dried veneer sheet 1 after drying is continuous, the sheet 1 is cut into sheets of a constant length during transportation on the transport conveyor 26.

Figure 18:
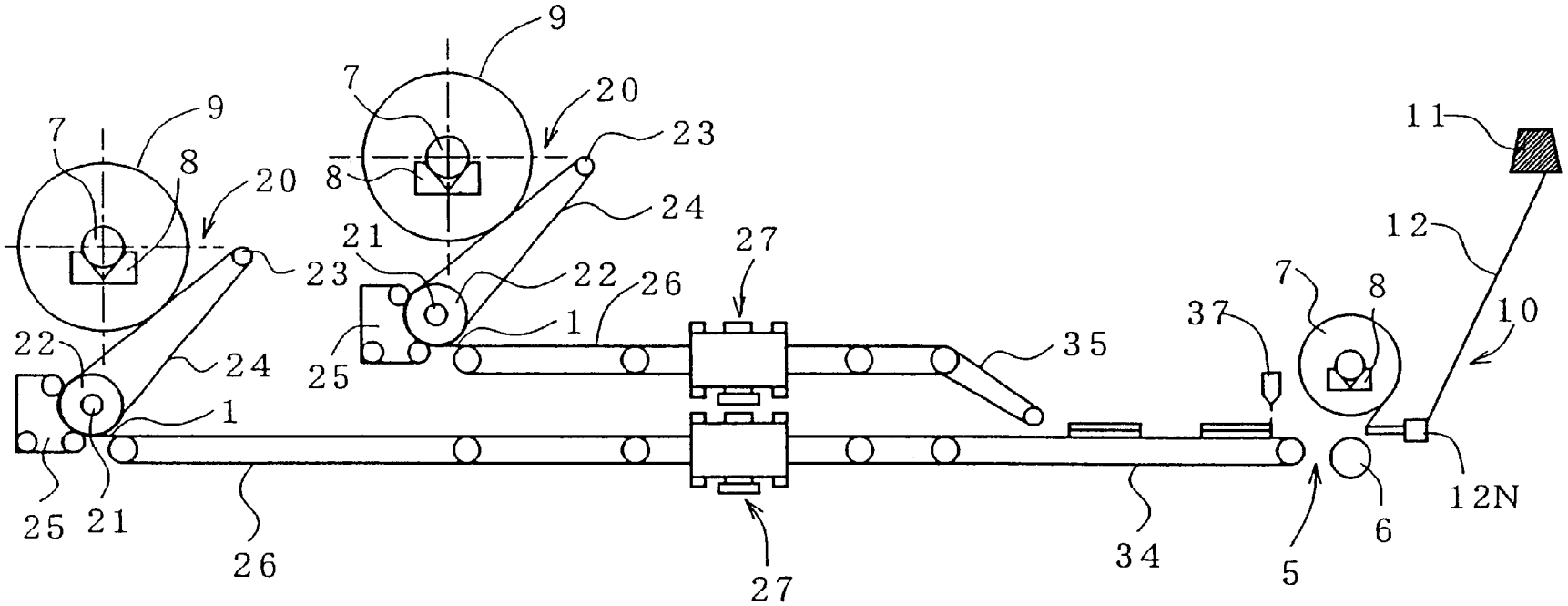
FIG. 18 is a side view of an embodiment in which two veneer rolls that have been obtained by reeling dried veneer sheets are unwound to combine and form a composite veneer roll.

In FIG. 18, an embodiment is shown in which two veneer rolls 9 of different kinds (for a face sheet and a substrate sheet) are provided in a veneer sheet unwinding position 20 and veneer sheets 1 after drying each of a constant length are individually cut one by one from each of the two veneer rolls 9 to combine two veneer sheets as two overlapping veneer sheets 1 and produce a composite form respectively from the two veneer rolls 9. In this case, all that is needed is that the system is configured as follows: Two pair of a transport conveyor 26 and position control means 27 disposed in parallel to the transport conveyor 26, similar to the above described, are arranged at two levels, one above the other, respectively for uses in transportation of face sheets and substrate sheets. Further, a guide conveyor 35 is disposed at the terminal end of the upper level transport conveyor 26 and the guide conveyor 35 guides veneer sheets 1 to a transport surface of a combining conveyor 34. For convenience of description, the lower level transport conveyor 26 is for a face sheet and the upper level transport conveyor is for a substrate sheet.

In this case, veneer sheets (a face sheet and a substrate sheet) after drying each of a constant length are individually unwound from two veneer rolls 9 (respectively for a face sheet and a substrate sheet) in a veneer sheet unwinding position 20 and the veneer sheets 1 (a face sheet and a substrate sheet) after drying are transferred on the upper and lower level transport conveyors 26. Positions of the veneer sheets 1 (a face sheet and a substrate sheet) after drying are respectively controlled on the upper and lower level transport conveyors 26 by position control means 27. Thereafter, a veneer sheet 1 (a face sheet) transported in a straight movement from the lower level transport conveyor 26 and a veneer sheet 1 (a substrate sheet) transported from the upper level transport conveyor 26 through the guide conveyor 35 are combined on the combining conveyor 34 in an overlapping manner while the leading edges of both veneer sheets are aligned. Then, pairs of two overlapping veneer sheets 1 (a face sheet and a substrate sheet) are reeled while spatial intervals between pairs of two overlapping veneer sheets 1, end to end, in the transport direction are narrowed by the interval narrowing means as a composite veneer roll 41 and the composite veneer roll 41 is stored in a composite veneer roll stock area to achieve an equilibrium between veneer sheets of different kinds (a face sheet and a substrate sheet) in moisture content.

In the embodiments, descriptions are made of the case where pairs of two overlapping veneer sheets 1 are reeled while spatial intervals between pairs of two overlapping veneer sheets 1, end to end, in the transport direction are narrowed. This process is one in which pairs of a face sheet and a substrate sheet in a composite state for use in producing three ply laminated wood. Next, description will be made of an embodiment to obtain a composite veneer roll obtained by reeling three kinds of veneer sheets including face, central core and substrate sheets that are used in producing five ply laminated wood.

Figure 19:
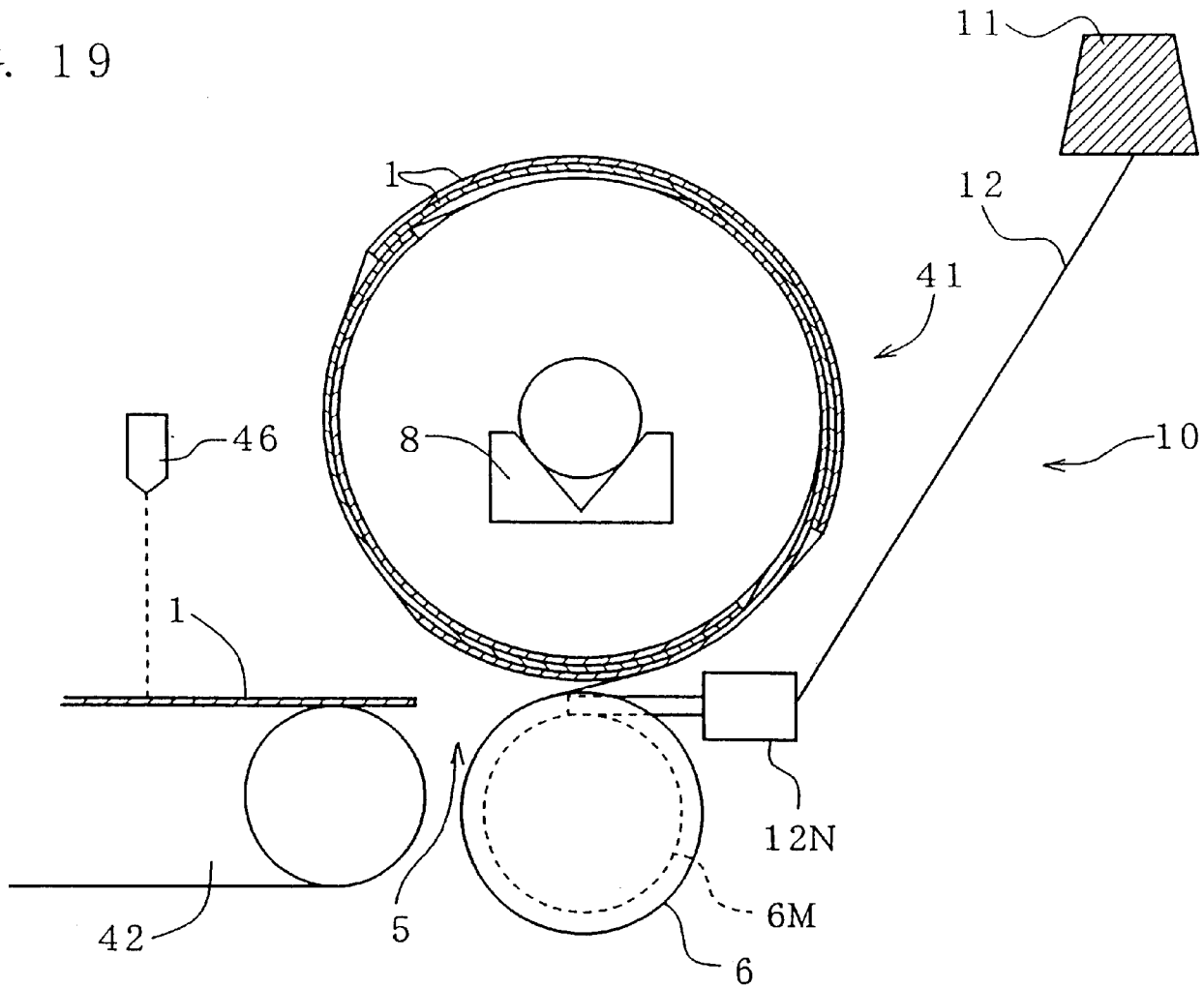
FIG. 19 is a schematic view for illustration of another composite veneer roll.

Such a composite veneer roll is achieved as follows: As shown in FIG. 19, pairs of two overlapping dried veneer sheets and single dried veneer sheets are alternately wound with a pair of two overlapping dried veneer sheets and a single dried veneer sheet as a set on a large diameter take-up reel 7 as described above with threads 12 as guide into a multilayer structure to form a composite veneer roll and the composite veneer roll is used in producing five ply laminated wood. That is, in this case, pairs of two veneer sheets 1 overlapping each other and single veneer sheets, all with the same fiber orientation, are reeled in an alternate manner along a winding direction.

There are three cases in order to realize a composite veneer roll described above in a broad sense: in a first case, a face sheet, a substrate sheet and a central core sheet are all of the same kind, in a second case, a substrate sheet and a central core sheet are both of the same kind, but a face sheet is different from the other two, and in a third case, a face sheet, a substrate sheet and a central sheet are all different from one another. Among them, the former two will below be described with reference to the figures described above.

Description will be made of the case where a face sheet, a substrate sheet and a central core sheet are all of the same kind with reference to FIGS. 13 and 14.

Figure 20:
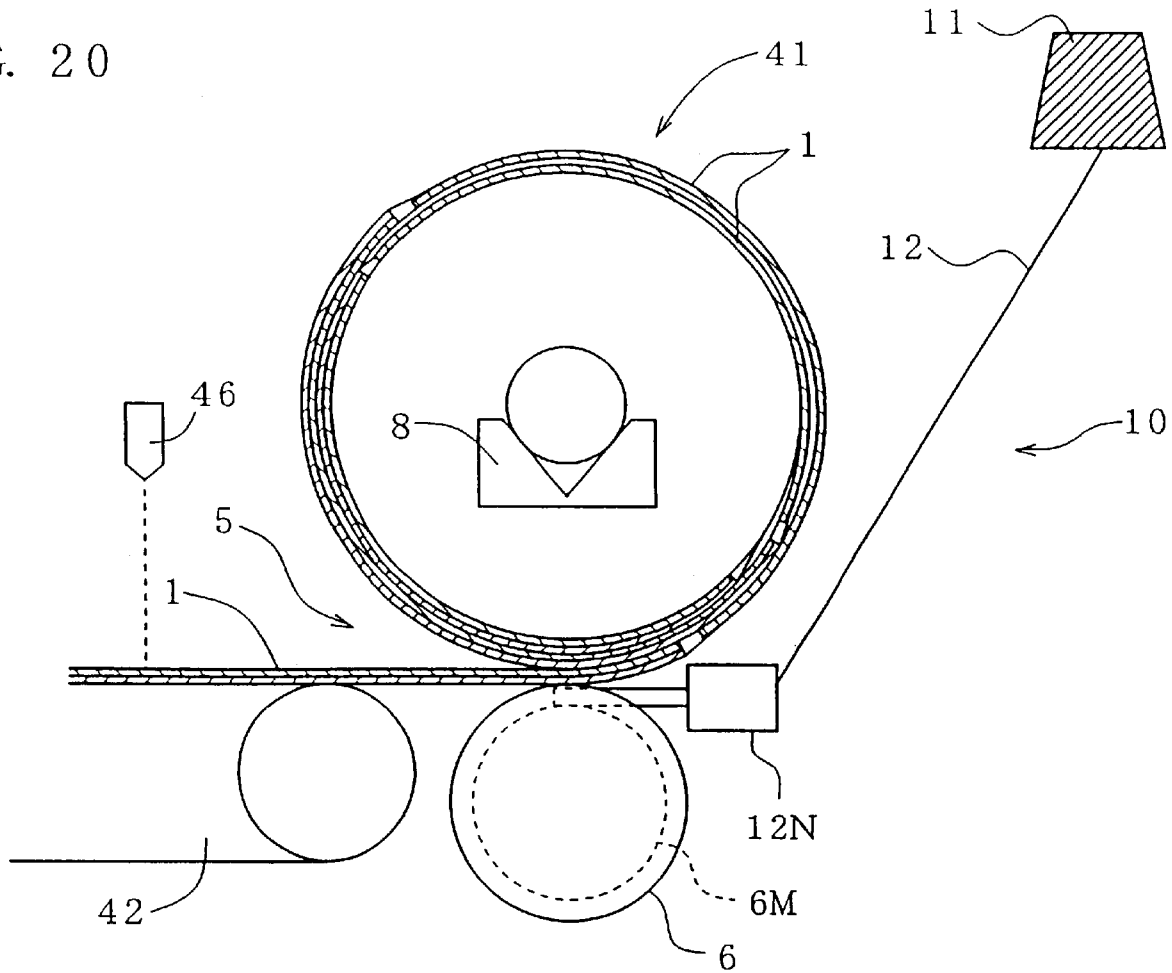
FIG. 20 is a schematic view for illustration of another composite veneer roll after narrowing spatial interval.

Veneer sheets 1 after drying each of a constant length are individually unwound to be transferred onto the transport conveyor 26 in the veneer sheet unwinding position 20. A position of a veneer sheet 1 is controlled on the transport conveyor 26 by the position control means 27. Then, two veneer sheets 1 are transported in a straight movement on the lower level conveyor 32 by connecting the change-over conveyor 31 to the lower level conveyor 32. After the two veneer sheets 1 are transported in a straight movement, a single veneer sheet 1 is transferred and transported on the upper level transport conveyor 33, by connecting the change-over conveyor 31 to the upper conveyor 33. Therefore, the change-over conveyor 31 transfers two veneer sheets to the lower level conveyor 32 to transport thereon, while the change-over conveyor 31 transfers a single veneer sheet to the upper level conveyor 33 to transport thereon. On the combining conveyor 34, a single veneer sheet 1 transported from the upper level conveyor 33 through the guide conveyor 35 overlaps and is aligned with one of a pair of two veneer sheets 1 transported straight on the lower level conveyor 32 such that the leading edges of the single sheets coincide with each other. Then, a pair of two overlapping veneer sheets 1 are wound on the take-up reel 7 by the interval narrowing means. Following the winding, the other of the pair of two veneer sheets 1 is transported straight from the lower level conveyor 32 subsequent to the one of the pair of two veneer sheets 1 onto the combining conveyor 34. In such a way, pairs of two overlapping veneer sheets 1 and single veneer sheets 1 are alternately transported on the combining conveyor 34 and veneer sheets 1 are efficiently wound on the take-up reel 7 while spatial intervals between pairs of two overlapping veneer sheets 1 and single veneer sheets 1, end to end, in the winding direction are narrowed as shown in FIG. 20.

Then, description will be made of a case where kinds of a substrate sheet and a central core sheet are the same as each other, but a face sheet is of a dedicated kind with reference to FIG. 18.

In this case, for convenience of description, among two veneer sheet rolls 9, the upper level veneer roll 9 is used for substrate sheets and central core sheets, while the lower level veneer roll 9 is exclusively used for face sheets. Single veneer sheets 1 after drying each of a constant length are individually wound from the veneer rolls 9 and respectively transferred onto the upper and lower level transport conveyors 26, 26. Positions of the single veneer sheets are controlled on the upper and lower level transport conveyors 26, 26 by the position control means 27 respectively. Thereafter, a single veneer sheet 1 (a face sheet) transported straight from the lower level conveyor 26 and a single veneer sheet 1 (in this case, a substrate sheet) transported from the upper level transport conveyor 26 through the guide conveyor 35 are combined and aligned with respect to the leading edges in an overlapping manner. Then, the two overlapping veneer sheets 1 are wound on the take-up reel 7 by the interval narrowing means. After winding of the two overlapping veneer sheets 1 (a face sheet and a substrate), a single veneer sheet 1 (in this case, a central core sheet) is transported from the upper level transport conveyor 26 through the guide conveyor 35 following the two overlapping veneer sheets 1 (a face sheet and a substrate). That is, single veneer sheets 1 are alternately used as a substrate sheet and a central core sheet. In a case of the substrate sheet, a single veneer sheet 1 from the upper level transport conveyor 26 is superimposed on a single veneer sheet 1 (a face sheet) transported from the lower level transport conveyor 26, whereas in a case of a central core sheet, the veneer sheet 1 is alone wound on a take-up reel 7 as a composite veneer roll 41 while spatial intervals between the preceding two overlapping veneer sheets 1 or the following two overlapping veneer sheets 1 are narrowed in an end-to-end arrangement in the winding direction by the interval narrowing means. Composite veneer rolls are stored in the composite veneer roll stock area. It should be appreciated that in this case, an unwinding speed of the upper level roll (alternately used for a substrate sheet and a central core sheet) is controlled so as to be about two times that of the lower level roll (for a face sheet) and a transport ratio in a unit time between the numbers of veneer sheets 1 (a face sheet) transported from the lower level transport conveyor 26 and veneer sheets 1 (alternately changed between a substrate sheet and a central sheet) transported from the upper level transport conveyor 26 through the guide conveyor 35 is 1:2.

Figure 21:
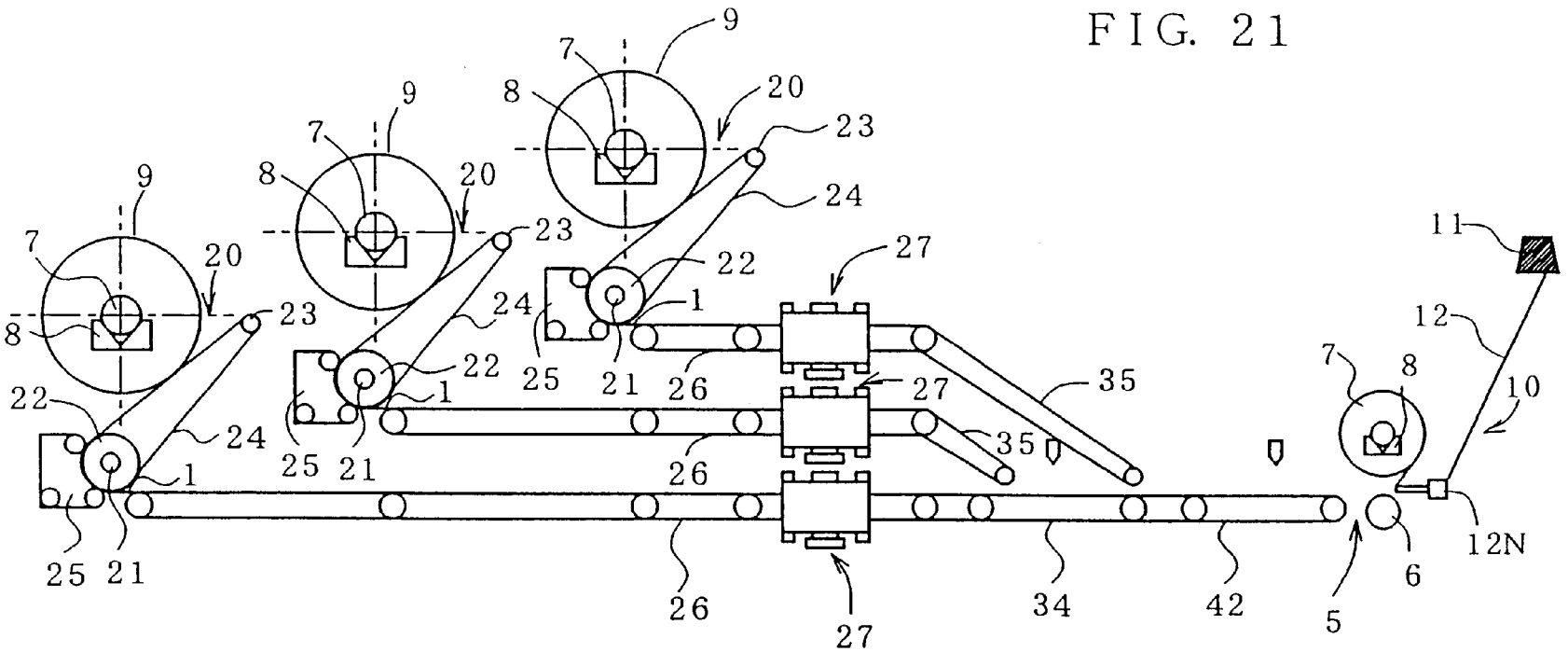
FIG. 21 is a side view of an embodiment in which three veneer roll that have been obtained by reeling dried veneer sheets are unwound to laminate and form a composite veneer roll.

In FIG. 21, there is shown an embodiment in which single veneer sheets 1 (a face sheet, a substrate sheet and a central sheet) after drying each of a constant length are individually unwound from three veneer rolls 9 of different sheet kinds (for a face sheet, a substrate sheet and a central sheet) in the veneer sheet unwinding position 20, and pairs of two overlapping veneer sheets (a face sheet and a substrate sheet) and single veneer sheet (a center core sheet) are again reeled as a set to produce a composite veneer roll. In this embodiment, transport conveyors 26 and position control means 27, both similar to those in the above described embodiments, are respectively provided in three levels for a face sheet, a substrate sheet and a center core sheet. For convenience of description, it is assumed that among the transport conveyors at respective levels, the transport conveyor 26 at the upper level is used for a central core sheet, the transport conveyor 26 at the middle level is used for a substrate sheet and the transport conveyor 26 at the lower level is used for a face sheet. A guide conveyor 35 that guides a single veneer sheet 1 (a substrate sheet) from the terminal end of the middle level transport conveyor 26 is located at a transport surface of a combining conveyor 34 that is connected to the lower transport conveyor 26. Further, a relay conveyor 42 is disposed between the combining conveyor 34 and a veneer sheet winding position 5. The starting end of the relay conveyor 42 and the terminal end of the combining conveyor 34 are in a staggered manner arranged and can circulate independently from each other. A guide conveyor 35 is disposed at a transport surface of the relay conveyor 42 and the guide conveyor 35 transfers a single veneer sheet 1 (a central core sheet) from the terminal end of the upper level transport conveyor 26 to the transport surface.

In this case, single veneer sheets 1 (a face sheet, a substrate sheet and a central sheet) after drying each of a constant length are individually unwound from respective three veneer rolls 9 of different sheet kinds (for a face sheet, a substrate sheet and a central core sheet) at the veneer sheet unwinding position 20 and the single veneer sheets 1 are respectively fed onto the upper, middle and lower level transport conveyors 26. Single veneer sheets 1 (a face sheet, a substrate and a central core sheet) are controlled with respect to position on the upper, middle and lower level transport conveyors 26 by the respective position control means 27. Thereafter, a single veneer sheet 1 (a face sheet) transported straight from the lower level transport conveyor 26 and a single veneer sheet 1 (a substrate sheet) transported from the middle level transport conveyor 26 through the guide conveyor 35 are combined in an overlapping manner in alignment at the leading edges.

Next, description will be made of interval narrowing means in the embodiment with reference to FIG. 22.

A pulse generator 36 is provided to the combining conveyor 34 and a first detector 44 as described above is disposed above the combining conveyor 34. The starting end of the relay conveyor 42 is in a staggered manner connected to the terminal end of the combining conveyor 34. A pule generator 45 is provided to the relay conveyor 42 and further a second detector 46 similar to the above described is disposed above the relay conveyor 42. A distance setter 39 is connected to a drive controller 38 and in the distance setter 39, a distance L1 from a position of the first detector 44 to the drive roller 6 and a distance L2 from the second detector 46 to the drive roller 6 are set. The distances L1 and L2 are stored as the numbers of pulses by reading the numbers of pulses from the pulse generators 36 and 45.

When the first detector 44 senses the leading edge of a pair of two overlapping veneer sheets 1 (a face sheet and a substrate sheet) transported on the combining conveyor 34, the first detector 44 transmits a detection instruction to a drive controller 38 that is a control system of the drive roller 6. A plurality of memory elements are included in the drive controller 38, the detection instruction is written on one of the memory elements and not only does the drive controller 38 stop the drive roller 6 but also transmits an unwinding prohibitive instruction to an unwinding controller 47 (for a central core sheet) for the upper level to prevent a single veneer sheet 1 (a central core sheet) from being transported onto the upper level transport conveyor 26. A pair of two overlapping veneer sheet 1 (a face sheet and a substrate sheet) are transported on the combining conveyor 34 and the relay conveyor 42 over distance L1 and when the memory element detects by counting the number of pulses, an activating instruction is transmitted to the drive roller 6 to restart activation thereof. An unwinding start instruction is transmitted to the upper level unwinding controller 47 to restart an unwinding operation at the upper level and thereby, a single veneer sheet 1 (a central core sheet) is started to transport from the upper level transport conveyor 26 to the relay conveyor 42. After issuance of all the instructions is finished, the element is reset. A pair of two overlapping veneer sheets 1 that has arrived at the upper point of the drive roller 6 is driven by the drive roller 6 over a length of the sheets and thereby, are wound on the take-up reel 7 with threads 12 as guide. The length of the two overlapping veneer sheets is determined by the first detector 44, such that when the pair of two overlapping veneer sheets 1 (a face sheet and a substrate sheet) are transported on the combining conveyor 34, the first detector 44 senses the leading edge and trailing edge and the length is stored in the drive controller 38 as the number of pulses.

On the other hand, a single veneer sheet 1 (a central core sheet) waiting on the upper level transport conveyor 26 is transported onto the relay conveyor 42 through the guide conveyor 35. When the second detector 46 senses the leading edge of a single veneer sheet 1 (a central core sheet) in the course of transportation on the relay conveyor 42 by the circulation thereof, transmits a detection instruction to the drive controller 38. The detection instruction is written on one of the memory elements in the drive controller 38 and not only is driving of the drive roller 6 stopped but an unwinding prohibitive instruction is transmitted to the unwinding controller 48 for the middle and lower levels. Transportation of veneer sheets 1 (a face sheet and a substrate) from the middle and lower transport conveyors 26 onto the combining conveyor 34 is prevented from occurring.

When a veneer sheet 1 (a central core sheet) is transported on the relay conveyor 42 over a distance L2 and the memory element detects the transportation by counting up of the number of pulses, an activation instruction is issued to the drive roller 6 to restart activation thereof. Further, an unwinding start instruction is issued to the unwinding controller 48 for the middle and lower levels to restart unwinding operations at the middle and lower levels and single veneer sheets 1 (a face sheet and a substrate sheet) are restarted to transport onto the combining conveyor 34 from the middle and lower level transport conveyors 26. After all the instructions are issued, the memory element is reset. A single veneer sheet 1 (a central core sheet) that has arrived on the drive roller 6 is driven over a length of the sheet by the drive roller 6 and thereby, the single veneer sheet 1 (a central core sheet) is wound on the take-up reel 7 with the threads 12 as guide while a spatial interval between the following single veneer sheet 1 and the trailing end of the pair of two overlapping veneer sheets 1 (a face sheet and a substrate sheet) wound previously is narrowed. The length of the single veneer sheet (a central core sheet) is determined by the second detector 46, such that when a single veneer sheets 1 (a central core sheet) is transported on the relay conveyor 42, the second detector 46 senses the leading edge and trailing edge and the length is stored in the drive controller 38 as the number of pulses. It should be appreciated that since lengths 40 of single veneer sheets 1 are almost constant in cutting, the constant length may be stored in the drive controller 38 as a length 40 similar to the described above.

By repetition of the above described series of operations, the drive roller 6 intermittently rotates and pairs of two overlapping veneer sheets 1 (a face sheet and a substrate sheet) and single veneer sheets 1 (a central core sheet), with a pair of overlapping veneer sheets and a single veneer sheet as a set, are efficiently wound on the take-up reel 7 in a sequential manner while a spatial interval between single veneer sheets and pairs of two overlapping veneer sheets, end to end, arranged in the winding direction is narrowed. A composite veneer roll 41 reeled in such a way is transported to a composite veneer roll stock area and stored with the result that an equilibrium in moisture content is achieved between sheets of different kinds (a face sheet and a substrate sheet). It should be appreciated that while in the embodiment, description is made of the case where control is performed by pulses that are converted from a distance for convenience, similar control can also be achieved by using a delay circuit in which a distance is converted to a time period.

In the embodiment, while an unwinding prohibitive instruction and an unwinding start instruction are issued to the unwinding controller 47 (for a central core sheet) for the upper level or the unwinding controller 48 for the middle and lower levels by pulse control of a memory element in the drive controller 38, this procedures can be replaced with the following way.

That is, when the trailing edges of a pair of two overlapping veneer sheets 1 (a face sheet and a substrate sheet) are sensed by the second detector 46 disposed above the relay conveyor 42, the detection instruction is transmitted to the unwinding controller 48 for the middle and lower levels from the drive controller 38 as an unwinding prohibitive instruction. Transportation of veneer sheets 1 (a face sheet and a substrate sheet) onto the combining conveyor 34 from the middle and lower level transport conveyors 26 is prevented from occurring in response to the instruction. On the other hand, in synchronism with this issuance of the detection instruction, the detection instruction is further transmitted to the unwinding controller 47 for the upper level from the drive controller 38 as a unwinding starting instruction. Transportation of a single veneer sheet 1 (a central core sheet) onto the relay conveyor 42 from the upper level transport conveyor 26 is restarted in response to the instruction. A single veneer sheet 1 (a central core sheet) waiting on the upper level conveyor 26 is transported onto the relay conveyor 42 through the guide conveyor 35. The second detector 46 senses the leading edge of a single veneer sheet 1 (a central core sheet) in the course of transportation on the relay conveyor by circulation of the belt thereof, the second detector 46 transmits the detection instruction to the drive controller 38 and then the drive controller 38 issues the detection instruction to the unwinding controllers 48 for the middle and lower levels as the unwinding prohibitive instruction, wherein the unwinding controllers 48 for the middle and lower levels are connected to the drive controller 38. Transportation of two veneer sheets 1 (a face sheet and a substrate sheet) onto the combining conveyor 34 respectively from the middle and lower level transport conveyors 26 are prevented from occurring in response to the instruction.

Figure 22:
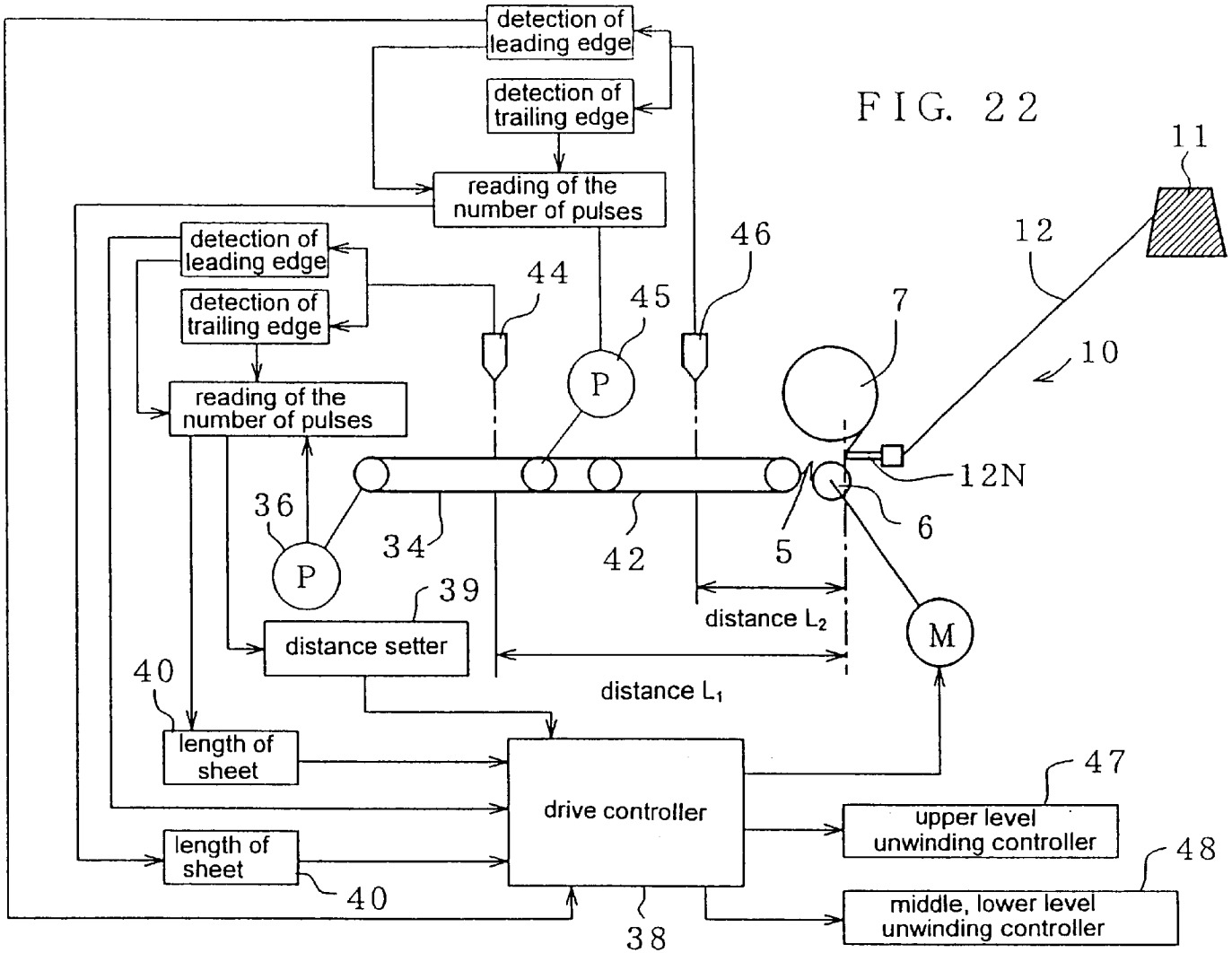
FIG. 22 is a block diagram illustrating interval narrowing means for another composite veneer roll.
Figure 23:
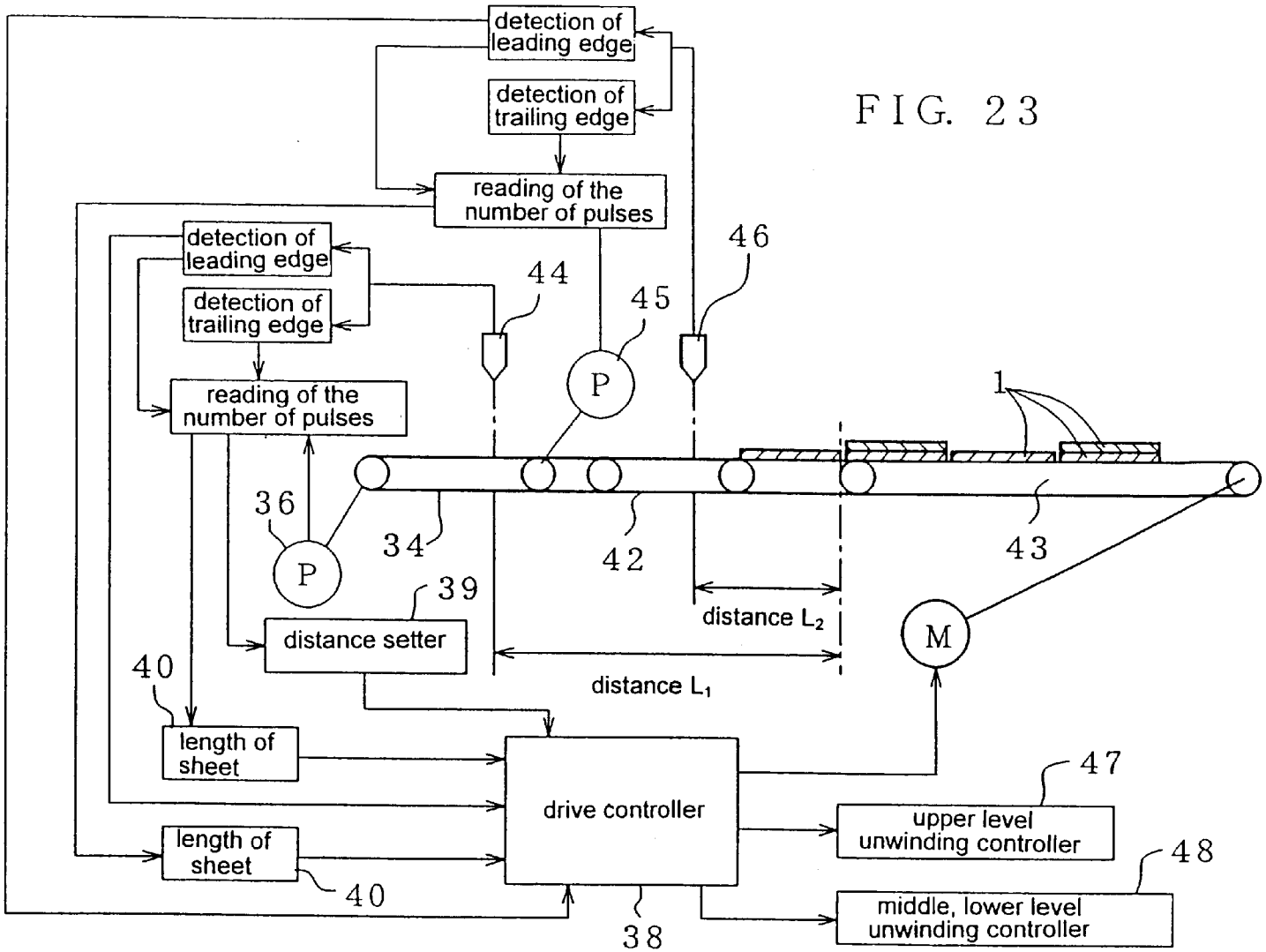
FIG. 23 is a block diagram illustrating another interval narrowing means for another composite veneer roll.

While interval narrowing means shown in FIG. 22 is operated by intermittent rotation of a drive roller 6 in a veneer sheet reeling position 5, description will be made of another embodiment of the interval narrowing means with reference to FIG. 23, wherein the above described interval narrowing means performs narrowing of a spatial interval in the course of transportation in a stage prior to the veneer sheet reeling position 5. It should be appreciated that the same constituents as those corresponding of FIG. 22 are indicated by the same marks.

The starting end of a interval narrowing conveyor 43 that performs narrowing of the spatial interval is disposed in a staggered manner with the terminal end of a relay conveyor 42 and the conveyors 43 and 42 can independently be driven. In this configuration, the first detector 44 senses the leading edge of a pair of two overlapping veneer sheets 1 (a face sheet and a substrate sheet) transported on a combining conveyor 34, the first detector 44 transmits a detection instruction to a drive controller 38 that is a control system of the interval narrowing conveyor 43. A plurality of memory elements are included in the drive controller 38 and the detection instruction is written on one of the memory elements and the drive controller 38 not only stops driving of the interval narrowing conveyor 43, but transmits an unwinding prohibitive instruction to an unwinding controller 47 (for a center core sheet) for the upper level with the result that transportation of a single veneer sheet 1 (a central core sheet) to the upper level transport conveyor 26 is prohibited. When a pair of two overlapping veneer sheets 1 (a face sheet and a substrate sheet) are transported on the combining conveyor 34 and the relay conveyor 42 over a distance L1 and the memory element detects the transportation by counting up the number of pulses, an activation instruction is issued to the interval narrowing conveyor 43 to restart activation thereof. Further, an unwinding start instruction is issued to an unwinding controller 47 for the upper level to restart an unwinding operation at the upper level and restart transportation of a single veneer sheet (a central core sheet) onto the relay conveyor 42 from the upper level transport conveyor 26. After all the instructions are issued, the memory element is reset. A pair of two overlapping veneer sheets 1 (a face sheet and a substrate sheet) that has arrived on the interval narrowing conveyor 43 are wound on a take-up reel 7 with threads 12 as guide by driving the interval narrowing conveyor 43 over a length of the pair of two overlapping veneer sheets 1 (a face sheet and a substrate sheet).

On the other hand, a single veneer sheet 1 (a central core sheet) waiting on the upper level transport conveyor 26 is transported onto the relay conveyor 42 through the guide conveyor 35. When a second detector 46 senses the leading edge of a single veneer sheet 1 (a central core sheet) in the course of transportation in company with of circulation of the relay conveyor 42, the second detector 46 transmits a detection instruction to the drive controller 38. The detection instruction is written on one of memory elements in the drive controller 38 and thereby, not only is driving of the interval narrowing conveyor 43 stopped but the detection instruction is transmitted to the unwinding controller 48 for the middle and lower levels as an unwinding prohibitive instruction. Transportation of veneer sheets 1 (a face sheet and a substrate sheet) respectively from the middle and lower level transport conveyors 26 onto the combining conveyor 34 is prevented from occurring.

The veneer sheet 1 (a central core sheet) is transport on the relay conveyor 42 over a distance L2 and when the memory element detects the transportation by counting up the number of pulses, an activation instruction is issued to the interval narrowing conveyor 43 to restart activation thereof. Further, an unwinding start instruction is issued to the unwinding controller 48 for the middle and lower levels to restart unwinding operations at the middle and lower levels, with the result that transportation of veneer sheets 1 (a face sheet and a substrate sheet) from the middle and lower level conveyors 26 onto the combining conveyor 34 is restarted. After all the instruction are issued, the memory element is reset. A single veneer sheet 1 (a central core sheet) that has arrived on the interval narrowing conveyor 43 is transported on the interval narrowing conveyor 43 by driving the conveyor 43 over a length of the pair of two over lapping veneer sheets 1 (a face sheet and a substrate sheet). Hence, pairs of two overlapping veneer sheets 1 (a face sheet and a substrate sheet) and single veneer sheets 1 (a central core sheet) are in a waiting state on the interval narrowing conveyor 43 in the alternate order while a spatial interval between a single veneer sheets and a pair of two overlapping veneer sheets, end to end, in sequence in the winding direction is narrowed and thereafter, the pairs of two overlapping veneer sheets 1 (a face sheet and a substrate sheet) and the single veneer sheet 1 (a center core sheet) are respectively transported to the veneer sheet reeling position 5 in an alternate manner, followed by winding the veneer sheet and sheets in the alternate order on a take-up reel 7 with threads 12 as guide.

Figure 24:
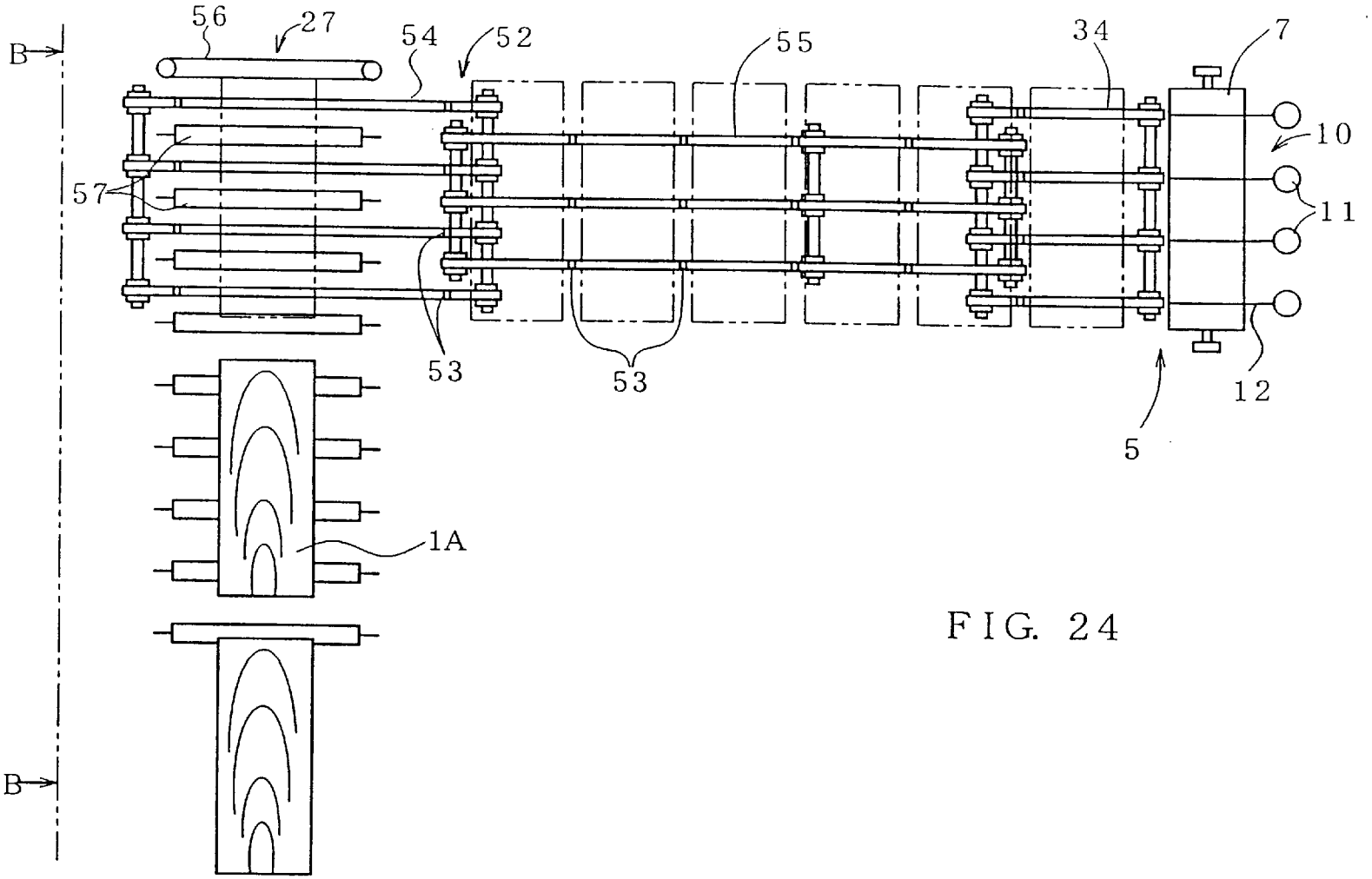
FIG. 24 is a plan view of an embodiment to form a composite veneer roll from veneer sheets fed from piles of veneer sheets after drying.
Figure 25:
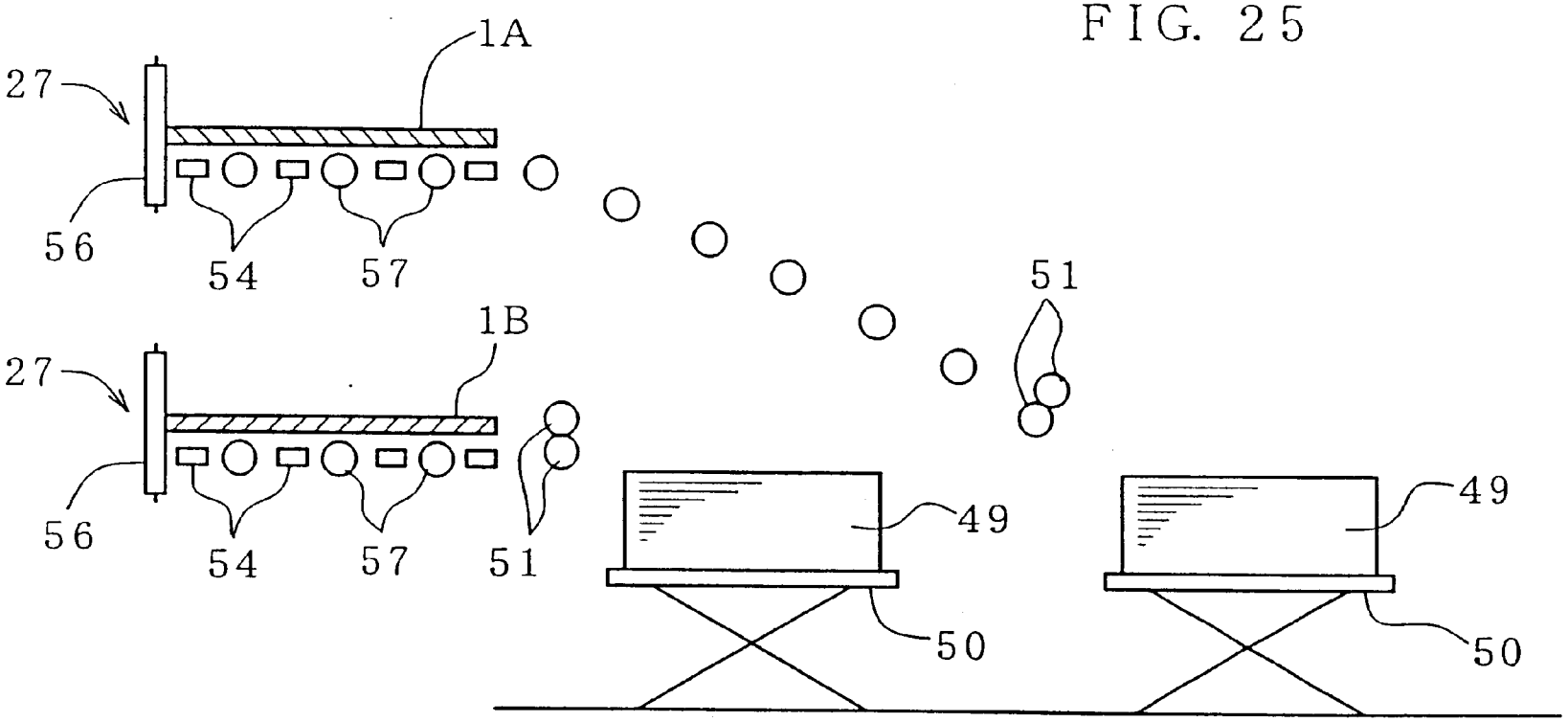
FIG. 25 is a sectional view taken on line B—B of FIG. 24 in an arrow direction.
Figure 26:
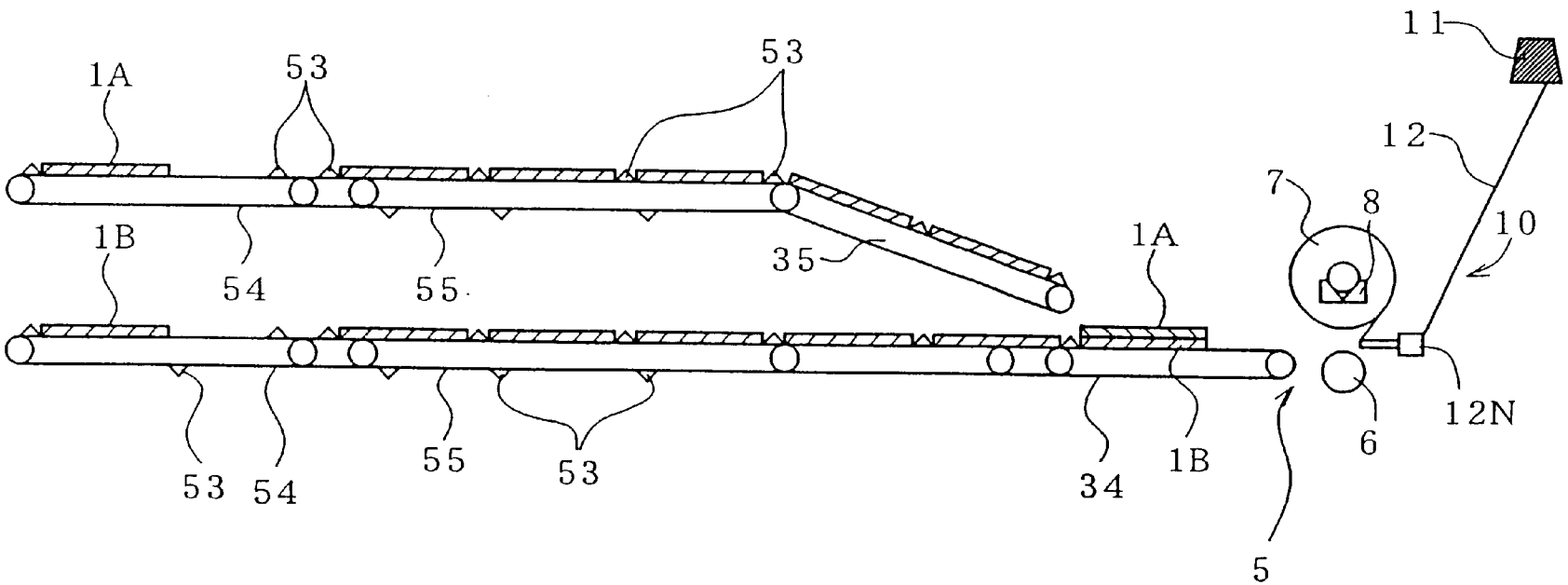
FIG. 26 is a partly cut-away side view of FIG. 24.
Figure 27:
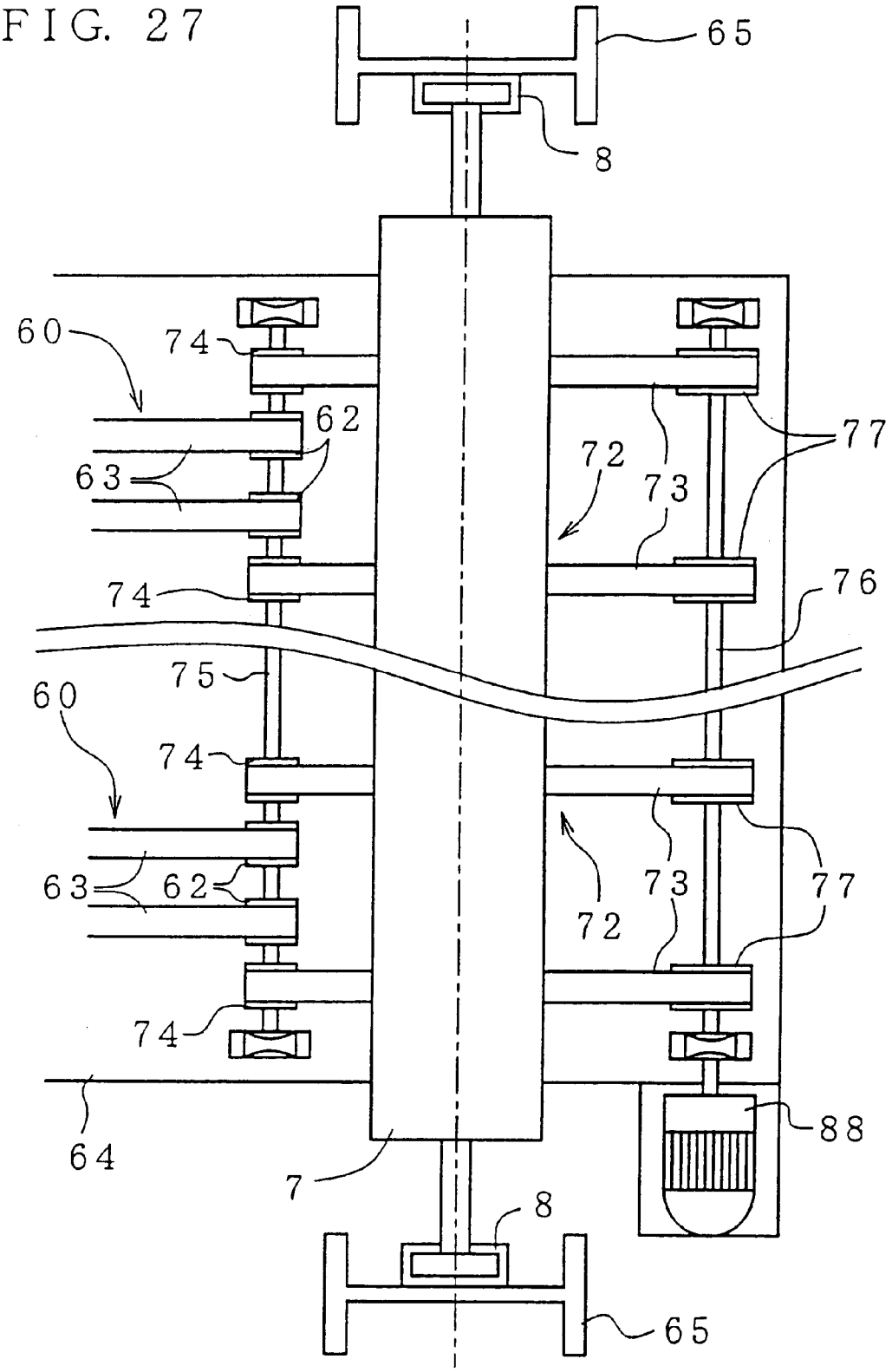
FIG. 27 is a partly cut-away plan view showing an embodiment of a veneer reeling apparatus.

In FIGS. 24 to 26, there is shown an embodiment in which a face veneer sheet and a substrate veneer sheet, both after drying, that are different in kinds from each other are respectively fed from piles of face veneer sheets and substrate sheets to be wound on a take-up reel 7.

The piles 49 of face veneer sheets 1A and substrate sheets 1B, both after drying, that are different from each other in kinds are placed on lifters 50 and the top heights of the piles 49 are controlled to be of any value all time. A pair of conveyors connecting to the lifters 50 are installed as two routes, one above the other, in an adjacent manner to each other with pinch rollers 51 interposed therebetween. The pair of conveyors respectively for transportation of face veneer sheets and substrate veneer sheets at levels, upper and lower, are provided as interval narrowing means 52 for the veneer sheets 1A and substrate sheets 1B that are alternately transported one after another. The interval narrowing means 52 comprises an upstream conveyor 54 that is constructed from belts and chains on which spikes 53 are fixed at spatial intervals about two times a width of a face veneer sheet 1A or a substrate veneer sheet 1B and a downstream conveyor 55 downstream from the upstream conveyor 54 that is constructed from belts or chains on which spikes 53 are fixed at spatial intervals about the same width as that of a face veneer sheet 1A or a substrate veneer sheet 1B. The terminal end of the upstream conveyor 54 is combined in a staggered manner with the starting end of the downstream conveyor 55 and a speed of the upstream conveyor 54 is controlled so as to be almost two times that of the downstream conveyor 55.

Position control means 27 is provided on one side of the upstream conveyor 54 as viewed in the transport direction (on the other side of the upstream conveyor 54 from the lifter 50) at any point along the upstream conveyor 54 and the position control means 27 controls one side of each of face veneer sheets 1A and substrate veneer sheets 1B as view in the transportation. The position control means 27 is constituted of a control belt 56 a shaft direction of whose pulleys is vertical and the inside surface of whose belt is in parallel to the upstream conveyor 54 and can freely circulate in a direction of transportation of the upstream conveyor 54. A roller conveyor 57 is provided such that parallel tubular rollers thereof are respectively inserted between belts or chains of the upstream conveyor 54 and the roller conveyor 57 can freely be moved so as to protrude from a transport surface or retreat from the transport surface. The roller conveyor 57 can further be circulated so as to face in a direction intersecting the transport direction of the upstream conveyor 54.

Face sheets 1A and substrate sheets 1B are individually fed onto the pinch roller 51 from the tops of the piles 49 on the lifters 50 one at a time and reach onto roller conveyor 57 after being fed on the pinch rollers 51. In this situation, the roller conveyor 57 is controlled in a raised state in which the roller conveyor 57 is protruded from the transportation surface of the upstream conveyor 54 and circulated toward the control belt 56. A face veneer sheet 1A or a substrate veneer sheet 1B proceeds up to the control belt 56 so as to be eventually put in contact therewith and then one end of the face veneer sheet 1A or the substrate veneer sheet 1B is slid a little such that the one end is turned toward a shaft direction of the tubular rollers under control in company with rotation of the control belt 56. Thereafter, when the roller conveyor 57 is retreated from the transport surface of the upstream conveyor 54, the face veneer sheet 1A or the substrate veneer sheet 1B is transferred onto the upstream conveyor 54 and transported toward the downstream conveyor 55 with the trailing end supported by the spikes 53.

When a face veneer sheet 1A or a substrate veneer sheet 1B in transportation with the spikes 53 as stoppers on the upstream conveyors 54 reaches the starting end of the down stream conveyor 55, Since a speed of the downstream conveyor 55 is controlled so as to be about half that of the upstream conveyor 54, the leading edge of the face veneer sheet 1A or the substrate veneer sheet 1B gradually catches up with spikes 53 of the downstream conveyor 55. Just before the leading edge of the face veneer sheet 1A or the substrate veneer sheet 1B is put in contact with spikes 53 of the downstream conveyor 55, the trailing edge of the face veneer sheet 1A or the substrate veneer sheet 1B comes to be supported by spikes 53 of the downstream conveyor 55 since an upper belt of the upstream conveyor 54 reaches a point of return at the terminal end thereof. In this situation, the face veneer sheet 1A or the substrate veneer sheet 1B comes to be fully disposed on the downstream conveyor 55 between spikes 53 thereof at the leading and trailing edges of the veneer sheets 1A or 1B and thereafter, spatial intervals between the veneer sheets 1A or 1B, end to end, arranged in the transportation direction are narrowed.

The starting end of a combining conveyor 34 is connected in a staggered manner to the terminal end of the lower level downstream conveyor 55 at a downstream position of the lower level downstream conveyor 55 and a substrate veneer sheet 1B on the lower level downstream conveyor 55 is transferred keeping a straight movement with no special procedure. On the other hand, a guide conveyor 35 is disposed at the terminal end of the upper level downstream conveyor 55 and the guide conveyor 35 guides a face veneer sheet 1A on the upper level downstream conveyor 55 onto a transport surface of the combining conveyor 34. The guide conveyor 35 has a down slope toward the transport direction and the distal end of the guide conveyor 35 is held close to the transport surface of the combining conveyor 34. On the combining conveyor 34, a substrate veneer sheet 1B transported in straight movement from the lower level downstream conveyor 55 and a face veneer sheet transported from the upper level down stream conveyor 55 through the guide conveyor 35 are combined while the leading edges of the veneer sheets 1A and 1B are aligned with each other in an overlapping manner.

A pair of two overlapping veneer sheets composed of a face veneer sheet 1A and a substrate veneer sheet 1B are transported on the combining conveyor 34 and arrive in a veneer sheet reeling position 5. In this situation, the drive roller 6 rotates at almost the same speed as that of combining conveyor 34, a take-up reel 7 is rotated in a reverse direction to that of the drive roller 6 by a frictional force produced from a driving force of the drive roller 6 and pairs of two overlapping veneer sheets composed of a face veneer sheet 1A and substrate veneer sheets 1B are wound on a take-up reel 7. In this case, spatial intervals between pairs of overlapping veneer sheets composed of a face veneer sheet 1A and a substrate veneer sheet 1B are narrowed being arranged end to end in a winding direction, thereby entailing reeling of veneer sheets with good efficiency.

While in the above embodiment, description, for convenience, is made of the case where there are provided the interval narrowing means 52 constructed from the upstream and downstream conveyors 54 and 55, and the position control means 27 respectively for use to control a face veneer sheet 1A and a substrate veneer sheet 1B, which are disposed at positions, above or below, at any spatial interval in the transport direction, it is also allowable that the upstream and downstream conveyors 54 and 55 are disposed in an adjacent manner at any spatial interval on both sides, left or right, of the transport direction, or disposed at opposite positions with the combining conveyor 34 interposed therebetween. Further, the interval narrowing means 52 constructed from the upstream and downstream conveyors 54 and 55 can be replaced with controlled intermittent rotation of the drive roller 6 in the veneer sheet reeling position 5. Still further, interval narrowing means according to the controlled intermittent rotation of the drive roller 6 in the embodiments can be replaced with the interval narrowing means 52 constructed from the upstream and downstream conveyors 54 and 55.

Next, description will be made of another embodiment of a veneer reeling apparatus of the invention with reference to FIGS. 27 to 33.

A transport conveyor 60 has a configuration in which a plurality of belts 63 are extended over a starting end pulley 61 and a distal end pulley 62, and the pulleys 61 and 62 are freely rotatable by driving of a motor (not shown) and mounted on a frame 64. A pair of reel supports 65 are provided at positions on the outsides of the transport conveyor 60 in the vicinity of the terminal end thereof in a direction perpendicular to the transport direction. In the reel supports 65, there are provided a reel receiver 8 that supports a take-up reel 7 in a freely rotatable manner; a reel downpresser 66 that presses the take-up reel 7 downward from above when veneer sheets 1 are wound on the take-up reel 7 while respectively facing inwardly in an opposite manner, thereby constituting a veneer sheet reeling position 5. Further, fluid cylinders 67 for use in suspension are provided on both sides of the reel supports 65 at an upper position thereof with the front sides down and the distal end of the piston rod 68 is connected to one end of a support member 70 such as chains or belts that are wound on a support section 69 of the frame 64, while the end of the support member 70 is fixed at a support section 71 of a reel support 65.

A winding guide member 72 is disposed in a space covering from below the take-up reel 7 to the other side of the take-up reel 7 from the veneer sheet 1 feed side, opposing to the circumferential surface of the body of the take-up reel 7, wherein the winding guide member 72 plays a role to wind the veneer sheet 1 transported from the transport conveyor 60 on the take-up reel 7. The winding guide member 72 includes a plurality of endless bands 73 that are arranged at arbitrary spatial intervals along the shaft direction of the take-up reel 7 and the endless bands are located, as shown in FIG. 29, in an opposite manner to the circumferential surface of the take-up reel 7 along the circumferential surface, from the lower surface of the take-up reel 7 to a part of the circumferential surface on the other side from the veneer sheet 1 feed side.

Figure 28:
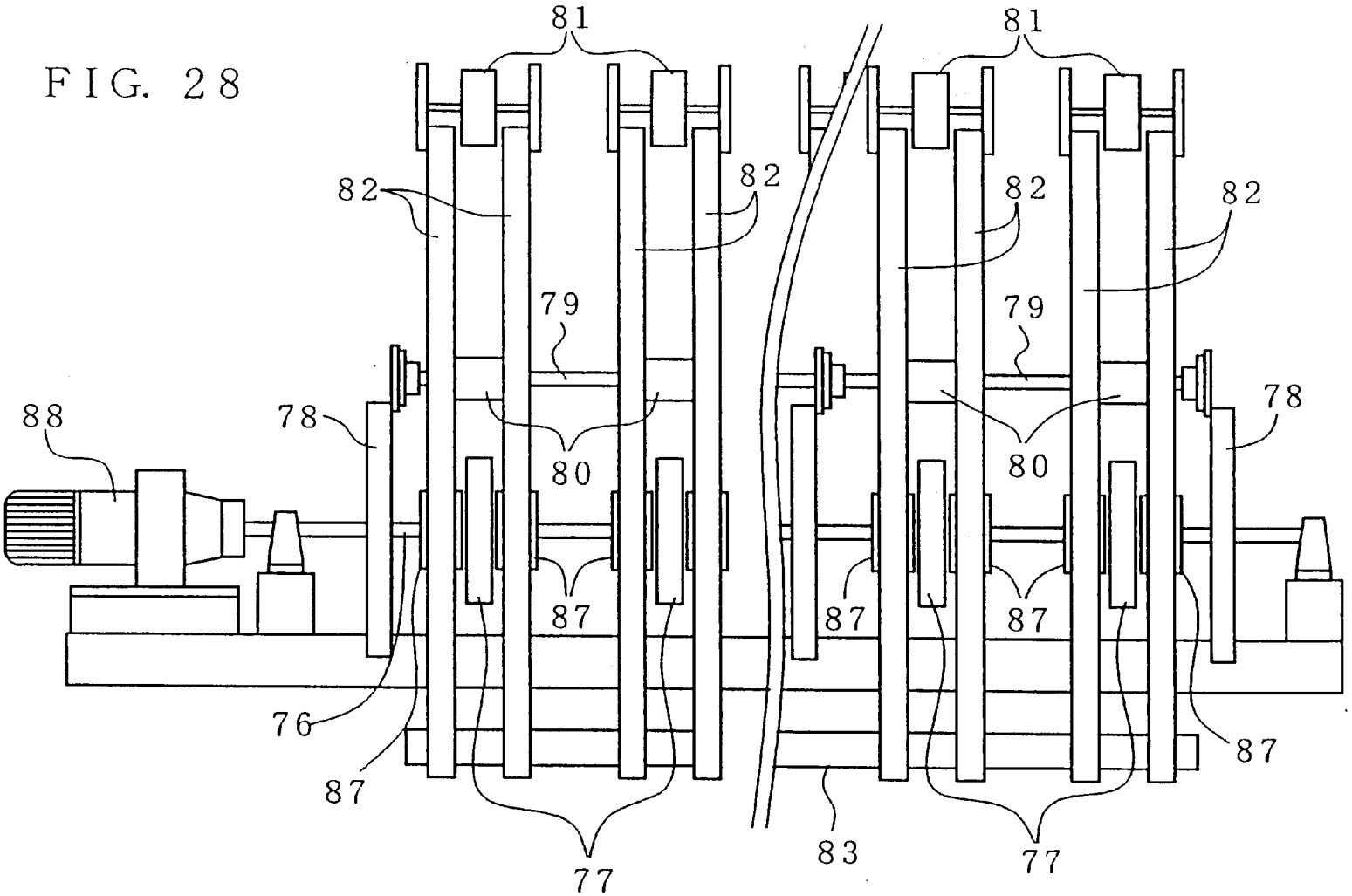
FIG. 28 is a partly cut-away plan of FIG. 27.
Figure 29:
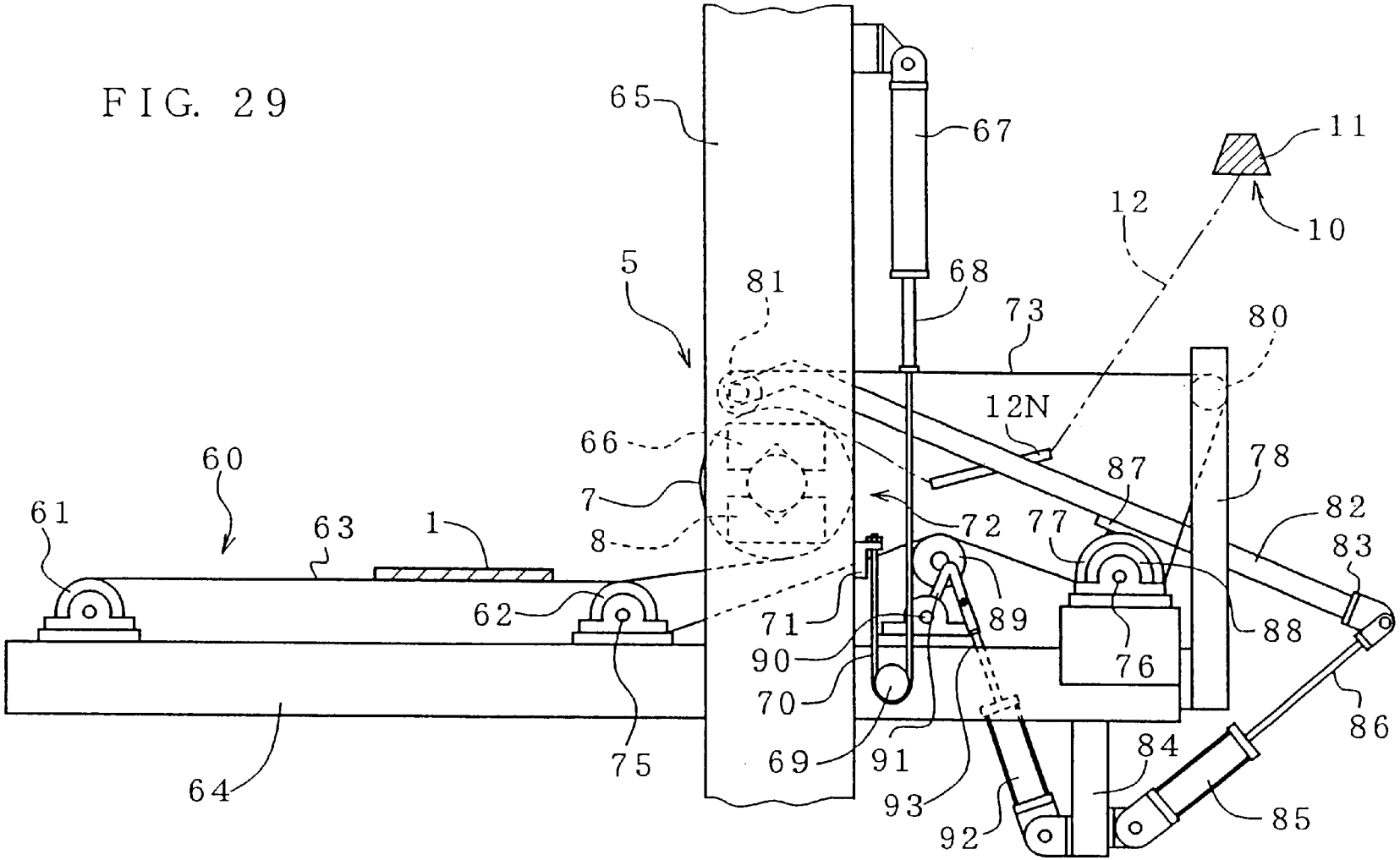
FIG. 29 is a side view showing an embodiment of a veneer reeling apparatus.

The winding guide member 72 shown in FIG. 29 are constructed from a plurality of endless bands 73 that respectively extend over pulleys disposed in a base end section, a middle section, an upper section and a distal end section. That is, the pulleys 74 in the base end section are mounted on a shaft 75 of a plurality of distal end pulleys 62 of the transport conveyor 60 such that the pulleys 74 are respectively inserted between the plurality of distal end pulleys 62 that are mounted on the shaft 75 in arbitrary spatial intervals along the shaft direction. Further, pulleys 77 in the middle section are disposed in a corresponding manner to the pulleys 74 in the base section on and along a middle shaft 76 that is supported with bearings in the vicinity of the distal end of the frame 64. An upper shaft 79 is rotatably supported between the top portions of a plurality of support members 78 disposed along a direction perpendicular to the transport direction at the distal end of the frame 64 and pulleys 80 in the upper section are disposed on the upper shat 79 along the shaft direction thereof in a corresponding manner to the pulleys 74 and 76 of the base section and the middle section. Further, as shown in FIG. 28, each of pulleys 81 in the distal end section are supported between the fore-ends of a pair of support arms 82 in a rotatable manner and base ends of pairs of the support arms 82 are commonly connected to a connecting beam 83 while being in pairs disposed along the connecting beam 83. The connecting beam 83 is attached to piston rods 86 of fluid cylinders 85 that are used for a following action, wherein the fluid cylinders 85 swingably supported by brackets 84 that protrude from the lower portion in the vicinity of the distal end of the frame 64. Pairs of the support arms 82 are provided with support sections 87 in the middle region thereof and bearing surfaces fixed on the support sections 87 are placed on the middle shaft 76.

Therefore, each of the endless bands 73 extends from a pulley 74 in the base section, to a pulley 77 in the middle section, to a pulley 80 in the upper section and to a pulley 81 in the distal section. The transport conveyor 60 and the winding guide member 72 are controlled in rotation at almost the same speed as each other by receiving rotation of a motor 88 installed at one end of the middle shaft 76. When pairs of the support arms 82 are swung toward the take-up reel 7 by the fluid cylinder 85 for a following action with the support sections 87 that are placed on the middle shaft 76 through the bearing surfaces of the support sections 87 each as a fulcrum, the pulleys 81 in the distal end section located at the distal ends of pairs of support arms 82 comes to touch the circumferential surface of the take-up reel 7 and the winding guide member 72 is pressed closely in plane contact with the circumferential surface of the take-up reel 7 in conformity of the curvature of the circumference.

A plurality of thread feeding mechanisms 10 for feeding the threads 12 wound as guides for winding a veneer sheet 1 on the take-up reel 7 are disposed in arbitrary spatial intervals along the shaft direction of the take-up reel 7. For example, the thread feeding mechanisms 10 are respectively arranged between each pair of the endless bands of the winding guide member 72 and nozzles 12N are mounted in almost the middle regions of the support arms 82. On the other hand, in order to make the threads 12 entangled with the take-up reel 7, highly frictional regions are provided on the take-up reels: For example, at arbitrary spatial intervals along the shaft direction thereof, sand paper pieces are attached at a plurality of spots on the take-up reel 7 or instead, small raised portions which are formed, for example by a knurling tool are provided.

Figure 30:
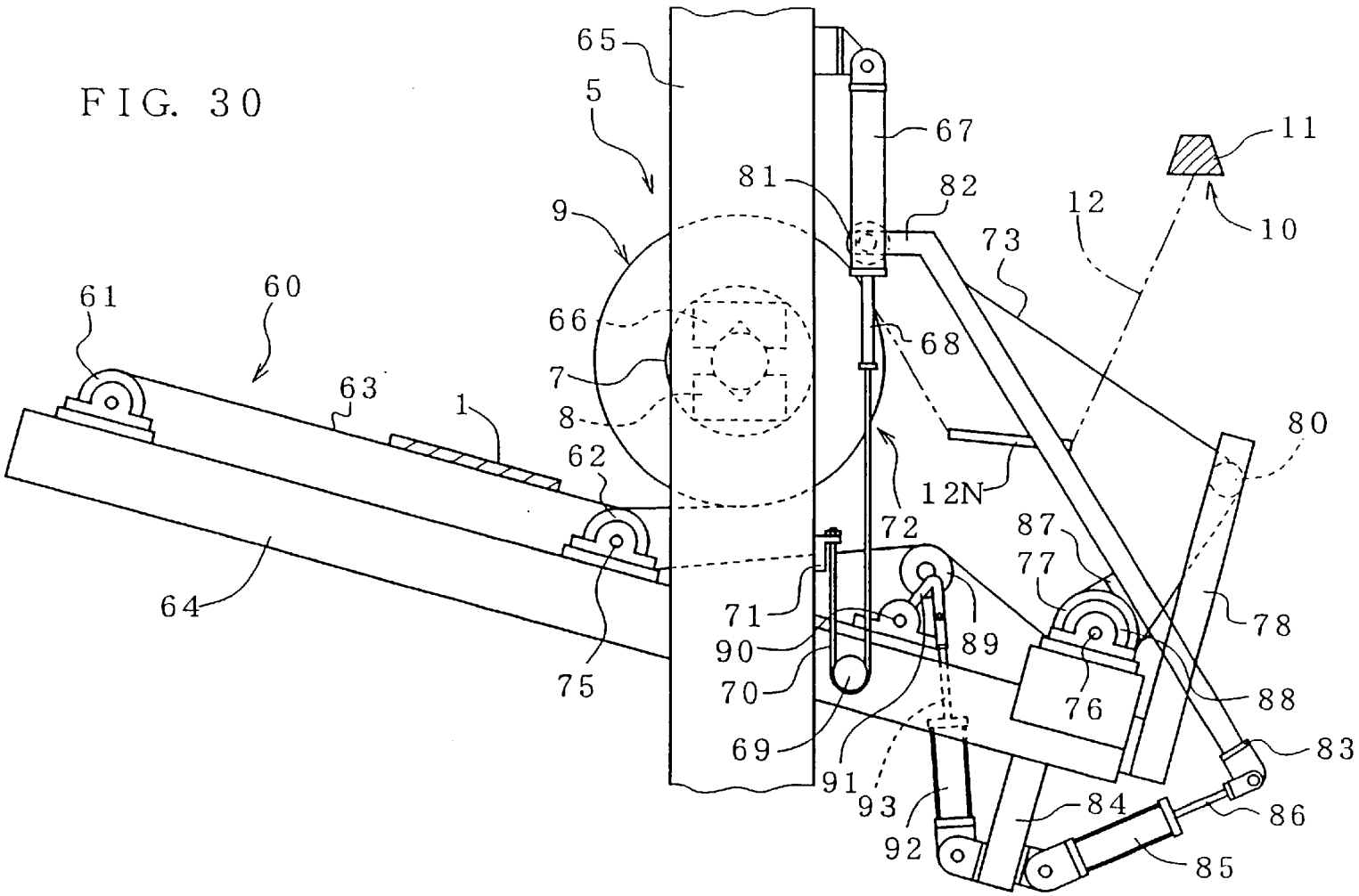
FIG. 30 is a view for illustration of a working state of FIG. 29.

Further, in the winding guide member 72, rotary pulleys 89 are provided in order to maintain the winding guide member 72 in a firmly stretched condition under a constant tension by pushing or pulling the endless bands 73 constituting the winding guide member 72 under a pressure while guaranteeing a rotation force of the winding guide member 72 so as to be rotatable all time. That is, as shown in FIGS. 29 and 30, L-like levers 91 are provided in number corresponding to the number of the endless belts 73 constituting the winding guide member 72 along a shaft 90 supported with bearings on the frame 64. The rotary pulleys 89 are rotatably supported at protruded portions of the rotary shafts 91 and the other end of the L-like shape levers 91 are fixed at piston rods of the fluid cylinders 92 for firm stretching swingably supported by a bracket 84 that protrudes from the lower portion in the vicinity of the distal end of the frame 64. The rotary pulleys 89 shown in FIGS. 29 and 30 press the endless belts 73 constituting the winding guide member 72 by a pressure or the rotary pulleys 89 shown in FIG. 31 pull the endless belts 73 outwardly by a force and thereby, the winding guide member 72 is held in a firmly stretching condition, while guaranteeing a rotation force of the winding guide member 72.

It should be appreciated that there also can be given another configuration in which the rotary pulleys 89 are rotatably supported on a shaft (not shown) inserted through the protruded portions of levers 91 located at both ends of a series of the levers 91 at arbitrary spatial intervals along the shaft direction and the other end of the L-like levers 91 at the both ends are fixed at the pistons of the fluid power cylinders 92 for firmly stretching. With such a configuration, the rotary pulleys 89 can integrally act on the winding guide member 72 in one piece to its firmly stretching condition with the result that the endless belts 73 of the winding guide member 72 can be in conformity with the curvature of the take-up reel 7. However, as shown in the example shown in the figure, an advantage can be enjoyed in a case where there are provided the fluid cylinders 92 for the firmly stretching that individually impart pressures to the respective endless belts 73 constituting the winding guide member 72: For example, even if there arises a deflection by a self weight in the take-up reel 7 or a thickness of a veneer sheet 1 is fluctuated, the configuration in the example can maintain firmly stretching conditions of the respective endless belts 73 of the winding guide member 72 at the same degree of tightness to impart almost the same frictional forces to a veneer sheet 1 in winding at positions on the sheet 1 along the shaft direction of the take-up reel 7.

In a operation of reeling a veneer sheet 1, at first a fluid is fed to a front port of each fluid cylinder 67 for suspension and thereby, the distal end of the frame 64 is swung upwardly with the shaft of the starting end pulley 61 of the transport convey or 60 located in the transport-inside of a veneer sheet 1 as a fulcrum. Therefore, the distal end of the frame 64 swings together with the transport conveyor 60 and the winding guide member 72 and with the swing movement, the winding guide member 72 comes to be put in contact with the lower surface of the take-up reel 7 that is rotatably supported by a reel receiver 8. Then, the fluid cylinders 85 for a following action and the fluid cylinders 92 for firm stretching are activated and the endless belts 73 of the winding guide member 72 are put into close contact with the lower surface of the take-up reel 7 at first and then with a part of the circumferential surface of the take-up reel 7 on the other side thereof from the veneer sheet 1 transport-in side while keeping a firmly stretching condition of each endless belts 73.

Under such circumstances, threads 12 that are fed from thread reels 11 are blown through nozzles 12N to highly frictional regions on the take-up reel 7 such that the tips of the threads 12 get entangled with the highly frictional regions. Following the thread blowing, the winding guide member 72 is rotated at least one time or preferably several times and thereby, a tension is made to be produced between the take-up reel 7 with which the threads 12 are entangled and the threads 12. Thereafter, veneer sheets 1 transported from a previous step are guided through the transport conveyor 60 into between the lower surface of the take-up reel 7 and the winding guide member 72 that is controlled so as to run at almost the same speed as that of the transport conveyor 60. It should be appreciated that the veneer sheets 1 may be in a damp condition as cut by a veneer lathe (not shown), or in a dry condition caused by drying in a veneer dryer (not shown), or further in a cut state that is produced by cutting a continuous veneer sheet in constant length along a fiber orientation or in a continuous state.

Since the winding guide member 72 are closely in plane contact with part of the circumferential surface of the take-up reel 7 covering from the lower portion of the take-up reel 7 to the other side from the veneer sheet 1 transport-in side, a veneer sheet 1 is wound on the take-up reel 7 keeping a plane contact along the curved surface of the take-up reel by a frictional force produced in company of driving of the winding guide member 72. In the winding operation of a veneer sheet 1, the threads 12 are in a firmly stretching condition between the take-up reel 7 and the nozzles. Hence, when a veneer sheet 1 is wound on the take-up reel 7 with a frictional force produced from driving of the winding guide member 72, the threads 12 are wound on the take-up reel 7 together with the veneer sheet 1 at a plurality of positions along the shaft direction starting at the leading edge of the veneer sheet 1.

Especially when a veneer sheet 1 is in a cut sheet state, the veneer sheets 1 can firmly be wound on the take-up reel 7 since a plurality of endless bands 73 of the winding guide member 72 are closely put in plane contact with the curvature of part of the circumferential surface of the take-up reel 7. Further, even when a veneer sheet 1 is one after drying and a stiffness of fibers therein is high in degree as compared with a veneer sheet 1 in a damp state, the veneer sheet 1 can be wound on the take-up reel 7 in a copying condition along the outer surface thereof.

Further, the threads 12 are wound on the outer surface of a veneer sheet 1 as guides between the endless bands 73 that runs in parallel to one another which constitute the winding guide member 72 when the veneer sheet 1 is pressed onto the outer surface of the take-up reel 7 in close contact by the winding guide member 72. For this reason, even when a close contacting state with the winding guide member 72 is canceled after a veneer sheet 1 is wound on the take-up reel 7, there arises no chance for a winding state of the veneer sheet 1 to be unfavorably relaxed since the threads 12 are wound the veneer sheet 1 from the outside in a plurality of rows.

Figure 33:
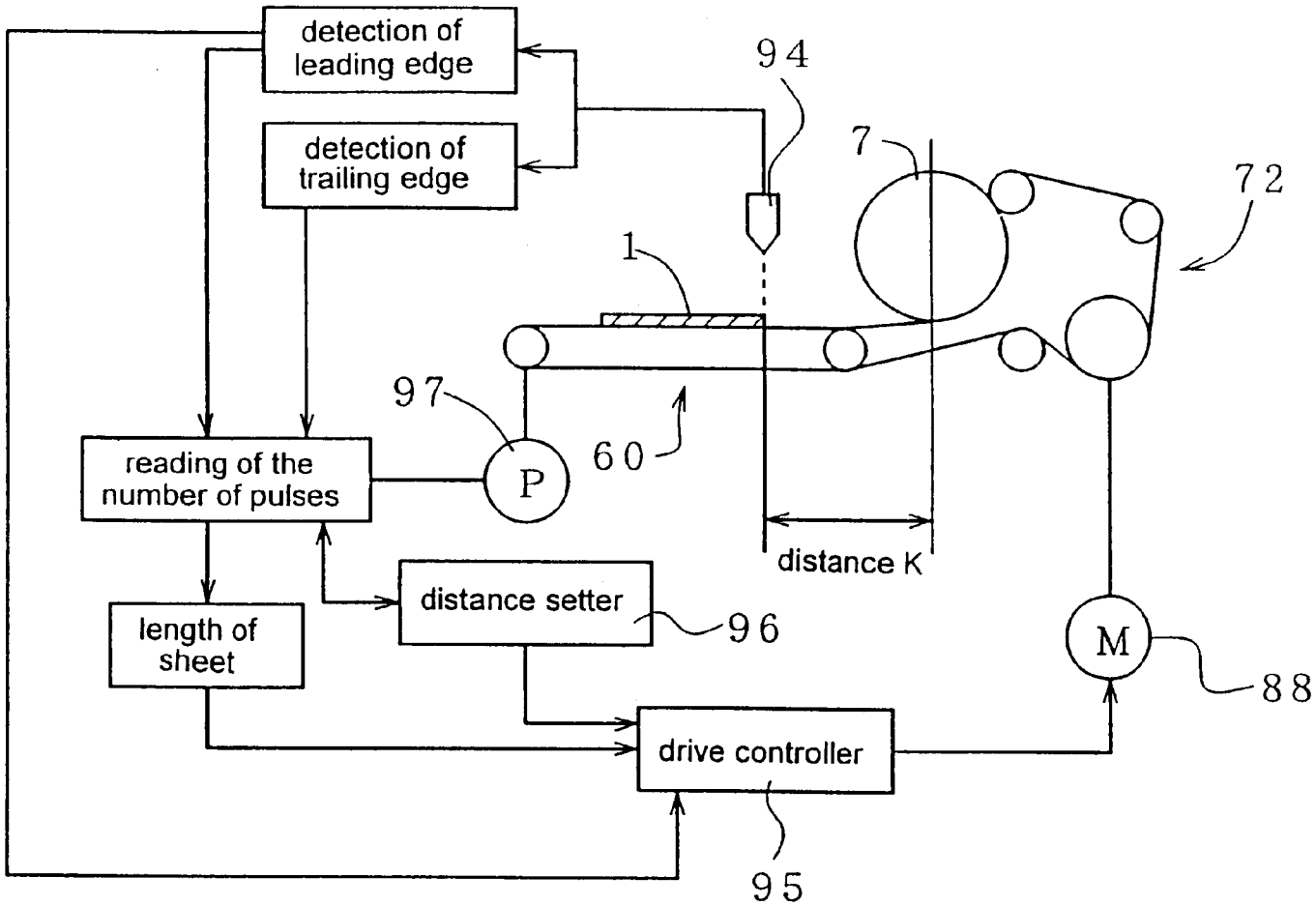
FIG. 33 is a block diagram of interval narrowing means.

Following are descriptions of an embodiment in which veneer sheets 1 in a cut sheet state are wound on a take-up reel 7 while narrowing spatial intervals between the veneer sheets 1 arranged end to end in the winding direction in consideration of winding efficiency with reference to FIG. 33.

When a detector 94 of a contact type or a non-contact type such as a transparency type and a reflection type senses the leading edge of a veneer sheet 1, the detector transmits a detection instruction to a drive controller 95 that is a control system of the winding guide member 72. A distance setter 96 that sets a distance K from the detector 94 to the winding guide member 72 is connected to the drive controller 95 and the drive controller 95 stops circulation of the winding guide member 72. A pulse generator 97 is provided to the transport conveyor 60, the veneer sheet 1 is transported over a distance K on the transport conveyor 60 and the transportation is detected by counting up of the number of pulses. The veneer sheet 1 that has arrived on the winding guide member 72 is wound on the take-up reel 7 with the threads 12 as guide by driving the winding guide member 72 over a length of the veneer sheet 1. The length of the veneer sheet 1 is determined by detecting the leading and trailing edges thereof in transportation on the transport conveyor 60 with the detector 94 and the length thereof is stored in the drive controller 95 as the number of pulses. Further, since a length of a veneer sheet 1 is cut in a constant value, the constant value may be stored in the drive controller 95 as a length of a veneer sheet 1 in advance. When the leading edge of a next veneer sheet 1 is detected by the detector 94, the next veneer sheet 1 arrives on the winding guide member 72 after operations in steps similar to those of the above description and is wound on the take-up reel 7 with threads 12 as guide while spatial intervals between the veneer sheets 1 arranged, end to end, in a winding direction are narrowed. With repetition of such operations, veneer sheets are sequentially wound on the take-up reel 7 in an efficient manner by intermittent circulations of the winding guide member 72 while narrowing spatial intervals between veneer sheets 1 arranged end to end in the winding direction.

It should be appreciated that when the veneer sheet 1 breaks or tears with ease from cracks, rifts or the like defect (such defects tend to frequently occur in a veneer sheet 1 after drying) even if a veneer sheet 1 that is reeled is in a continuous state, or when a veneer roll in winding operation is relaxed in the middle section thereof, as described above, a plurality of threads 12 are wound as guides together with the veneer sheet 1 and thereby, stable reeling can be attained.

Since the individual endless bands 73 constituting the winding guide member 72 are independently maintained in a firmly stretching condition by pressures of almost the same magnitude applied respectively, the endless bands 73 of the winding guide member 72 keeps in respective conditions of the same degree of firm stretching and frictional forces of the same strengths can be exerted on the veneer sheet 1 at any portion thereof along the shaft direction of the take-up reel 7 even if deflection due to self weight occurs in the take-up reel 7 or there arise fluctuations in thickness of the veneer sheet 1.

As the veneer sheet 1 is wound on the take-up reel 7 and a diameter of the veneer roll 9 is increased, the distal end of the frame 64 is swung downward by increase in the diameter of the veneer roll 9 with the shaft of the pulley 61 of the starting end of the transport conveyor 60 as a fulcrum. Since the reel receiver 8 supporting the take-up reel 7 with the bearings is fixedly positioned, the veneer roll 9 presses down the frame 64 by increase in diameter of the veneer roll 9 through the winding guide member 72 by a pressure that overcomes a fluid pressure of the fluid cylinder 67 for suspension. Further, as a diameter of the veneer roll 9 increases, positions of the pulleys 81 in the distal end section of the winding guide member 72 is gradually raised while beating a fluid pressure of the fluid cylinder 85 for a following action (clockwise movement in FIGS. 29 and 30). Further, with a increase in diameter of the veneer roll 9, positions of the pulleys 89 that individually press the endless bands 73 of the winding guide member 72 to a firmly stretched condition are respectively displaced while beating pressures of the fluid cylinder 92 for firm stretching. Such displacements are apparent from comparison between a starting position for reeling of a veneer sheet 1 shown in FIG. 29 and a position in the course of winding operation shown in FIG. 30.

Figure 31:
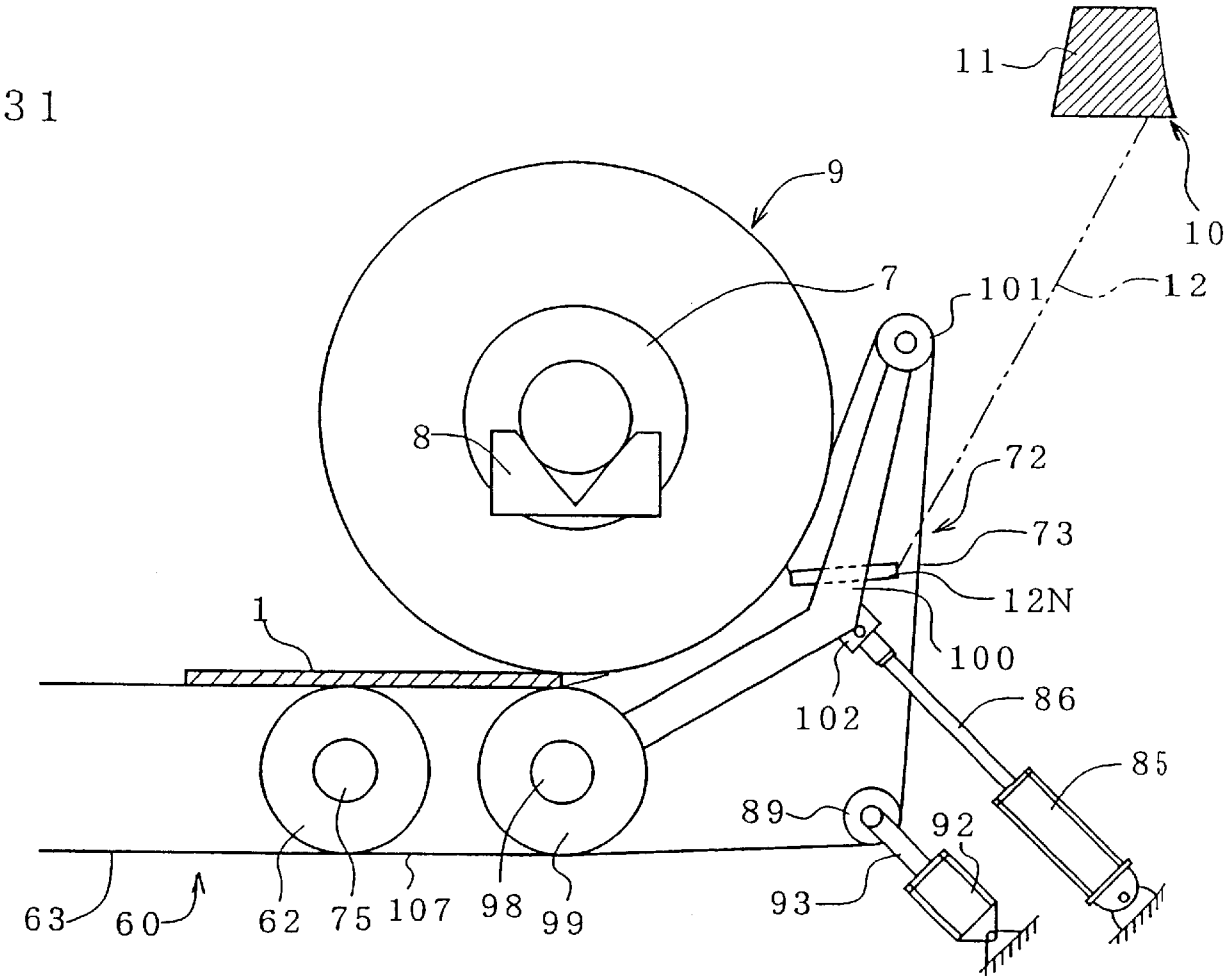
FIG. 31 is a schematic view for illustration showing another embodiment of a veneer reeling apparatus.

Further, the winding guide member 72 can take another configuration as shown in FIG. 31 in addition to the above described configuration: a lower portion of the winding guide member 72 is a base end and the distal end is an free end as shown in FIG. 31, and a plurality of endless bands 73 extend over the both pulleys. That is, a base end shaft 98 of the winding guide member 72 is rotatably supported at a forward position of the shaft 75 of the distal end pulley 62 of the transport conveyor 60 below the veneer sheet 1 reeling position, connection pulleys (not shown) are disposed in positions corresponding to the distal end pulleys 62 on the base end shaft 98 and a connection conveyor 107 is formed over the distal end pulleys 62 and the connection pulleys. A plurality of base end pulleys 99 are mounted on the base end shaft 98 at arbitrary spatial intervals along the direction of the shaft 98. Pairs of support arms 100 that are bent in the middle region thereof with the distal end upward are independently swingably mounted on the base end shaft 98 with the base end shaft 98 as a fulcrum while each base end pulley 98 is sandwiched by a pair of support arms 100. Distal end pulleys 101 of a small diameter each are rotatably supported between a pair of two adjacent support arms 100, not only endless bands 73 extend over the base end pulleys 99 and the distal end pulleys 101 of a small diameter but the support arms 100 are commonly connected to a connection beam 102 as one piece at arbitrary positions on the support arms 100 and further, both ends of the connection beam 102 are attached to piston rods 86 of fluid cylinders 85 for a following action swingably supported on the frame 64.

While the endless bands 73 are belts that extend over the base end pulleys 99 and the distal end pulleys 101 in an endless manner, diameters of the base end pulleys 99 and the distal end pulleys 101 are not equal to each other, but a diameter of the base end pulleys 99 is larger than that of the distal end pulleys 101. A margin of distance arises by a difference in radius between the base end pulleys 99 and the distal end pulleys 101 when the endless bands 73 are pressed to the lower portion of the circumferential surface of the take-up reel 7 and thereby, the endless bands 73 can be pressed to the lower portion of the circumferential surface of the take-up reel 7 in a contact area with a width. More of frictional force can be used with increase in contact area between the endless belts 73 and the lower outer surface of the take-up reel 7 caused by such a pressing state over an area with the result that a veneer sheet 1 can be wound on the take-up reel 7 in a stable manner. In addition, since the support arms 100 that support the base end pulleys 99 and the distal end pulleys 101 are each bent in its middle region upward, there arises neither interference nor contact between the upper track of each of the endless bands 73 facing the circumferential surface of the take-up reel 7 and an support arm 100, between lower surface and upper surface, and thereby, a inconvenience such as stoppage of circulation of the endless bands 73 can be avoided, which ensures winding a veneer sheet 1 on a take-up reel 7.

Figure 32:
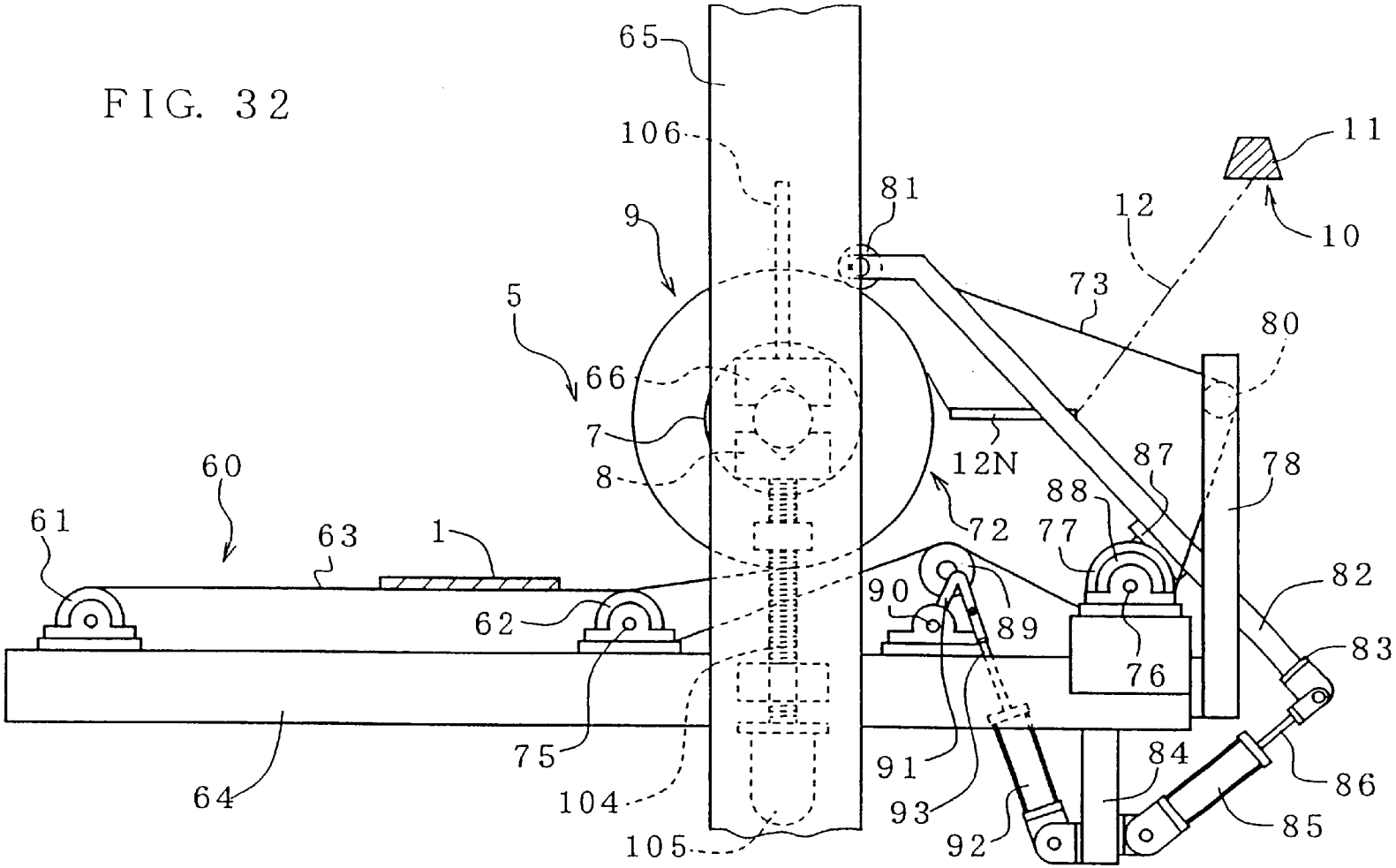
FIG. 32 is a side view showing another embodiment of FIG. 29.

Further, while in the embodiment, the frame 64 is freely swingable by means of the fluid cylinder 67 for suspension, instead a member that is swingable by a balance weight or the like can be supported by a pressure. Still further, contrary to the above described cases, the following configuration can be adopted: A position of the take-up reel 7 is vertically shiftable, while the winding guide member 72 is fixedly supported in a circulating manner. As a mechanism for vertically shifting the reel receiver 8, as shown in FIG. 32, for example, the reel receivers 8 supporting the take-up reel 7 at both ends are connected to a feed shaft 104 and the feed shaft 104 is rotatably coupled with a motor 105. On the other hand, a line sensor 106 that senses a diameter of the veneer roll 9 is provided on a reel support 65. Therefore, a thickness of a veneer sheet 1 being wound is detected and the reel receivers 8 at both side of the take-up reel 7 are shifted upward by action of the feed shaft 104 with the motor 105 by a thickness of the veneer sheet 1 of detection for each rotation of the take-up reel 7.

Then, description will be made of an embodiment of a tape feeding unit for feeding a tape to a veneer roll of the invention with reference to an embodiment shown in FIGS. 34 to 57.

Figure 34:
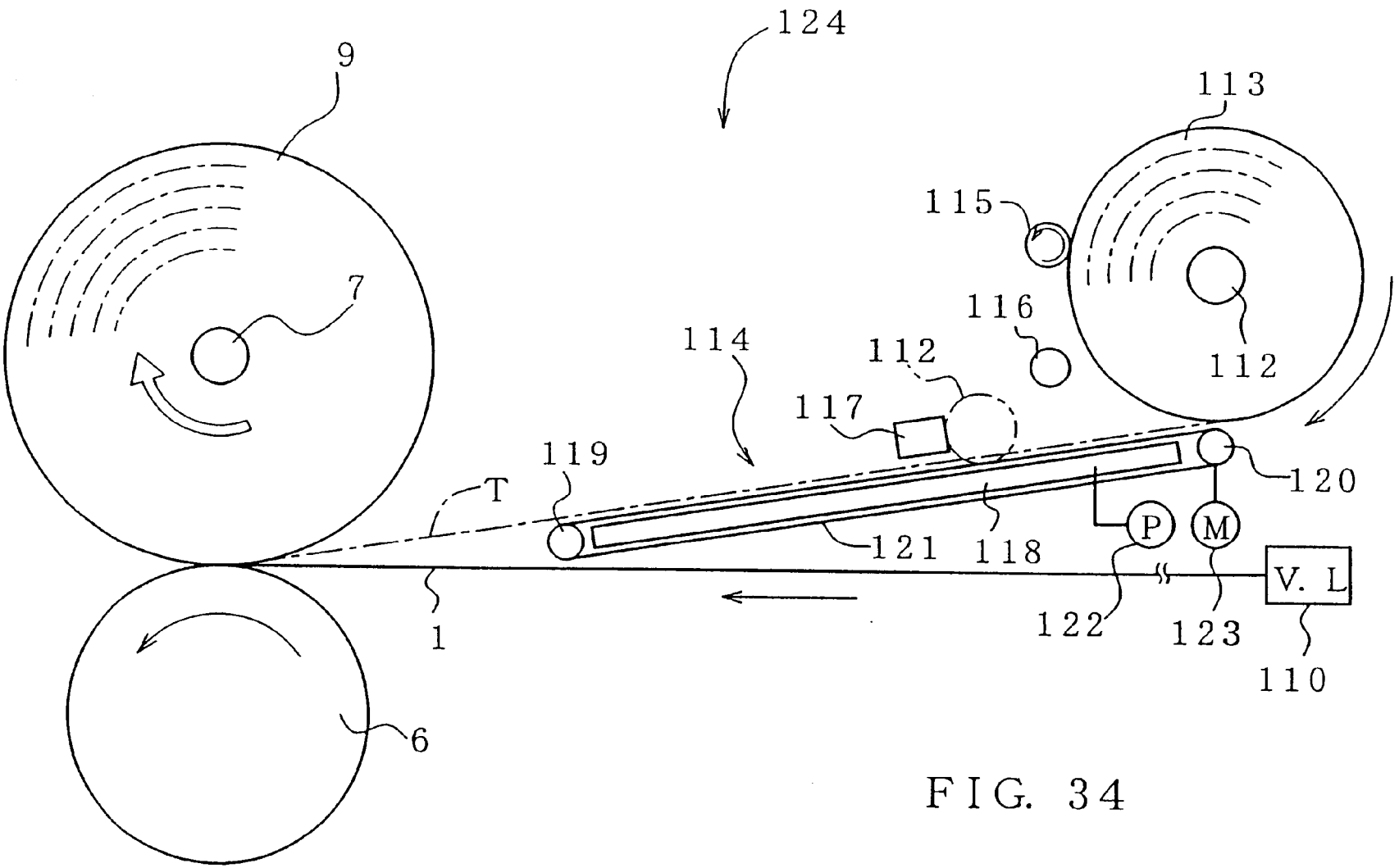
FIG. 34 is a side view conceptually showing a tape feeding unit.

In FIG. 34, there is shown a situation in which a veneer sheet 1 that is cut by a veneer lathe 110 and transported downstream therefrom is wound on a take-up reel 7 to form a veneer roll 9. A drive roller 6 is in contact with the circumferential surface (direct below the shaft of the take-up reel 7) of the veneer roll 9 and driving for winding the veneer sheet 1 on the take-up reel 7 is produced by a frictional force. Further, a tape T is stuck on a veneer sheet 1 in order to reinforce both ends of the veneer sheet 1 by inserting the tape T into between veneer sheets in winding operation.

The tape T is unwound from a feed source at an upstream position, that is a tape roll 113 wound on a core 112, fed to a veneer roll 9 side by means of a vacuum chuck conveyor (feed conveyor) 114 as transport means and wound on a veneer sheet 1. The tape T is fed as the tape is wound on the veneer sheet 1. That is, the tape roll 113 is pulled into the veneer roll 9 while keeping at a fixed position and thereby, rotated in a following manner at the fixed position. There are provided first and second roller stoppers 115 and 116 that idle as forward movement stopper members in order that the tape roll rotates for unwinding while blocking forward movement of the tape roll 113.

The roller stopper 115 is rotated in a slave manner by friction while being in contact with the outer surface of the tape roll 113 when the tape roll 113 is of a large diameter. The roller stopper 116 is rotated in a slave manner by friction while being in contact with the outer surface of the tape roll 113 when the tape roll 113 is of a small diameter. The roller stopper 116 is arranged below the roller stopper 115, a clearance (an exit section) is located still below the roller stopper 116 and when the tape roll 113 comes to have a diameter equal to less than a predetermined value, the tape roll 113 is passed through the clearance. The tape roll 113 of a small diameter that has passed through the clearance runs to a core stopper 117 located down stream from the roller stoppers 115 and 116 and a small amount of the-tape remaining on the core 112 is unwound to nothing thereon while being in contact with the core stopper 117. After the unwinding is completed, the core 112 is discharged sideways, which will detailed later.

The vacuum chuck conveyor 114 is equipped with a vacuum box (a negative pressure chamber) 118 that extends long along the transport direction of the tape T and an endless belt 121 capable of passing gas therethrough extends over pulleys 119 and 120 such that the endless belt 121 encloses the vacuum box 118. A negative pressure is created in the negative pressure chamber 118 by means of a vacuum pump 122 and a negative pressure acts on the tape T through holes for gas passage and the tape T is vacuum chucked on the upper surface of the belt 121. A circulation track on the belt 121 is moved, for example, by driving from a motor 123 connected to the pulley 120 from the tape roll 113 side to the veneer roll 9 side of a veneer sheet 1 and the tape T is unwound and fed from the tape roll 113.

Figure 35:
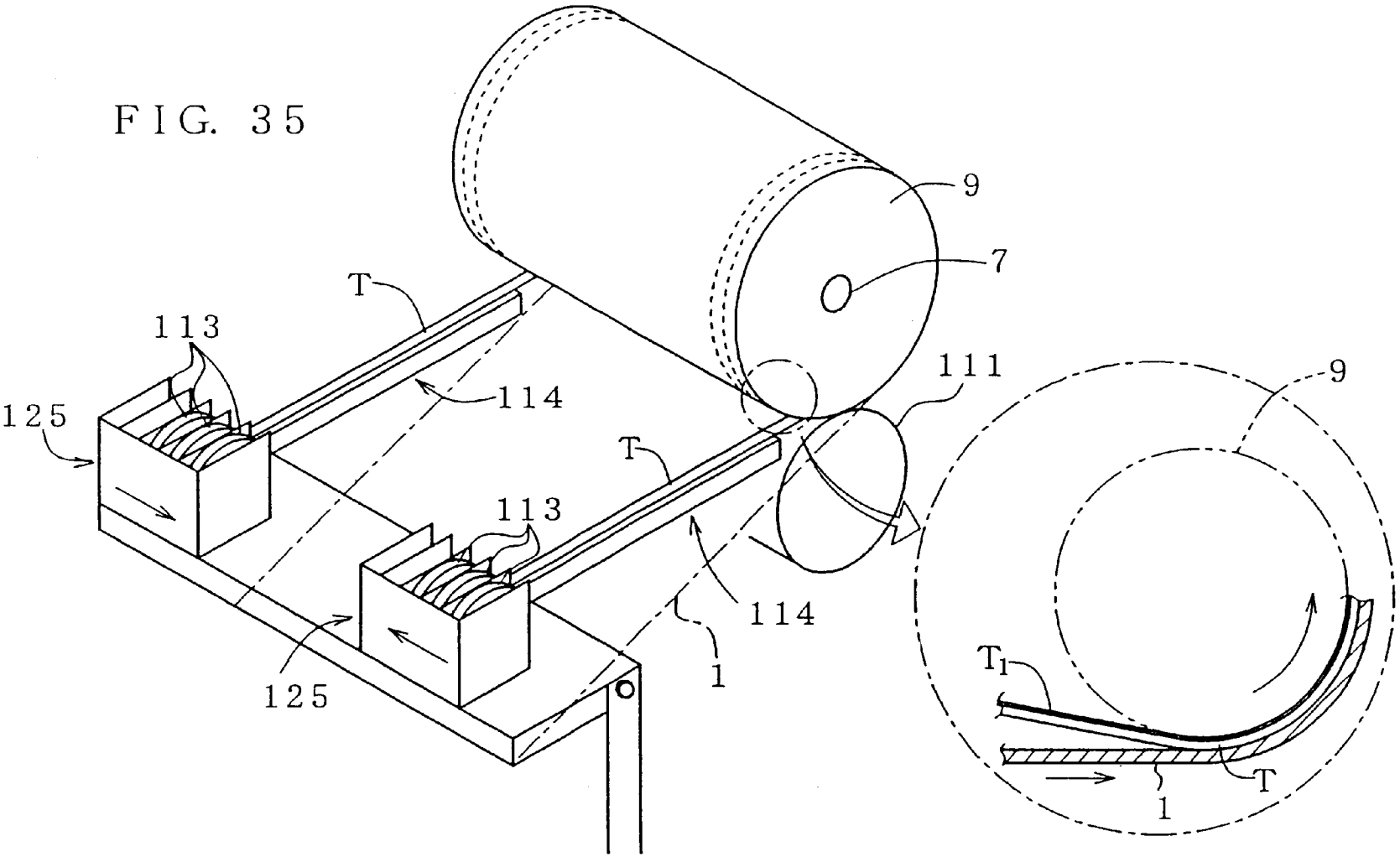
FIG. 35 is a perspective view showing a way of tape feeding.

Such tape feeding units 124 as a pair are provided, for example, so as to correspond to both ends of a veneer roll 9 as shown in FIG. 35. The tape T has, for example, an adhesive layer T1 on an upper surface thereof and the tape T is stuck on a veneer sheet 1 at both side ends thereof by the adhesive layer on the upper surface of the tape T in the course of winding the veneer sheet 1 on the take-up reel 7. Further, a material of the tape T is, for example, paper of a predetermined quality and so on.

A tape roll 113 as a feed source of a tape T is disposed at the upstream end of a vacuum chuck conveyor 114 and a plurality of tape rolls 113 are accommodated in tape racks 125. Two of the tape racks 125 are provided in corresponding manner to the two vacuum chuck conveyors 114 located on the left and right sides of the veneer roll 9, wherein structures of the left and right tape racks 125 are the same as each other. Description will be made of one of the two tape racks 125. The tape racks 125 are stepwise moved (in tact feed) inwardly from an initial position outward from both side surfaces of the veneer roll 9 at a predetermined pitch. Detailed description will be made of the table racks 125 later.

Figure 36:
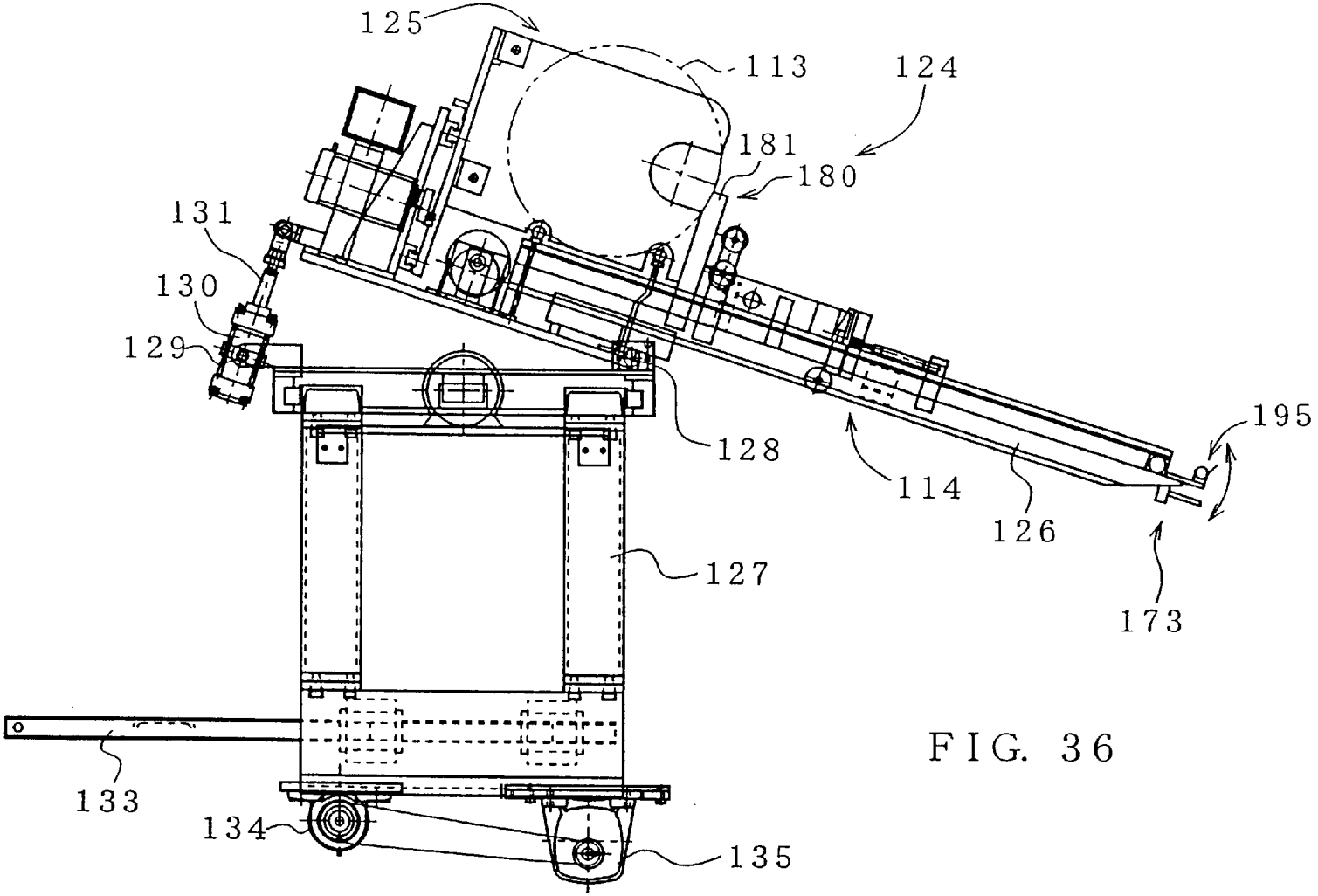
FIG. 36 is a further detailed side view showing the tape feeding unit of FIG. 34.

As shown in FIG. 36, a feed frame 126 supporting the vacuum chuck conveyor 114, the tape racks 125 and so on is connected to a base frame 127 so as to be swingable with a fulcrum shaft 128 extending in a horizontal direction, located in the middle of the feed frame 126 as a fulcrum. A piston rod 131 of cylinder 130 as an actuator swingably mounted on the base frame 127 through a shaft 129 is connected with back end side of the conveyor 114 of the feed frame 126 and the feed frame 126 is swingable as a whole through a predetermined angle in directions, upward or downward, in a vertical plane by contracting or stretching of the piston rod 131 of the cylinder 130. Such a movement is to increase a tension in the tape T when the tape is disconnected as will be described later.

The base frame 127 can move over a predetermined distance along guide rails 133 disposed in a horizontal direction. The base frame 127 further can self-propelled in a forward or backward direction by a driving force of a motor 134 with reduction gears 135 mounted on the base frame 127. With such a construction, the distal end of the vacuum chuck conveyor 114 can move to or away from the veneer roll 9.

Figure 37:
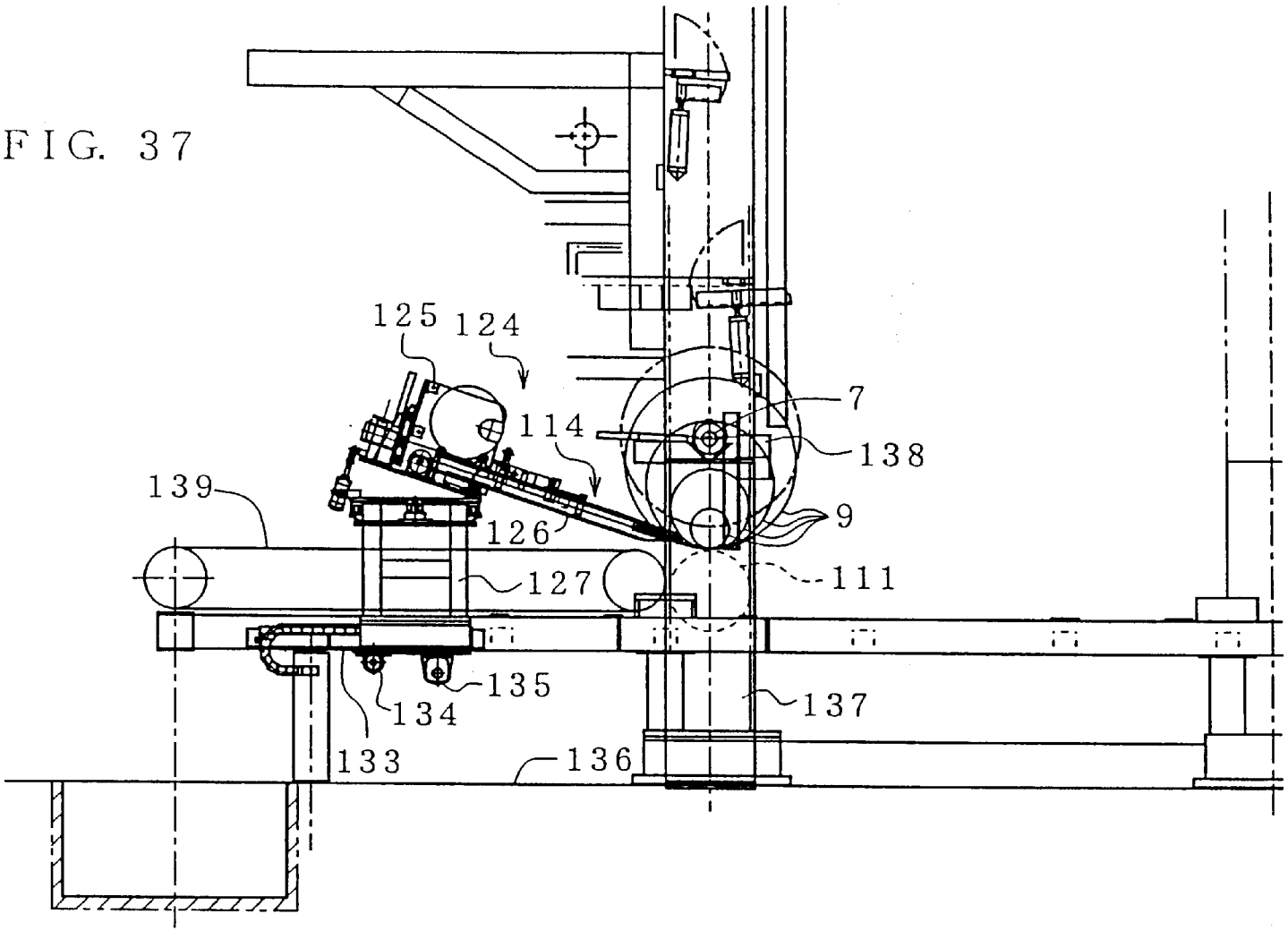
FIG. 37 is a side view showing FIG. 36 including peripheral structures thereof.

As shown in FIG. 37, a vertical frame 137 is erected from a floor surface 136, a take-up reel 7 located in the center of a veneer roll 9 is supported on an elevator 138 that is shiftable upward or downward along the vertical frame 137 and as a diameter of a veneer roll 9 increases, the elevator 138 is raised and in turn the take-up reel 7 is also raised. In addition to such a type in which as a diameter of a veneer roll 9 increases, the take-up reel 7 is shifted upwardly over a corresponding distance to increase in the diameter, Another type may be adopted, in which a position of the take-up reel 7 is fixed in a vertical direction and a drive roller 6 is lowered over a corresponding distance to increase in the diameter. In the latter case, a position of the distal end of the conveyor 114 of the tape feeding unit 124 may be kept constant in position independently form increase of diameter of a veneer roll 9. The veneer roll 9 whose diameter reaches a predetermined value is hung while supporting parts in the vicinity of bearings at both ends of the take-up reel 7 using suspension hooks(not shown) to transport to a reeling deck (not shown). A veneer sheet or sheets 1 that are eventually wound into a veneer roll 9 is transported in this scene from the veneer lathe side by means of a veneer sheet conveyor 139.

Figure 38:
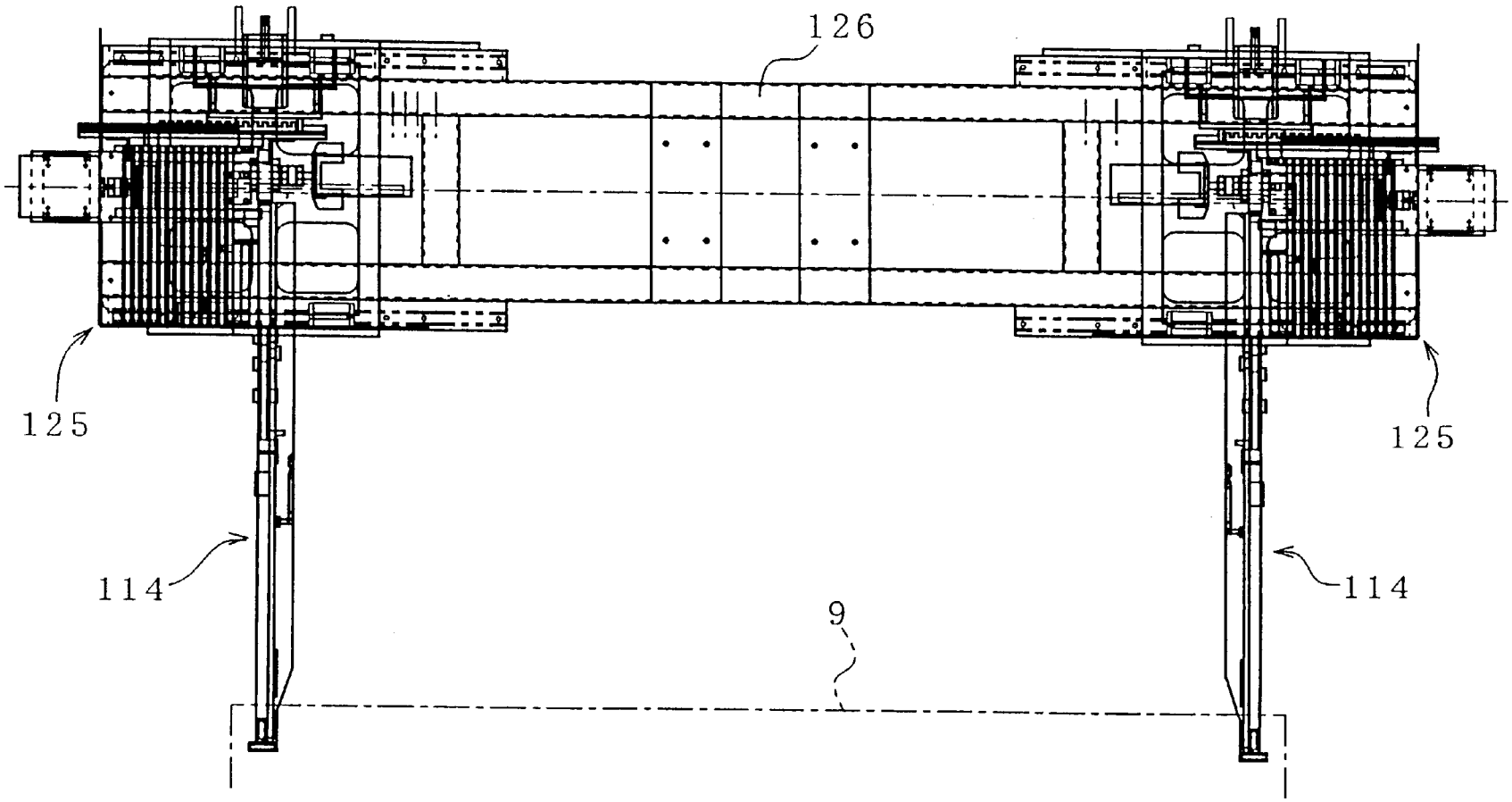
FIG. 38 is a plan view of FIG. 36.
Figure 39:
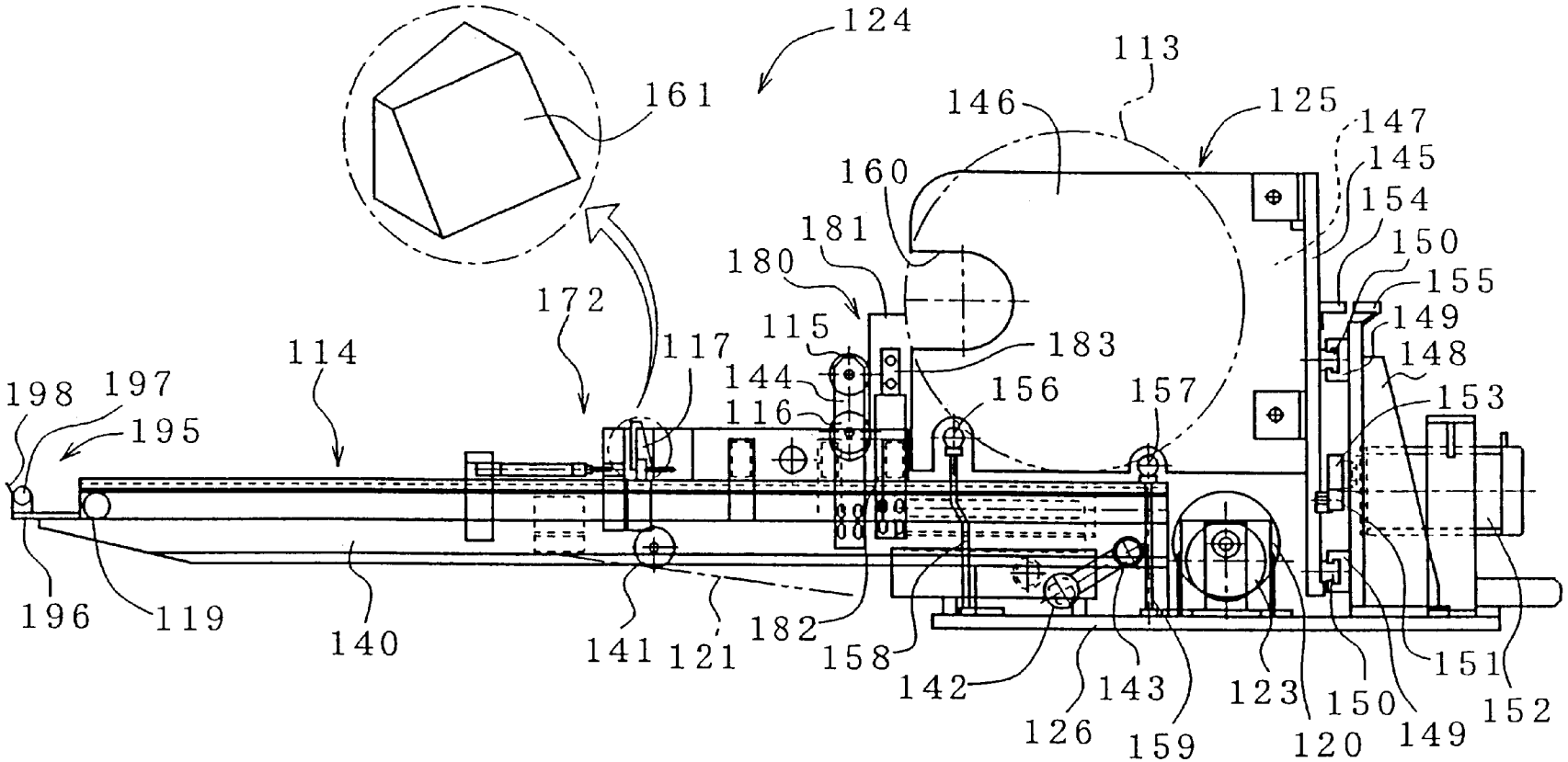
FIG. 39 is a side view showing a tape feeding unit singly in which the base frame of FIG. 36 is omitted.

FIG. 38 is a plan view of a part of the tape feed unit 124 in which the feed frame 126 is connected between the vacuum chuck conveyors 114 and the tape racks 125 as a cross member (in a direction perpendicular to a tape feed direction). One half (left or right half) of the tape feed unit 124 is shown in an enlarged side view of FIG. 39 and in a plan view of FIG. 40. As shown in FIG. 39, a conveyor frame 140 of the conveyor 114 constitutes part of the feed frame 126, its protruded from the body (126) as a cross member in a forward direction and is integrally combined with the body (the cross member). While the belt 121 of the conveyor 114 has the pulleys 119 and 120 at both ends in a longitudinal direction thereof and returns at the both ends, a guide roller 141 and a tension increasing roller 142 are provided between the both pulleys 119 and 120. The conveyor 114 can be swingable about the shaft 143.

The motor 123 is connected to the pulley 120 on the upstream side and the belt 121 is driven for circulation by the motor 123. A tape rack 125 is located above the end portion on the upstream side of the circulation track of the belt 121 and the first and second roller stoppers 115 and 116 are disposed above the belt 121 in an adjacent manner to the tape rack 125 downstream therefrom. The roller stoppers 115 and 116 are freely rotatably supported by the stopper frame 144 erected from the conveyor frame 140 such that the roller stoppers 115 and 116 are arranged in a vertical direction in a predetermined spatial interval. Positions of the roller stoppers 115 and 116 can be adjusted at least in a direction upward or downward (if a need arises, in a length direction of the conveyor) by adjusting the stopper frame 144 in position relative to the conveyor frame 140.

A tape roll rotation stop device 180 is disposed in the upstream side from the roller stoppers 115 and 116, that is between the tape rack 125 and the roller stoppers 115 and 116 on the circulation track of the belt 121. That is, as shown in FIGS. 39, 41, 51, 52 and 53, a receiving member 181 is attached to the conveyor frame 140 so as to vertically erect therefrom on one side of the belt 121 in an intersecting direction of a circulation direction of the belt 121 and a support frame 182 is attached to the conveyor frame 140 on the other side thereof so as to vertically erect therefrom. A cylinder 183 as an actuator is mounted on the support frame 182 and a press member 185 is connected to the fore-end of the piston rod 184, wherein a tape roll 113 on the belt 121 whose forward movement is blocked by the roller stoppers 115 and 116 is pressed on one side thereof by the press member 185 that is movable in a press action.

Figure 54:
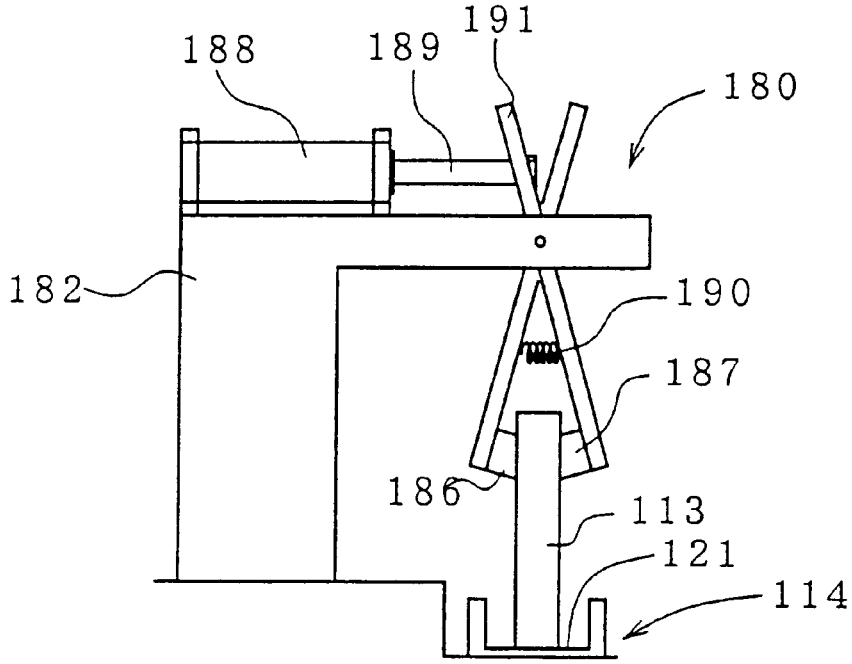
FIG. 54 is a conceptual plan view showing another embodiment of a tape rotation stop device.

Further, the tape roll rotation stop device 180, in addition to the above described way, can be in a configuration in which a pair of pinching members 186 and 187 that can open from or close to both sides of the upper portion of a tape roll 113 is used at an upstream position from the roller stoppers 115 and 116 as shown in FIG. 54. That is, the support frame 182 is put up on the conveyor frame 140 so as to be erected upward from the conveyor frame 140 and a cylinder 188 as an actuator is mounted on the support frame 182. On the other hand, the pair of the pinching members 186 and 187 that are normally closed in an engaging manner by a torsion coil spring 190 is supported in a suspension state from the support frame 182. A support section 191 of one 187 of the pinching members 186 and 187 is connected to the fore-end of a piston rod 189 of the cylinder 188. When a tape T is unwound from a tape roll 113 on the belt 121 which is blocked in forward movement by the roller stoppers 115 and 116, the pair of pinching members 186 and 187 comes into an open state by action of the cylinder 188, while when rotation of the tape roll 113 is stopped, the pair of pinching members 186 and 187 is closed by canceling the action of the cylinder 188.

Figure 55:
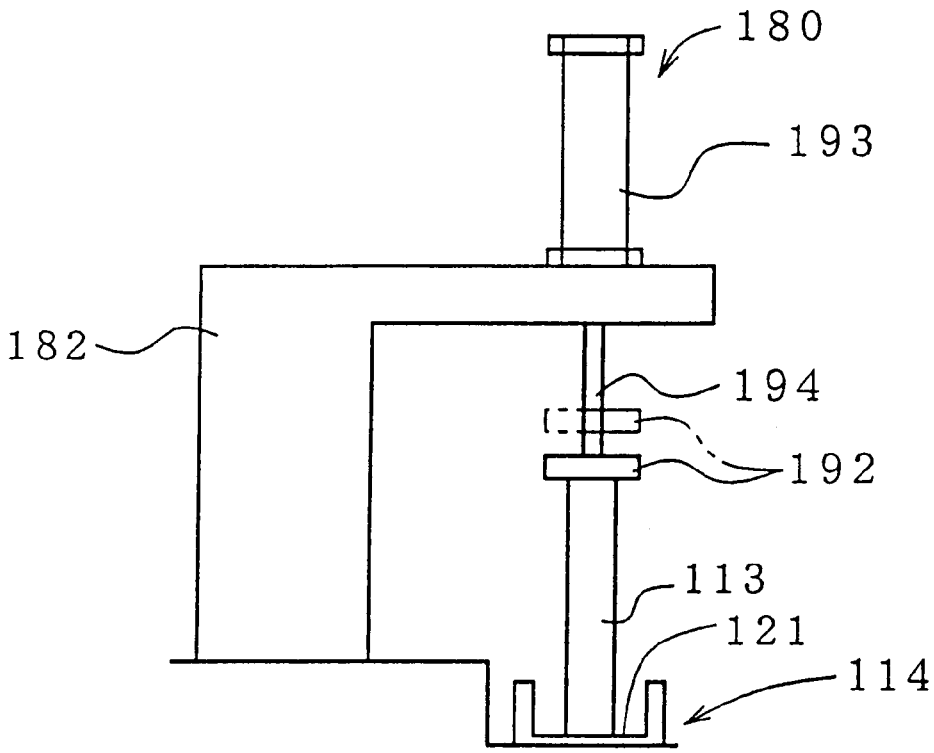
FIG. 55 is a conceptual plan view showing another embodiment of a tape rotation stop device.

Further, the tape roll rotation stop device 180, still in addition to the above described ways, can be in a configuration in which a press member 192 as the tape roll rotation stop device 180 is put into contact with the top surface of a tape roll 113 or separated away from the top surface thereof, wherein the press member 192 with a waiting position above a tape roll 113 is at the upstream position from the roller stoppers 115 and 116 as shown in FIG. 55. That is, a cylinder 193 as an actuator is mounted on the support frame 182 and the press member 192 is connected to the fore-end of a piston rod of the cylinder 193. The press member 192 can in a reciprocating manner move between a position where the press member 192 does not interfere with rotation of the tape roll 113 and a position where the press member 192 is put into contact with the top surface of the tape roll 113, thereby enabling stoppage of the tape roll 113.

Figure 41:
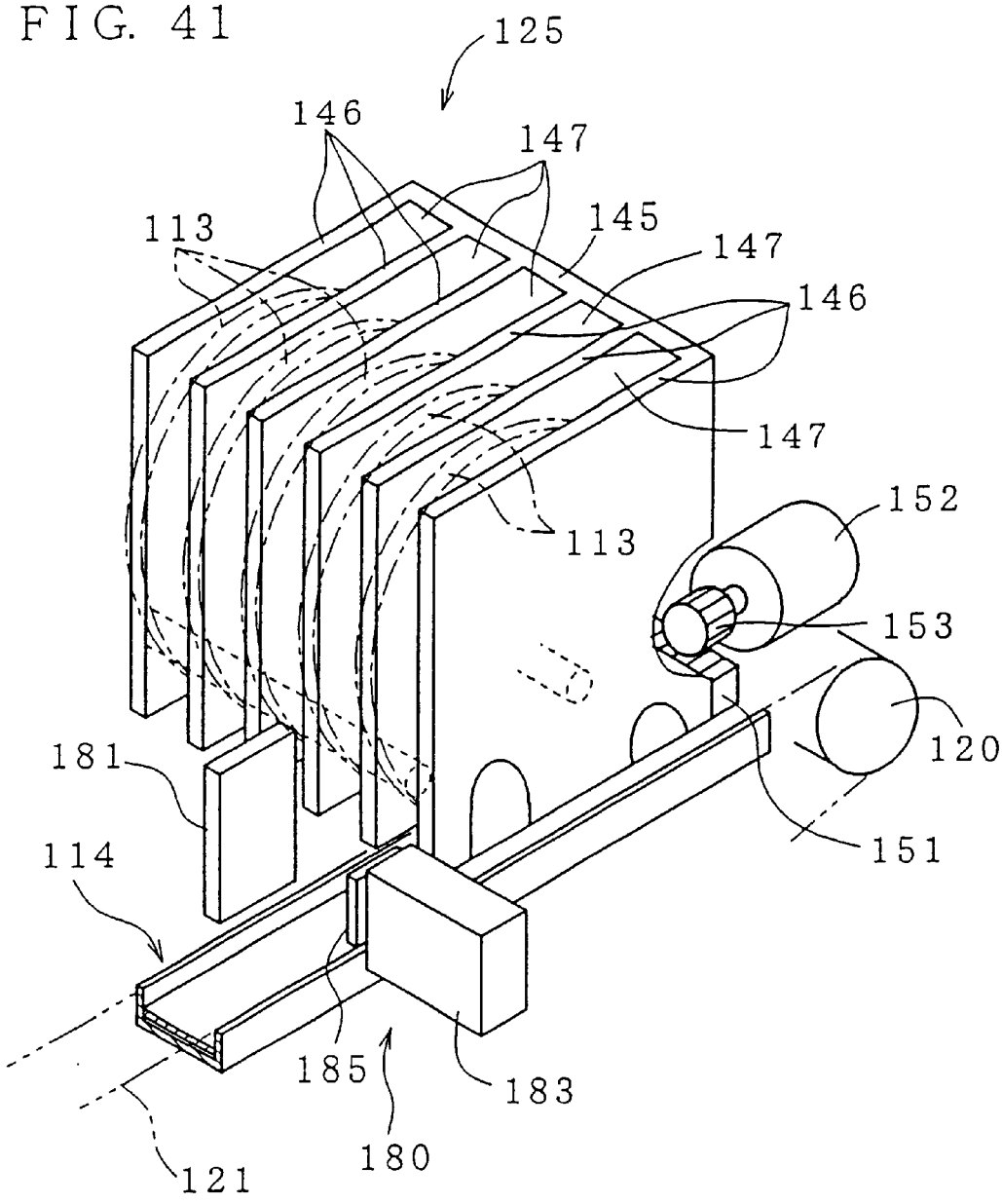
FIG. 41 is a conceptual perspective view of a tape rack and a tape roll rotation stop device.

The tape rack 125, as shown in FIG. 41, comprises: a back plate 145 constituting a back section; and partition plates 146 as a plurality of partition wall sections integrally connected with the back plate 145 and spaces between the partition plates 146 are a plurality of tape housing rooms 147. Such a tape rack 125 has not only an open front side but also an open bottom side. In this example, an top side is further open, but the top side may be closed. Further, as shown in FIG. 39, an upright frame 148 is fixed to the feed frame 126 at a position backward from the tape rack 125 and rail engaging sections 150 formed on a back plate 145 of the tape rack 125 are mated, in a slidable manner, with a pair of guide rails 149 provided in parallel to each other in a predetermined spatial interval one above the other on the upright frame 148. With such a configuration, the tape rack 125 is supported in a movable manner in a direction perpendicular to the transport direction of the vacuum chuck conveyor 114 above the belt 121 in the upstream side end section thereof.

Figure 40:
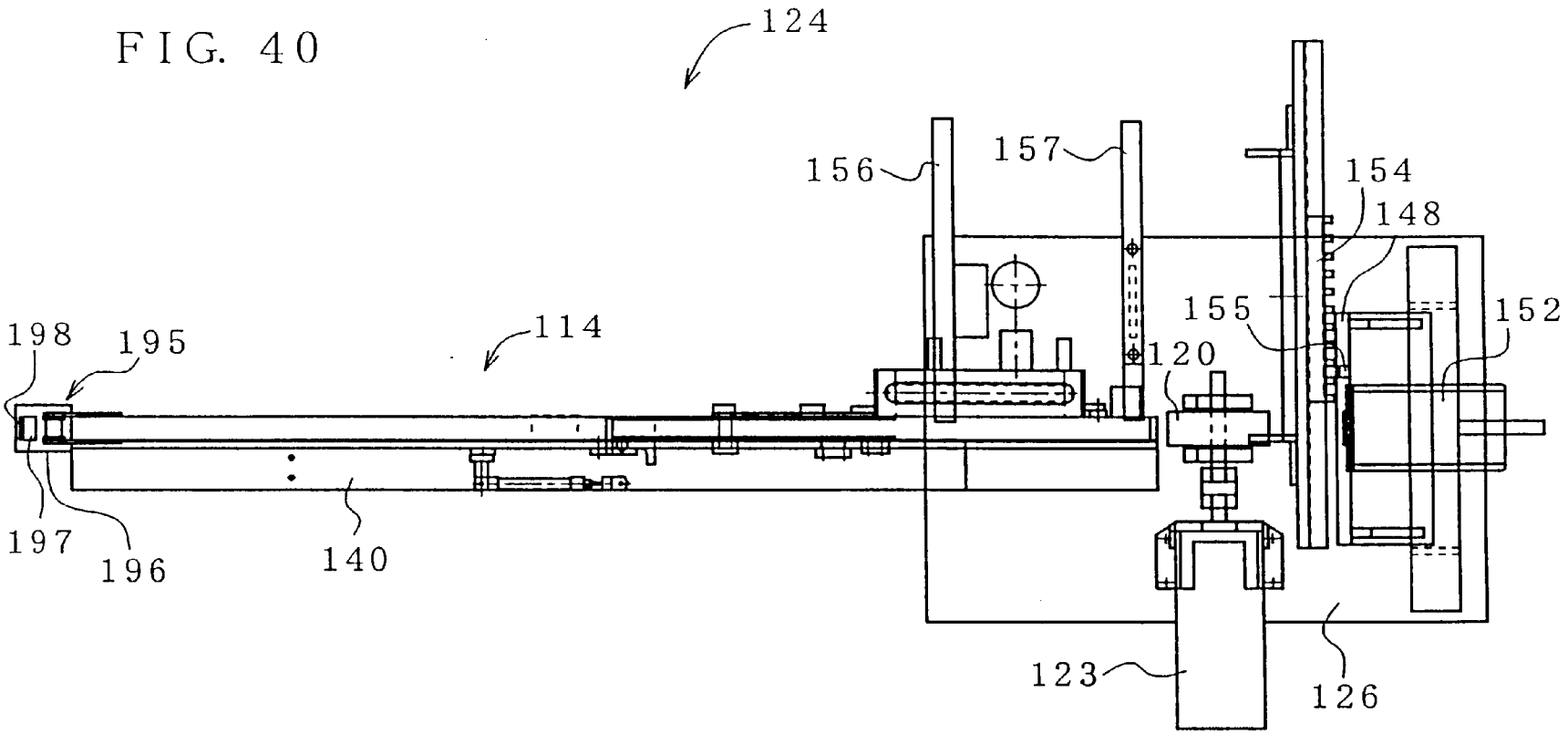
FIG. 40 is a plan view of FIG. 39, in which a tape rack is omitted.

A rack gear 151 is fixed between the pair of rail engaging sections 150 of the back plate 145 in a horizontal direction and a pinion gear 153 of a tact feed motor 152 fixed on the upright frame 148 is mated with the rack gear 151. The tact feed motor 152 functions as an intermittent feed device for the tape rack 125 and intermittently moves the tape rack 125 at a pitch of tape housing rooms 147 (in other words, a pitch of partition plates 146) in a lateral direction. In order to determine a position of the tape rack 125 in the movement, as shown in FIG. 40, a movement detecting section 154 in a comb shape is provided along a moving direction on the tape rack side while a proximity switch 155 is provided on the side of the upright flame 148, wherein the proximity switch 155 detects a movement of the one pitch of the tape rack 125 and sends a detection signal to a control section of a motor to stop. It should be appreciated that the back plate 145 may be removed to open the back section of the tape housing rooms 147. In this case, the rack gear 151 can be located in any position as far as the rack gear 151 is in an integral relation with a partition plate 146.

It should further be appreciated that in a case where the tact feed motor 152 is a pulse motor (step motor), movement and positioning of the tape rack 125 can be determined by counting the number of pulses. Further, determination of a position of the tape rack 125 and detection of the position can also be performed using a signal of a rotary encoder, a signal from a magnescale or the like that is connected to the pulse motor. In those cases, the movement detecting section 154 and the proximity switch 155 can be removed. It should be appreciated that FIG. 40 shows a plan view of a state in which the tape rack 125 is omitted.

In FIG. 39, since the lower side of the tape rack 125 is open, a tape roll 113 in a tape housing room 147 is supported spaced from a surface of the belt 121 of the vacuum chuck conveyor 114. Therefore, two guide bars 156 and 157 are disposed at a predetermined spatial interval almost in a horizontal direction along a moving direction (a direction perpendicular to the conveyor 114) of the tape rack 125. The guide bars 156 and 157 are located at a height slightly above a belt surface in the upstream side end section of the conveyor 114 by means of support members 158 and 159 upwardly erected from the feed frame 126 and as shown in FIG. 40, the guide bars 156 and 157 respectively have one ends located at points just before intersections between the belt conveyor 114 and extensions of the guide bars 156 and 157 with the other ends outside the conveyor 114.

In FIG. 39, when the tape rack 125 moves in a direction perpendicular to the sheet on which the figure is drawn, since a tape roll 113 in a tape housing room 147 is received by the guide bars 156 and 157 at the lower end portion thereof and supported at a height above the conveyor 114, the tape roll 113 is guided to approach the conveyor 114 sideways while being in contact with the guide bars 156 and 157.

In FIG. 39, a cut-way 160, for example in a U-like shape or others, which opening gets started from the front end edge and proceeds toward the back end, is formed in the front portion of a partition plate 146 of the tape rack 125. This cut-away is formed, for example, in order to facilitate insertion of a tape roll 113 by a worker into a tape housing room 147 of the tape rack 125 one at a time, or in order to facilitate taking-out of a tape roll 113 by a worker from a housing room 147 of the tape rack 125 when a tape roll 113 is required to be taken out for some reason. In FIG. 41, the cut-away is omitted.

Figure 42:
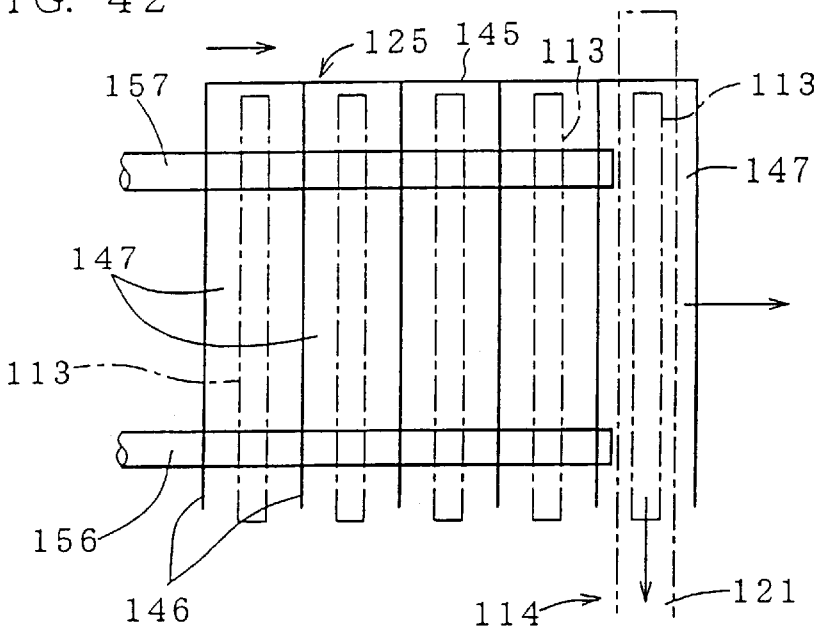
FIG. 42 is a plan view of FIG. 41, in which a tape roll rotation stop device is omitted.

As shown in FIG. 42, tape rolls 113 are accommodated in tape housing rooms of a tape rack 125 each in a standing position and the tape rolls 113 are supported by the guide bars 156 and 157. The housing rooms 147 of the tape rack 125 are moved so as to be positioned on the belt 121 of the vacuum chuck conveyor 114 sequentially from one end thereof (in the figure, the right end) with a spatial interval of tape rolls 113 thus accommodated as a pitch.

Since the guide bars 156 and 157 run to a point just before intersections between extensions of the guide bars 156 and 157 and the belt 121, a tape roll 113 that have moved onto the belt 121 rests on the belt 121 by stepping down from the guide bars 156 and 157. Since the belt 121 has a down slope toward downstream and also driven in a direction toward downstream, a tape roll 113 resting on the belt 121 automatically moves toward downstream, but there are the first and second roller stoppers 115 and 116 as the forward movement stoppers as described above, wherein when the tape roll 113 is of a large diameter, a forward movement of the tape roll 113 is first blocked by the roller stopper 115.

In this situation, the tape roll 113 is not released from the tape rack 125 but more than one half thereof still remains in a tape housing room 147. Hence, in a state of FIG. 43, when the tape roll 113 gets started with unwinding, two partition plates 146 are present on both sides of the tape roll 113 and the two partition plates works as sideways control members to prevent the tape roll 113 from falling sideways. Therefore, the tape roll 113 does not fall sideways and at the same time, can rotate and unwind in the tape housing room 147.

That is, partition plates 146 of the tape rack 125 function not only as members forming spaces for accommodate tape rolls 113, but as sideways control members to prevent falling sideways of a tape roll 113. In such a way, a partition plate 146 exerts two functions, which in turn, makes a structure of the tape rack 125 simple. Further, while a tape roll 113 has a pressure-sensitive adhesive layer normally on all its inner surface, there is a part of the inner surface at the starting end with no pressure-sensitive adhesive layer, the part is vacuum chucked on the belt 121 and thereby, unwinding can smoothly get started. When unwinding of one tape roll 113 is finished, the tape rack 125 is moved by one pitch and the next tape roll 113 is brought onto the belt 121 of the conveyor 114 similar to the preceding tape roll 113, thereafter followed by procedures similar to the above described way.

Figure 43:
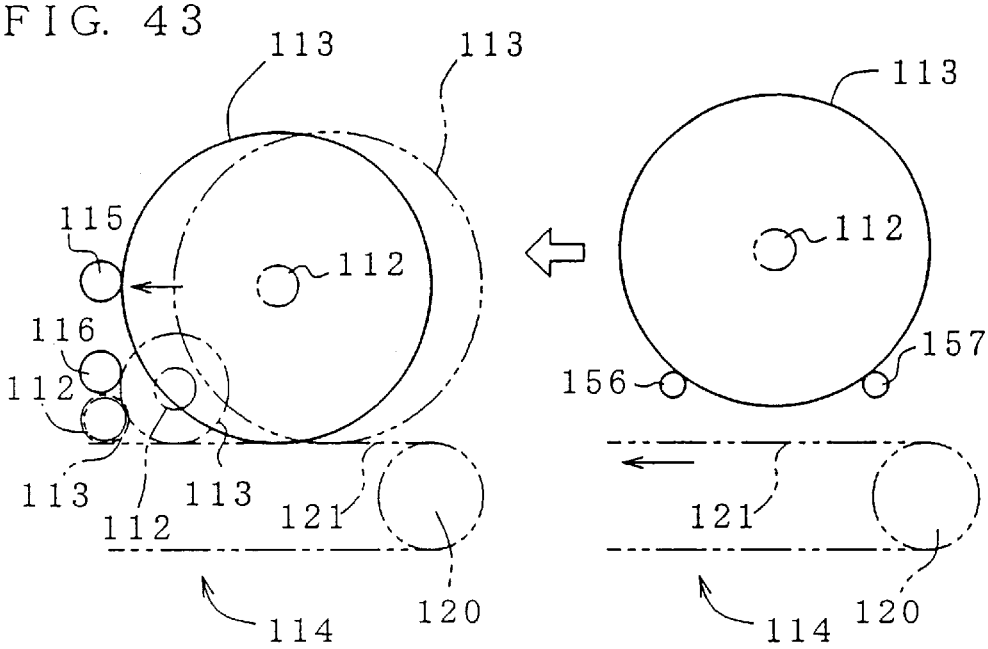
FIG. 43 is a view for illustration showing feeding of a tape roll onto a conveyor and a forward movement roller stopper.

As shown in FIG. 43, description is made above such that there is a clearance of a height slightly larger than a diameter of a core 112 of a tape roll 113 between the roller stopper 116 in the lower side and the upper surface of the belt 121. When process reaches a time point that unwinding of a tape roll 113 is close to finish, the rest of the tape roll 113 with a residual tape passes under the roller stopper 116 to run toward down stream. The core stopper 117 (see FIG. 34), which is located at a position spaced apart from roller stopper 116 downstream, is provided as a stopper at a higher position above the belt 121. Therefore, after the tape roll 113 with some length of the tape remaining on the core hits the core stopper 117, the remaining tape T is unwound from the core 112 to nothing thereon while being rotated. It should be appreciated that at this point, another new tape roll 113 waits its turn in the rear and therefore, a tape unwound from the new tape roll 113 and a final part of the tape unwound from the tape roll 113 with a short length of the tape remaining on its core 112 are fed temporarily in a simultaneous manner.

Figure 44:
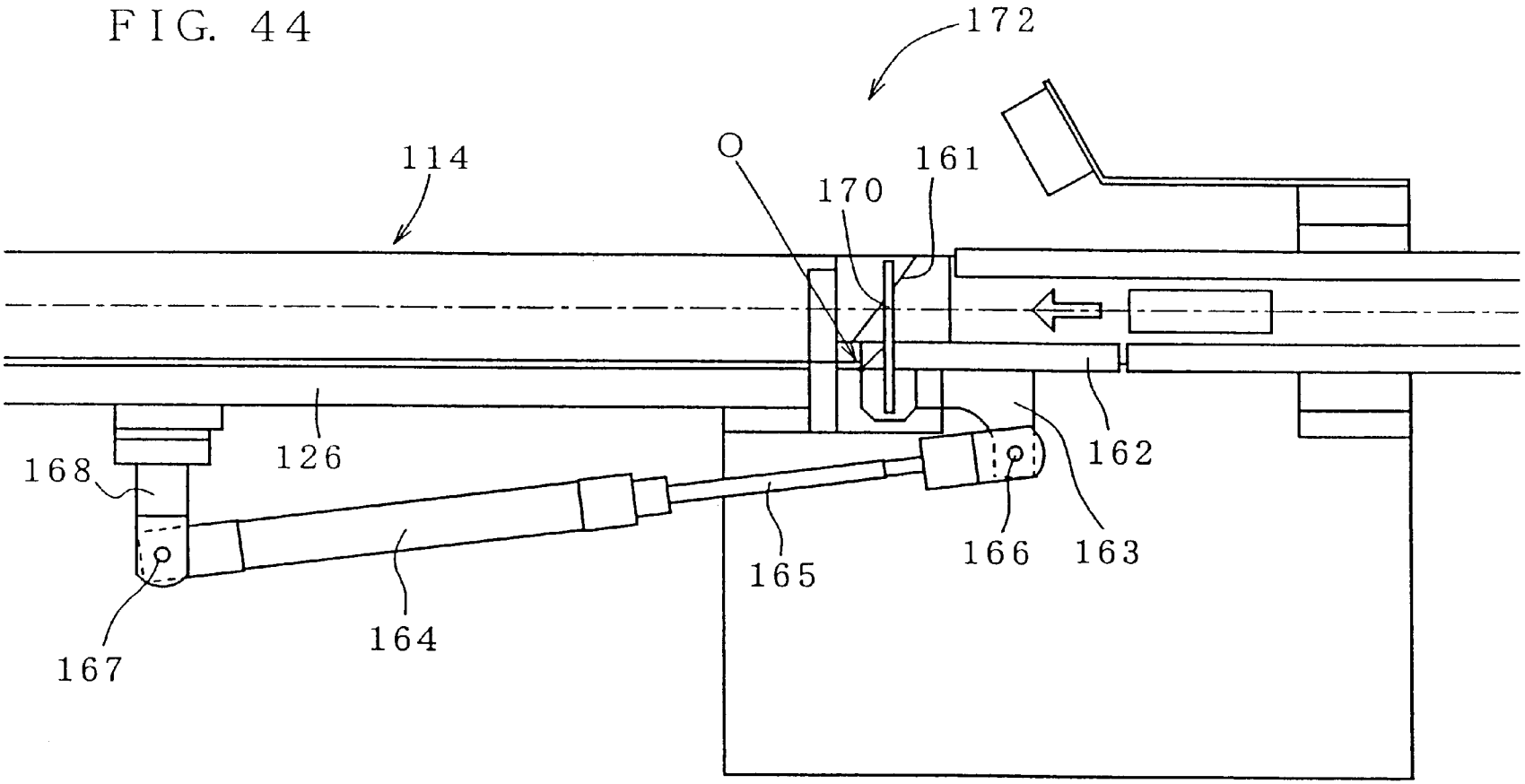
FIG. 44 is a plan view showing an example of a core discharge unit.

A stopper surface 161 of the core stopper 117 has a three-dimensional inclination and faces not only upstream with a slope but opens sideways. Hence, a core 112 that hits the stopper surface 161 is blocked in its advancement downstream and at the same time receives a force sideways as if by an action of a cam surface. Around the core stopper 117, as shown in FIG. 44, a door 162 is provided such that it can open or close sideways with a axial line 0 extending almost vertically from upward to downward as a fulcrum. A piston rod 165 of a cylinder 164 as opening/closing drive means is connected to the door 162 with a bracket 163 interposed therebetween and a base end of the cylinder 164 is fixed at a side surface of the feed frame 126 with the help of a pin 167 and the bracket 168.

Figure 45:
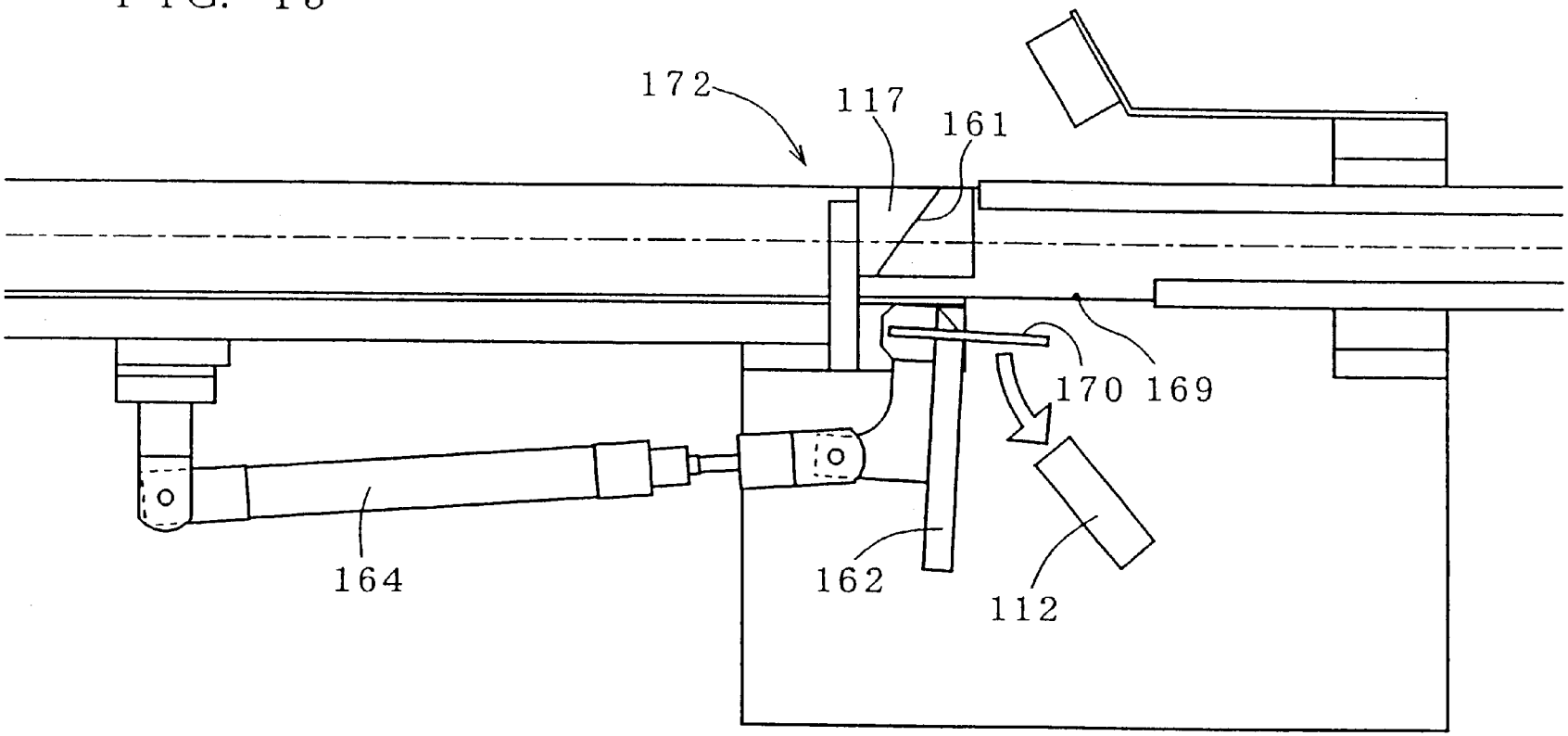
FIG. 45 is a plan view showing a state where a door is open.

Further, as shown in FIG. 45, when the piston 165 retreats into the cylinder 164, the door 162 opens sideways to form an opening 169 to the side toward which the stopper surface 161 of the core stopper 117 faces. Since the core 112 receives a lateral force directing sideways from the stopper surface 161, it can be discharged in the direction through the opening 169. In the embodiment, in order to ensure the discharge sideways of the core 112, a catching bar 170 is provided to the door 162 as a discharge member to be used for forcibly discharging the core 112 while catching. The catching bar 170 is fixed to the door 162 at almost a right angle such that it extends from the door 162 at a height above the upper surface of the belt 121 of the conveyor 114. The catching bar 170 has a shape such that when the core 112 comes to the stopper surface 161 under the catching bar 170, the fore-end of the catching bar 170 further extends beyond the distal end of the core 112 and then is bent downward to form a hook portion 171 (see FIG. 46). When the door 162 opens, the hook portion 171 of the catching bar 170 catches the distal end of the core 112 and discharges the core 112 sideways while turning laterally, following swing movement of the door 162.

With such a mechanism, since the core 112 does not remain but can automatically be removed, a continuous feed of a tape T can be ensured with ease. In the embodiment, as described above, a core discharge unit 172 is constructed of the stopper surface 161, the door 162, the catching bar 170 and the cylinder 164 that works in opening and closing the door 162.

Figure 47:
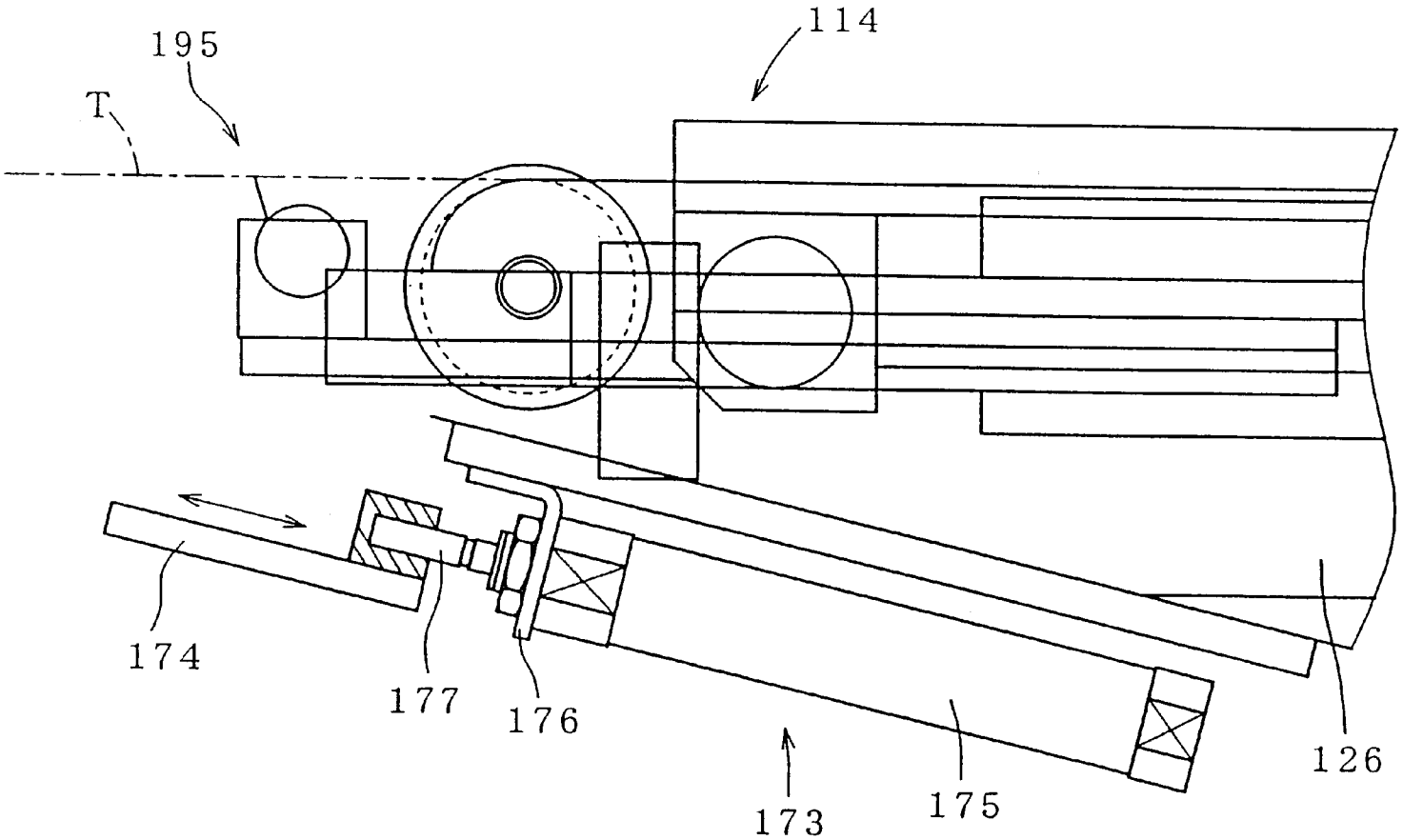
FIG. 47 is a side view showing an example of a tape twist preventive mechanism at the distal end of a conveyor.
Figure 48:
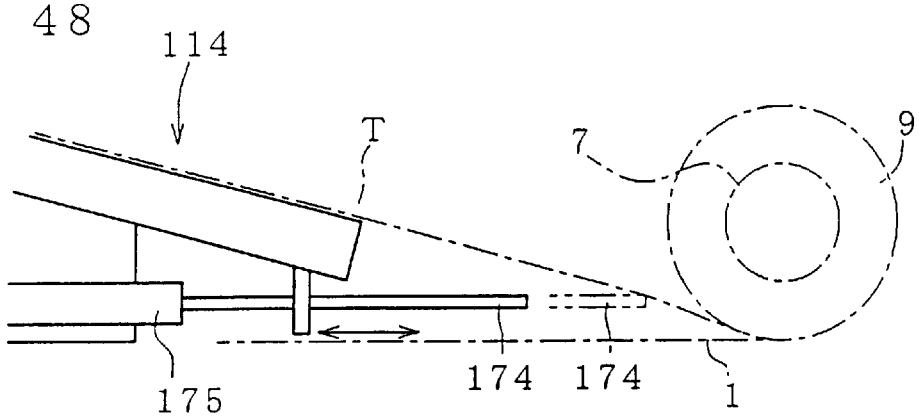
FIG. 48 is a view for illustration of action of the tape twist preventive mechanism.

As shown in FIG. 36, a tape twist preventive mechanism 173 is provided at the distal end of the conveyor 114 to feed a tape T and the mechanism 173 prevents the tape from being twisted (upside down) in the course of taking into between veneer sheets. In the twist preventive mechanism 173, a spatula-like member 174 protrudes such that the fore-end thereof intersects the running route of the tape T that is taken into between veneer sheets at an acute angle as shown in FIG. 47, wherein the intersection is realized in a spatially relative way. Further, the base end of the spatula-like member 174 is fast held at a piston rod 177 of a cylinder 175 as a moving means for the base end of the spatula-like member 174. The cylinder 175 is fixed on the lower side of the feed conveyor 126 with a bracket 176 interposed therebetween. As shown in FIG. 48, the spatula-like member 174 touches the lower surface of the running tape T while positioning above a veneer sheet 1 fed from the veneer lathe side described above to control an angle of the running tape T in a lateral direction of the tape T.

Figure 49:
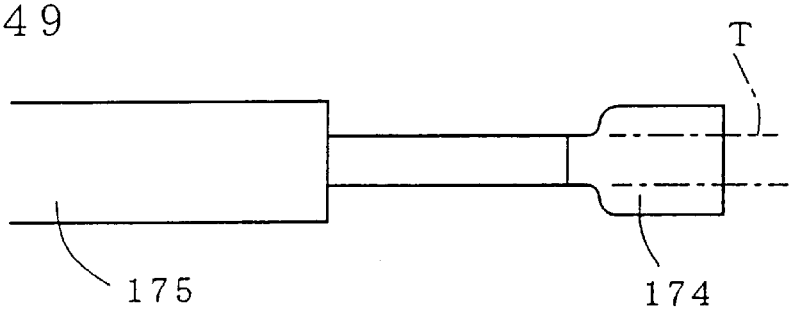
FIG. 49 is a plan view of the tape twist preventive mechanism.
Figure 50:
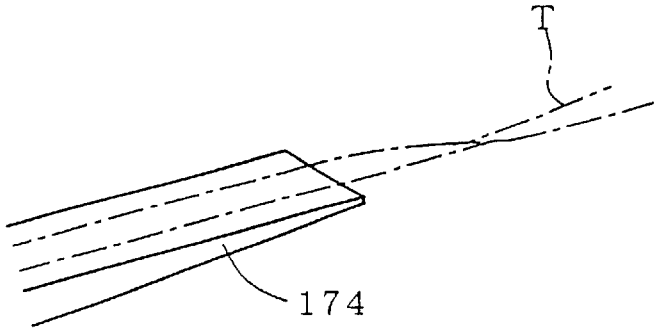
FIG. 50 is a view for illustration of a state where a twist of a tape is corrected.

FIG. 49 shows an example of the spatula-like member 174 as viewed above and the member has a contact surface of a plate with a width more or less larger than that of the tape. FIG. 50 shows a state in which the spatula-like member 174 functions such that the spatula-like member 174 pushes up the tape onto the lower surface to correct a twist of the tape T.

Figure 56:
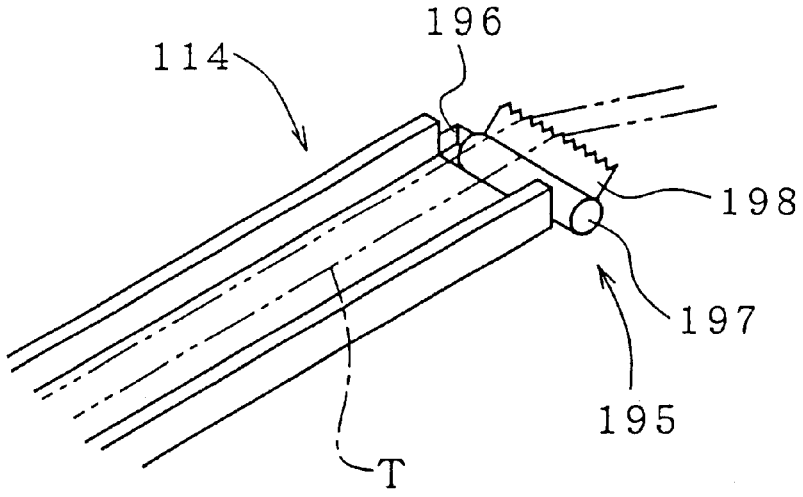
FIG. 56 is a perspective view conceptually showing a tape cutting unit.

As shown in FIGS. 39 and 40, a tape cutting unit 195 is provided at the distal end of the conveyor 114 for feeding. The tape cutting unit 195 comprises: a bracket 196 protruding from the distal end of the conveyor frame 140 for the feed conveyor 114; a support member 197 fixed to the bracket 196; and a tape cutting tool 198 held by the support member 197. The tape cutting tool 198 has a cutting section extending in a direction intersecting the tape feed direction. As shown in FIG. 56, the cutting section is formed such that the top portion has protrusions, preferably sawteeth. The cutting section touches the tape surface with the sawteeth in a sliding manner.

Figure 57:
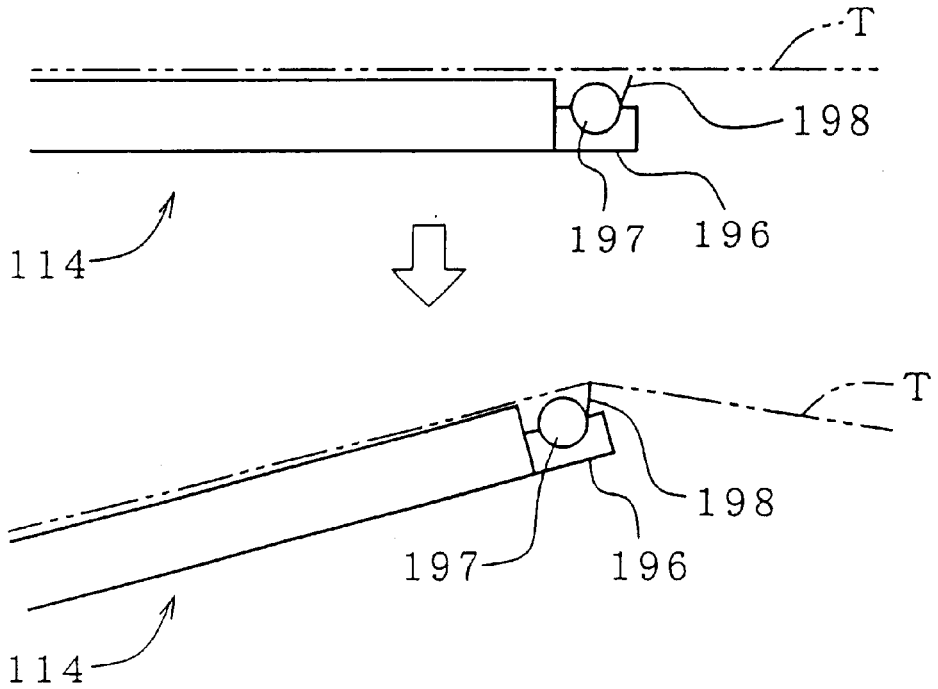
FIG. 57 is a view for illustration of action of a mechanism that gives an increased tension to a tape in tape cutting.
Figure 58:
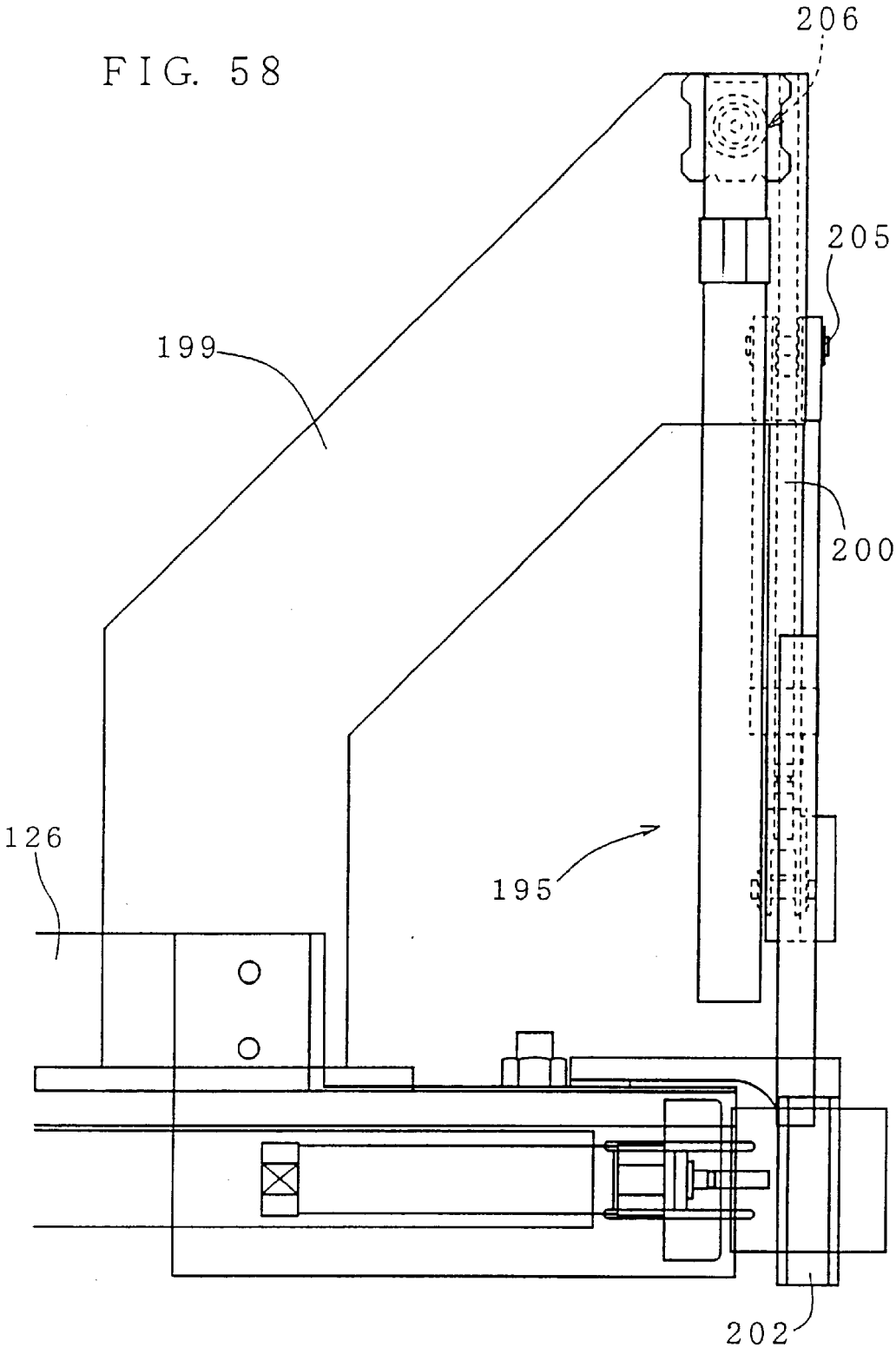
FIG. 58 is a bottom view showing another embodiment of a tape cutting unit at the distal end of a conveyor.

In the tape cutting, as shown in FIG. 57, the conveyor 114 is swung upwardly about the fulcrum axis 128 that shown in FIG. 36 as a fulcrum by the action of the cylinder 130 through a predetermined angle such that the tape cutting tool 198 is at least raised and the cutting section thereof is put into sliding contact with the lower surface of the tape. With this swing of the conveyor 114, as shown in FIG. 57, the tape T receives a tension larger than in a normal condition.

Figure 59:
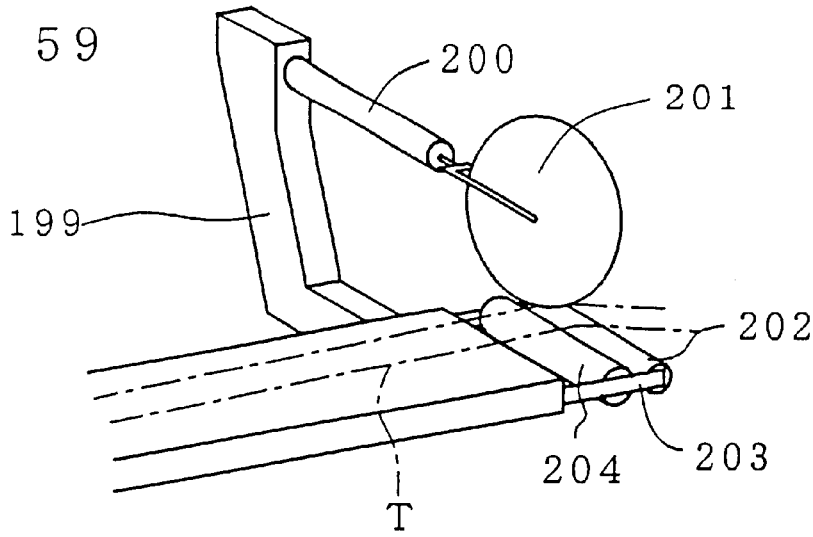
FIG. 59 is a perspective view conceptually showing the tape cutting unit of FIG. 58.

Further, the tape cutting unit 195 can assume a configuration as shown in FIGS. 58 to 63. That is, a tape cutting unit 195, as shown in FIG. 59, comprises: a bracket 199 that protrudes sideways from the feed frame 126; a cylinder 200 for moving a tape cutter 201, fixed to the bracket 199; the tape cutter 201 (of a disk shape in this case, hereinafter referred to as cutter) connected to a piston rod of the cylinder 200; and a tape receiving member 202 that is used to pinch and cut the tape T with cooperation of the disk-like cutter 201 in the vicinity of the cutter 201 such that the tape T does not escape from the cutter 201. In the example, the tape receiving member 202 has a shape of a cylindrical shaft and is fixedly held by bracket 203 at the distal end of the feed frame 126 (the distal end of the conveyor 114) in a direction perpendicular to the tape feed direction at a position very close to the tape running route. Further, there is provided a guide roller 204 that freely rotates and guides running of the tape T in idling contact with the lower surface of the tape T at the tip of the distal end of the conveyor 114 upstream from the tape receiving member 202 in an adjacent manner thereto (at a directly forward position of, upstream from the tape receiving member 202).

Figure 60:
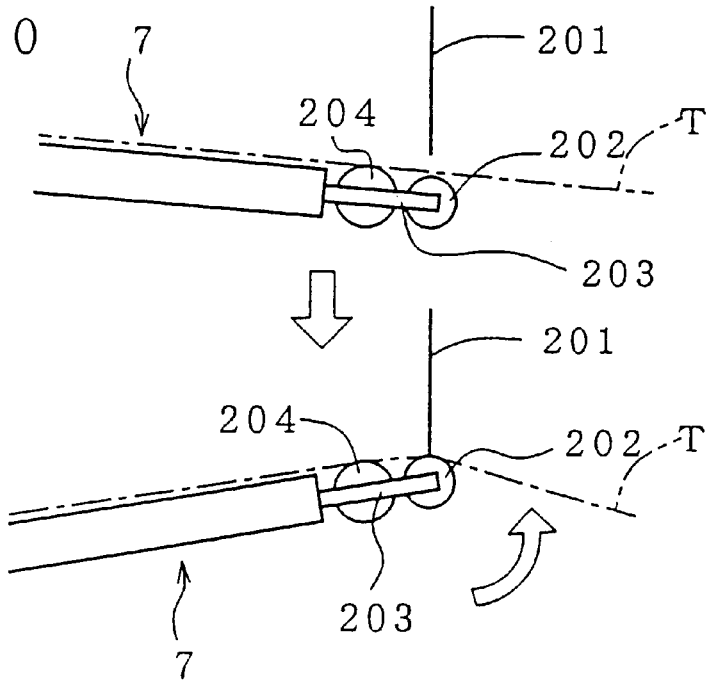
FIG. 60 is a view for illustration of action of a mechanism that gives a tension to a tape in tape cutting.
Figure 61:
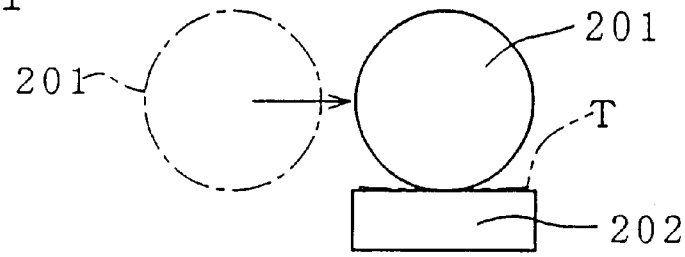
FIG. 61 is a view for illustration of action in tape cutting by a cutter.

As shown in FIG. 61, the cutter 201 is moved in a lateral direction toward the tape receiving member 202 and thereby, cuts the tape T while rotating in the width direction. In the cutting, as shown in FIG. 60, the conveyor 114 swings upward with a fulcrum shaft 128 shown in FIG. 36 as a fulcrum through a predetermined angle by the action of a cylinder 130 such that the tape receiving member 202 is raised and gives the tape T a tension. With this movement of the conveyer 114, as shown in FIG. 60, the tape T is given a tension larger than in a normal condition and the disk-like cutter 201 is cut in the tape T in such a tense state, thereby, cutting the tape T with ease.

A surface of the tape receiving member 202 is made at least from a soft material such as urethane rubber and a blade edge of the cutter 201 is cut in the surface. A shape of the tape receiving member 202 may be a plate, but a shaft-like member such as a cylinder as in this example is preferred since a receiving portion of the tape receiving member 202 can periodically be changed by rotation of the member so as to disperse a cutting-in position over the member with the result that it is avoided that the tape receiving member 202 is locally deteriorated due to concentrated use at a limited position and a lifetime of the member can be elongated.

Figure 62:
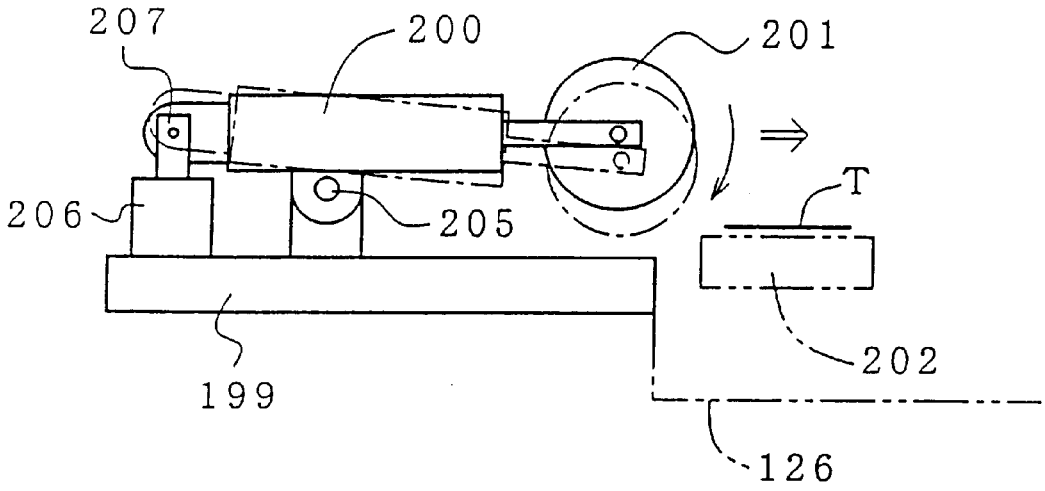
FIG. 62 is a plan view showing an example of a tape cutting unit different from FIGS. 59 and 60.

It should be appreciated that as shown in FIG. 62, a cylinder 200 for swinging a disk-like cutter 201 is mounted on a bracket 199 with a fulcrum shaft 205 as a fulcrum for swinging the cylinder 200 such that the disk-like cutter 201 is freely cut in the tape receiving member 202, wherein the fore-end of a piston rod 207 of the cylinder 200 can be connected to a base frame that supports the cylinder 200 for moving a cutter. In this case, the piston rod 207 of the cylinder 206 for swinging a cutter is extended such that a working point of the cutter 201 can cut into the tape receiving member 202 to some extent before or during the lateral movement of the disk-like cutter 201and in the state, the disk-like cutter 201 is moved in the width direction of the tape T to ensure cutting of the tape T.

Figure 63:
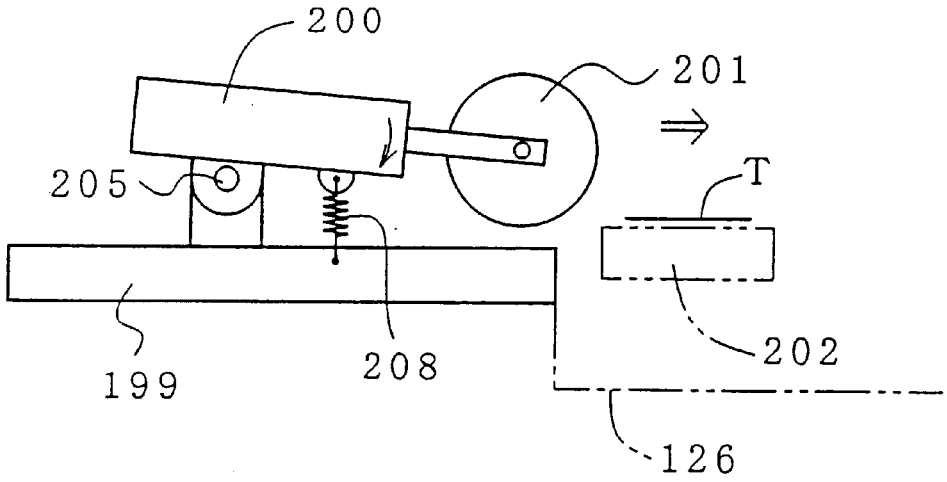
FIG. 63 is a plan view showing an example of a tape cutting unit different from FIG. 62.

Alternatively, as shown in FIG. 63, an elastic member 208 such as a spring or rubber can be mounted between the bracket 199 and the base frame supporting the cylinder 200 for moving a cutter and thereby, the disk-like cutter 201 can cut into the tape receiving member 202 with the fulcrum shaft 205 as a fulcrum. In this case, since the working point of the cutter 201 can intrude into the tape receiving member 202 all the time because of use of the elastic member 208, when in this state, the disk-like cutter 201 traverses the tape T in a lateral direction, the tape can be sure to be cut.

Following is description of the whole of operations associated with the tape feeding unit.

When tape rolls 113 are set in the tape rack 125 as in FIG. 41, the tape rack 125 is laterally moved by the motor 152 and a first tape housing room 147 is located on the belt 121 of the conveyor 114, then as in FIGS. 42 and 43, a tape roll 113 steps down from the guide bars 156 and 157 and rests on the belt 121 and moves downstream over a small distance till the roll hits the first roller stopper 115. At the position, the tape T is unwound from the tape roll 113 by the vacuum chuck conveyor 114 and the tape roll 113 is rotated to unwind the tape T in company with rotation of the first roller stopper 115.

Especially, in starting of winding a veneer sheet 1 on the take-up reel 7, the tape T comes to be twisted upside down with ease and as shown in FIG. 48. When such a twist occurs in the tape T, then the spatula-like member 174 advances from the cylinder 175 to correct or prevent twist of the tape T, the spatula-like member 174 is kept at the position after the advancement for a predetermined short time as it is and thereafter the spatula-like member 174 retreats therefrom to restore its original position. Further, while a twist is frequently experienced at starting of the winding, even when the tape T is unwound from a tape roll 113 and runs toward and is inserted into between veneer sheets 1 in a normal state, there is frequently encountered, in the course of insertion, a phenomenon that the tape T is twisted from the normal state by turning upside down. Therefore, operations in which the tape T is pressed onto a surface of the tape roll 9 by the spatula-like member 174 are preferably repeated continuously and regularly till the tape is broken from when the tape T gets started with insertion into between veneer sheets.

As a tape roll 113 is smaller in diameter in the course of unwinding of the tape T, the tape roll 113 comes to get into contact with the second roller stopper 116 as shown in FIG. 43 and unwinding continues while the stopper 116 is rotated. At the last stage, when a diameter of the tape roll 113 comes to be smaller than that of the clearance under the second roller stopper 116, then the core 112 moves downstream through under the second roller stopper 116 together with a residual tape of a small amount thereon and after the movement is stopped by the core stopper 117 of FIG. 34, the tape roll 113 rotates and is unwound there till nothing on the core 112, though, for a short time.

Figure 46:
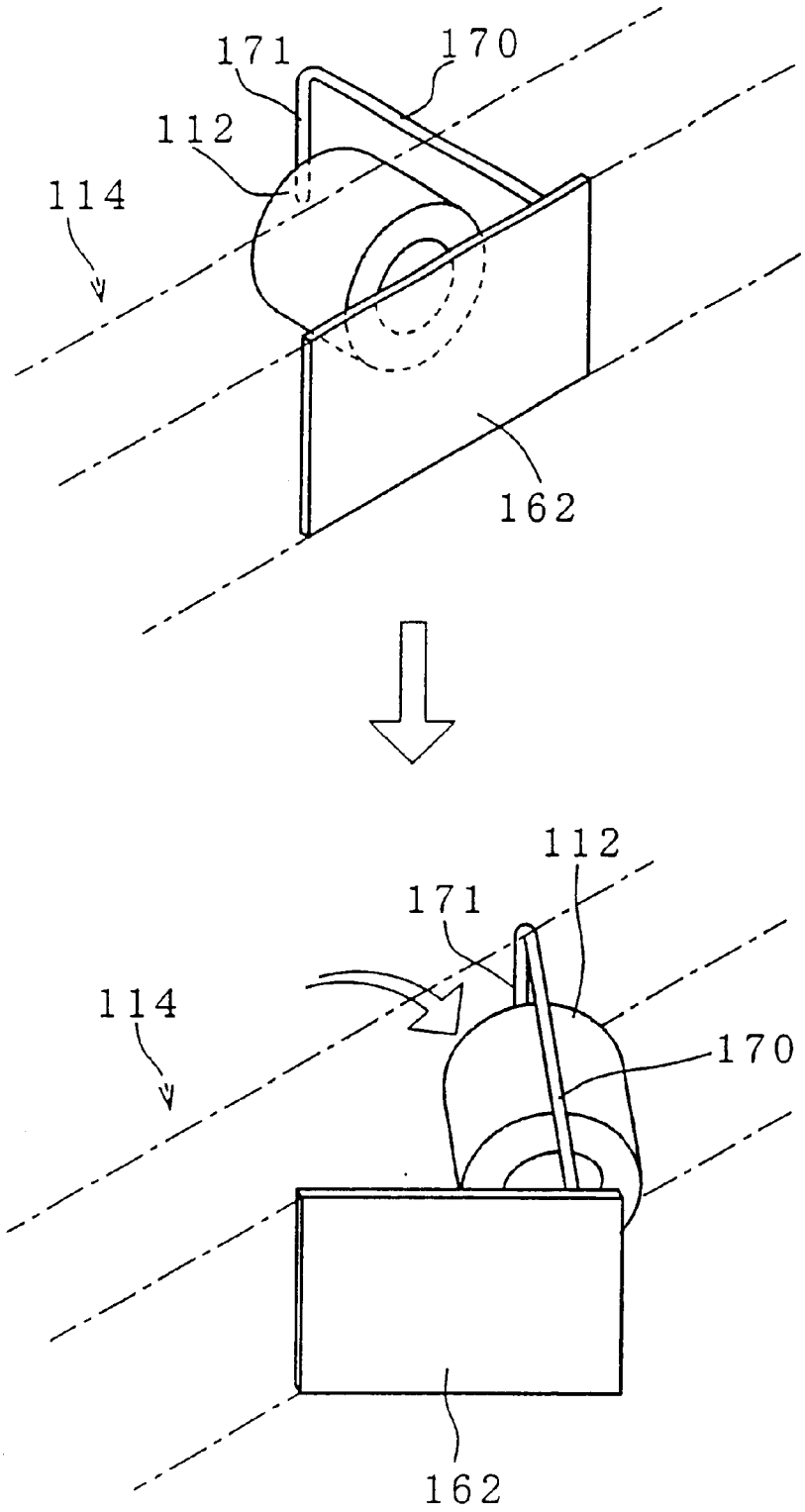
FIG. 46 is a view for illustration showing discharge action of a core.

Thereafter, as shown in FIGS. 44 to 46, the piston rod 165 of the cylinder 164 retreats, the door 162 opens, the catching bar 170 forcibly discharges the bare core 112 in the course of opening the door 162 toward the side of the conveyor 114, and then the door 162 closes.

A predetermine time period before the discharge of the bare core 112, the tape rack 125 of FIGS. 41 and 42 performs a lateral movement over a distance corresponding to one pitch of arrangement of the tape housing rooms 147 to feed a next tape roll 113 onto the conveyor 114 and the next roll 113 starts unwinding the tape T as shown in FIG. 43. In this situation, as shown FIG. 34, when the tape T is still fed from an unwound residue on the preceding tape roll 113 by the core stopper 117, the tapes are doubly fed, though, for a short time period till the residue is unwound to nothing.

A tape rotation stop device 180 at an upstream position from the forward movement stopper member is activated, when a reeling operation is terminated since a diameter of a veneer roll 9 of a veneer sheet 1 have reached a predetermined value in the course of unwinding of the tape roll 113, or when a reel operation is interrupted in order to change a thickness of a veneer sheet 1 according to a nature and condition of a log. The cutting section of the tape cutting tool 198 is put into sliding contact with the lower surface of the tape T before rotation of the tape roll 113 is ceased. To be concrete, the tape feeding unit 124 is swung through a small angle as a whole counterclockwise in the figure with the shaft 128 of FIG. 36 as a fulcrum by retreat of the piston rod 131 of the cylinder 130. With the movement of the tape feed unit 124, as shown in FIG. 57, the tape cutting tool 198 at the distal end of the conveyor 114 raises the tape T to make the sawteeth as the top portion of the cutting section touch the lower surface of the tape T in a sliding manner. It should be appreciated that the sawteeth as the top portion and the lower surface of the tape T unwound may be kept in sliding contact with each other all time from when the tape T is inserted into between veneer sheets to wind on the take-up reel 7 into a tape roll 9. If, likewise, the sawteeth of the cutting section and the lower surface of the tape T are constantly in sliding contact with each other, there can be enjoyed a additional effect that the sawteeth as the top portion of the cutting section are sharpened by a frictional condition generated from the sliding contact with the tape T.

Figure 51:
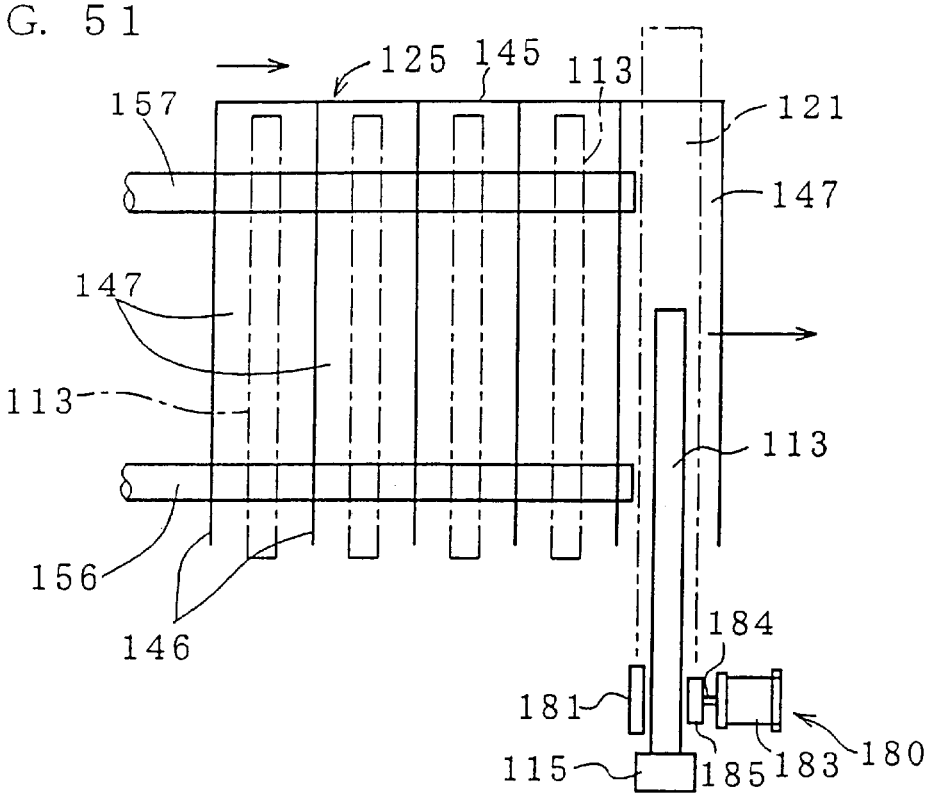
FIG. 51 is a conceptual plan view of a tape rack and a tape rotation stop device.
Figure 52:
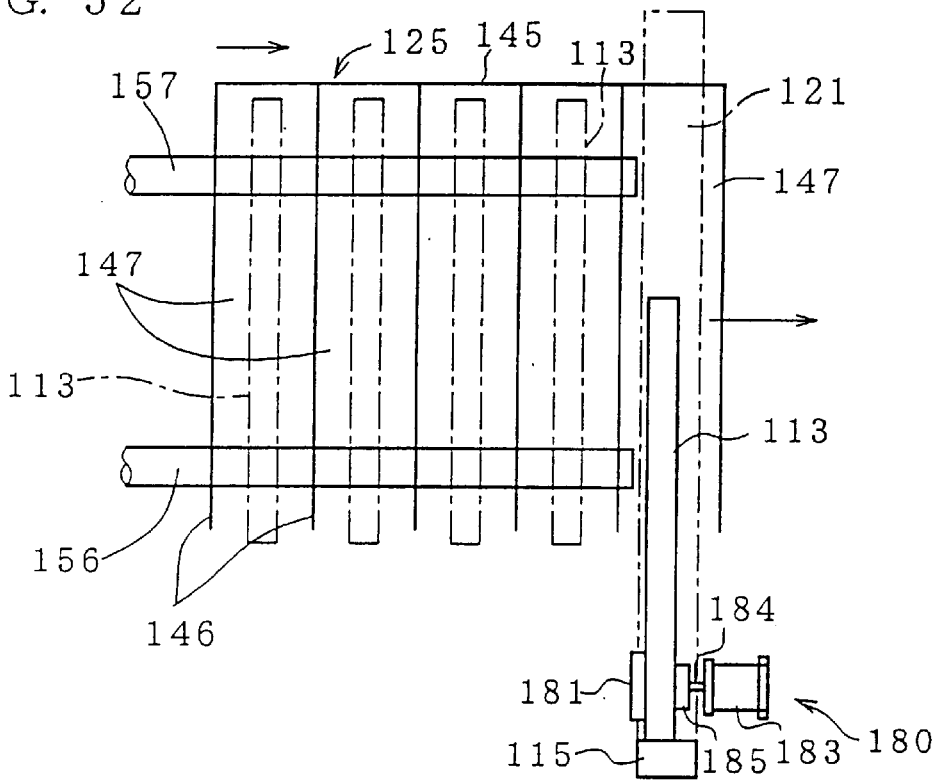
FIG. 52 is a view for illustration of action where rotation of a tape roll is ceased.
Figure 53:
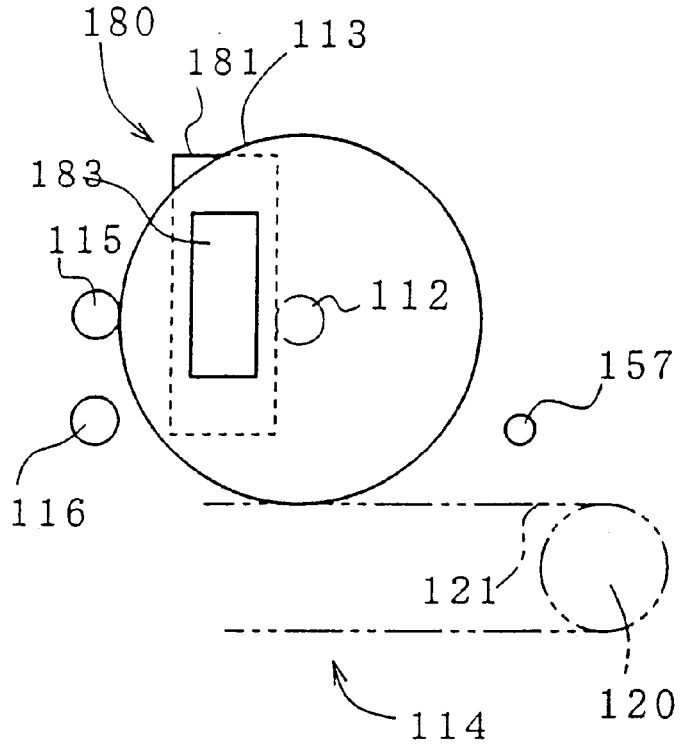
FIG. 53 is a conceptual side view of a tape rotation stop device.

As shown in FIG. 51, when a forward movement of the tape roll 113 placed on the belt 121 is blocked by the roller stoppers 115 and 116, and the tape T is unwounded from the tape roll 113, rotation of the tape roll 113 is stopped. In order to stop rotation of the tape roll 113, as shown in FIG. 52, the cylinder 183 is activated to move the press member 185 in a direction intersecting a direction of tape unwinding and stops the tape roll 113 by pressing the tape roll 113 between the press member 185 and the receiving member 181 located on the other side of the tape roll 113 from the press member 185.

While driving of veneer lathe is also stopped almost in synchronism with rotating stoppage of the tape roll 113, the take-up reel 7 continues to inertial rotation in the veneer sheet reeling position. Therefore, the tape T is pulled toward the take-up reel 7 in inertial rotation independently from the stoppage of unwinding the tape T from the tape roll 113 and thereby, tension in the tape T is further increased. The tape T whose tension is increased is broken at the weakest point thereof, that is a point where the cutting section of the tape cutting tool 198 is pressed into the tape T on the lower surface thereof. Further, since rotation of the tape roll 113 is stopped and thereby the tape T is not unwound from the tape roll 113, the fore-end portion of the broken tape T is left at the cutting section and awaits next time unwinding of the next tape T.

Further, in order to increase the tension in the tape T, another method is available in addition to the inertial rotation described above: As shown in FIG. 36, the base frame 127 supporting all the tap feeding unit 124 is retreated along the guide rails 133 in a horizontal direction by driving of the motor 134 over a predetermined distance and thereby, the vacuum chuck conveyor 114 can be separated spaced from the veneer roll 9 as well. This can be rep aced with an operation to further raise a position of the tape cutting tool 198 in sliding contact with the lower surface of the tape T. This operation can be performed in such manner that the piston rod 131 of the cylinder 130 is withdrawn and thereby, swings the entire tape feeding unit 124 with the shaft 128 of FIG. 36 as a fulcrum counterclockwise through a small angle from the position in sliding contact with the lower surface of the tape T of the tape cutting tool 198.

Further, in order to stop rotation of the tape roll 113, as shown in FIG. 54, a method may be adopted: While a pair of the pinching members 186 and 187 are in an open state by action of the cylinder 188 when the tape T is unwound, the pair of the pinching members 186 and 187 is closed in a direction intersecting a unwinding direction of the tape roll 113 so as to pinch the tape roll 113 from both sides thereof by canceling the action of the cylinder when rotation of the tape roll 113 is stopped.

Still further, in addition to the above descriptions, another method may be adopted in order to stop rotation of the tape roll 113, as shown in FIG. 55, while the press member 192 is withdrawn (upward) at a position for waiting where no interference with rotation of the tape roll 113 occurs in unwinding of the tape T, the press member 192 is pressed down to a position where the member gets into contact with the top surface of the tape roll 113 by action of the cylinder 193 and the tape roll 113 is then pressed between the press member 192 and the vacuum chuck conveyor 114.

According to this method, when reeling of a veneer sheet is interrupted in the middle of winding or finished, the tape T can be cut while keeping the cutting section of the tape cutting tool 198 in sliding contact with the tape at a position where the tape cutting tool 198 is positioned by ceasing rotation in unwinding of the tape roll 113. Hence, the tape roll 113 in rotation in a following manner to a winding speed is not necessary to be slowed and stopped temporarily. Especially, in case of logs that cause frequent terminations in winding operation by interruption due to defects included therein regardless a large diameter thereof or short time operations due to smallness in diameter, operation efficiency can be increased with adoption of this method.

Further, description will be made in a case of tape cutting using a disk-like cutter 201: As a preparatory operation, the tape feeding unit 124 is swung as a whole counterclockwise in the figure through a small angle by extension of the piston rod 131 of the cylinder 130 with the shaft 128 of FIG. 36 as a fulcrum to raise the distal end of the conveyor 114 as shown in FIG. 60, with the result that a tension larger than in a normal condition is produced in the tape T. The tape T in such a high tension state is cut by the disk-like cutter 201 in a state in which the disk-like cutter 201 is pressed into the tape receiving member 202 and after the cutting, the disk-like cutter 201 retreats. Thereafter, the entire tape feeding unit 124 is swung back through the small angle clockwise to restore it original position, while the conveyor 114 is returned downward through the small angle.

While in the above descriptions, the tape rack moves laterally, another configuration may be available: A tape case in which one tape roll is accommodated is fixedly installed above a feed conveyor and the front, bottom and back (or top) sides thereof are opened and not only a forward movement stopper member is provided in front thereof, but a new tape roll 113 is supplied from behind or above of the tape case. Further, another operations are also allowed: The vacuum chuck conveyor 114 is employed only in the initial stage of starting winding the tape T on the take-up reel 7 or veneer roll 9, while when the tape T is unwound from the tape roll 113 by a pulling force of the veneer roll 9, vacuum of the vacuum chuck conveyor 114 is broken and circulation thereof is not driven (all mechanisms thereof are stopped), or the vacuum is broken but the circulation is still in operation (no reduced pressure is applied).

Figure 64:
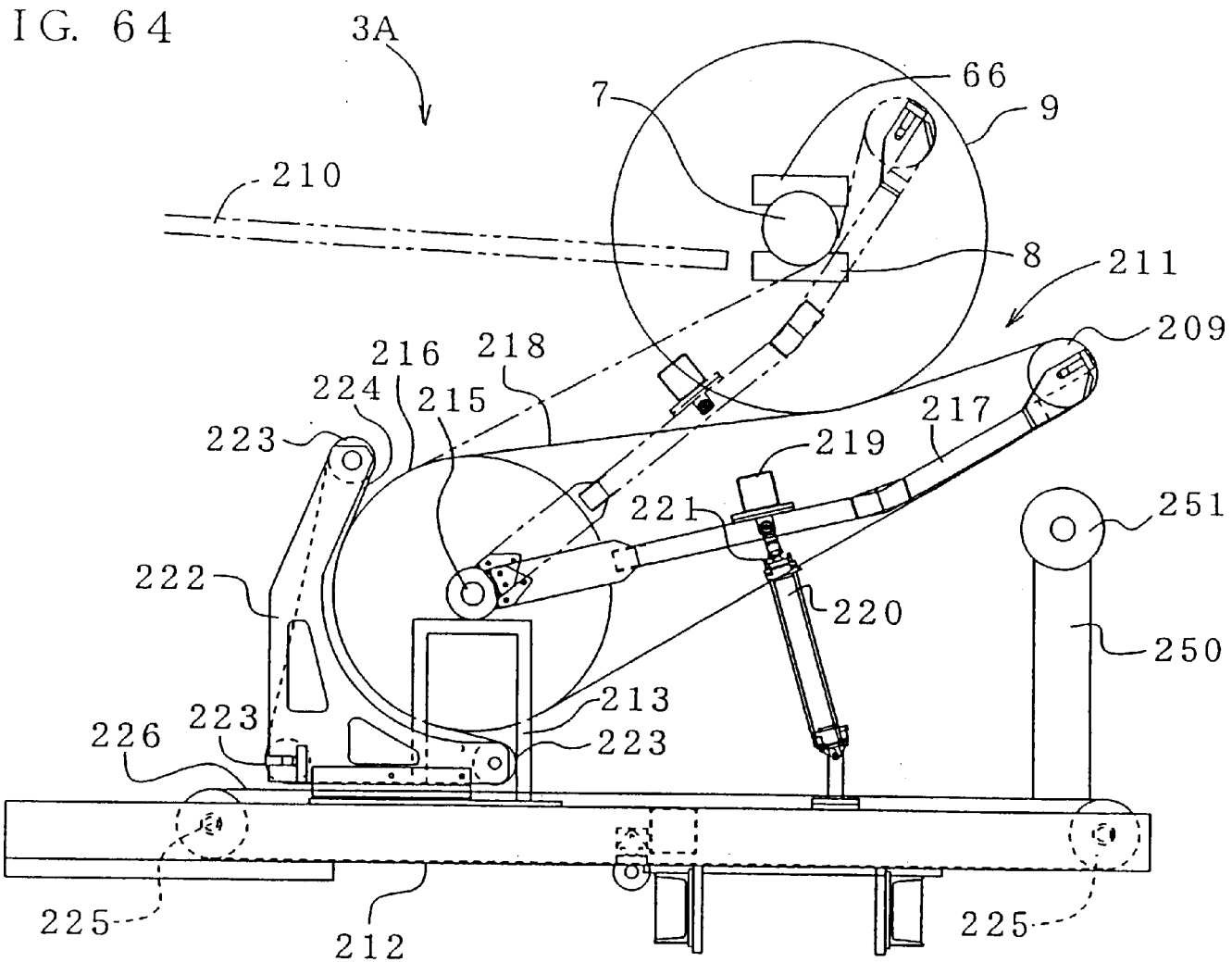
FIG. 64 is a side view showing an embodiment of unwinding of a veneer sheet from a veneer roll.
Figure 65:
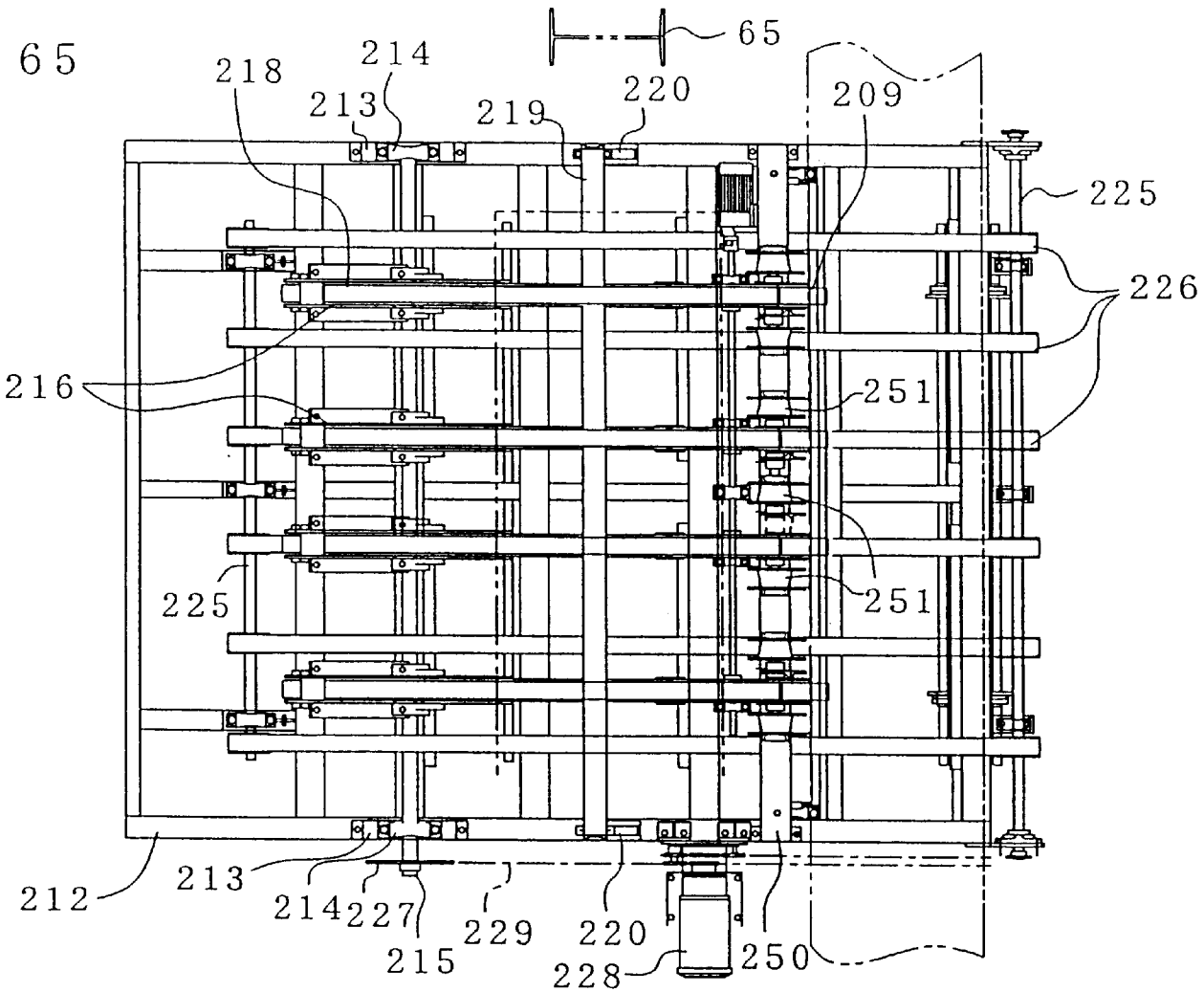
FIG. 65 is a plan view of FIG. 64.

Next, descriptions will be made of an embodiment of a veneer roll unwinding apparatus of the invention with reference to the accompanying drawings:

A first description of a veneer roll unwinding position 211 gets started with an example of an unwinding process for a veneer sheet 1 with reference to FIGS. 64 and 65. A transfer frame 210 having an easy down slope is installed toward a pair of reel supports 65 disposed, left and right, at the terminal end of a veneer roll stock area 3A and bearings at both ends of a take-up reel on which the take-up reel 7 with a veneer roll 9 thereon is supported are placed on the transfer frame 210. Reel receivers 8 rotatably supporting the both end bearings are disposed inside the pair of reel supports 65 downstream from the transfer frame 210 and reel down-pressers 66 that can freely swingable relative to the top portion of the bearings of the reel receivers 8 are disposed above the reel receivers 8.

A support table 213 is provided on both sides a machine frame 212 in a direction perpendicular to the transport direction thereof, in the upstream side from the unwinding position 211, and placed below the transfer frame 210. A support shaft 215 is received by bearings 214 mounted on the support table 213 and a plurality of base end pulleys 216 each of a large diameter are fixedly attached to the support shaft 215 along the shaft direction thereof at arbitrary spatial intervals. Pairs of support arms 217 are swingably supported on the support shaft 215 for the base end pulleys 216 at both sides of the respective base end pulleys 216, wherein each of the pair of support arms 217 is bent in a middle region with the distal end displaced upwardly. Each of distal end pulleys 209 each of a small diameter are rotatably supported between the distal ends of a pair of the support arms 217 and not only do drive guide bands 218 respectively extend over the base end pulleys 216 and the distal end pulleys 209, but the pairs of support arms 217 are commonly connected to a connection beam 219 at arbitrary positions of the respective support arms 217. Both ends of the connection beam 219 are mounted on the piston rods 221 of fluid cylinders 220 swingably supported on the machine frame 212.

An auxiliary frame 222 is provided at a position opposite to the base end pulleys 216 in the upstream side thereof on the machine frame 212 and has an opposite surface to the base end pulleys 216 which surface has a profile of an arc expanded along the curvature of the base end pulleys 216, and a fold-back guide member 224 whose belts extend over three pulleys 223 all of which are supported by the auxiliary frame 222 and runs along the base end pulleys 216. A fold-back conveyor 226 is disposed directly below the fold-back guide member 224 to connect to the fold-back guide member 224 and constituted of a plurality of belts that extend between a pair of shafts 225 supported on the machine frame 212 at two points, upstream and downstream in the transport direction thereof.

A chain 229 extend between a chain wheel 227 mounted on one side of the support shaft 215 and a motor 228 disposed on the machine frame 212, the drive guide bands 218 are controlled counterclockwise in the FIG. 64 in a freely rotatable manner and the fold-back guide member 224 guarantees an upside-down motion of a pinched veneer sheet 1 in cooperation with the drive guide bands 218.

The drive guide bands 218, which are arranged in plural rows in a direction perpendicular to the transport direction, are freely swingable with the support shaft 215 as a fulcrum such that the distal end pulleys 209, which are free ends, move to or away from the veneer roll 9 in company with extending or contacting the piston rod 221 of the fluid cylinder 220. Thereby, the drive guide bands 218 can freely move to or away from the lower portion of the outer circumferential surface of the veneer roll 9. In unwinding a veneer sheet 1 from the veneer roll 9, a fluid is fed through a backward port of the fluid cylinder 220 to extend the piston rod 221 in the most contracted position and thereby, the drive guide bands 218 in plural row are put into press contact with the lower portion of the circumferential surface of the veneer roll 9 supported by the reel receivers 8 at both side ends thereof.

Then, when the drive guide bands 218 are swung counterclockwise in FIG. 64 by a driving force of the motor 228, the drive guide bands 218 are put into a press contact with the veneer roll 9 and a free end of a veneer sheet 1 of the veneer roll 9 is unwound by a frictional force of the drive guide bands 218 and guided to the fold-back guide member 224 in a state in which the veneer sheet 1 is transferred and carried on the drive guide bands 218. In this situation, the fold-back conveyor 226 is controlled at almost the same speed as those of the drive guide bands 218 and the transport conveyor for a veneer dryer in the downstream side and receives the veneer sheet 1 that is moved along the curvature of the fold-back guide member 224 which is turned upside down between the drive guide bands 218 and the fold-back guide member 224. After such a pinched upside-down motion, the veneer sheet 1 is transported to the veneer dryer from the fold-back conveyor 226.

Then, description will be made of another embodiment of a fold-back motion of a veneer sheet 1 that is transported on the drive guide bands 218 with reference to FIGS. 66 to 69. It should be appreciated that this embodiment of a fold-back motion is preferably employed for a fold-back transportation cut from a conifer log or the like that has neither expandability nor contractibility in a direction intersecting fiber orientations of a veneer sheet, that is easy to be broken or torn when a tension is applied in a direction intersecting fiber orientations.

Figure 66:
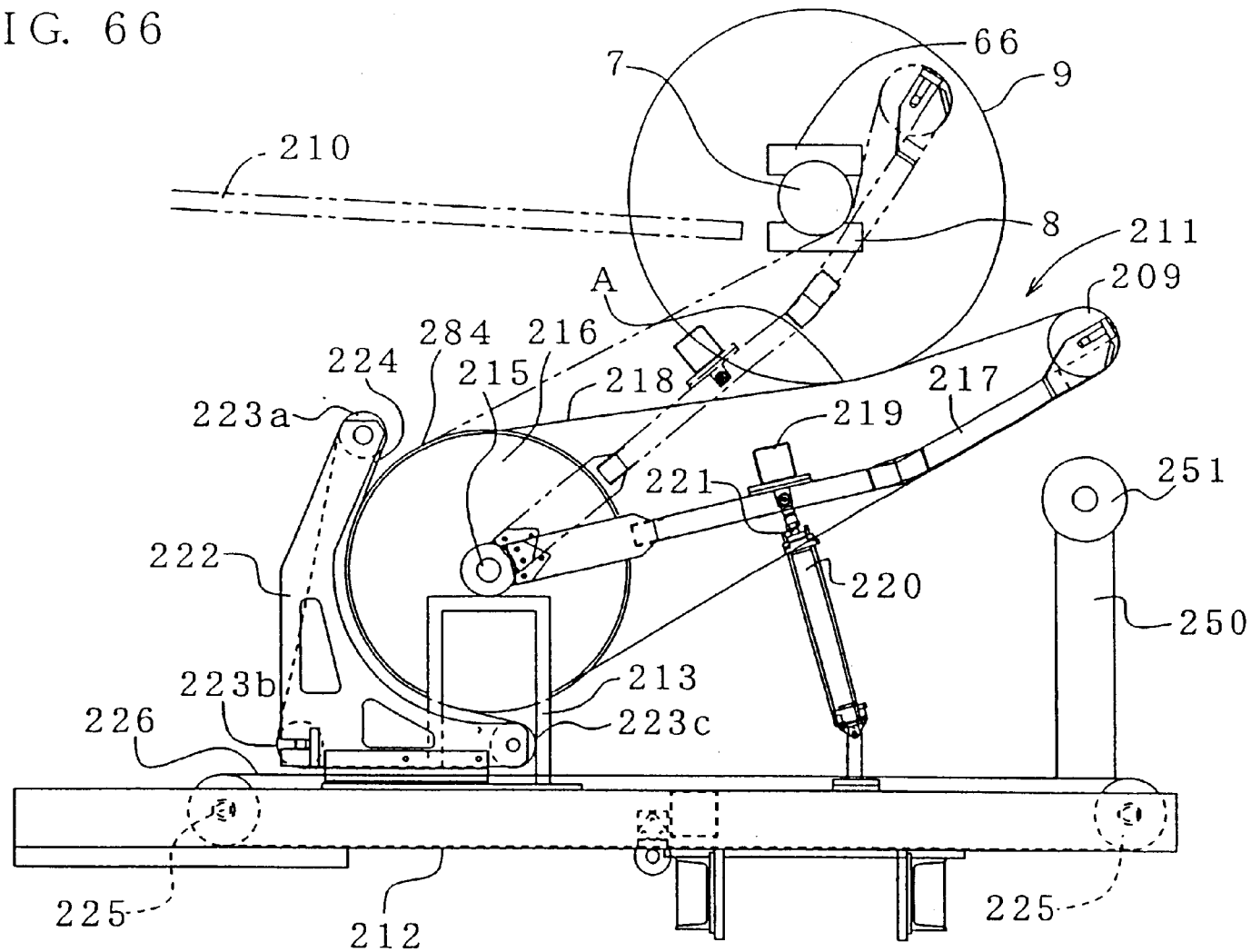
FIG. 66 is a side view showing another embodiment of unwinding of a veneer sheet from a veneer roll.
Figure 67:
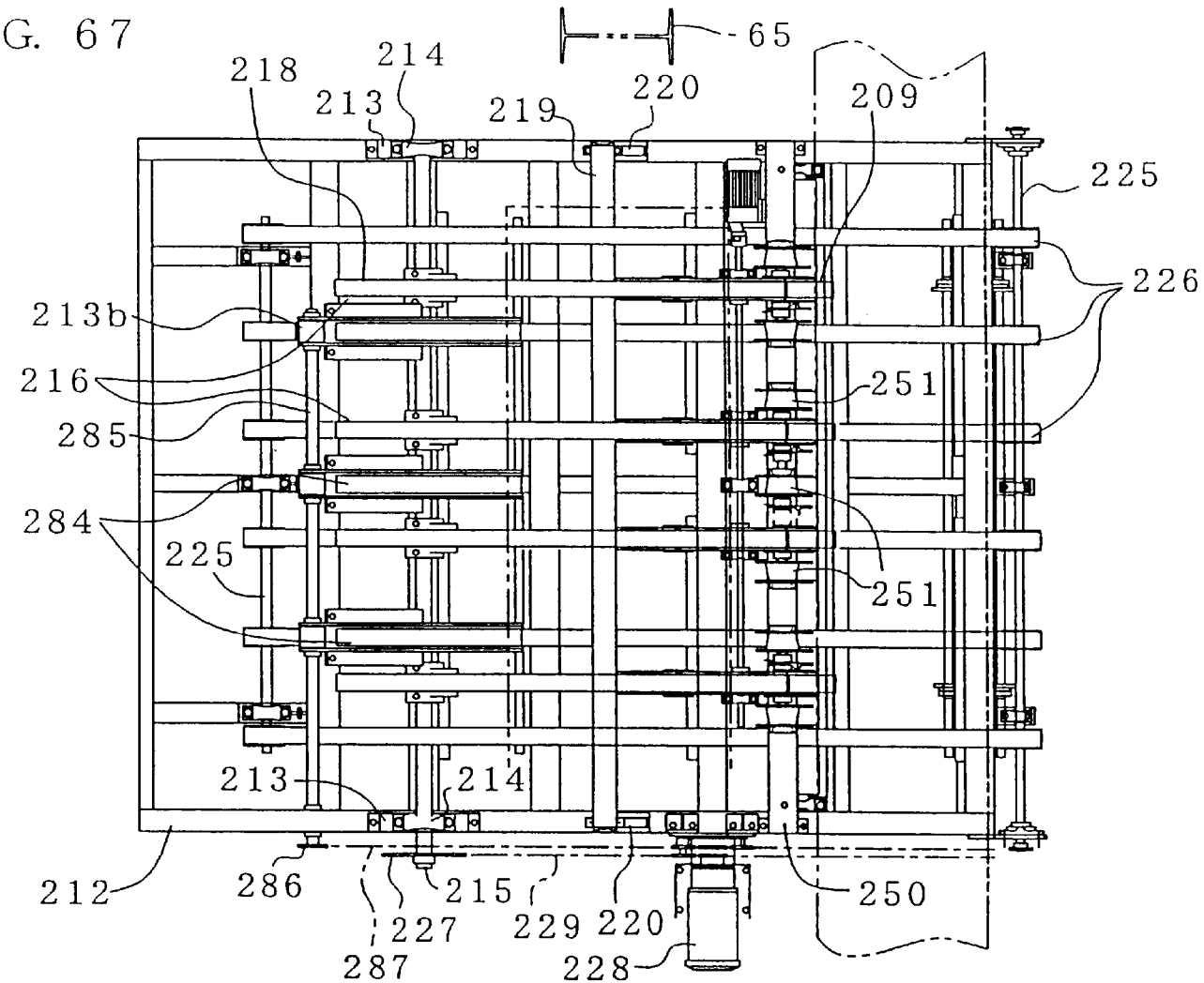
FIG. 67 is a plan view of FIG. 66.

First, in FIG. 66, relay pulleys 284 are mounted on the support shaft 215 in an independently rotatable manner with bearings in positions close to the base end pulleys 216 and the relay pulleys 284 have a larger diameter than a diameter of the base end pulleys 216. The relay pulleys 284 are preferably in plural number in a freely idling manner on the support shaft 215 in an adjacent manner to the base end pulleys 216 and the upper portion of the circumferential surface of each relay pulley 284 is at least higher than the transport surface of each drive guide bands 218. A veneer sheet in transportation on the drive guide bands 218 is transferred to the relay pulleys 284 during a folding-back motion.

Fold-back guide members 224 is disposed on the opposite side to fold-back sections of the relay pulleys 284. It is preferable that in the fold-back guide members 224, the auxiliary frame 222 has an opposite surface to the relay pulleys 284 which surface has a profile of an arc extended along the curvature of the relay pulleys 284 and erected on the machine frame 212. Pulley 223*a* are disposed in the top portion of the auxiliary frame 222 whose profile is almost of a triangle, pulleys 223*b* are disposed at the left corner of the lower portion thereof and pulleys 223*c* are disposed in the protrusion of the lower portion thereof. Endless bands extends over the three type pulleys 223*a*, 223*b* and 223*c* in a winding manner. The endless bands extending over the three sets of pulleys 223*a*, 223*b* and 223*c* are provided in number corresponding to the number of the relay pulleys 284 at positions respectively corresponding to the positions at which the respective relay pulleys 284 in an opposite manner. The endless bands are in plane contact with part of the circumferential surfaces of the relay pulleys 284 on the veneer sheet fold-back side in a sliding manner. The veneer sheet is externally pressed from both sides thereof when the veneer sheet is folded backed on the replay pulleys 284 while the veneer sheet 1 is kept in sliding contact with an outer circumferential surface on the fold-back sides of the relay pulleys 284.

Each set of the pulleys 223*a*, 223*b* and 223*c*, for example the pulleys in the left corner of the lower portion are fixed on a pulley shaft 285 thereof. A chain wheel 286 mounted at one side of the pulley shaft 285 and a motor 228 disposed on the machine frame 212 are wound by a chain 287 and the fold-back guide member 224 is controlled at almost the same speed as a transport speed of a veneer sheet 1 transported on the drive guide bands 218 counterclockwise in FIG. 66 in a freely circulating manner.

The drive guide bands 218 arranged in plural rows in a direction perpendicular to the transport direction make distal end pulleys 209 that are disposed at free ends freely swingable in the direction toward a veneer roll 9 in company with extension or contraction of the piston rod 221 of the fluid cylinder 220 and thereby, the drive guide bands 218 can freely move to or away from the lower portion of the outer circumferential surface of the veneer roll 9. In unwinding a veneer sheet 1 from the veneer roll 9, a fluid is fed through a backward port of the fluid cylinder 220 to extend the piston rod 221 in the most contracted position and thereby, the drive guide bands 218 in plural rows are put into press contact with the lower portion of the circumferential surface of the veneer roll 9 supported by the reel receivers 8 at both side ends.

Then, when the drive guide bands 218 are swung counterclockwise in FIG. 66 by a driving force of the motor 228, a free end of a veneer sheet 1 of the veneer roll 9 is unwound by a frictional force of the drive guide bands 218 and transferred and carried on the drive guide bands 218. When the veneer sheet 1 unwound is transported to reach the fold-back section, the veneer sheet 1 is transferred to the relay pulleys 284 from the drive guide bands 218 and receives a driving force of the endless bands of the fold-back guide member 224 to turn upside down while being pinched and folded back between the relay pulleys 284 and the endless bands.

Figure 68:
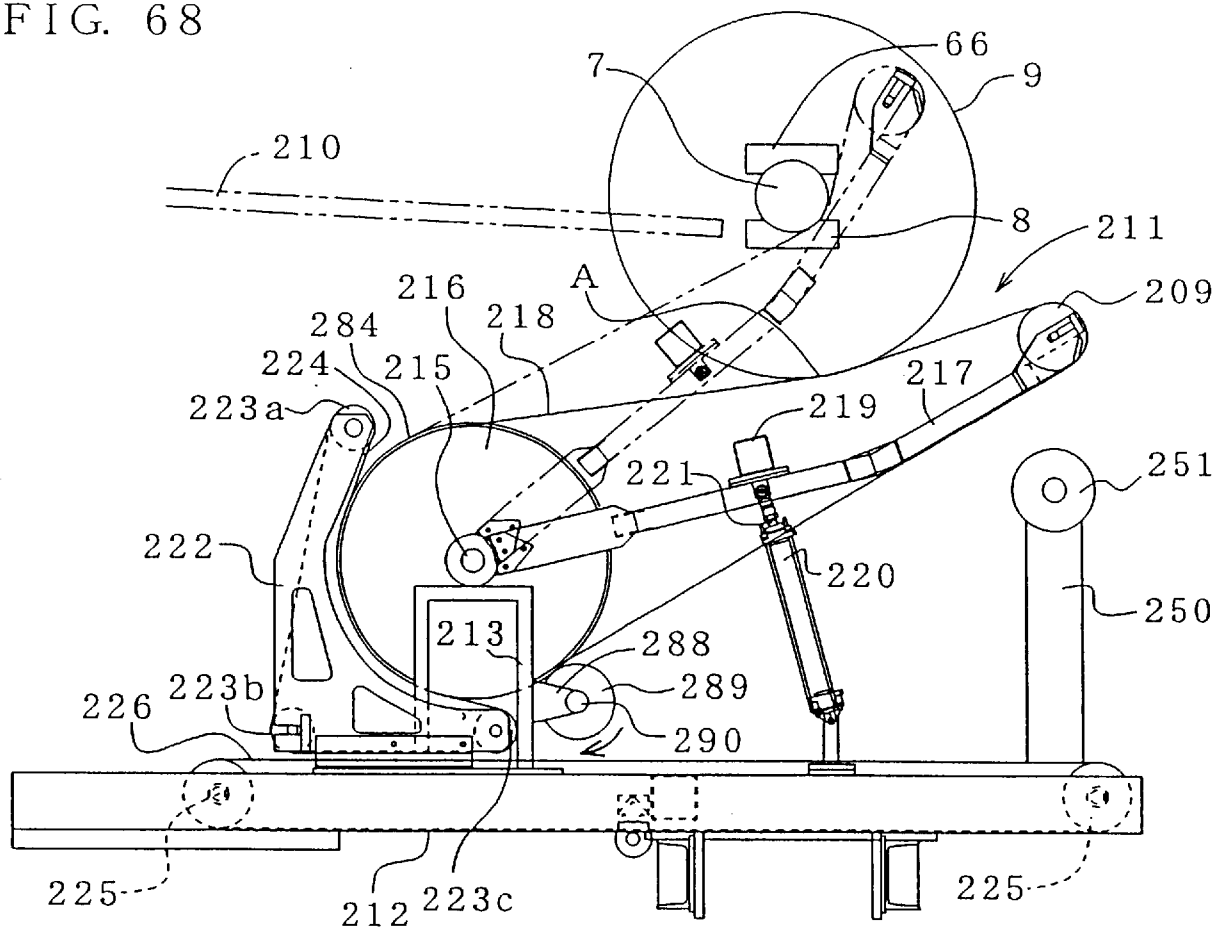
FIG. 68 is a side view showing another embodiment of unwinding of a veneer sheet from a veneer roll.

It should be appreciated that in order to fold back and turn upside down a veneer sheet 1 that is pinched between the relay pulleys 284 and the endless bands, the relay pulleys 284 can be driven instead of driving the endless bands. For example, as shown in FIG. 68, a shaft 290 of touch rolls 289 whose shaft direction is in parallel to the support shaft 215 is rotatably supported on a shaft 288 disposed on the right side of the support table 213. The touch rolls 289 touch the circumferential surfaces of the relay pulleys 284 that are mounted of the support shaft 215 in a freely idling manner. When the touch rolls 289 receives a driving force of the motor 228 and are rotated clockwise in FIG. 68, then the relay pulleys 284 are rotated counterclockwise in FIG. 68 and the veneer sheet 1 can be turned upside down by folding back with the endless bands of the fold-back guide member 224 and the relay pulleys 284 while pinching therebetween.

Figure 69:
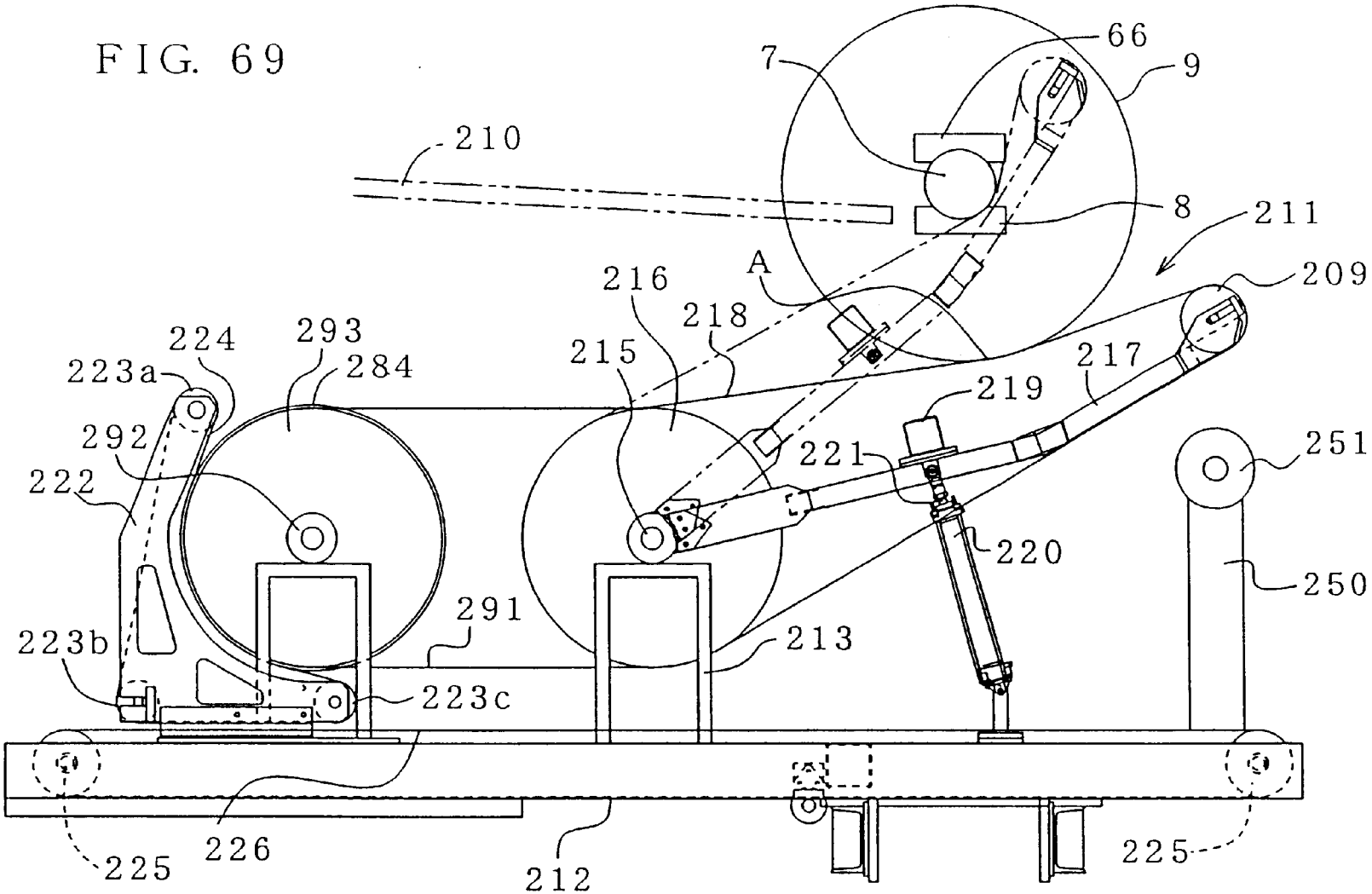
FIG. 69 is a side view showing another embodiment of folding-back of a veneer sheet.

Further, in FIG. 69, there is shown still another embodiment of a fold-back motion of a veneer 1 unwound from a veneer roll 9. According to the embodiment, the apparatus comprises: Drive guide bands 218 on which a veneer sheet 1 is transported; and a connection conveyor 291 that is provided in a predetermined spatial interval, wherein the terminal end in the transport direction of the connection conveyor 291 serves as a fold-back position of the veneer sheet 1. Connection pulleys 293 are respectively fixed on a connection shaft 292 along the shaft direction at positions corresponding to the base end pulleys 216 fixed on the support shaft 215 and endless bands such as belts extend between the base end pulleys 216 and the connection pulleys 293. Further, relay pulleys 284 are rotatably supported on the connection shaft 292 with bearings or the like in close positions of the connection pulleys 293 and a diameter of each of the relay pulleys 284 is larger than that of each of the connection pulleys 293. It is preferable that the relay pulleys 284 are disposed adjacent to the connection pulleys 293 on the connection shaft 292 in plural number and the uppermost part of the circumferential surface of each of the relay pulleys 284 is at least higher than the transport surface of the connection conveyor 291. Furthermore, the fold-back guide member 224 is disposed that is described above on the opposite side of the fold-back section of the relay pulleys 284 and the fold-back guide member is in sliding contact with the circumferential surface of the veneer sheet fold-back side of the relay pulleys 284.

In such a way, since the transport speed of each of the drive guide bands and a speed at which a veneer sheet 1 is folded back between the endless bands constituting the fold-back guide member 224 and the relay pulleys 284 are controlled to be almost the same, there is no chance where the veneer sheet 1 is pulled in a direction intersecting fiber directions thereof in company with control of a circumferential speed in the fold-back motion. Hence, no excessive concentration of tension arises at the starting position A of unwinding of a veneer sheet 1 from a veneer roll 9 caused by the drive guide bands 218, thereby preventing breaking and tearing in the fiber direction of a veneer sheet 1 at the unwinding starting position from occurring.

A veneer sheet 1 that has been folded back while pinching between the endless bands and the relay pulleys 284 comes onto the fold-back conveyor 226 while turning upside down. In this situation, the fold-back conveyor 226 are controlled at almost the same speed as the speeds of the drive guide bands 218, the fold-back guide member 224 and the transport conveyor of the veneer dryer, receives the veneer sheet 1 that proceeds along the curvature of the fold-back guide member 224, is turned upside down between the drive guide bands 218 and the fold-back member 224 while pinching therebetween and eventually sends the veneer sheet 1 to the veneer dryer from the fold-back conveyor 226.

The drive guide bands 218 are always kept in a state in which the drive guide bands 218 are in press contact with a lower portion of the circumferential surface of a veneer roll 9 in company with extension of the fluid cylinder 220 and as a diameter of the veneer roll 9 is reduced in the course of unwinding of a veneer sheet 1, the pairs of support arms 217 are swung counterclockwise in FIG. 64 with the base ends pulleys 216 as a fulcrum such that the distal end pulleys 209 side moves counterclockwise in FIG. 64. While each of the drive guide bands 218 is of a belt type that extends over a base end pulley 216 and a distal end pulley 209in an endless manner, both pulleys 216 and 209 are not of the same diameter as each other but a base end pulley 216 is larger in diameter than a distal end pulley 209. Therefore, when the drive guide bands 218 are pressed on the lower portion of the circumferential surface of the veneer roll 9, there arises a spatial margin corresponding to a difference between diameters of both pulleys 216 and 209, which can make the drive guide bands 218 press a lower portion of the circumferential surface of the veneer roll 9 over a surface area extending in the reel shaft direction with a width. With such a pressure over the surface area, a contact area between the drive guide bands 218 and of the lower portion of the veneer roll 9 increases, which in turn enables more of a frictional force to be produced, with the result that the veneer sheet 1 can be unwound from the veneer roll 9 in a stable manner. Further, since the base end pulleys 216 each has a large diameter, a fold-back diameter of the veneer sheet 1 increases, which realizes smooth transportation of the veneer sheet 1 in folding back motion. Besides, since the support arms 217 are bent in the middle regions thereof with the distal end thereof displaced upward, there can be avoided inconveniences that the upper tracks of the drive guide bands 218 touch and interfere with the corresponding support arms 217, between lower and upper surfaces, or thereby the drive guide bands 218 stop circulation thereof as a diameter of the veneer roll 9 is reduces, making unwinding of a veneer sheet 1 from a veneer roll 9 ensured.

Figure 70:
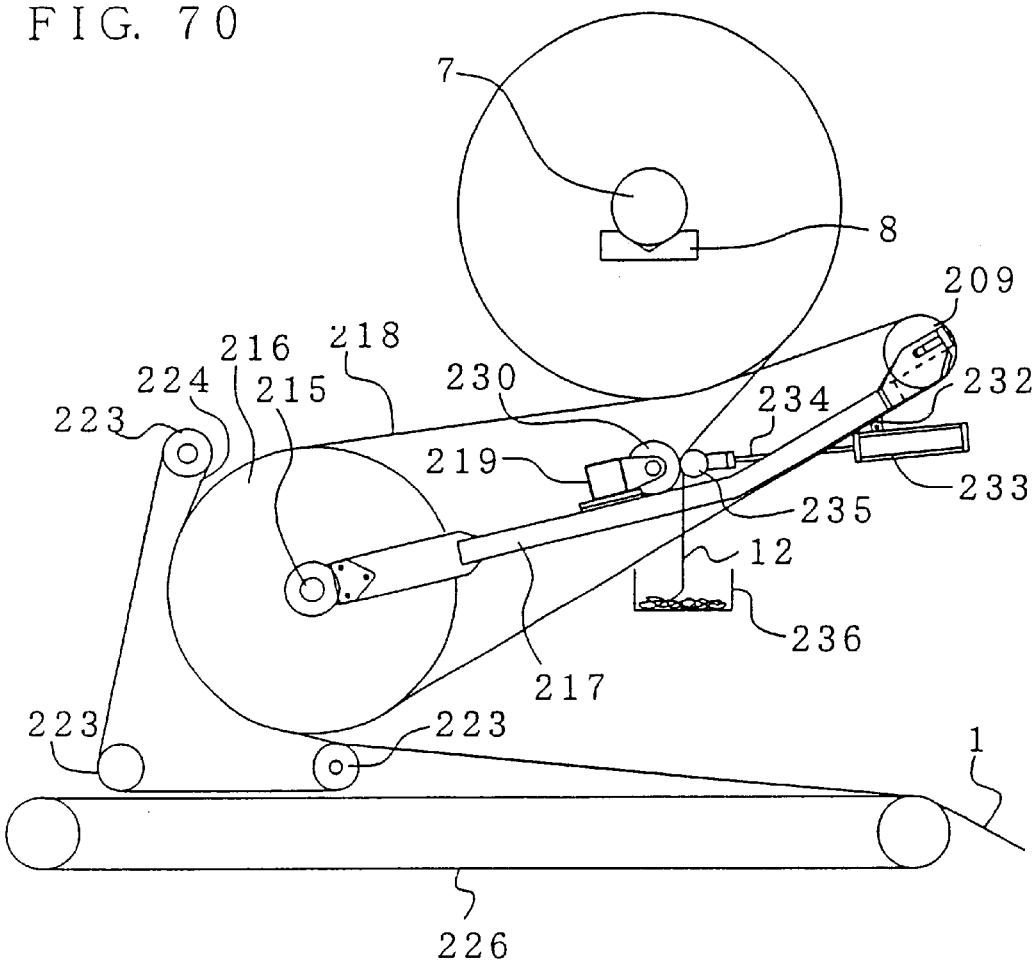
FIG. 70 is a side view showing an embodiment of a thread recovery unit.
Figure 71:
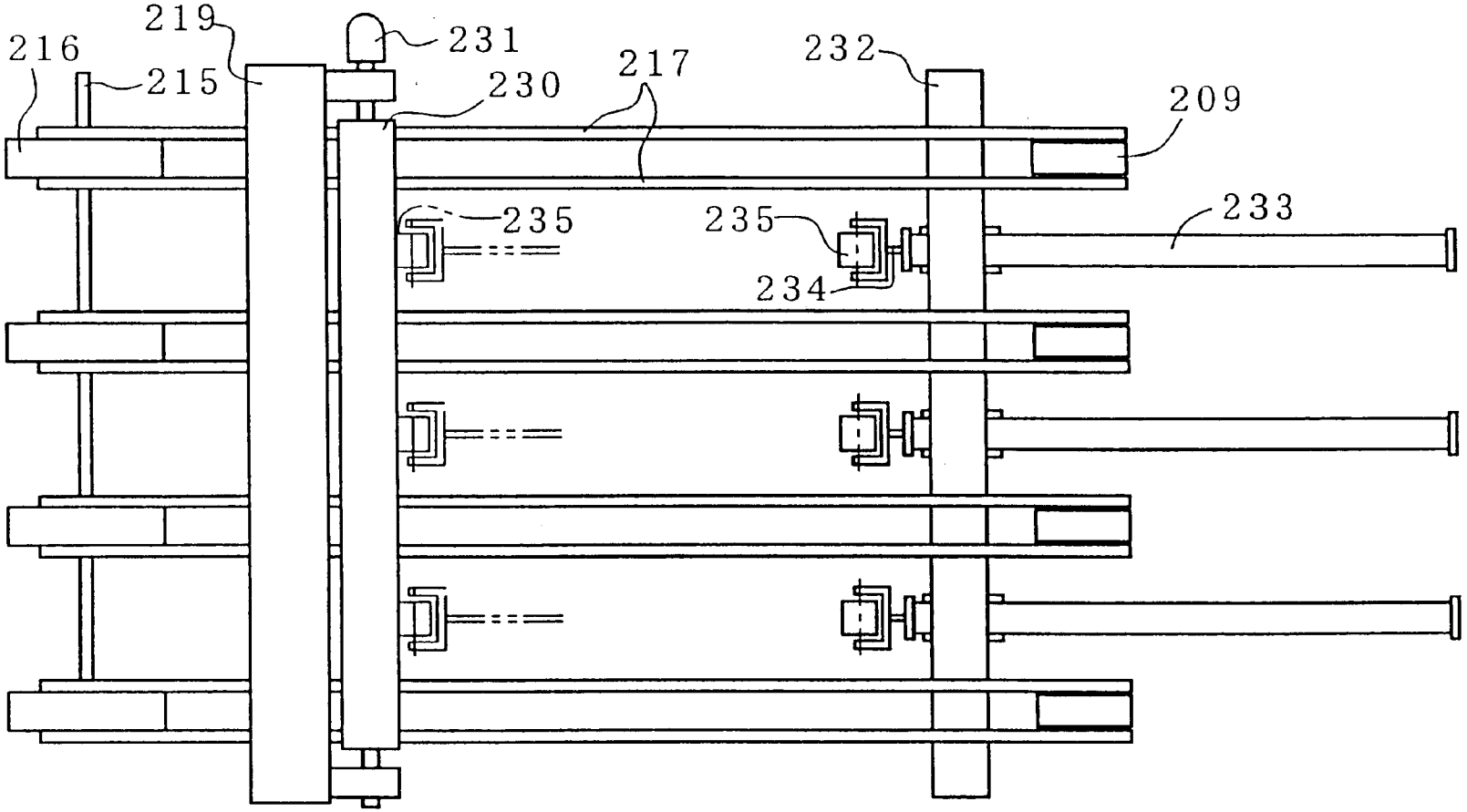
FIG. 71 is a plan view of FIG. 70.

Then, description will be made of an embodiment where a veneer sheet 1 is unwound while threads 12 that were wound as guide are recovered, wherein there is a case where the threads 12 are wound on a take-up reel 7 together with a veneer sheet 1 in a plural rows arranged at arbitrary spatial intervals along the shaft direction of the take-up reel 7. As shown in FIGS. 70 and 71, not only is a unwinding roller 230 of a single cylinder supported on a shaft thereof in front of the connection beam 219 downstream side therefrom, but a motor 231 is provided at an end of the shaft. On the other hand, fluid cylinders 233 for respectively driving a plurality of unwinding rollers 235 with a same diameter cylinder to move to or away from the unwinding roller 230 are provided between the pairs of support arms 217 on a receiving frame 232 over the pairs of the support arms 217 in the vicinity of the distal ends of the respective pairs of support arms 217. Further, piston rods 234 of the fluid cylinders 233 supports the respective unwinding rollers 235 at fore-ends thereof in a rotatable manner.

As described above, not only are the plurality of drive guide bands 218 put into contact with the lower portion of the circumferential surface of the veneer roll 9, but the short unwinding rollers 235 are moved toward the long unwinding roller 230 by extending the piston rods 234 of the fluid cylinders 233 mounted on the receiving frame 232. Portions near the fore-ends of the plurality of threads 12 that are wound on the veneer roll 9 in arbitrary spatial intervals in the shaft direction thereof and which hang down from the circumferential surface of the veneer roll 9 are taken up and pinched between the rollers 230 and 235 in the course of movement of the short unwinding rollers 235.

Then, not only are the drive guide bands 218 circulated counterclockwise in FIG. 70 by a driving force of the motor 228, but the long unwinding roller 230 is controlled in synchronism with the drive guide bands 218 and the both rollers 230 and 235 are rotated in opposite directions, with the result that the threads 12 that have been wound on the veneer roll 9 as guide are unwound in company with the veneer sheet 1 unwound from the veneer roll 9. The threads 12 are wound on thread reels in synchronism with unwinding of a veneer sheet 1 from the veneer roll 9. Therefore, the veneer sheet 1 that has been transferred thereto and is now transported thereon is guided to the fold-back guide member 224 and sent to the veneer dryer similar to the above description, while the threads 12 unwound while pinching are recovered in a recovery box 236 disposed direct below the veneer roll 9.

Figure 72:
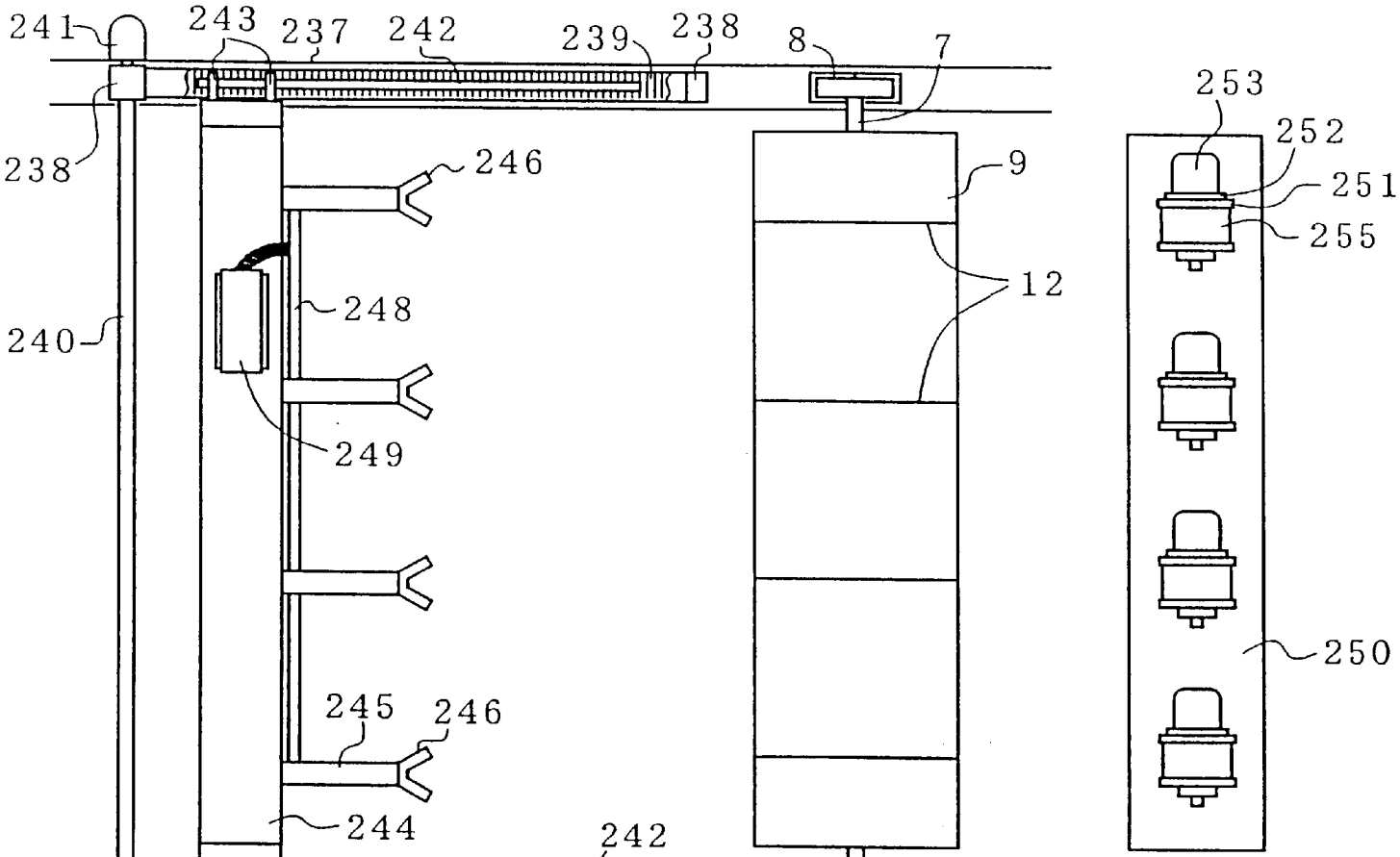
FIG. 72 is a plan view showing another embodiment of a thread recovery unit.
Figure 73:
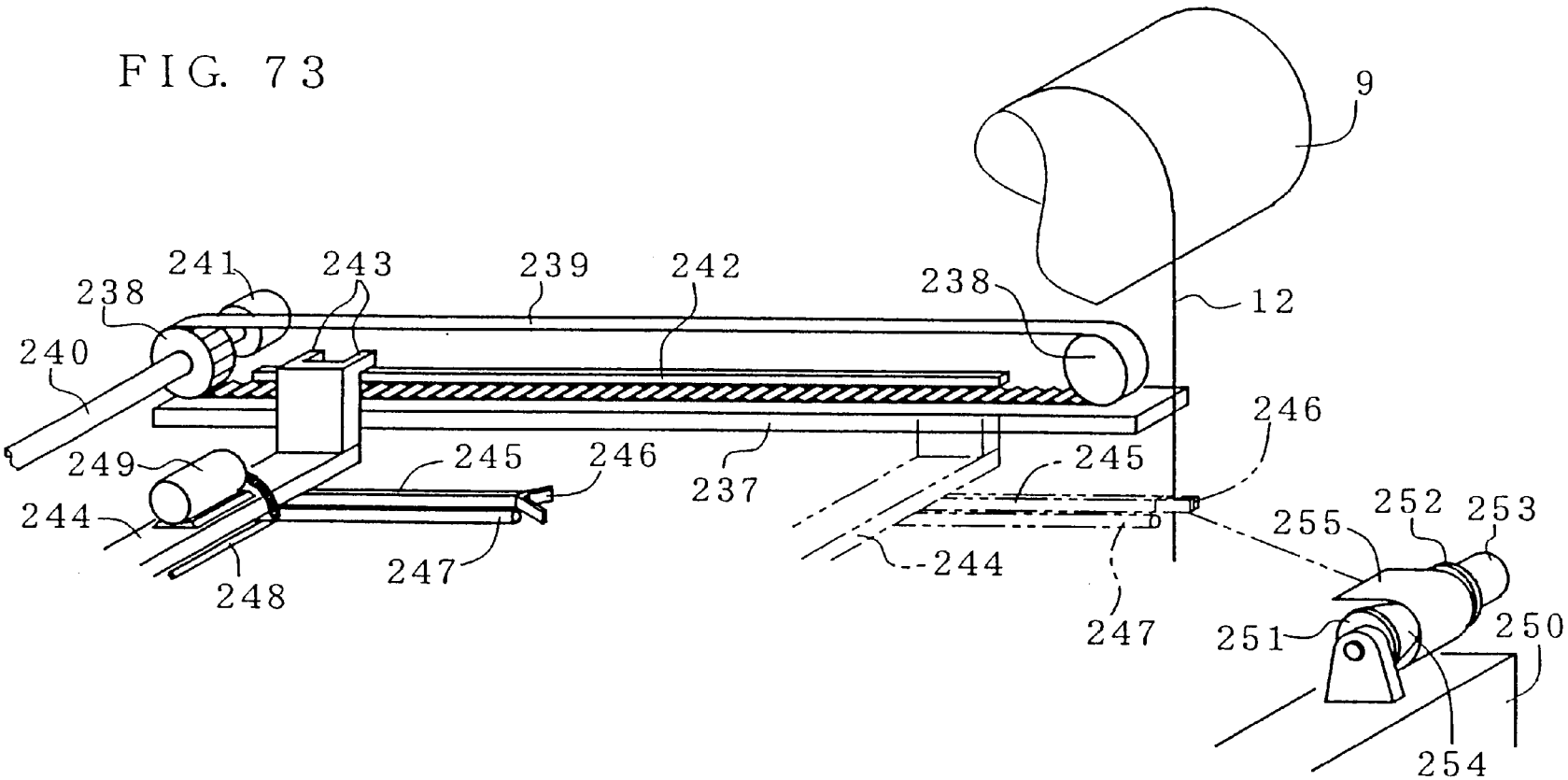
FIG. 73 is a partly cut-away perspective view of FIG. 72.

Next, description will be made of another embodiment in which the threads 12 are recovered with reference to FIGS. 72 and 73. A pair of horizontal beams 237 are provided below the transfer frame 210 and respectively extend toward the pair of the reel supports 65 at a spatial interval between the horizontal beams 237. A pair of timing belts 239 each extend over pulleys 238 that are rotatably supported at the forward and backward ends of a horizontal beam 237. The pair of timing belts 239 are synchronized with each other by a connection shaft 240 and not only are the timing belts 239 circulated in one direction or the other by driving forward or backward of a motor with reduction gears but a motion of each timing belt 239 is controlled with the help of the pulse generator included in the motor 241.

Linear ways 242 each are laid along the transport direction of a timing belt 239 between the both tracks, upper and lower, of the timing belt 239 and linear blocks 243 are attached on the respective timing belts 239. A travel member 244 is mounted between the linear blocks 243 in a direction perpendicular to the transport direction and a plurality of support members 245 are disposed in a direction perpendicular to the transport direction on the travel member 244 at spatial intervals each in a protruding state. Grasping members 246 each with a two-way forked end are provided at fore-ends of the support members 245, wherein each two-way forked end can freely be opened or closed, and nozzles 247 are each disposed on the lower surface of a support member 245 with the tip end of a nozzle 247 located close a grasping member 246. The nozzles 247 communicate with a blower 240 through respective air ducts 248.

On the other hand, not only are a plurality of thread reels 251 corresponding to the threads 12 supported on a frame 250 erected from the machine frame 212 downstream from the unwinding position 211, but the thread reels 251 are connected to the motors 253 through respective torque limiters 252. Further, thread guides 255 are each mounted on a body 254 of a thread reel 251 so as to cover almost along a semi-circumference of the body 254 with a gap therebetween.

According to the above described embodiment, when the timing belts 239 are in a normal direction circulated by driving of the motor 241 with reduction gears, the linear blocks 243 advance on the linear ways 242 in a sliding manner. When the travel member 244 mounted on the linear blocks 243 reaches in the neighborhood of a forward movement limit, the opened grasping members 246 mounted on the travel member 244 come to states in which each of the members 246 can grasp a thread 12 at the middle of a hanging length thereof hanging from the circumferential surface of the veneer roll 9, wherein the plurality of threads 12, as guide, are wound on the veneer roll 9 at arbitrary spatial intervals along the shaft direction of the veneer roll 9. Then, after the grasping members are closed to grasp the threads 12 in the vicinity of the tips thereof, air is ejected from the nozzles 247 mounted on the respective grasping members 246 and thereby, free fore-end portions of the threads 12 from grasping points thereof are blown away toward the thread reels 251 downstream from the respective grasping members 246.

In this situation, the thread reels 251 are rotated counterclockwise in FIG. 73, the free end portions of the threads 12 in a flying condition come to below the body 254 of the respective thread reels 251 and the free end portions of the threads 12 are carried on jet streams (blown-out streams) produced in clearances between the bodies 254 and the thread guides 255 to be wound on the reel bodies 254 and entangled therewith. After a predetermined time elapses, the threads 12 are released from the grasping members 246. Then, the threads 12 are kept in a firmly stretching state between the thread reels 251 and the veneer roll 9 by continuous rotation of the thread reels 251, whereas since the thread reels 251 receives driving of the motors 253 through the torque limiter 252 all time, excessive loads can be avoided on the respective thread reels 251. The threads 12 are wound on the thread reels 251 in synchronism with unwinding of a veneer sheet 1 from the veneer roll 9.

Under such circumstances, when the plurality of drive guide bands 218 get into contact with the lower portion of the circumferential surface of the veneer roll 9, then the veneer sheet 1 is unwound from the veneer roll 9 and the thread reels 251 are released from an overload condition following the starting of unwinding of the veneer sheet 1, thereby rotating the thread reels 251. Therefore, the veneer sheet 1 that has been transferred on the drive guide bands 218 is guided to the fold-back guide member 224 and thereafter as described above, sent to the veneer dryer by way of the fold-back conveyor 226. Further, the threads 12 that have been wound on the veneer roll 9 as guide are eventually wound on the respective thread reels 251. It should be appreciated that while the travel member 244 moves forward or backward by moving the timing belts 239 forward or backward with driving the motor 241 with reduction gears in one direction or the other way, there is no specific limitation to this way, but the driving may be replaced with any of extension or contraction of a fluid cylinder, a rack/opinion motion, a crank motion and so on.

While description is made of the case where the thread reels 251 are fixed, an embodiment will be described next in which the thread reels 251 are freely movable forward or backward.

Figure 74:
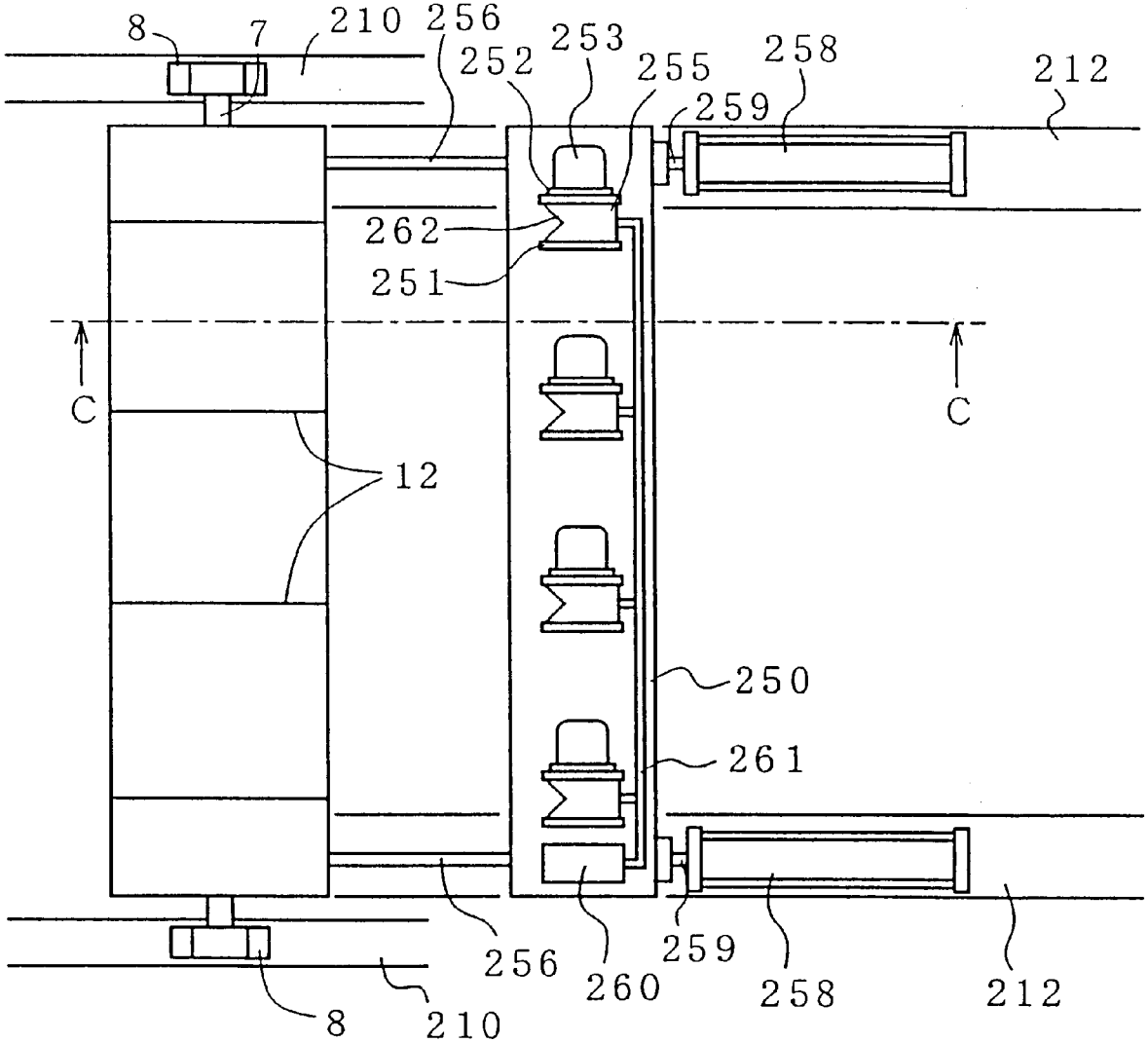
FIG. 74 is a plan view showing another embodiment of a thread recovery unit.
Figure 75:
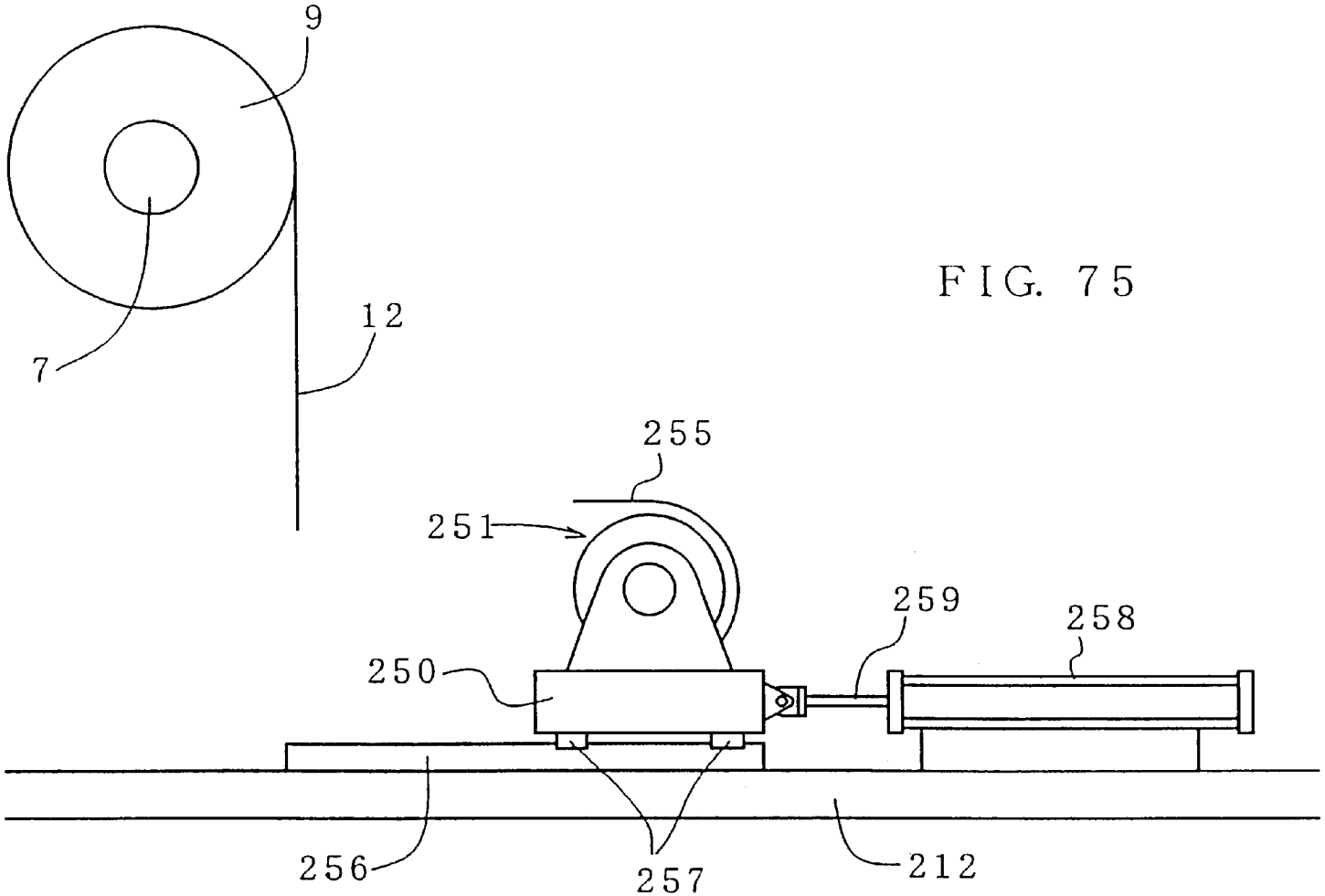
FIG. 75 is a sectional view taken on line C—C of FIG. 74 in an arrow direction.

As shown FIGS. 74 and 75, a frame 250 is mounted on the linear ways 256 that are laid on both sides of the machine frame 212 with the linear blocks 257 interposed therebetween, piston rods 259 of fluid cylinders 258 mounted on the machine frame 212 are attached to the frame 250, and the frame 250 can freely move, forward or backward, up to in the vicinity of the tips of the threads 12 arranged in plural rows, hanging from the circumferential surface of the veneer roll 9, wherein the threads are wound on the veneer roll 9 as guide for the veneer sheet 1 at arbitrary spatial intervals along the shaft direction of the veneer roll 9. Further, an exhauster 260 is provided above one side of the frame 250, while suction holes (not shown) are formed in the bodies 254 of the thread reels 251 and not only does the exhauster 260 communicate with the bodies 254 of the thread reels 251 through an exhaust duct 261 but cut-aways 262 each having an wedge-like shape are formed in the fore-ends of the thread guides 255 provided along the bodies 254 of the thread reels 251 with a gap therebetween.

According to the embodiment, the frame 250 moves toward the veneer roll 9 along the linear ways 256 following extending or contracting of the piston rod 259 of the fluid cylinder 258 and when the frame 250 reaches in the vicinity of the forward movement limit 254, the cut-aways 262 each having a wedge-like shape of the thread guides 255 are mated with portions in the vicinity of the tips of the threads 12 hanging from the circumferential surface of the veneer roll 9, wherein the threads 12 have been wound on the veneer roll 9 in the shaft direction thereof in plural rows as guide for the threads 12. Then, when the exhauster 260 is activated to produce an exhaust stream (suction stream)in spaces between the bodies 254 of the thread reels 251 and the thread guides 255, the tips as free ends of the threads 12 are wound on and entangled with the lower portions of the bodies 254 of the thread reels 251. Therefore, the threads 12 are kept in a firmly stretching condition between the veneer roll 9 and the thread reels 251 in continued rotation of the thread reels 251, and similar to the above described way, the threads 12 wound on the veneer sheet 1 as guide are wound on the thread reels 251 in synchronism with unwinding of the veneer sheet 1 from the veneer roll 9. It should be appreciated that while the frame 250 in the above described embodiment freely moves forward or backward according to extending or contracting of the piston rod 259 of the fluid cylinder 258, there is no specific limitation to this mechanism, but it may be replaced with a motion, forward or backward, of the timing belts by means of driving, in one direction or the other, of a motor with reduction gears as described above, a rack/pinion motion, a crank motion or the like.

In the embodiments, descriptions are made of recovery of the threads 12 on the preconditions that the tips of the threads 12 are hung down from the circumferential surface of the veneer roll 9 almost in a vertical condition wherein the threads 12 are wound as guide for a veneer sheet 1 in plural rows on the veneer roll 9 at arbitrary spatial intervals in the shaft direction of the veneer roll 9. However, when a veneer sheet 1 is wound to form a veneer roll 9, there arises a case where some of the terminal ends of the threads 12 wound as guide are entangled with fibers in the veneer sheet 1 and thereby not hung down vertically. Further, in the course when a veneer roll 9 formed by reeling a veneer sheet 1 moves along the easy down slope of the transfer frame 210, or during a time when a veneer roll 9 awaits its turn in the veneer roll stock area 3A, since a self-weight of each thread 12 is small, the threads are blown by a wind and a portion of each thread 12 in the middle thereof are entangled with fluffy fibers formed on the surface of the veneer sheet 1, with the result that hanging positions of the respective threads 12 on the veneer roll 9 are disturbed at random.

In such a case, recovery of the threads 12 cannot be performed. Description will be made of an embodiment in which a position of each thread 12 is corrected with reference to FIGS. 76 and 77.

Figure 77:
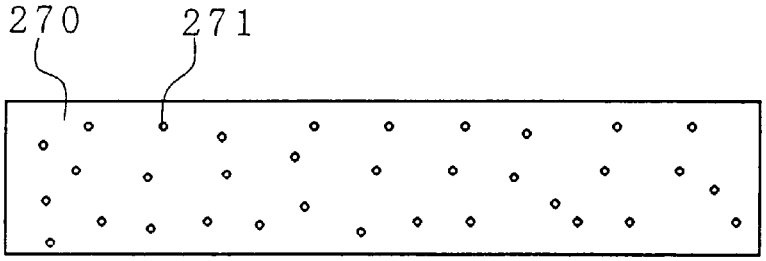
FIG. 77 is a rear view of a correcting member.

A pair of stoppers 263 that can freely protruded and retreated from the transport surface of the transfer frame 210 are provided at a waiting site of the veneer roll stock area 3A. A next veneer roll 9 awaits its turn while the preceding veneer roll 9 is in operation of unwinding in the unwinding position 211. A pair of longitudinal frames 264 vertically provided in the vicinity of the pair of stoppers 263 and moving blocks 265 are freely shiftable upward or downward by means of an elevating mechanism with the insides of the pair of longitudinal frames 264 as guide. An arm 267 is coupled with the top ends of the moving blocks 265 with a pin and fluid cylinders 268 as a forward/backward movement mechanism are supported by the lower ends of the moving blocks 265 so as to be freely inclinable. The distal end of the piston rod 269 of the fluid cylinder 268 is connected to a middle region of the arm 267, the fore-ends of the arms 267 are connected with both ends of the correcting member 270 and the correcting member 270 can freely be moved close to or away from the veneer roll 9 by action of the fluid cylinder 268 while swinging with the pin coupling section as a fulcrum. A plurality of vacuum chuck holes 271 are formed on the side surface facing the veneer roll 9 of the correcting member 270 as shown in FIG. 77, wherein the vacuum chuck holes are used for sucking and retaining the threads 12, and an exhauster 273 is connected to one end of the correcting member by way of a flexible exhaust duct 272.

Figure 76:
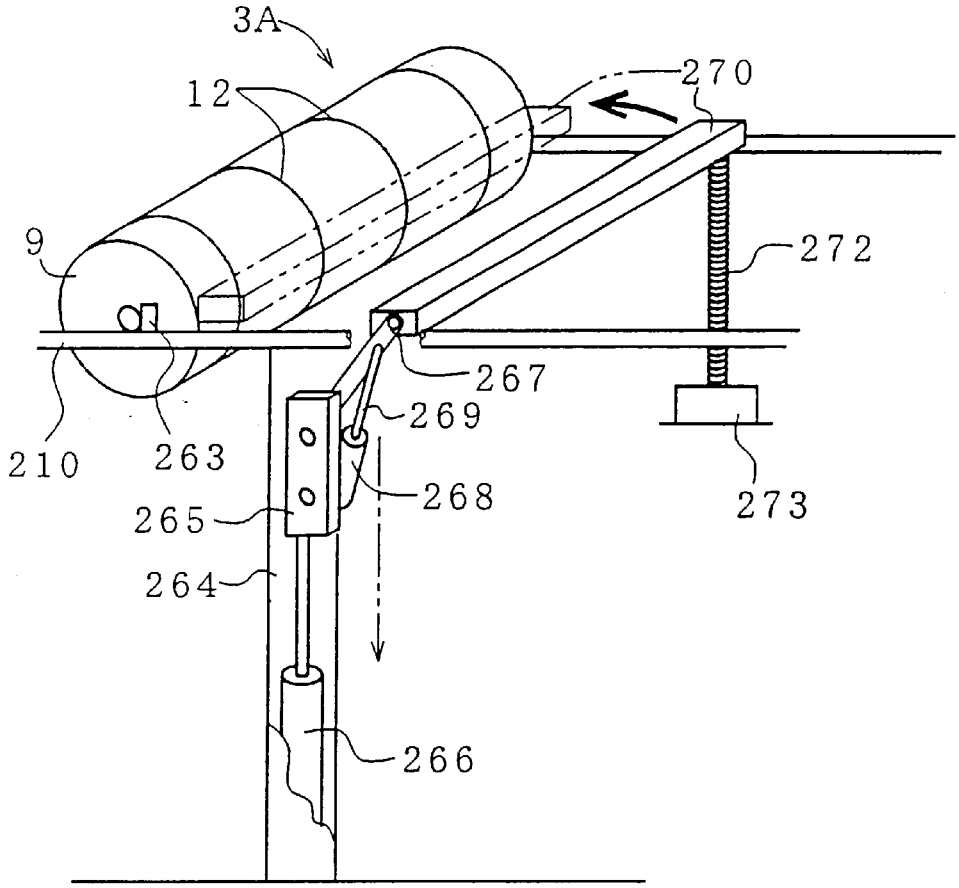
FIG. 76 is a perspective view showing an embodiment of a thread position correcting device.

The arm 267 is swung counterclockwise in FIG. 76 by action of the forward/backward movement mechanism (fluid cylinder 268) and thereby, the correcting member 270 is put into contact with and pressed onto the circumferential surface of a next veneer roll 9 in an area along the shaft direction in the downstream side at the upward movement limit of the moving block 265 while the preceding veneer roll 9 is in on unwinding operation at the unwinding position 211. When in contact with the next veneer roll 9, the threads 12 arranged in plural rows wound on the veneer roll 9 as guide are retained on the correcting member 270 by vacuum-chuck action using the vacuum chuck holes 271. After the threads 12 are retained by vacuum-chuck action, the moving blocks 265 is moved down by action of the elevating mechanism (fluid power cylinder 266) while a position of the correcting member 270 relative to the veneer roll 9 is locked. When the moving block 265 is moves down, the threads 12 gradually come to a firmly stretching state between the correcting member 170 and the veneer roll 9 while the threads 12 are retained by vacuum-chuck action. Therefore, even if the terminal ends of the threads 12 wound as guide are entangled with fibers of a veneer sheet 1 in the form of a veneer roll 9 or positions from which the threads are hung down are in disorder since the free portions of the threads 12 are entangled with fluffy fibers on the surface of the veneer roll 9 in the middle of the free portions, the free portions of the threads 12 come into a firmly stretching state before the moving block 265 reaches the downward movement limit with the result that entanglement of the threads 12 with fibers is solved. When the retaining condition of the threads 12 to the correcting member 270 is canceled at the downward movement limit of the correcting member 270, the threads 12 in the plural rows come into a state in which the threads 12 hang down from the circumferential surface of the veneer roll 9 almost vertically and respectively assume correct positions. It should be appreciated that while in the embodiment, the forward/backward movement mechanism of the correcting member 270 is the fluid cylinder 268, there is no specific limitation to the mechanism, but it may be replaced with a rack/pinion motion, a crank motion or the like and that while in the embodiment, an elevating mechanism for the moving block 265 is the fluid cylinder 266, it may be replaced with a motion, forward or backward, of the timing belts by means of driving, in one direction or the other, of a motor with reduction gears as described above, a rack/pinion motion, a crank motion or the like.

After the correction, the stopper 263 is retreated from the transport surface following completion of unwinding of the preceding veneer roll 9 and the next veneer roll 9 is transferred to the unwinding position 211. In this situation, since the correcting member is located in the downward movement limit, there arises no inconvenience in transfer operation.

In the above described embodiment, description is made of the case where correction of positions of threads 12 before recovery thereof is performed in a waiting position in the veneer roll stock area 3A while a preceding veneer roll 9 is in unwinding operation at the unwinding position 211, but such a correcting operation can be performed prior to unwinding operation of a new veneer roll 9 at the unwinding position 211.

Figure 78:
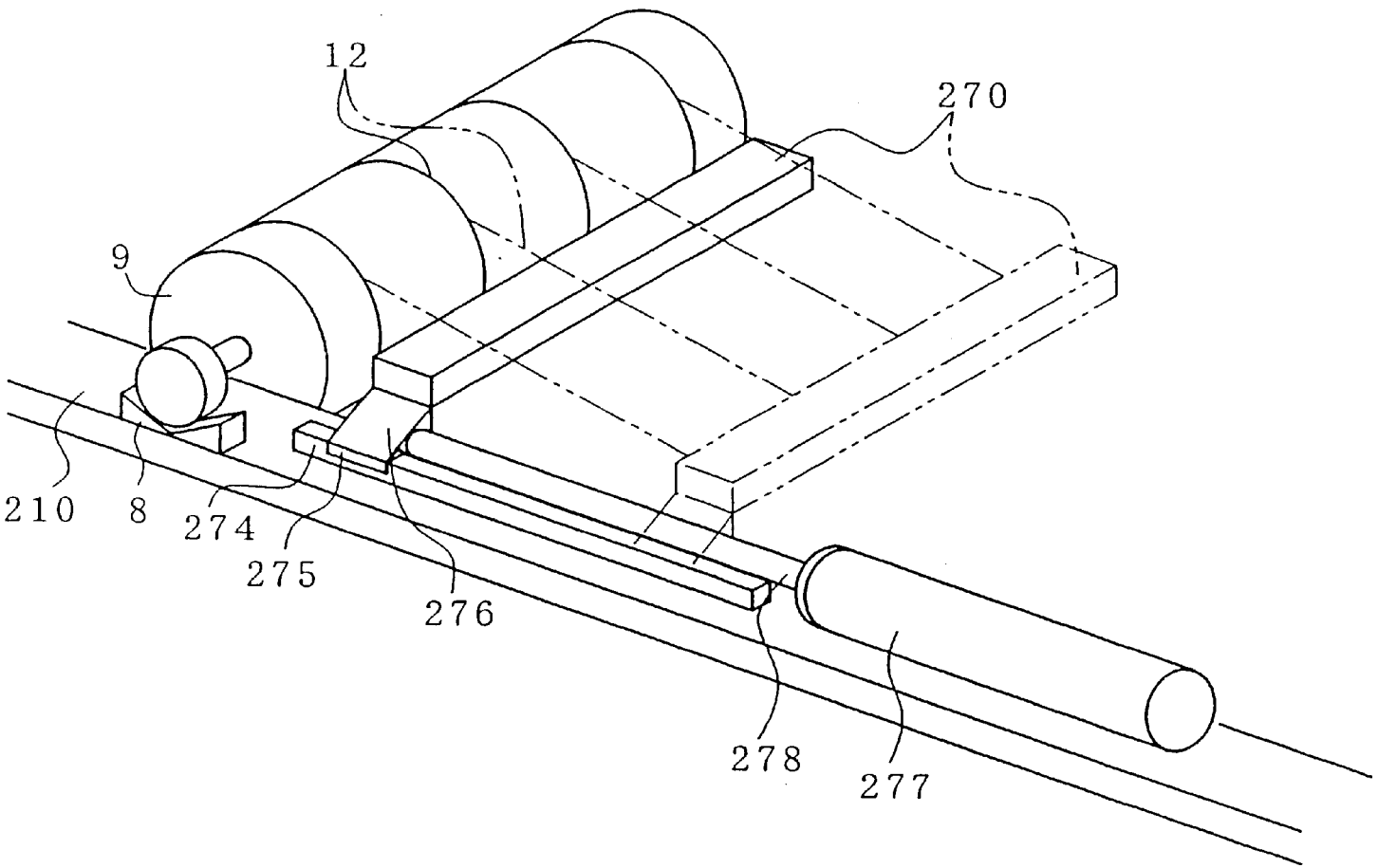
FIG. 78 is a perspective view of another embodiment of a thread position correcting device.

Next, description will be made of another embodiment in which positions of threads 12 are corrected with reference to FIG. 78. Linear ways 274 are laid down on the pair of transfer frames 210 in the downstream side from the unwinding position 211, that is in the downstream side from the reel receivers 8 placed on the pair of the transfer frames 210, linear blocks 275 are placed on the linear ways 274 in a freely movable manner and a correcting member 270 similar to the above description is mounted on the linear blocks 275 with a bracket 276 interposed therebetween. A forward/backward movement mechanism for moving the correcting member 270 to or away from a veneer roll 9 is provided in the further downstream side on the transfer frame 210 and the forward/backward, wherein in the embodiment, a fluid power cylinder 277 is adopted as the mechanism and the fore-end of the piston rod 278 thereof is connected to the bracket 276.

In this embodiment, the correcting member 270 is first withdrawn to the backward movement limit position or to a position where no interference with a veneer roll 9 arises by action of the forward/backward movement mechanism (fluid cylinder) 277. The veneer roll 9 moves on the transfer frames 210 and reaches a reel receiver position 8, and the bearings of the veneer roll 9 are rotatably supported by the reel receiver 8 and the reel down-presser 66. At this point, the drive guide bands 218 are in a waiting condition at the lower limit positions remote from the veneer roll 9. Then, the piston rod 278 of the fluid cylinder 277 is extended and the correcting member 270 is pressed along the linear ways 274 to reach the downstream side circumferential surface of the veneer roll 9 with the result that the correcting member 270 gets into press contact with the veneer roll 9 along the shaft direction. When in press contact of the correcting member 270, the threads 12 arranged in plural rows wound on the veneer roll 9 as guide are retained by vacuum-chuck action on the correcting member 270 with the help of the vacuum chuck holes 271 as described above. After vacuum-chuck retention of the threads 12, the piston rod 278 of the fluid cylinder 277 is contracted and then, the correcting member 270 begins to retreat on the linear ways 274. In the middle of the course of retreating of the correcting member 270, the threads 12 gradually come into a firmly stretching state between the correcting member 270 and the veneer roll 9 as drawn with double dot & dash lines in FIG. 78 while the threads 12 are retained by vacuum-chuck action on the correcting member 270. Therefore, even if the terminal ends of the threads 12 wound as guide are entangled with fibers of a veneer sheet 1 in the form of a veneer roll 9 or positions from which the threads are hung down are in disorder since the free portions of the threads 12 are entangled with fluffy fibers on the surface of the veneer roll 9 in the middle of the free portions of the threads 12, the free portions of the threads 12 come into a firmly stretching state before the correcting member 270 reaches the downward movement limit with the result that entanglement of the threads 12 with fibers is solved. Thereafter, when the correcting member 270 reaches the backward movement limit position, the vacuum-chuck retention of the threads 12 to the correcting member 270 is canceled and the threads 12 come into a state in which the free portions of the threads 12 are hung down almost vertically from the circumferential surface of the veneer roll 9 by self-weight from a state in which the free portions of the threads 12 are in a state pulled in the lateral direction from the veneer roll 9.

It should be appreciated that as the forward/backward movement mechanism of the correcting member 270 in the above described embodiment, extending and contracting motions of the fluid cylinder 277 are adopted, but there is no specific limitation to this mechanism, but it maybe replaced with a motion, forward or backward, of the timing belts by means of driving, in one direction or the other, of a motor with reduction gears as described above, a rack/pinion motion, a crank motion or the like. Further, in the above described embodiment, description is made of the case where correction of positions of threads 12 before recovery thereof is performed prior to unwinding operation of a new veneer roll 9 at the unwinding position 211, but such a correcting operation can be performed at the waiting position of the veneer roll stock area 3A while the preceding veneer roll 9 is in unwinding operation.

Figure 79:
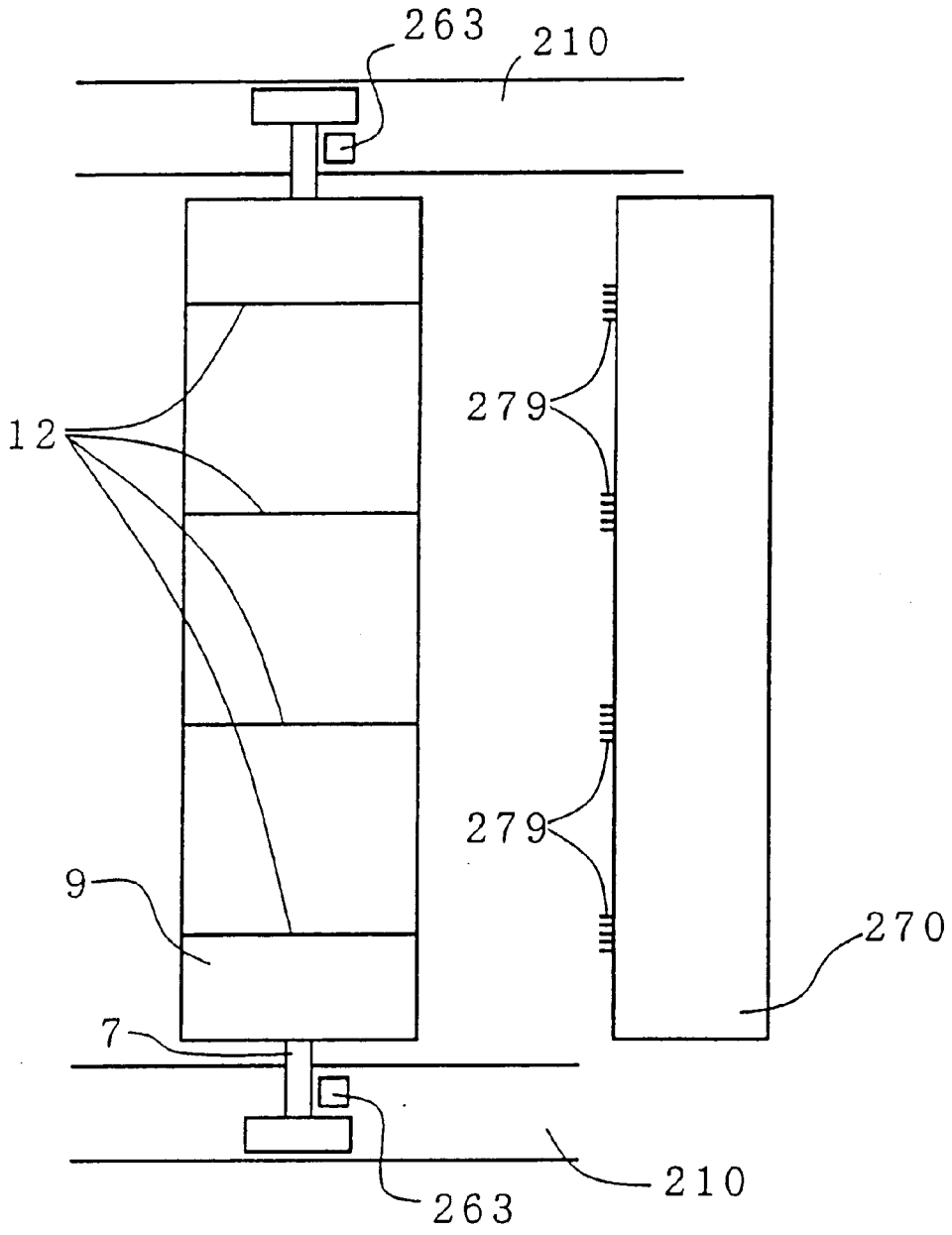
FIG. 79 is a plan view showing another embodiment of a thread position correcting device.

While in the above described embodiments, the vacuum-chuck holes 271 are formed on the correcting member 270 and positions of the threads 12 are corrected while retaining the threads 12 by vacuum-chuck action, the vacuum-chuck holes 271 can be replaced with a pressure sensitive adhesive tape such as an adhesive tape or a gummed cloth tape, stuck on the side facing a veneer roll 9 of the correcting member 270, wherein the threads 12 are entangled with the pressure sensitive adhesive tape to retain. In addition to them, as shown in FIG. 76, the following methods can also be adopted: A highly frictional member such as a magic tape or a sand paper with abrasive grains thereon is stuck on the side facing a veneer roll 9 of the correcting member 270, the surface of the correcting member 270 is deformed so as to form peaks and valleys in small size thereon by hammer shock, or the surface of the correcting member 270 is processed by filing or knurling so as to form fine protrusions 279 thereon, wherein the threads 12 are entangled with such rough surfaces of the correcting member 270 to retain. In this case, occurrence of a firmly stretching state between the threads 12 and the correcting member 270 is caused by entanglement retention by a pressure sensitive sheet, or entanglement retention by fine protrusions 279. It should be appreciated that the vacuum-chuck holes 271 to produce vacuum-chuck retention, the pressure sensitive adhesive tape to produce entanglement retention or fine protrusions to produce entanglement retention may be formed all over the surface facing a veneer roll 9 of the correcting member 270, but as shown in FIG. 79, such special areas each with a proper width may be formed on the correcting member 270 in the vicinity of positions corresponding to those where the threads 12 wound as guide in the shaft direction of take-up reel 7 of a veneer roll 9.

Figure 80:
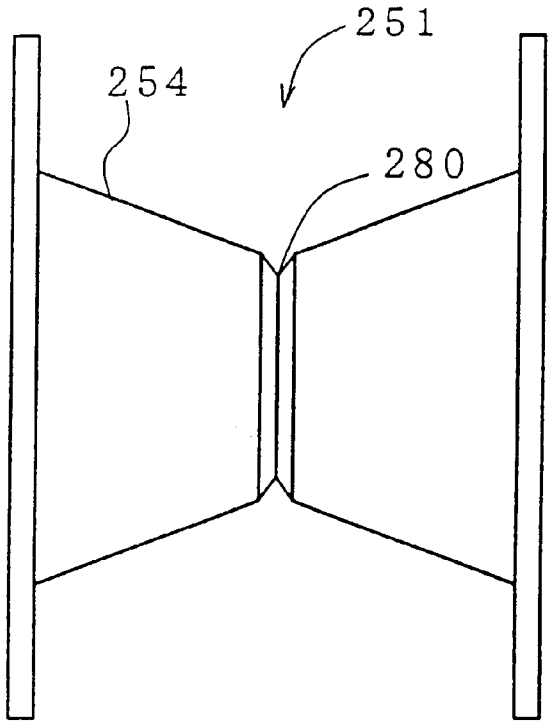
FIG. 80 is a side view showing anther embodiment of a thread reel.

A body 254 of the thread reel 251, as shown in FIG. 80, has a shape like a hand drum that comprises: two circular flanges at both sides; and a portion between the flanges that further includes two conical portions, the section of one conical portion being constituted of two slopes such that a diameter is narrowed toward the middle in its length from the flanges, both conical portions being in mirror-symmetry with the other, and a V shaped annular groove 280 being formed at connection between the two conical portions in the middle in its length, wherein the conical portions can be of a female/male fitting type or a screw type at the groove as the boundary, both being assembled in a demountable manner. Hence, with such a structure of the thread reel, recovered threads 12 can be taken out from the body 254 of the thread reel 251 with ease. According to the thread reel 251, when a thread 12 begins to be wound on the thread reel 251, the fore-end of the thread 12 that has reached the body 254 is guided along a slope and comes to the V shaped groove 280, which is located almost in the middle, thereby ensuring winding of the thread on the body 254. Further, after completion of winding of the threads 12, the thread reel 251 is divided into two halves, left and right, at the middle as the boundary and thereby, wound threads 12 on the thread reel 251 can be taken out with ease. Therefore, on the contrary, in the next operation, all that is required is to assemble the two halves into one piece, which entails improvement of operability.

Figure 81:
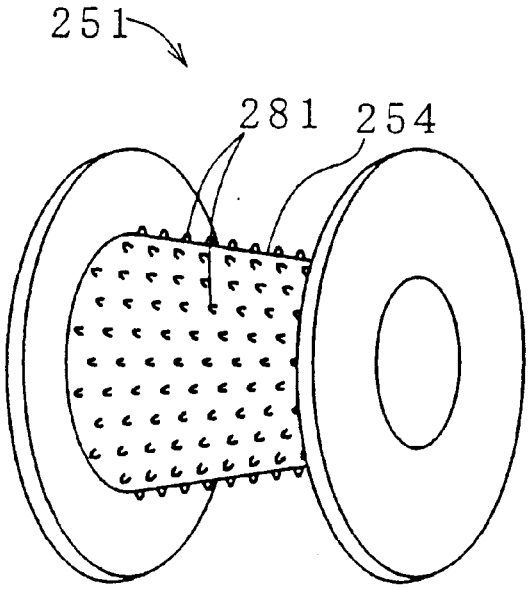
FIG. 81 is a perspective view showing another embodiment of a thread reel.

While in the above described embodiments, description is made of the case where the body 254 of the thread reel 251 has a smooth surface as a precondition, there can be a case of a pressure-sensitive tape such as an adhesive tape or a gummed cloth tape, which facilitates winding threads 12 on the body 254. Further, in addition, the following methods can also be adopted in which the body 254 itself is processed so as to be of a high friction coefficient: A highly frictional member such as a sand paper with abrasive grains thereon is stuck on the body 254, the surface of the body 254 is deformed so as to form peaks and valleys in fine size thereon by hammer shock, or the surface of the body 254 is processed by filing or knurling so as to form fine protrusions 281 thereon as shown in FIG. 81, wherein the threads 12 are entangled with the highly frictional member on the body 254 to retain with ease.

Accordingly, if the fore-end portion as a free end of a thread 12 gets into contact with any position on the surface of the body 254 in starting of winding of the thread 12 on a thread reel 251, the thread 12 is easily entangled with the surface of the body 254 since a pressure-sensitive tape or fine protrusions are provided on the surface. Hence, even if the fore-end as a free end of a thread 12 is misplaced with a not large deviation from predetermined positions, winding of the thread 12 on a thread reel 251 can be performed with no trouble. Thereafter, threads 12 are kept in a firmly stretching state between a veneer roll 9 and the thread reel 251 and the threads 12 wound as guide on the veneer roll 9 are taken-up on the thread reels 251 in synchronism with unwinding of veneer sheet 1 from the veneer roll 9 as described above.

Figure 82:
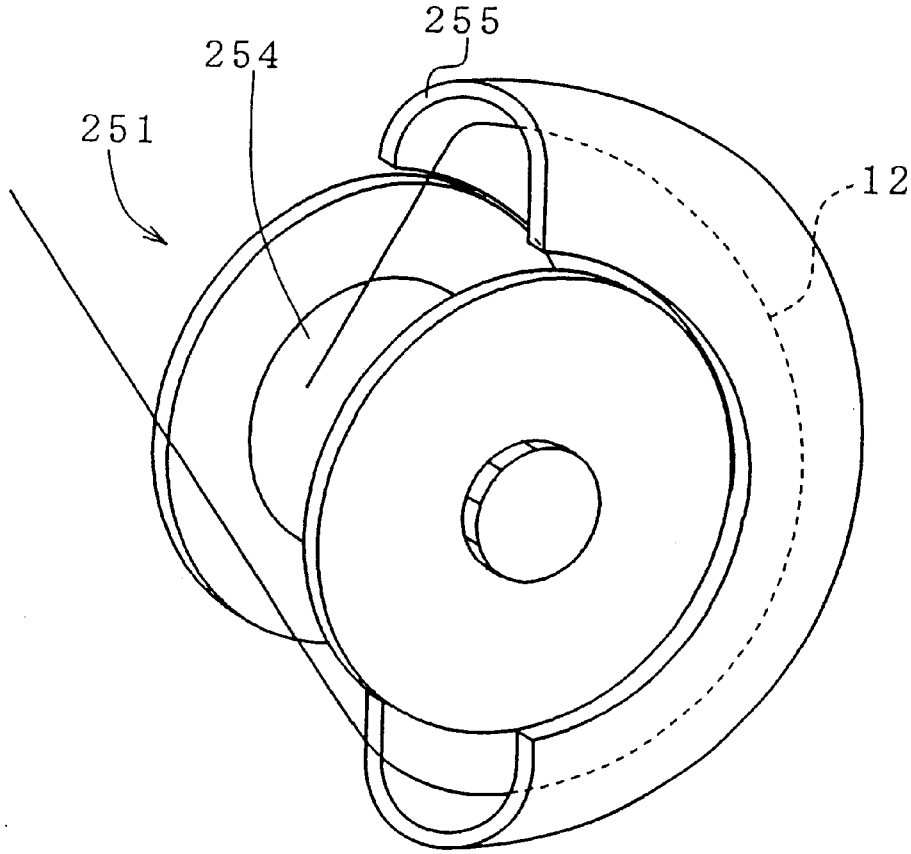
FIG. 82 is a perspective view showing another embodiment of a thread guide.
Figure 83:
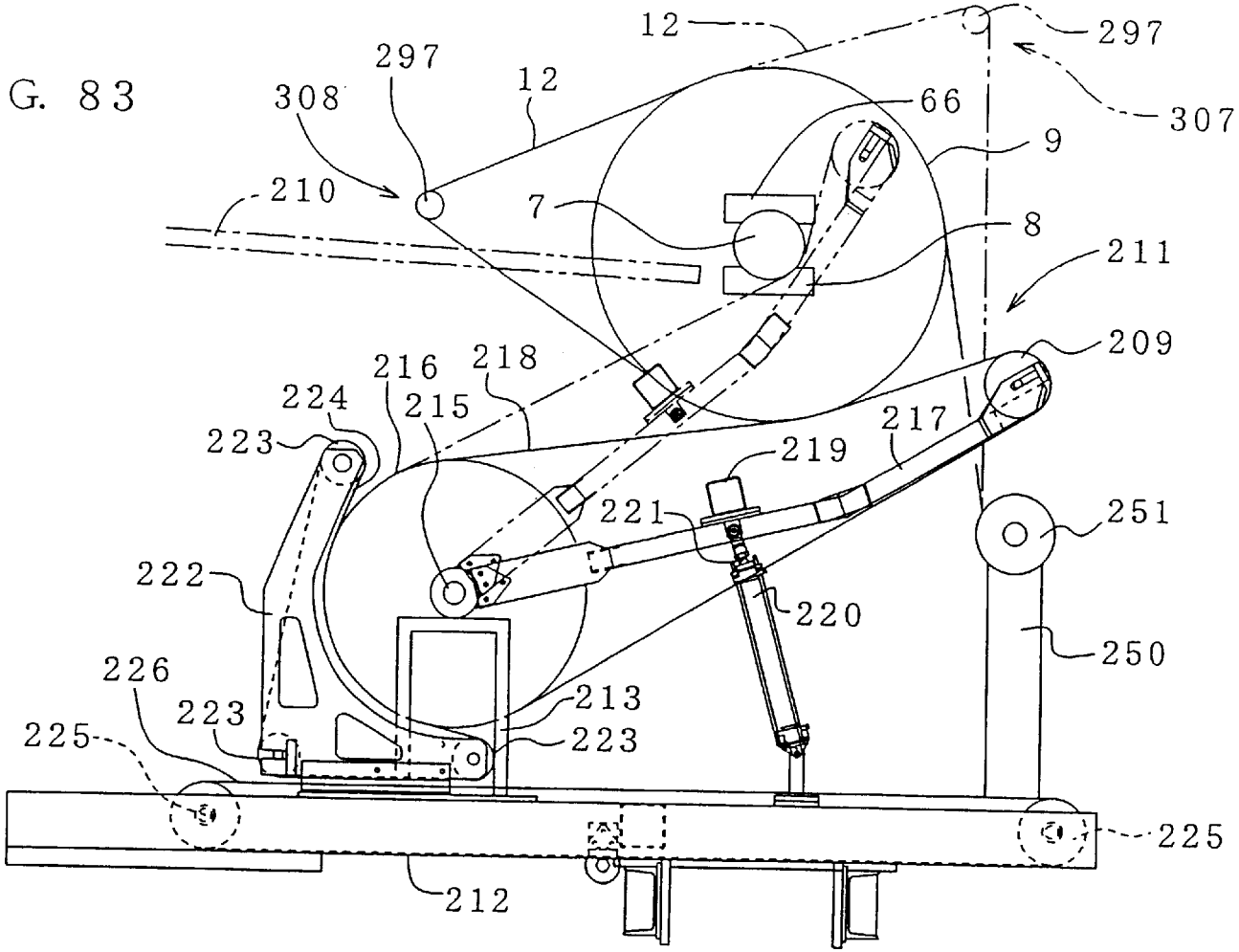
FIG. 83 is a side view showing another embodiment of unwinding of a veneer sheet from a veneer roll.

Further, a thread guide 255 can be formed as a flat half ring with a section of an arch-like shape as shown in FIG. 82 and in this case, the thread guide of this type is mounted along the flanges of a thread reel 251 such that a clearance is produced between the surface of the body 254 of the thread reel 251 and the thread guide 255 and one half of the introductory side for the thread is exposed as an open state. With this configuration, a thread 12 is guided into between the lower portion of the body 254 and the lower portion of the half-ring shaped thread guide 255 by ejection of air (blown-out) or an exhaust stream (suction steam). In this situation, since ejection of air (blown-out) or an exhaust stream (suction stream) flows toward the topmost part in an arch-like section of the flat half-ring along a route from the bottom part thereof to above, the fore-end of a thread 12 is carried on the stream to reach the topmost part of the thread guide 255 and arrive at the upper opening thereof, thereafter falling down by self weight on the body 254 due to extinction of a stream. Therefore, the fore-end of a thread 12 is in a state where it is wound along more than a half circumference of the body 254 of the thread reel 251 and the thread 12 is easily wound on body 254 in company with counter-clockwise rotation as in FIG. 82 of a thread reel 251.

Especially when a thread reel has a body of a hand drum type, the fore-end portion of a thread 12 that falling down from above a thread guide 255 runs along a slope to arrive at a V-like groove 280 located in the middle, making winding of a thread 12 ensured.

Then, as shown FIGS. 83 to 89, description will be made of an embodiment where at least one of threads 12 wound in plural rows arranged on a veneer roll 9 in the length direction thereof is protruded outside the veneer roll 9 with an angle θ from a state where the thread is wound along the circumferential surface of the veneer roll 9 and in the situation, a veneer sheet 1 is unwound from the veneer roll 9.

Figure 89:
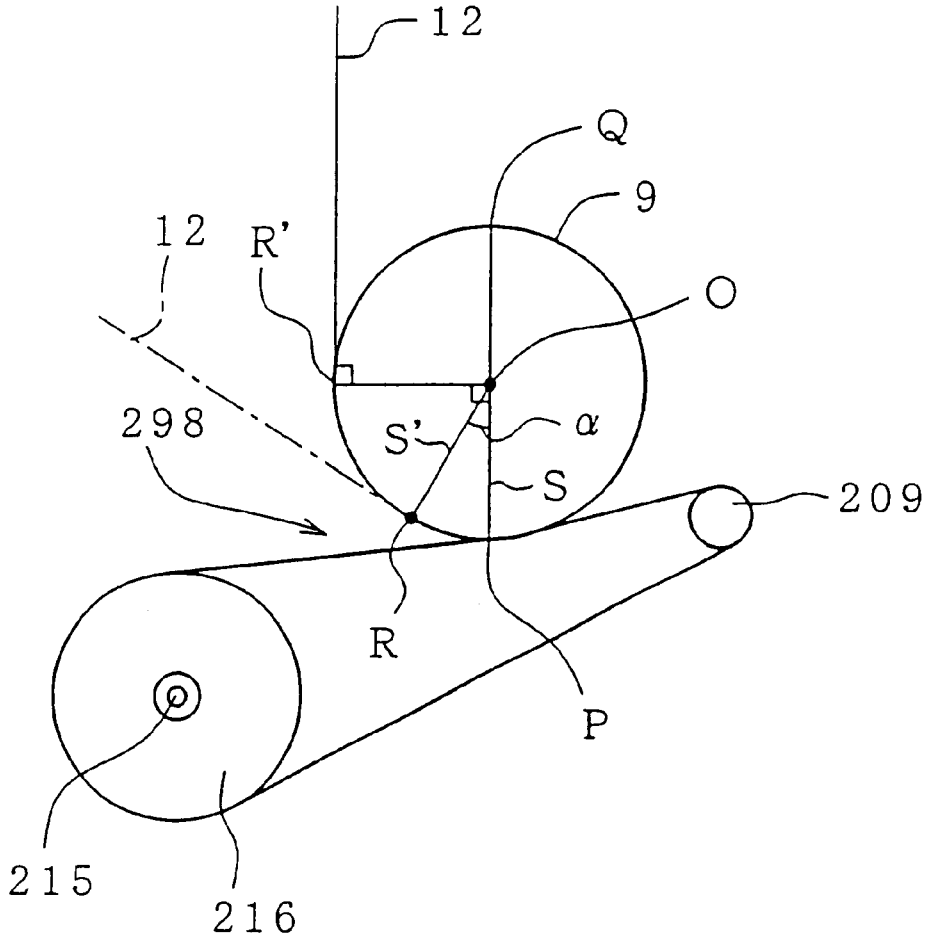
FIG. 89 is a view for illustration of a principle of blocking action for accompaniment of a veneer sheet in unwinding.

When a thread 12 is protruded outside the veneer roll 9, as shown in FIG. 89, a pulling direction of a thread 12 is first determined such that the direction is located in the middle between a veneer sheet separating position P at which the veneer sheet 1 begins to be unwound from the veneer roll 9 and a position Q at which a line from the veneer sheet separating position P through the center of the veneer roll 9 intersects the circumference of the veneer roll 9 in the unwinding side of a veneer sheet 1 side formed between the veneer sheet separating position P and the veneer sheet separation opposite position Q. It is important that the pulling direction is determined such that when a veneer sheet 1 unwound from the veneer roll 9 tends to be wound on the veneer roll 9 in accompanying manner, the pulling direction of the thread 12 works so as to prevent accompanying phenomena of a veneer sheet 1 with the veneer roll 9 from occurring and to be effective for bringing the veneer sheet 1 back to the transport surface 298. Therefore, it is preferable that in angle α formed between a line S that connects between the center O of the veneer roll 9 and the veneer sheet separating position P and a line S' that connects the center and a separating point R of a thread 12 is less than 180 degrees, or desirably less than 90 degrees, and a thread 12 is preferably pulled out from the veneer roll 9 with an angle in the ranges. With such an angle in use, a veneer sheet 1 tending to accompany the veneer roll 9 is effectively prevented by a thread 12 from accompanying and is effectively brought back to the unwinding transport surface 298. On the other hand, when a thread 12 is pulled toward almost directly above along the curvature of the veneer roll 9 (in a direction tangential at the middle point R') or in a direction inclined from the directly above toward the other side from the veneer sheet 1 unwinding side, it is hard to block the accompanying action of a veneer sheet 1 by a thread 12.

Figure 85:
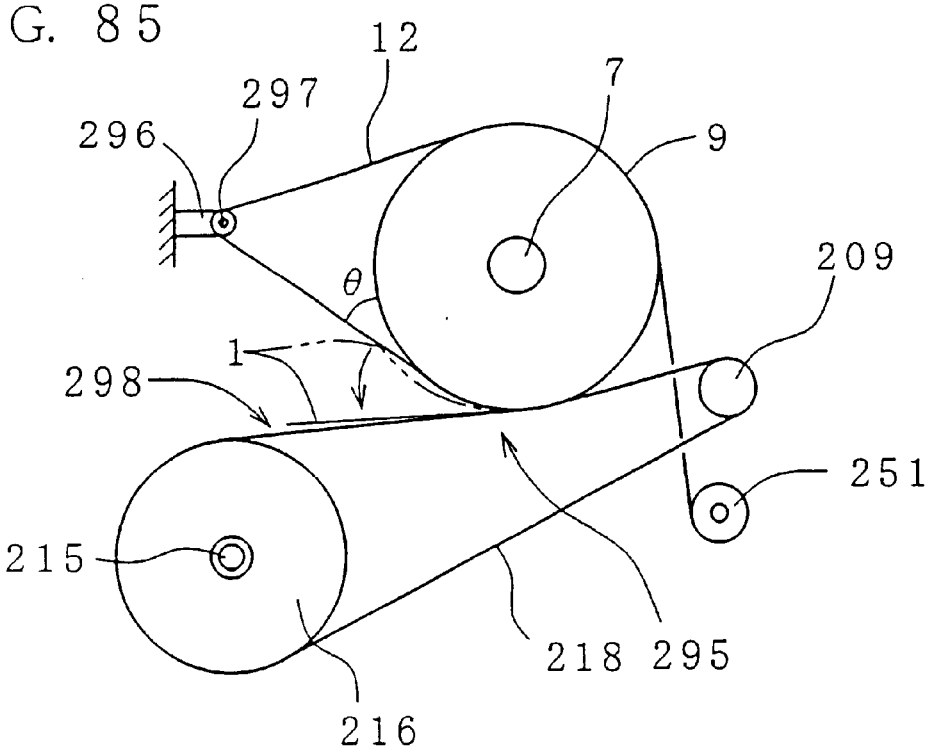
FIG. 85 is a view for illustration of blocking action for accompaniment of a veneer sheet in unwinding.

As shown in FIG. 85, a position at which a thread 12 is supported protruding outwardly is located close to an unwinding surface 295 on which a veneer sheet 1 is unwound from the veneer roll 9. For example, a support member 296 is protruded from a beam constituting the reel support 65 in the veneer roll transport-in side. A thread auxiliary pulley 297 is mounted in rotatable manner at the fore-end of the support member 296, a thread 12 that is wound along the curvature of the veneer roll 9 is protruded outwardly and the thread 12 is supported by the thread auxiliary pulley 297. In this situation, threads 12 wound on the veneer roll 9 in plural rows arranged in the length direction of the veneer roll 9 are pinched between the unwinding rollers 230 and 235 or kept in a properly firm stretching condition by the thread reel 251 that continues to rotate through a torque limiter 252.

Figure 84:
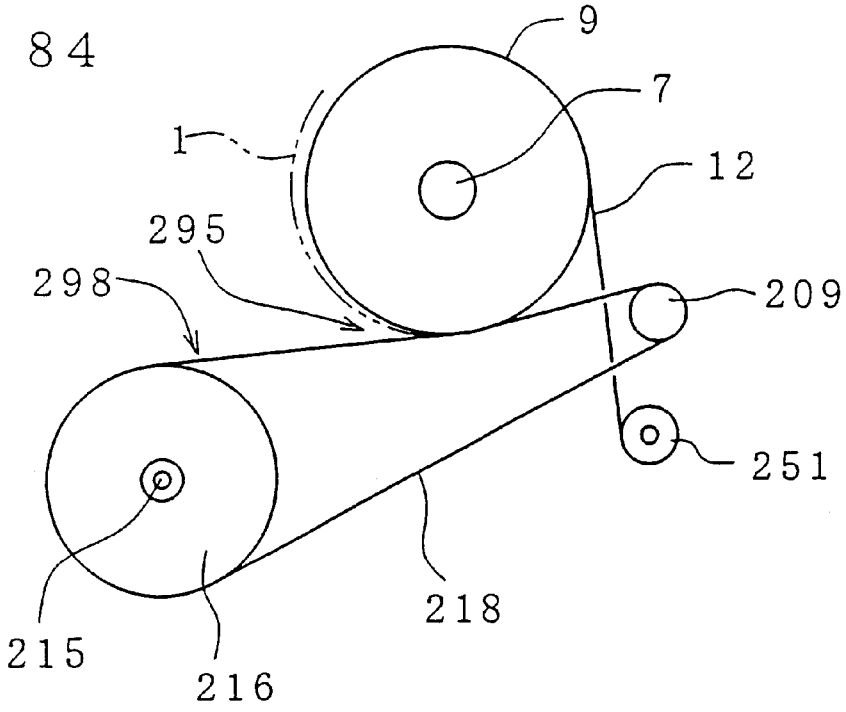
FIG. 84 is a view for illustration of blocking action for accompaniment of a veneer sheet in unwinding.

As described above, when a veneer sheet 1 is unwound while recovering a thread 12 from a veneer roll 9, there is a case where a veneer sheet 1 tends to be rewound by accompanying the surface of the veneer roll 9 in rotation for unwinding as shown in FIG. 84, while the veneer sheet 1 is not unwound to the transport surface 298. In such a case, as shown in FIG. 85, since a thread 12 protruding from a state where the thread 12 resides along the curvature of the veneer roll 9 and supported by the thread auxiliary pulley 297 is in a state where the thread 12 extends outwardly at an angle θ to the circumferential surface of the veneer roll 9, the thread 12 prevents the veneer sheet 1 from not only accompanying the veneer roll 9 but being rewound thereon by getting into contact with the unwound veneer sheet 1. The veneer sheet 1 that is blocked from the accompanying by a thread 12 is brought back to the unwinding transport surface 298 and thereby transferred to the next step.

It should be appreciated that while even at least one thread 12 that protrudes outwardly effectively works, it is preferable that when threads 12 arranged in the vicinity of both sides in the length direction of a veneer roll 9 are respectively protruded outwardly and supported by the thread auxiliary pulley 297, a veneer sheet 1 to be unwound that would otherwise tend to accompany is prevented from the accompanying by actions from the both sides which increases its effectiveness of the thread auxiliary pulley 297 due to threads 12 from the both sides instead of a single thread 12.

If a support position by the thread auxiliary pulley 297 for a thread 12 is close to the unwinding surface 295 as described above, a veneer sheet 1 that tends to accompany a veneer roll 9 can be blocked against the accompanying at an initial stage thereof. However, if machine or something is installed in a passage leading to a proper support position for the thread auxiliary pulley 297 or the support position makes a worker hard to come to or go away from his work site since he has to walk through there, it can be solved in such a manner that a thread 12 is protruded outwardly at another position and then the support position can be moved close to the unwinding surface 295 of a veneer sheet 1.

Figure 86:
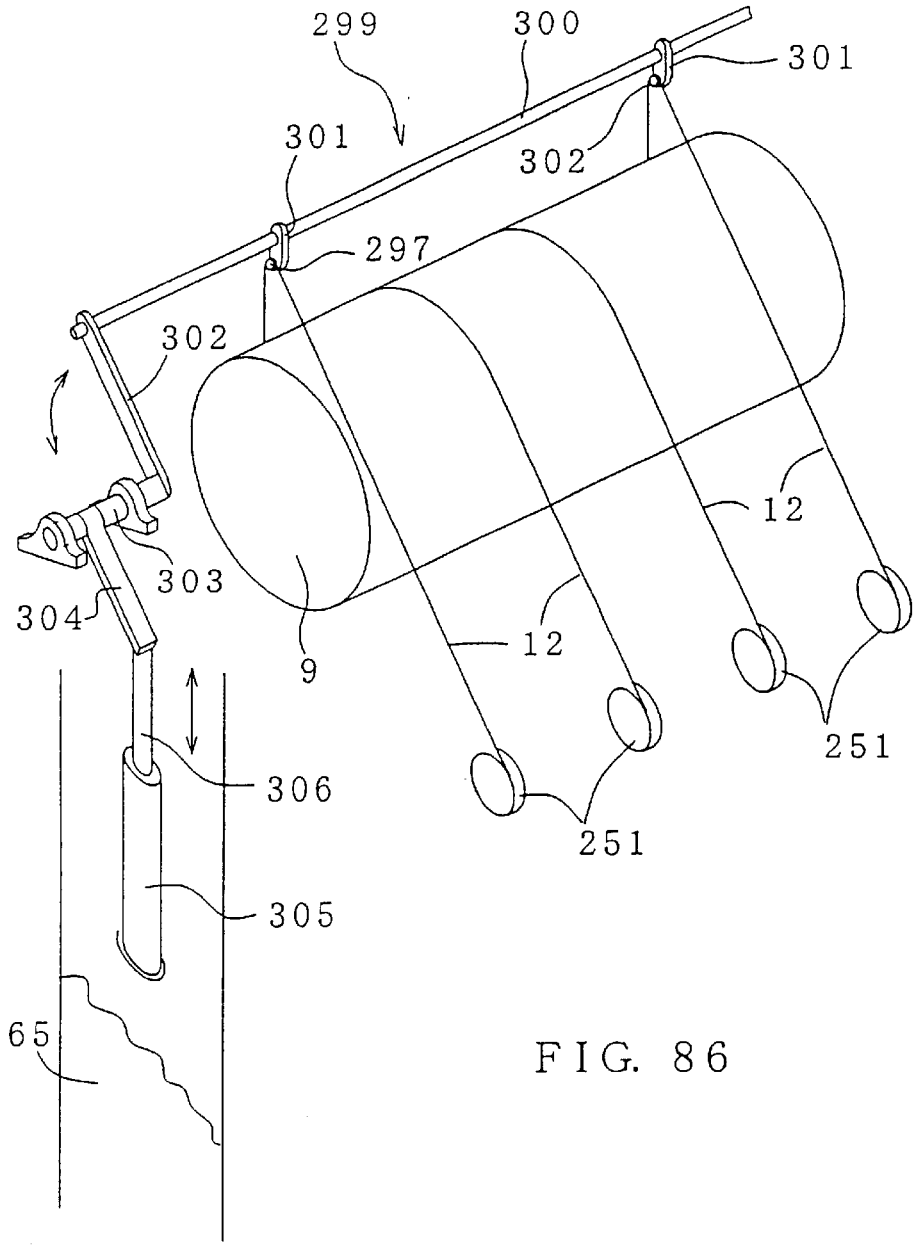
FIG. 86 is a schematic partly cut-away perspective view showing blocking of accompaniment of a veneer sheet in unwinding.

In FIG. 86, a unit with which the support position for a thread 12 is moved is exemplified, a thread support unit 299 is located at a position spaced from the circumferential surface of the veneer roll 9 outwardly in a radial direction. Protruded arms 301 to which the thread auxiliary pulleys 297 are rotatably mounted are further mounted on a support shaft 300 in the vicinity of its both ends, wherein the support shaft 300 extends almost in parallel to the shaft of a veneer roll 9. Both ends of the support shaft 300 are supported by arm rods 302 at one ends thereof and the other ends of the arm rod 302 are attached to rotary shafts 303. Further, an end of a lever 304 is mounted to one rotary shaft 303 and the other end is connected to a piston rod 306 of a fluid cylinder 305 supported by the reel support 65.

For example, in a case where a work site deck (not shown) is installed above the unwinding position 211, a worker protrudes threads 12 in the vicinity of both ends of the veneer roll 9 wound along the curvature of the veneer roll 9 to a protruding position 307 drawn with a double dot & dash line in the figure located outwardly in a radial direction while utilizing the deck. The threads 12 are supported by the auxiliary pulleys 297 held by the support shaft 300 while winding on the auxiliary pulleys 297. Then, the piston rod 306 of the fluid cylinder 305 is extended and thereby, the rotary shaft 303 is rotated through an angle to swing the support shaft 300 while keeping the support shaft 300 radially outwardly spaced from the veneer roll 9 and move the support shaft 300 to a displacement position 308 of FIG. 83 drawn with a solid line while routing along the circumferential surface of the veneer roll 9. After the displacement, as described above, the threads 12 are recovered from the veneer roll 9 and at the same time a veneer sheet 1 is unwound from the veneer roll 9.

Figure 87:
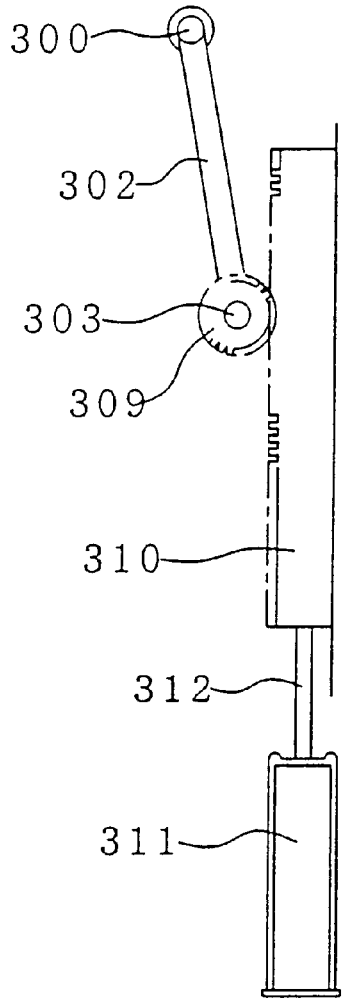
FIG. 87 is a plan view showing another rotating means of a rotary shaft shown in FIG. 86.

While in the embodiment, when the rotary shaft 303 is rotated through an angle, the lever 304 is swung, an alternative method is as follows: A pinion gear 309 is mounted to the rotary shaft 303 and a piston rod 312 of a fluid cylinder 311 is connected to a rack gear 310 to mesh with the pinion gear 309 as shown in FIG. 87. According to this method, the rack gear 310 is moved following extending or contracting of the piston rod 312 and thereby, the pinion gear 309 is rotated in one direction or the other, with the result that the support shaft 300 can be moved between the protruding position 307 and the displacement position 308.

Figure 88:
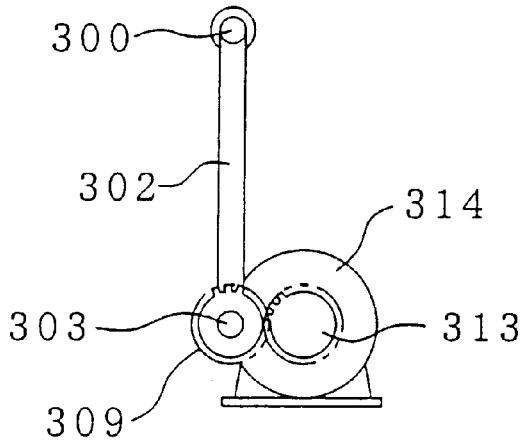
FIG. 88 is a plan view showing another rotating means of a rotary shaft shown in FIG. 86.

Further, likewise as shown in FIG. 88, another case may be a choice: A pinion gear 309 is mounted to the rotary shaft 303 and a drive shaft of a motor 314 is connected to a pinion gear 313 to mesh with the pinion gear 309. According to this method as well, the pinion gear 309 to mesh with the pinion gear 313 is rotated in one direction or the other following rotation of the motor 314 in one direction or the other and thereby, the support shaft 300 can be moved between the protrusion position 307 and the displacement position 308.

We claim:

1. A veneer reeling apparatus at least comprising:

a take-up reel that is rotatably supported at a veneer sheet winding position;

a winding guide member arranged in an opposite manner to the circumferential surface of the take-up reel in plural rows with arbitrary spatial intervals along a shaft direction of the take-up reel;

rotation transmitting means that imparts rotation to the winding guide member in order to wind a veneer sheet on the take-up reel;

following means that forces the winding guide member to run along part of the circumferential surface of the take-up reel in conformity with the curvature of thereof;

a transport conveyor that transports a veneer sheet into between the take-up reel and the winding guide member in cooperation with the winding guide member below the take-up reel; and firmly stretching means that imparts a tension to the winding guide member in order of wind a veneer sheet on the take-up reel, and wherein the firmly stretching means is rotary pulleys that are separately provided in order to individually push or pull endless bands in plural rows constituting the winding guide member under a pressure while guaranteeing a rotation force of the winding guide member when the winding guide member is pressed in conformity with the curvature of part of the circumferential surface of the take-up reel, wherein the firmly stretching means can individually displace press positions of the endless bands on the take-up reel as a diameter of a veneer roll produced by winding a veneer sheet on the take-up reel increases while maintaining the winding guide member in a firmly stretching condition under a constant tension.

2. A veneer reeling apparatus at least comprising:

a take-up reel that is rotatably supported at a veneer sheet winding position;

a winding guide member arranged in an opposite manner to the circumferential surface of the take-up reel in plural rows with arbitrary spatial intervals along a shaft direction of the take-up reel;

rotation transmitting means that imparts rotation to the winding guide member in order to wind a veneer sheet on the take-up reel;

following means that forces the winding guide member to run along part of the circumferential surface of the take-up reel in conformity with the curvature of thereof;

a transport conveyor that transports a veneer sheet into between the take-up reel and the winding guide member in cooperation with the winding guide member below the take-up reel;

firmly stretching means that imparts a tension to the winding guide member in order of wind a veneer sheet on the take-up reel, and a plurality of thread feeding mechanisms that feeds threads wound as guide in winding a veneer sheet on the take-up reel arranged in a shaft direction of the take-up reel; and wherein the firmly stretching means is rotary pulleys that are separately provided in order to individually push or pull endless bands in plural rows constituting the winding guide member under a pressure while guaranteeing a rotation force of the winding guide member when the winding guide member is pressed in conformity with the curvature of part of the circumferential surface of the take-up reel, wherein the firmly stretching means can individually displace press positions of the endless bands on the take-up reel as a diameter of a veneer roll produced by winding a veneer sheet on the take-up reel increases while maintaining the winding guide member in a firmly stretching condition under a constant tension.

3. A veneer reeling apparatus at least comprising:

a take-up reel that is rotatably supported at a veneer sheet winding position;

a winding guide member arranged in an opposite manner to the circumferential surface of the take-up reel in plural rows with arbitrary spatial intervals along a shaft direction of the take-up reel;

rotation transmitting means that imparts rotation to the winding guide member in order to wind a veneer sheet on the take-up reel;

following means that forces the winding guide member to run along part of the circumferential surface of the take-up reel in conformity with the curvature of thereof;

a transport conveyor that transports a veneer sheet into between the take-up reel and the winding guide member in cooperation with the winding guide member below the take-up reel; and firmly stretching means that imparts a tension to the winding guide member in order to wind a veneer sheet on the take-up reel; and wherein the winding guide member includes endless bands extend over at least three positions in a base end section, a middle section and a distal end section, wherein the winding guide member is connected to a distal end of the transport conveyor and when the winding guide member is swung toward the take-up reel by the following means, the winding guide member is pressed on part of the circumferential surface of the take-up reel in conformity with a curvature of the part, and wherein the firmly stretching means is rotary pulleys that are separately provided in order to individually push or pull endless bands in plural rows constituting the winding guide member under a pressure while guaranteeing a rotation force of the winding guide member when the winding guide member is pressed in conformity with the curvature of part of the circumferential surface of the take-up reel, wherein the firmly stretching means can individually displace press positions of the endless bands on the take-up reel as a diameter of a veneer roll produced by winding a veneer sheet on the take-up reel increases while maintaining the winding guide member in a firmly stretching condition under a constant tension.

4. A veneer reeling apparatus at least comprising:

a take-up reel that is rotatably supported at a veneer sheet winding position;

a winding guide member arranged in an opposite manner to the circumferential surface of the take-up reel in plural rows with arbitrary spatial inter also along a shaft direction of the take-up reel;

rotation transmitting means that imparts rotation to the winding guide member in order to wind a veneer sheet on the take-up reel;

following means that forces the winding guide member to run along part of the circumferential surface of the take-up reel in conformity with the curvature of thereof;

a transport conveyor that transports a veneer sheet into between the take-up reel and the winding guide member in cooperation with the winding guide member below the take-up reel; and firmly stretching means that imparts a tension to the winding guide member in order to wind a veneer sheet on the take-up reel, and wherein the winding guide member includes endless bands; the base end thereof is located below a veneer sheet winding position and the distal end thereof is free; the winding guide member is connected to the distal end of the transport end; and when the distal end of the winding guide member is swung toward the take-up reel by the following means with the base end as a fulcrum, the winding guide members pressed on part of the circumferential surface of the take-up reel in conformity with a curvature of the part, and wherein the firmly stretching means is rotary pulleys that are separately provided in order to individually push or pull endless bands in plural rows constituting the winding guide member under a pressure while guaranteeing a rotation force of the winding guide member when the winding guide member is pressed in conformity with the curvature of part of the circumferential surface of the take-up reel, wherein the firmly stretching means can individually displace press positions of the endless bands on the take-up reel as a diameter of a veneer roll produced by winding a veneer sheet on the take-up reel increases while maintaining the winding guide member in a firmly stretching condition under a constant tension.

* * * * *

UNITED STATES PATENT AND TRADEMARK OFFICE

CERTIFICATE OF CORRECTION

PATENT NO. : 6,619,580 B2
DATED : September 16, 2003
INVENTOR(S) : Youichi Ohshio et al.

It is certified that error appears in the above-identified patent and that said Letters Patent is hereby corrected as shown below:

Column 62,
Line 64, delete the word “of” and substitute therefore -- to --.

Column 63,
Line 33, delete the word “of” and substitute therefore -- to --.

Column 64,
Line 40, delete “inter also” and substitute therefore -- intervals --.
Line 65, delete “members” and substitute therefore -- member is --

Signed and Sealed this

Twentieth Day of January, 2004

JON W. DUDAS
*Acting Director of the United States Patent and Trademark Office*